US010233524B2

(12) United States Patent
Branagan et al.

(10) Patent No.: US 10,233,524 B2
(45) Date of Patent: Mar. 19, 2019

(54) HIGH DUCTILITY STEEL ALLOYS WITH MIXED MICROCONSTITUENT STRUCTURE

(71) Applicant: The NanoSteel Company, Inc., Providence, RI (US)

(72) Inventors: Daniel James Branagan, Idaho Falls, ID (US); Grant G. Justice, Idaho Falls, ID (US); Andrew T. Ball, Idaho Falls, ID (US); Jason K. Walleser, Idaho Falls, ID (US); Brian E. Meacham, Idaho Falls, ID (US); Kurtis Clark, Idaho Falls, ID (US); Logan J. Tew, Idaho Falls, ID (US); Scott T. Anderson, Idaho Falls, ID (US); Scott Larish, Idaho Falls, ID (US); Sheng Cheng, Idaho Falls, ID (US); Taylor L. Giddens, Idaho Falls, ID (US); Andrew E. Frerichs, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 671 days.

(21) Appl. No.: 14/864,219

(22) Filed: Sep. 24, 2015

(65) Prior Publication Data

US 2016/0145725 A1 May 26, 2016

Related U.S. Application Data

(60) Provisional application No. 62/054,728, filed on Sep. 24, 2014, provisional application No. 62/064,903, filed on Oct. 16, 2014.

(51) Int. Cl.

| | |
|---|---|
| ***C21D 9/46*** | (2006.01) |
| ***C22C 38/58*** | (2006.01) |
| ***C22C 38/34*** | (2006.01) |
| ***C22C 38/54*** | (2006.01) |
| ***B22D 11/00*** | (2006.01) |
| ***B22D 11/041*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/08*** | (2006.01) |
| ***C22C 38/16*** | (2006.01) |
| ***C22C 38/20*** | (2006.01) |
| ***C22C 38/32*** | (2006.01) |
| ***C22C 38/36*** | (2006.01) |
| ***C22C 38/38*** | (2006.01) |
| ***C22C 38/42*** | (2006.01) |
| ***C22C 38/56*** | (2006.01) |
| ***C22C 38/00*** | (2006.01) |

(52) U.S. Cl.

CPC ..... *C22C 38/58* (2013.01); *B22D 11/001* (2013.01); *B22D 11/041* (2013.01); *C21D 6/004* (2013.01); *C21D 6/005* (2013.01); *C21D 6/008* (2013.01); *C21D 8/0205* (2013.01); *C21D 8/0215* (2013.01); *C21D 9/46* (2013.01); *C22C 38/00* (2013.01); *C22C 38/02* (2013.01); *C22C 38/04* (2013.01); *C22C 38/08* (2013.01); *C22C 38/16* (2013.01); *C22C 38/20* (2013.01); *C22C 38/32* (2013.01); *C22C 38/34* (2013.01); *C22C 38/36* (2013.01); *C22C 38/38* (2013.01); *C22C 38/42* (2013.01); *C22C 38/54* (2013.01); *C22C 38/56* (2013.01)

(58) Field of Classification Search

CPC ..... C21D 6/005; C21D 6/004; C21D 6/008; C21D 9/46; C21D 8/0205; C21D 8/0215

See application file for complete search history.

(56) References Cited

U.S. PATENT DOCUMENTS

| | | | |
|---|---|---|---|
| 3,847,680 | A | 11/1974 | Fustukian et al. |
| 4,544,422 | A | 10/1985 | Rao |
| 6,818,074 | B2 | 11/2004 | Matsuoka et al. |
| 8,257,512 | B1 | 9/2012 | Branagan et al. |
| 8,419,869 | B1 | 4/2013 | Branagan et al. |
| 2011/0064601 | A1 | 3/2011 | Liljas et al. |
| 2014/0190594 | A1 | 7/2014 | Branagan et al. |

FOREIGN PATENT DOCUMENTS

| | | | |
|---|---|---|---|
| CN | 1396295 | A | 2/2003 |

OTHER PUBLICATIONS

International Search Report dated Dec. 21, 2015 issued in related International Patent Application No. PCT/US2015/051967.

European Search Report dated Feb. 7, 2018 issued in related European Patent Application No. 15843732.7.

Office Action from related Chinese Application No. 201580058841.0 dated Dec. 18, 2018. English translation attached.

*Primary Examiner* — Jessee R Roe

(74) *Attorney, Agent, or Firm* — Grossman, Tucker, Perreault & Pfleger, PLLC

(57) ABSTRACT

This disclosure deals with steel alloys containing mixed microconstituent structure that has the ability to provide ductility at tensile strength levels at or above 900 MPa. More specifically, the alloys contain Fe, B, Si and Mn and indicate tensile strengths of 900 MPa to 1820 MPa and elongations of 2.5% to 76.0%.

16 Claims, 47 Drawing Sheets

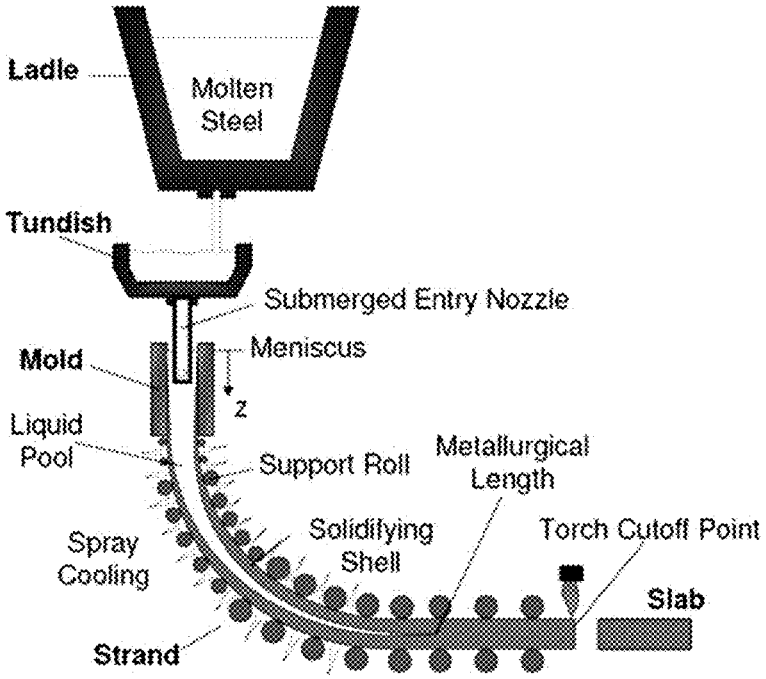
FIG. 1 Continuous slab casting process flow diagram.

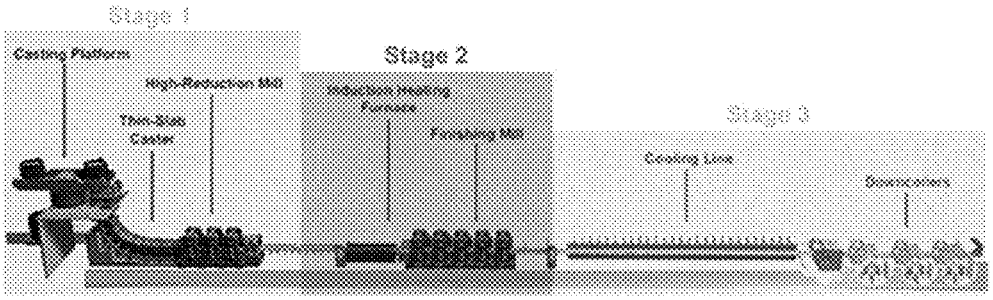
FIG. 2 Thin slab casting process flow diagram showing steel sheet production steps. Note that the process can be broken up into 3 process stages as shown.
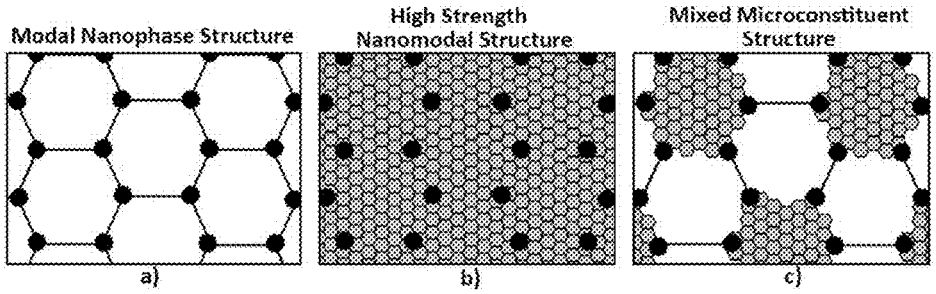
FIG. 3 Schematic representation of mixed microconstituent structure

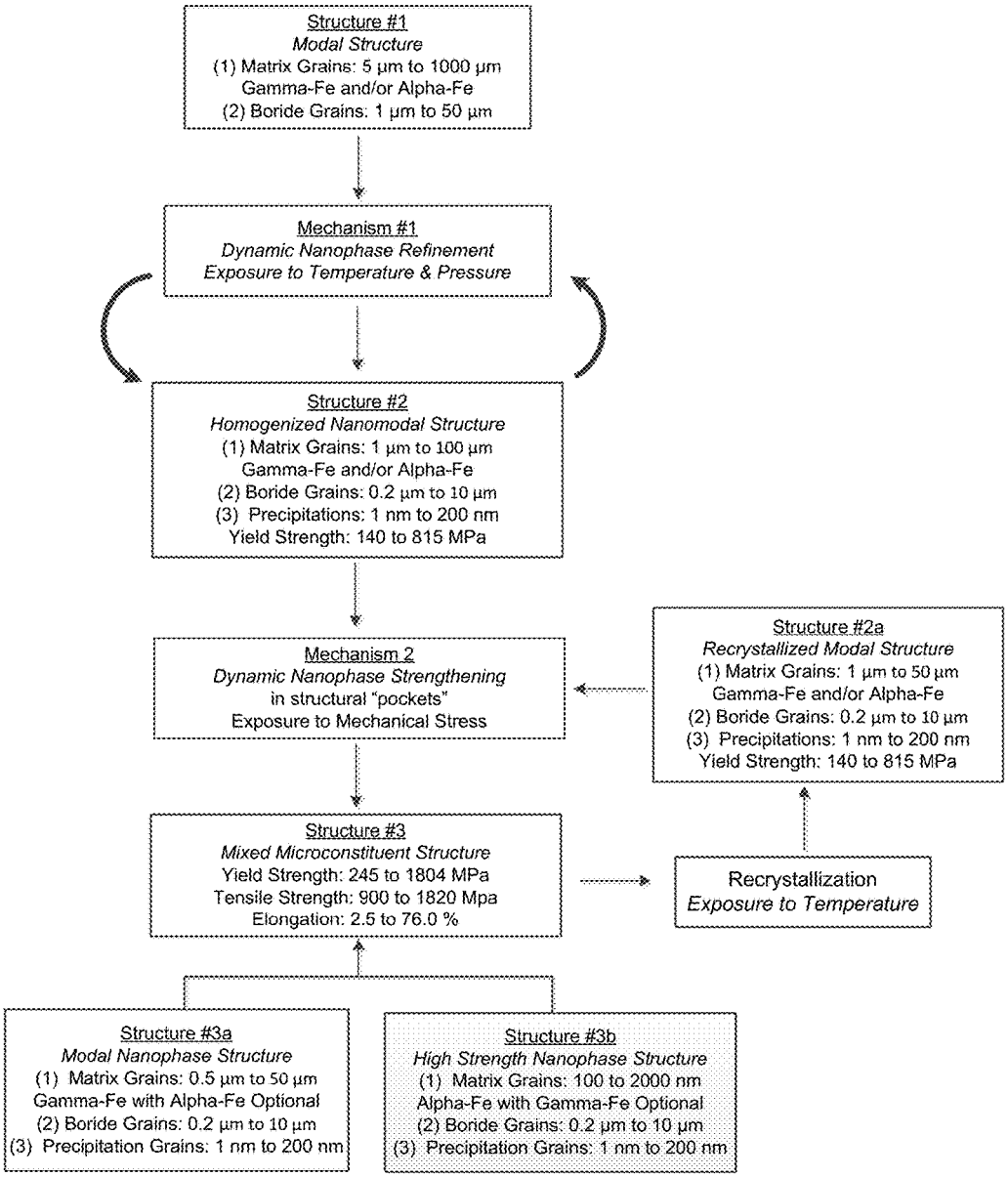
FIG. 4 Structures and mechanisms in High Ductility Steel alloys.

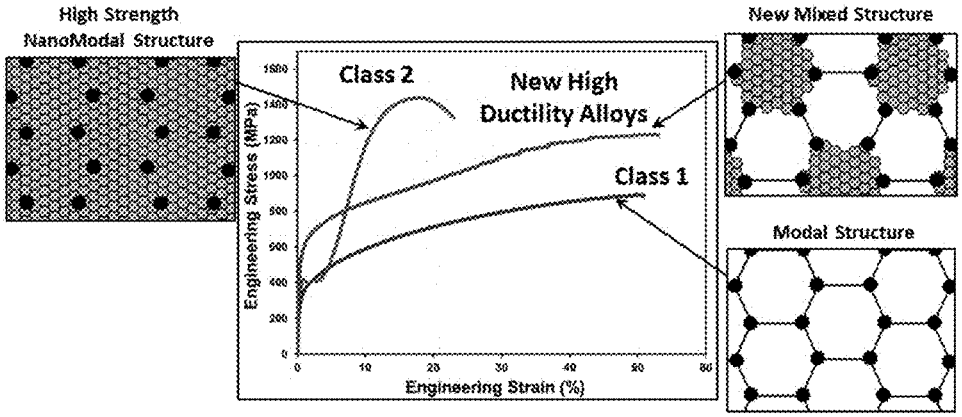
FIG. 5 Representative stress-strain curves demonstrating mechanical response of the alloys depending on their structure.

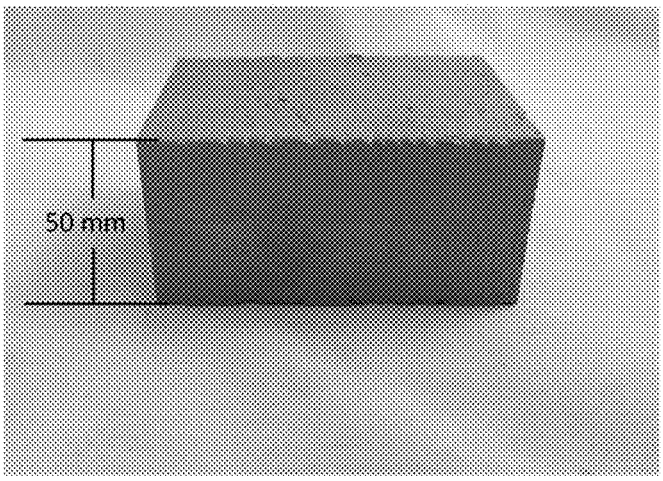
FIG. 6 A view of the as-cast laboratory slab from Alloy 61.
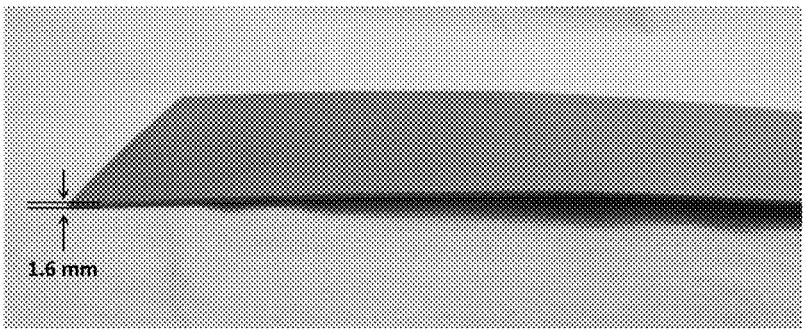
FIG. 7 A view of the laboratory slab from Alloy 59 after hot rolling.
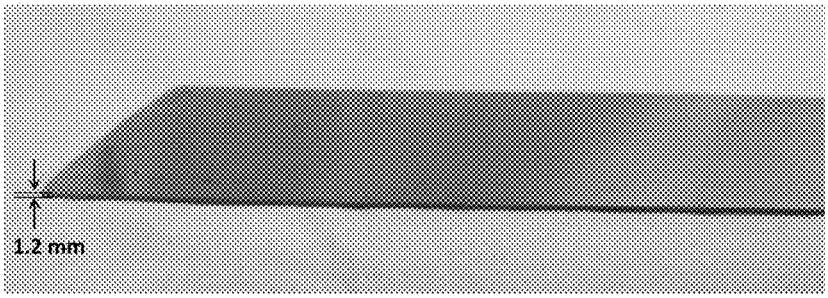
FIG. 8 A view of the laboratory slab from Alloy 59 after hot and cold rolling.

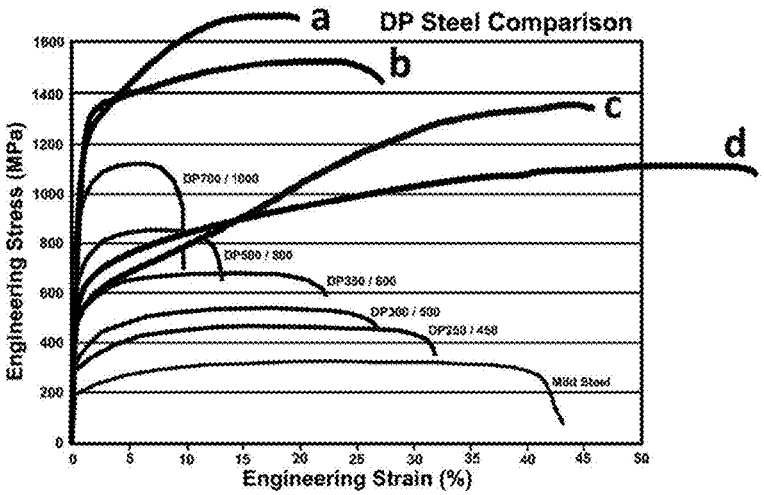
FIG. 9 Comparison of stress-strain curves of new non-stainless steel sheet types with existing Dual Phase (DP) steels.
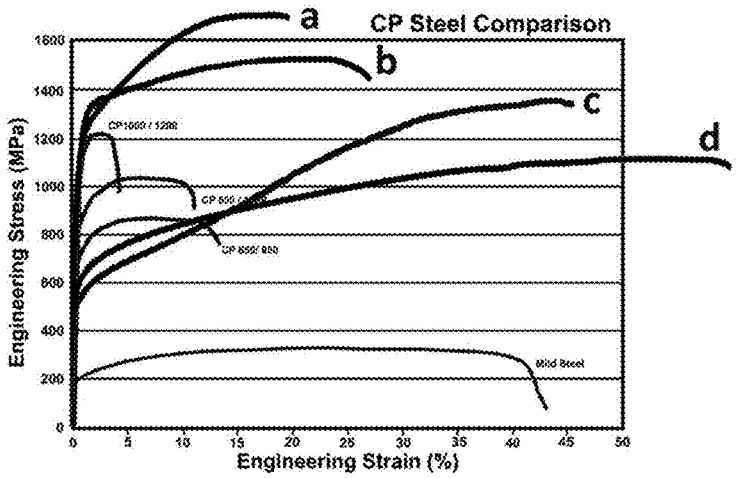
FIG. 10 Comparison of stress-strain curves of new non-stainless steel sheet types with existing Complex Phase (CP) steels.

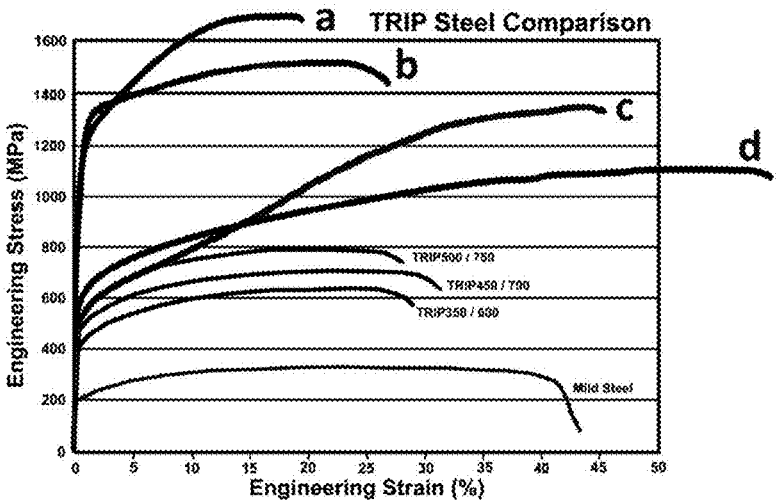
FIG. 11 Comparison of stress-strain curves of new non-stainless steel sheet types with existing Transformation Induced Plasticity (TRIP) steels.
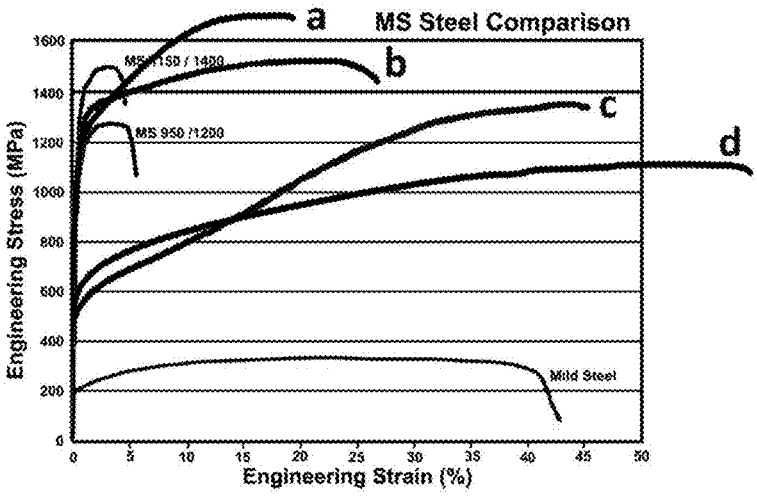
FIG. 12 Comparison of stress-strain curves of new non-stainless steel sheet types with existing Martensitic (MS) steels.

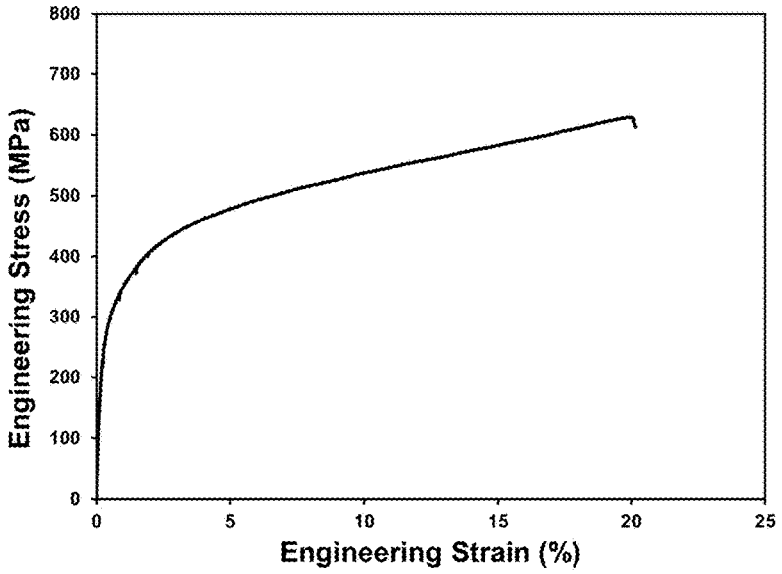
FIG. 13 Stress-strain curve corresponding to the TEM sample from the gage section after deformation in the as-cast condition.
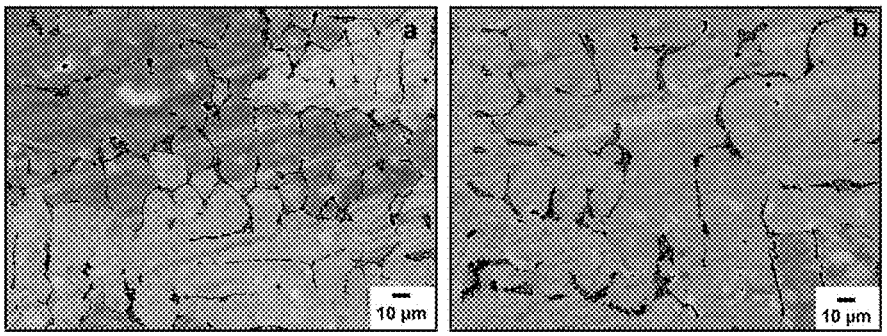
FIG. 14 Back-scattered SEM micrographs of microstructure in as-cast 50 mm thick Alloy 8 slab: a) at the edge; b) in the center of cross-section.

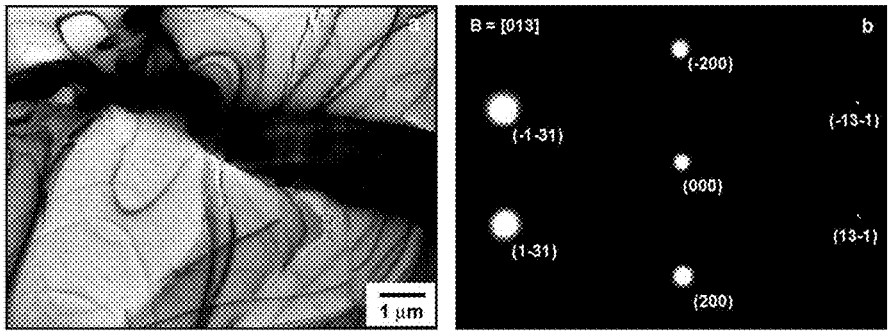
FIG. 15 Bright-field TEM micrograph and selected electron diffraction pattern of microstructure in the 50 mm thick as-cast Alloy 8 slab.
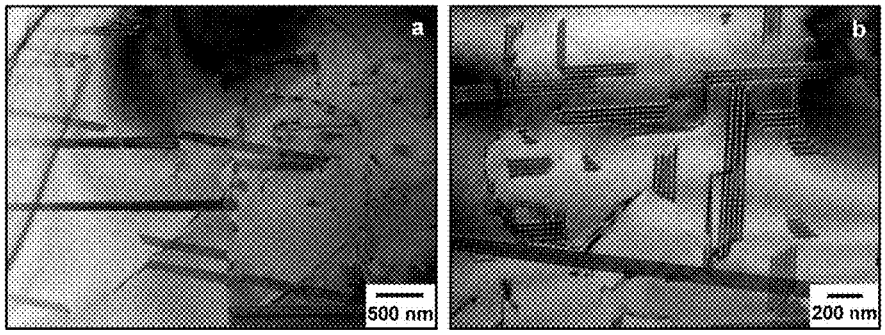
FIG. 16 Bright-field TEM micrographs of microstructure in the 50 mm thick as-cast Alloy 8 slab showing staking faults in the matrix grains.

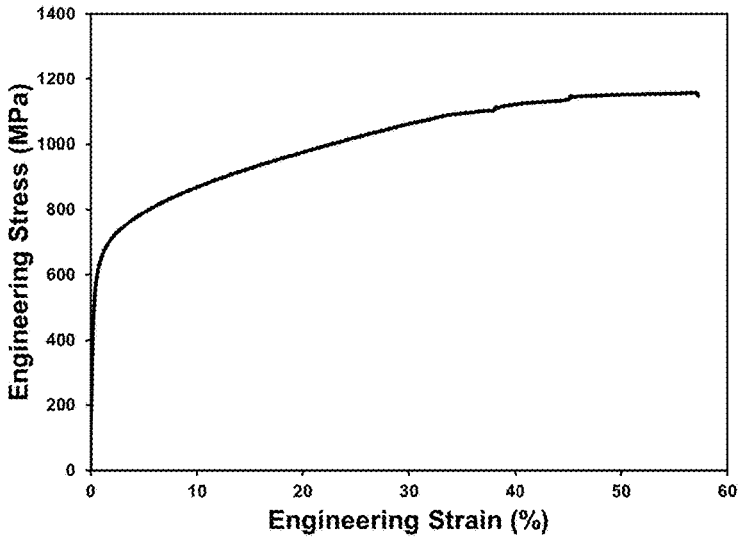
FIG. 17 Stress-strain curve corresponding to the TEM sample from the gage section after deformation of Alloy 8 in hot rolled condition.
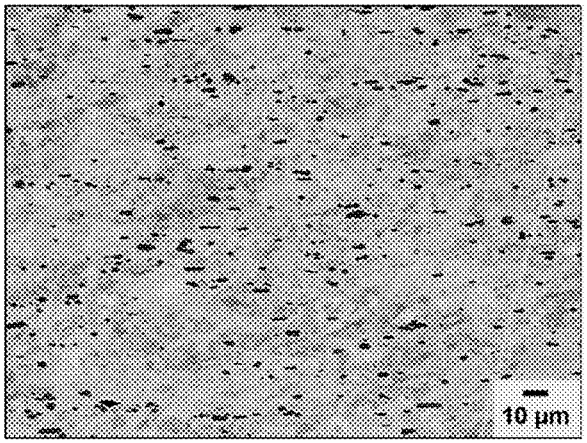
FIG. 18 Backscattered SEM micrograph of microstructure in the Alloy 8 slab after hot rolling at 1075 °C with 97% reduction.

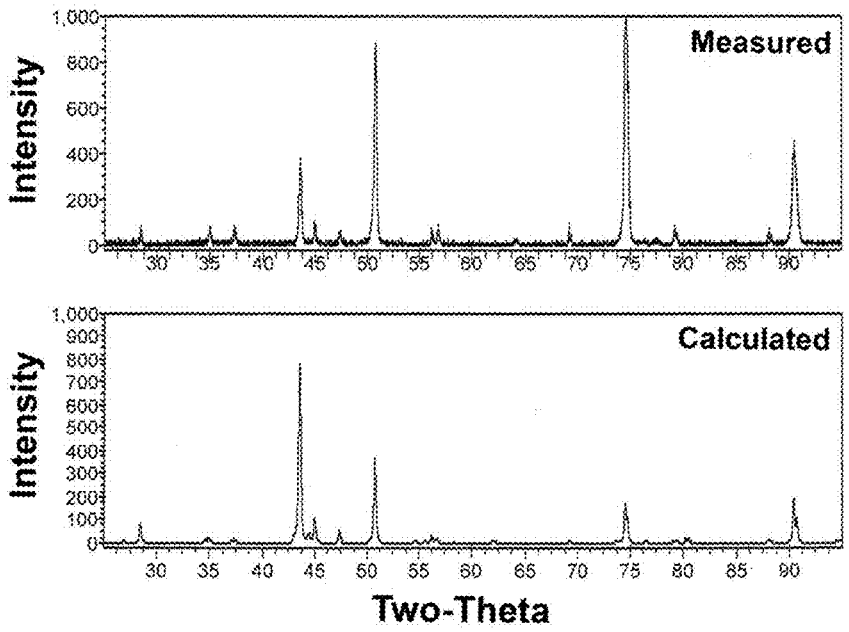
FIG. 19 X-ray diffraction data (intensity vs two-theta) for Alloy 8 slab after hot rolling at 1075°C with 97% reduction.

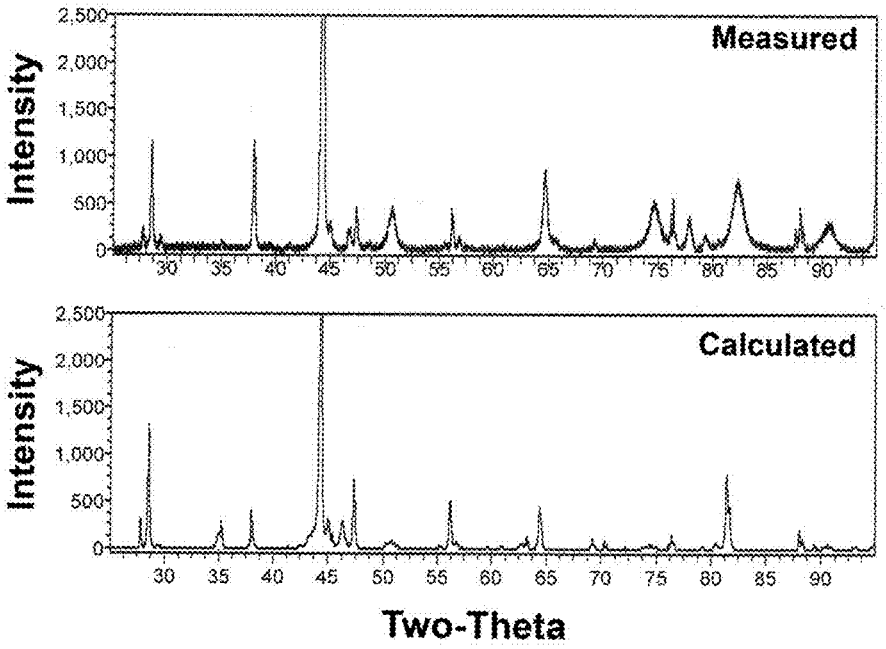
FIG. 20 X-ray diffraction data (intensity vs two-theta) for Alloy 8 slab after hot rolling at 1075°C with 97% reduction and tensile testing.

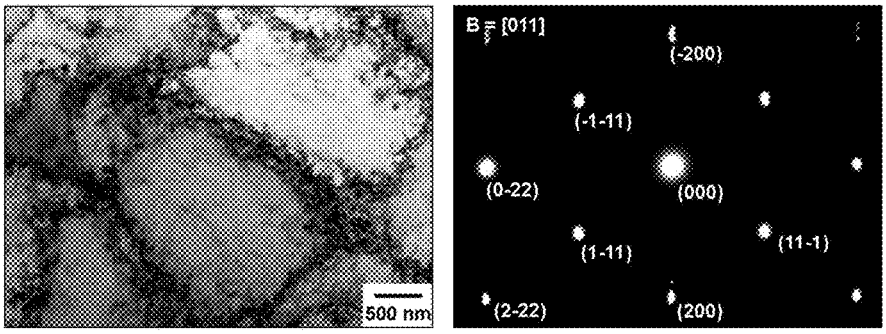
FIG. 21 Bright-field TEM micrograph at low magnification and selected area electron diffraction pattern for Alloy 8 slab after hot rolling.
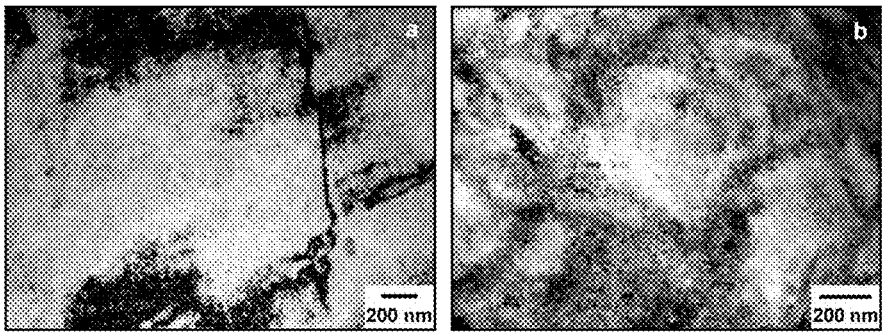
FIG. 22 Bright-field TEM micrographs of microstructure in Alloy 8 slab after hot rolling and tensile deformation showing matrix grains of Modal Nanophase Structure.

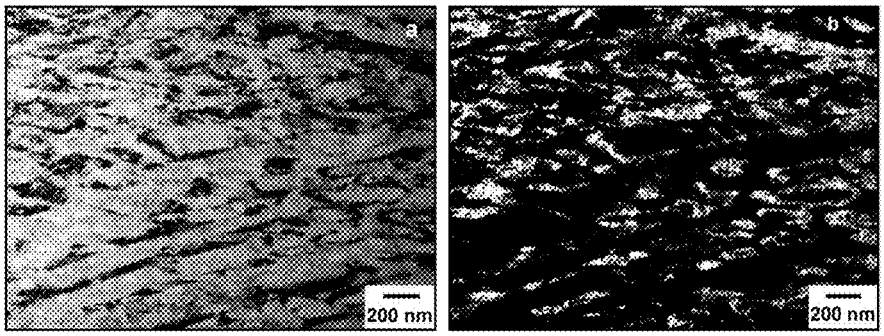
FIG. 23 Bright-field (a) and dark-field (b) TEM micrographs of microstructure in Alloy 8 slab after hot rolling and tensile deformation.
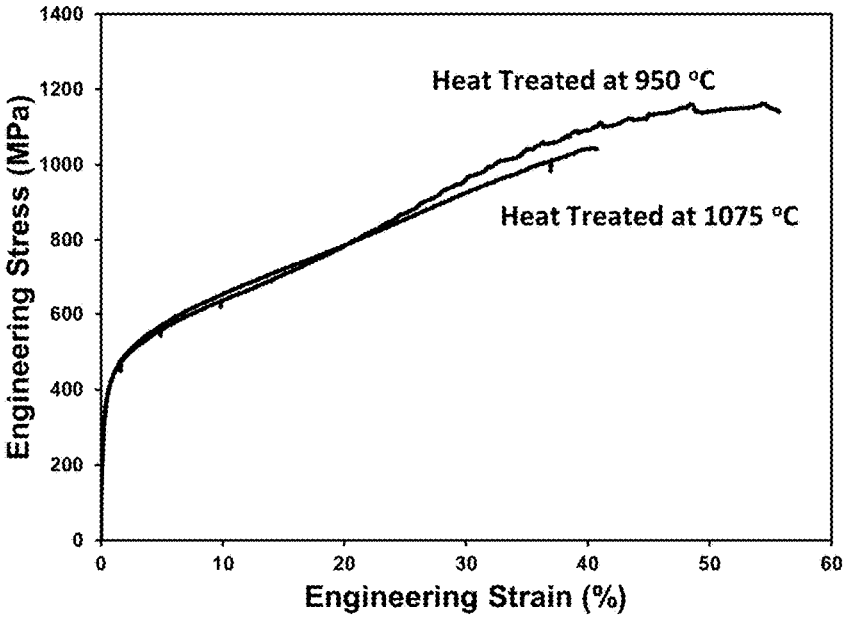
FIG. 24 Stress-strain curves corresponding to the TEM samples from the gage section after deformation in hot rolled Alloy 8 after two different heat treatments.

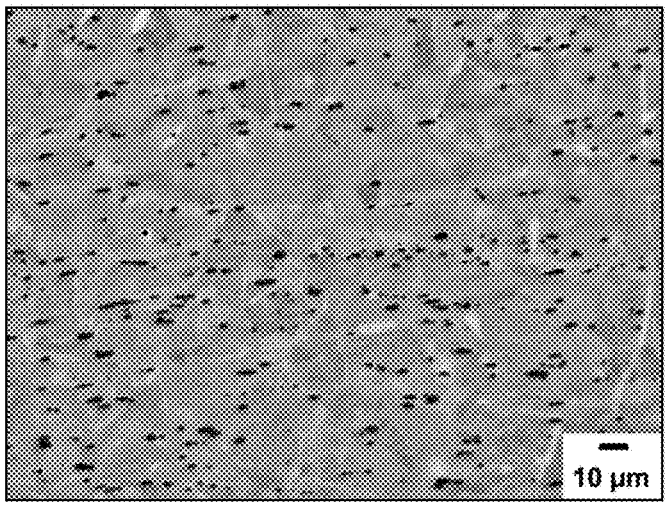
FIG. 25 SEM backscattered electron micrograph of microstructure in Alloy 8 slab after hot rolling and following heat treatment at 950°C for 6 hr.
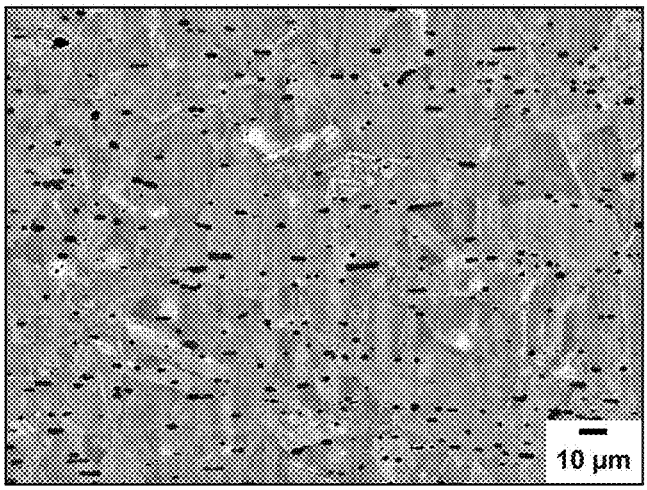
FIG. 26 SEM backscattered electron micrograph of microstructure in Alloy 8 after hot rolling and following heat treatment at 1075°C for 2 hr.

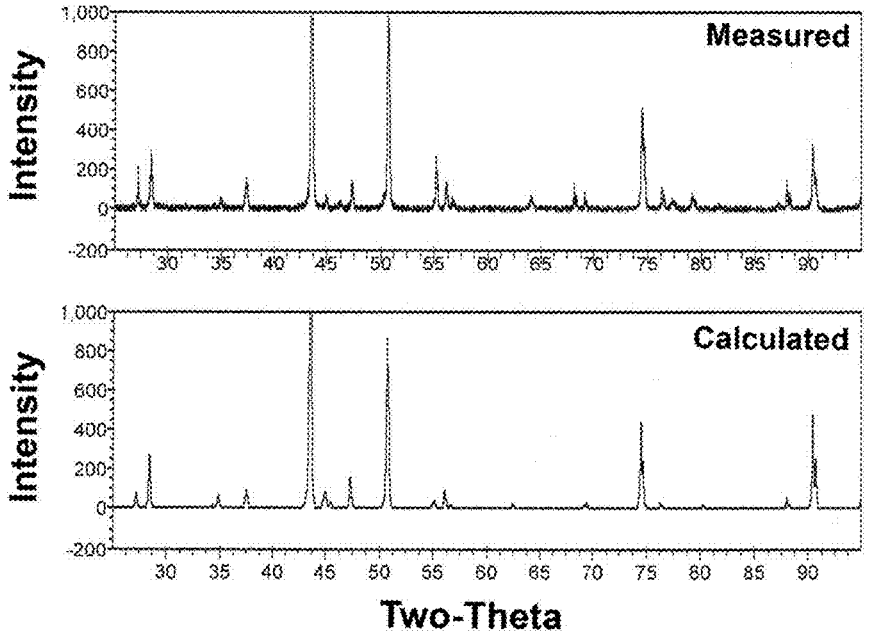
FIG. 27 X-ray diffraction data (intensity vs two-theta) for Alloy 8 slab after hot rolling and heat treatment at 950°C for 6 hours.

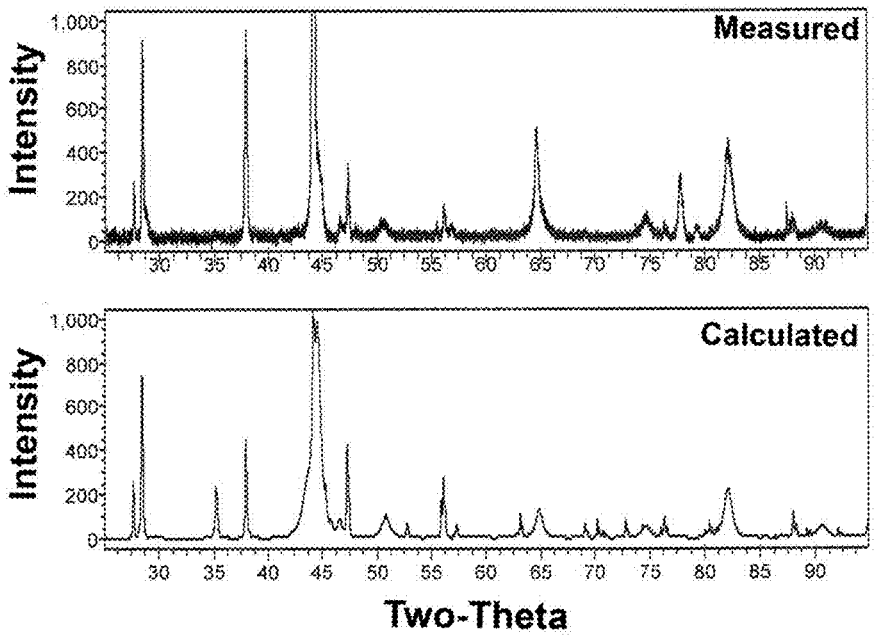
FIG. 28 X-ray diffraction data (intensity vs two-theta) for Alloy 8 slab after hot rolling, heat treatment at 950°C for 6 hours and tensile testing.

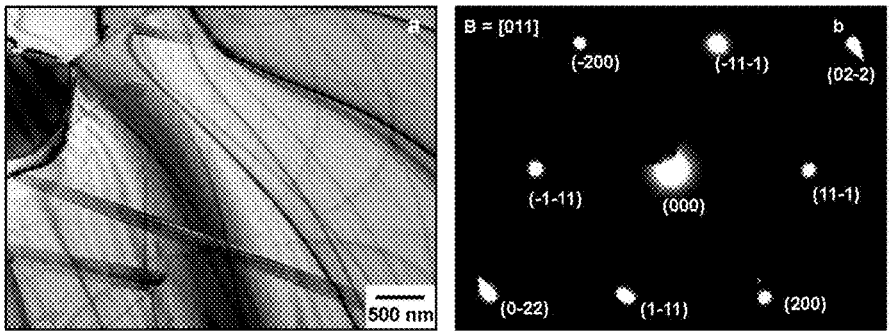
FIG. 29 Bright-field TEM micrograph at low magnification and selected area electron diffraction pattern for Alloy 8 slab.
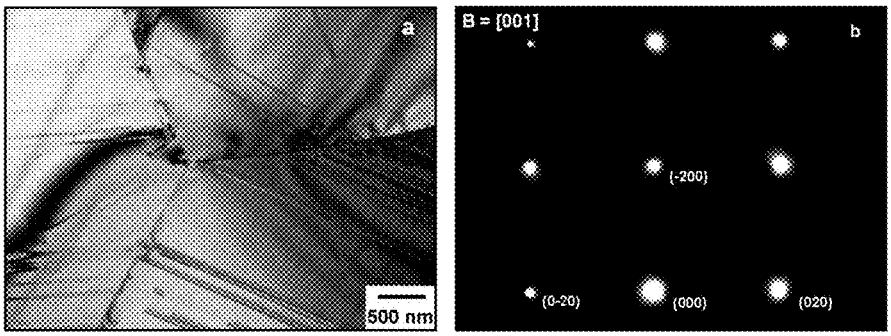
FIG. 30 Bright-field TEM micrograph at low magnification and selected area electron diffraction pattern for Alloy 8 slab.

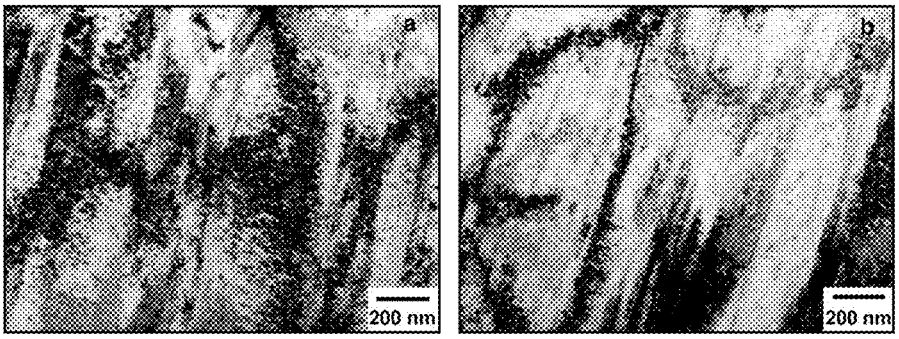
FIG. 31 Bright-field TEM micrographs of microstructure in Alloy 8 slab.
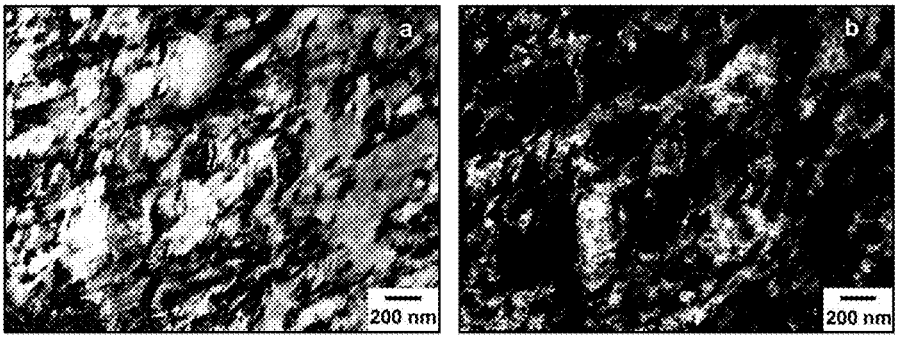
FIG. 32 Bright-field and dark-field TEM micrographs of microstructure in Alloy 8 slab.

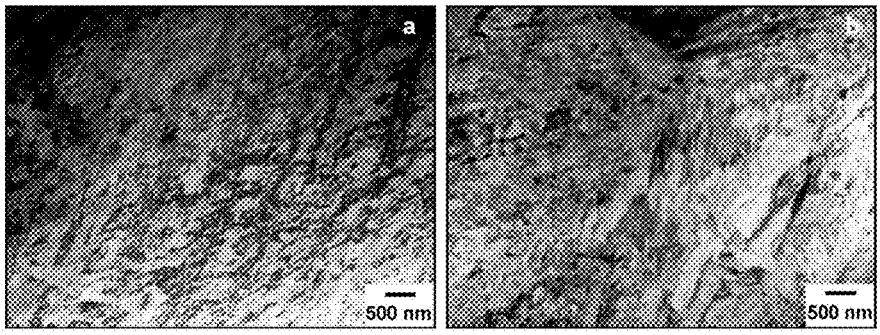
FIG. 33 Bright-field TEM micrographs of microstructure in Alloy 8 slab.
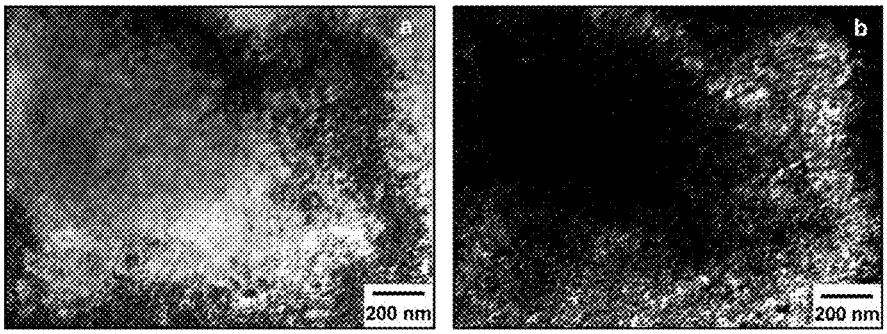
FIG. 34 Bright-field and dark-field TEM micrographs of microstructure in Alloy 8 slab.

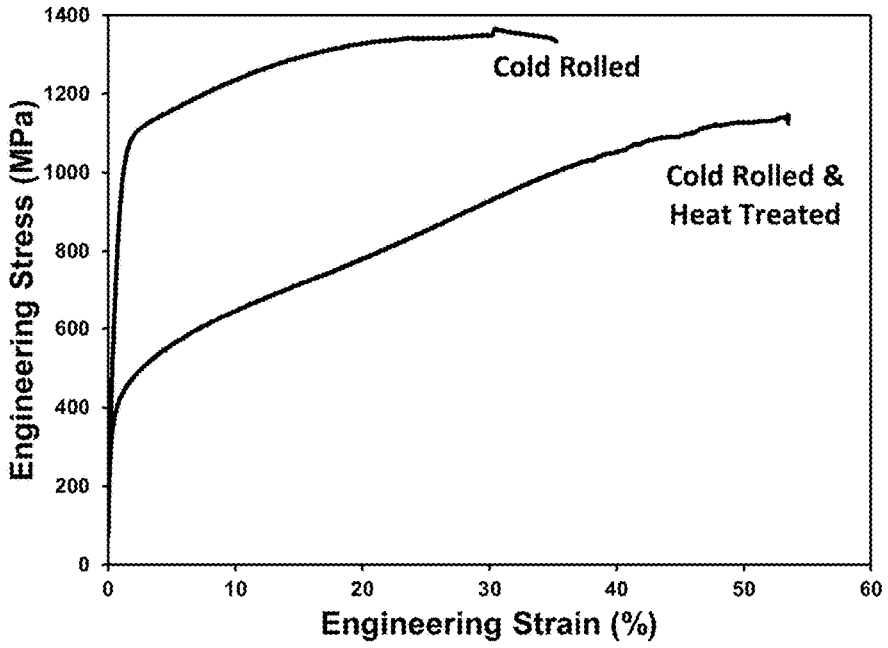
FIG. 35 Stress-strain curves corresponding to the TEM samples from the gage sections after deformation in cold rolled condition with and without heat treatment.

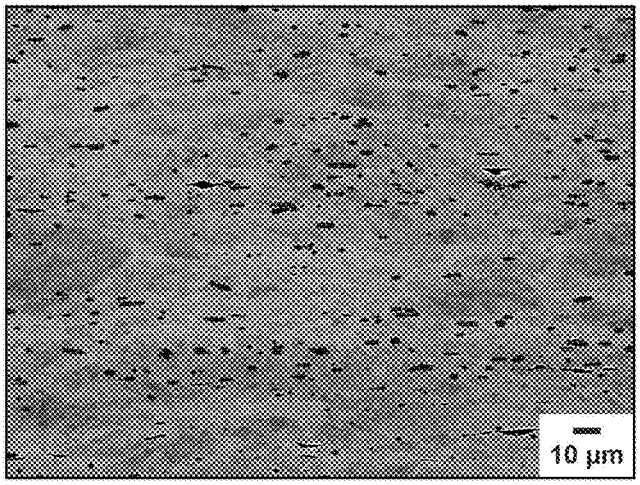
FIG. 36 SEM backscattered electron micrograph of microstructure in hot rolled Alloy 8 slab after cold rolling.
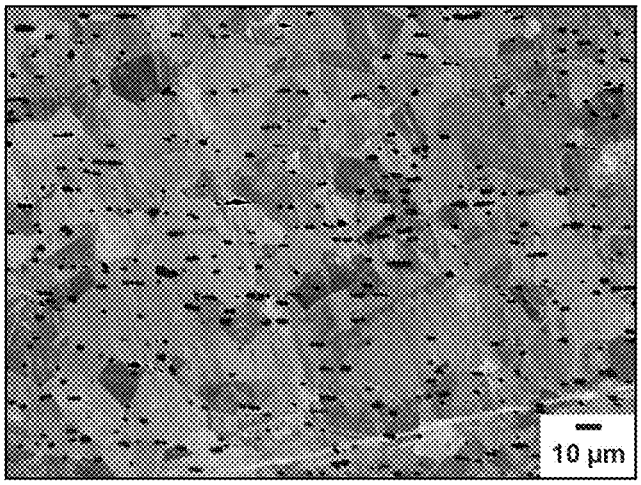
FIG. 37 SEM backscattered electron micrograph of microstructure in hot rolled Alloy 8 slab after cold rolling and heat treatment at 950°C for 6 hr.

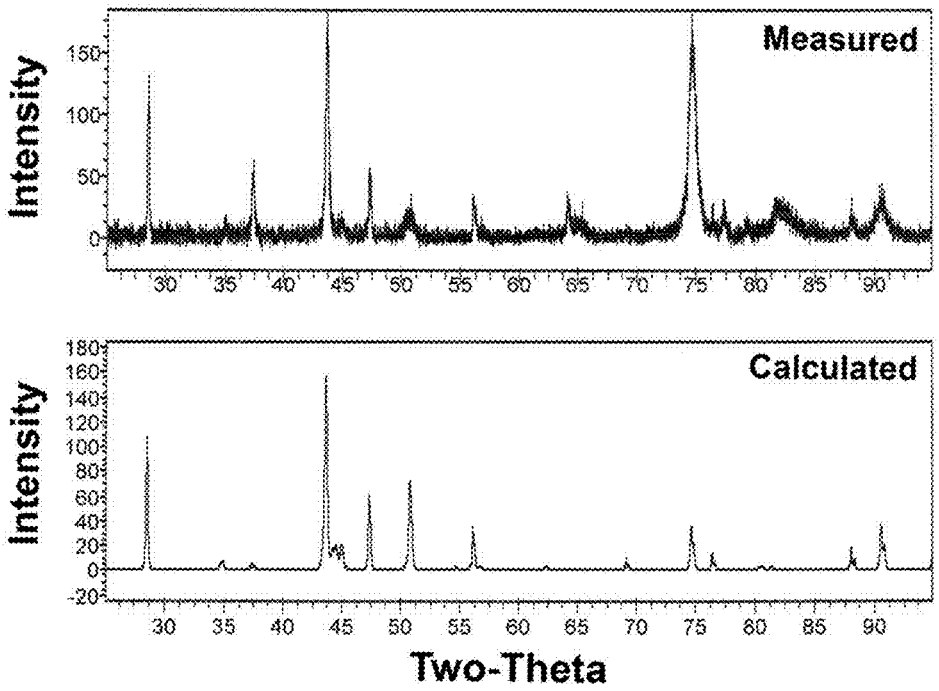
FIG. 38 X-ray diffraction data (intensity vs two-theta) for hot rolled Alloy 8 slab after cold rolling; a) Measured pattern, b) Rietveld calculated pattern with peaks identified.

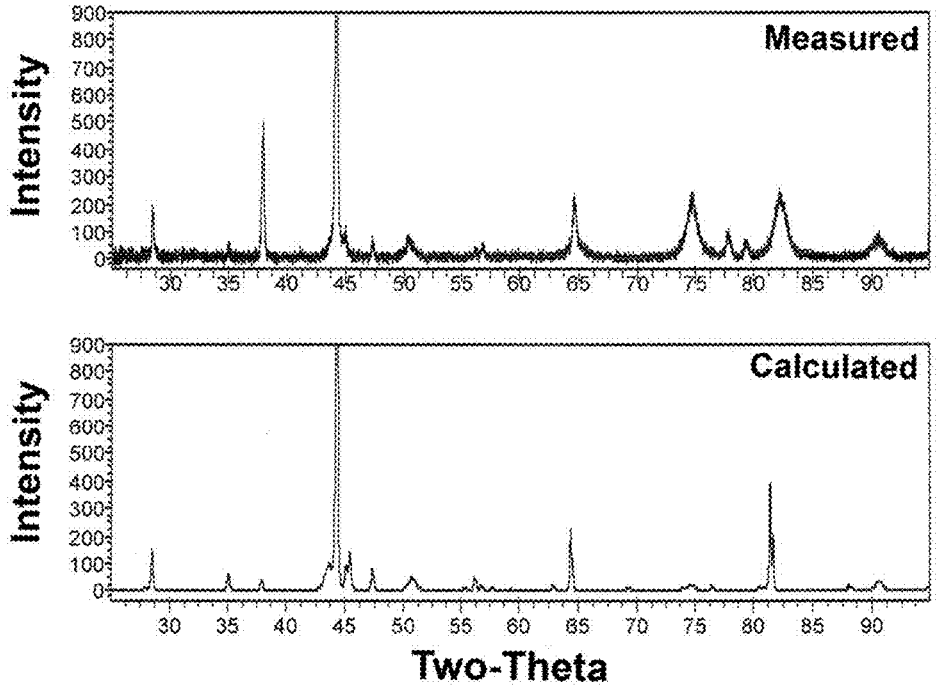
FIG. 39 X-ray diffraction data (intensity vs two-theta) for hot rolled Alloy 8 slab after cold rolling and tensile testing.

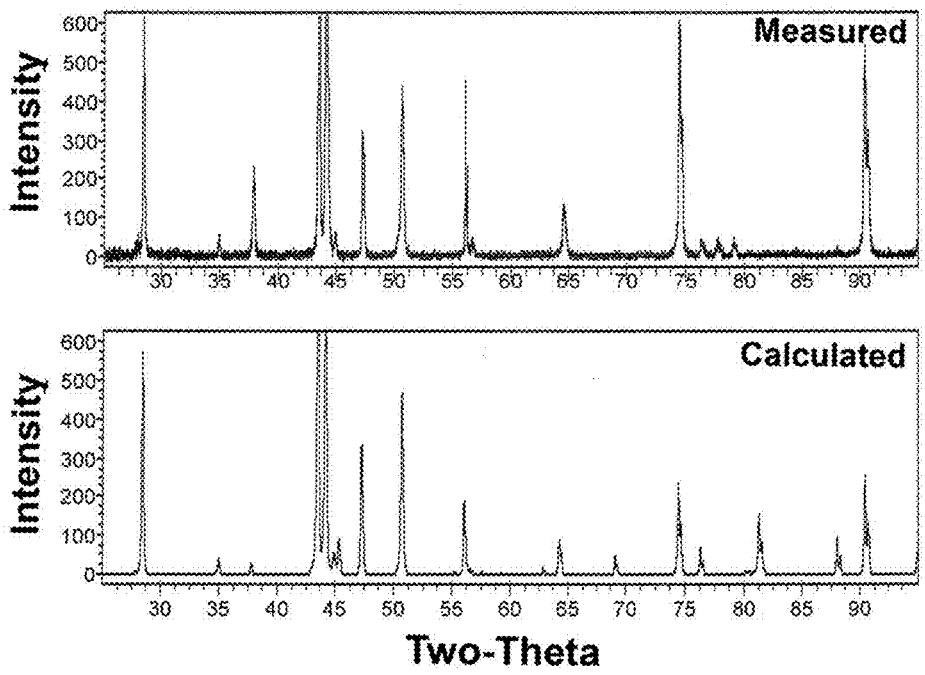
FIG. 40 X-ray diffraction data (intensity vs two-theta) for hot rolled Alloy 8 slab after cold rolling and heat treatment at 950°C for 6 hours.

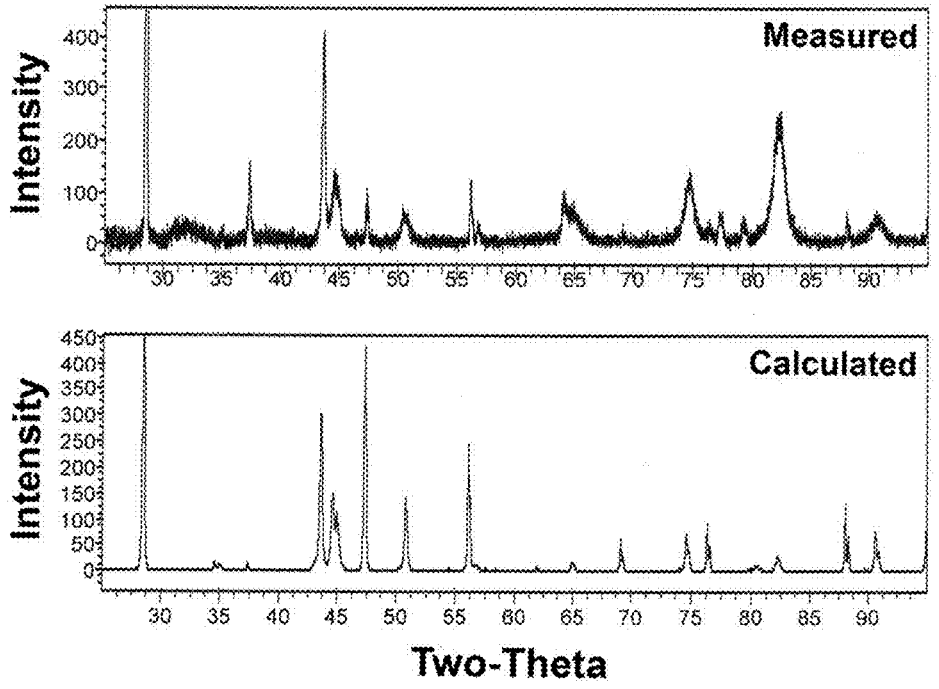
FIG. 41 X-ray diffraction data (intensity vs two-theta) for hot rolled Alloy 8 slab after cold rolling, heat treatment at 950°C for 6 hours and tensile testing; a) Measured pattern, b) Rietveld calculated pattern with peaks identified.

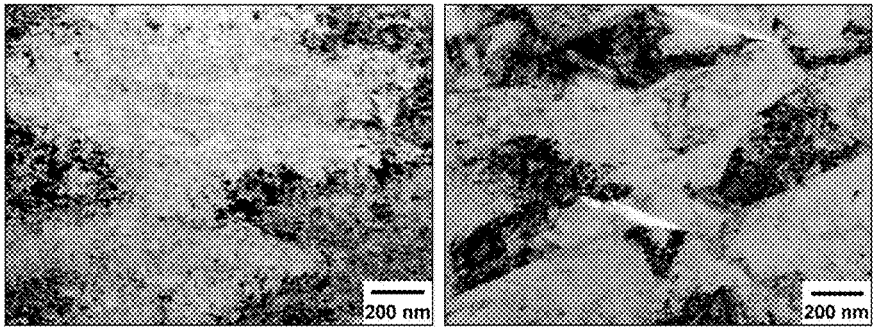
FIG. 42 Bright-field TEM micrographs of microstructure in hot rolled Alloy 8 slab after cold rolling showing Mixed Microconstituent Structure.
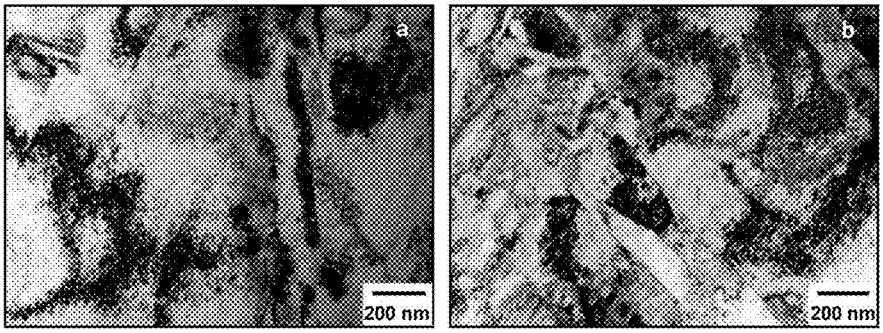
FIG. 43 Bright-field TEM micrographs of microstructure in hot rolled Alloy 8 slab after cold rolling and tensile deformation to fracture showing matrix grains of Modal Nanophase Structure.

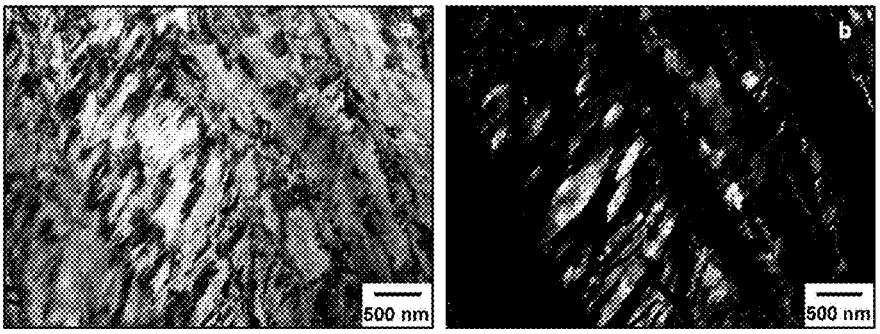
FIG. 44 Bright-field and dark-field TEM micrographs of microstructure in hot rolled Alloy 8 slab.
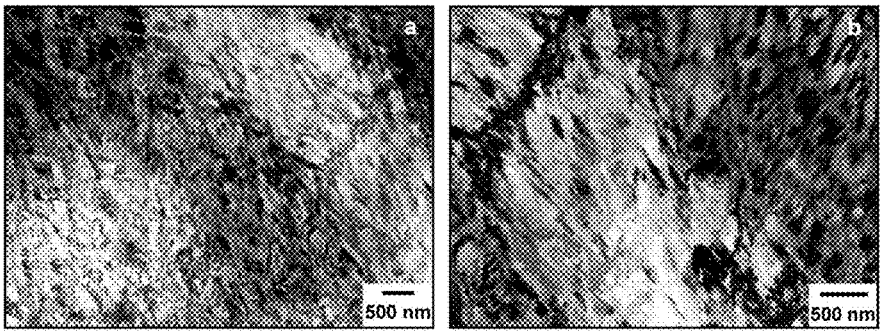
FIG. 45 Bright-field and dark-field TEM micrographs of microstructure in hot rolled Alloy 8 slab.

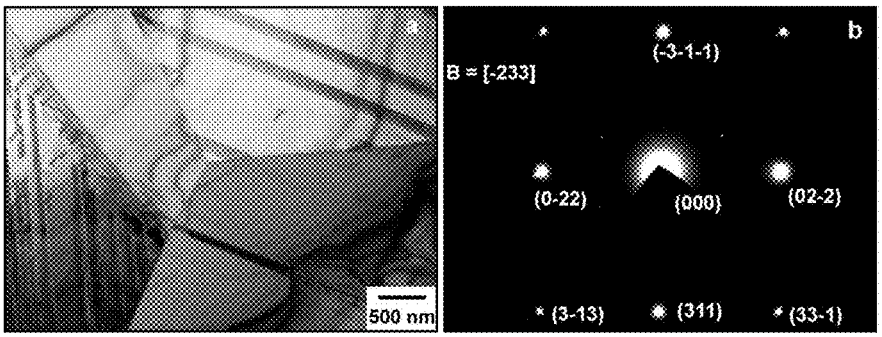
FIG. 46 Bright-field TEM micrograph at low magnification and selected area electron diffraction pattern for hot rolled Alloy 8 slab.
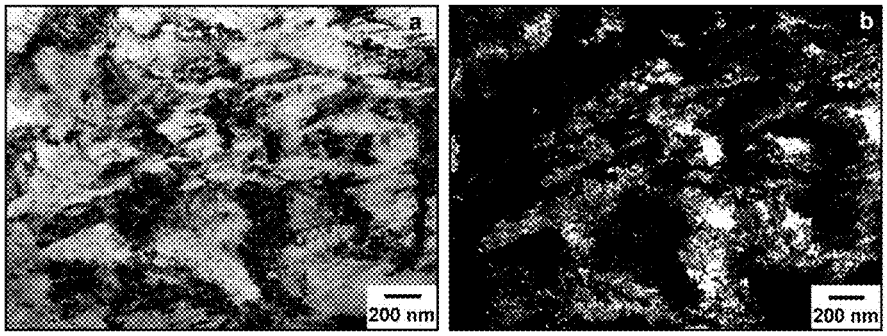
FIG. 47 Bright-field and dark-field TEM micrographs of microstructure in hot rolled Alloy 8 slab.

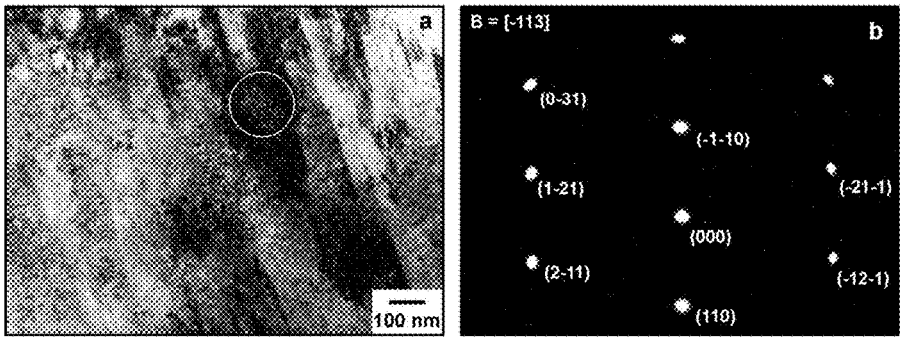
FIG. 48 Bright-field TEM micrograph and selected area electron diffraction pattern for hot rolled Alloy 8 slab.
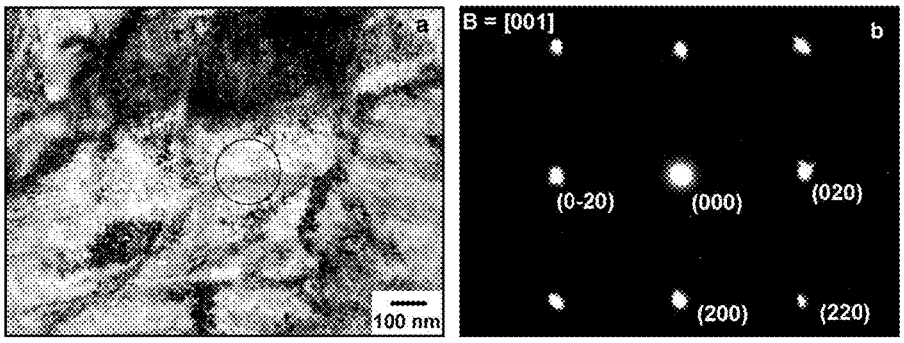
FIG. 49 Bright-field TEM micrograph and selected area electron diffraction pattern for hot rolled Alloy 8 slab.

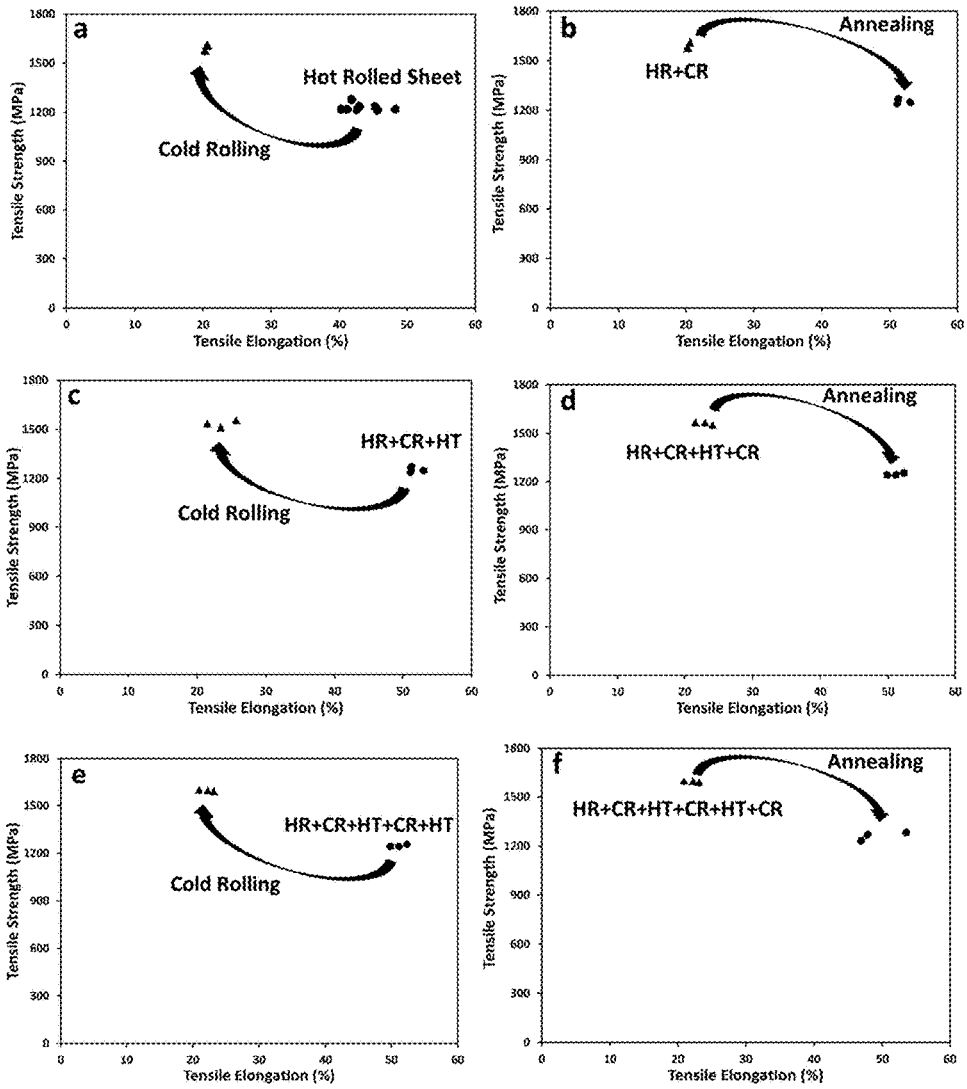
FIG. 50 Property recovery in Alloy 44 through cycles of cold rolling and annealing: (a) and (b) – cycle 1, (c) and (d) – cycle 2, (e) and (f) – cycle 3.

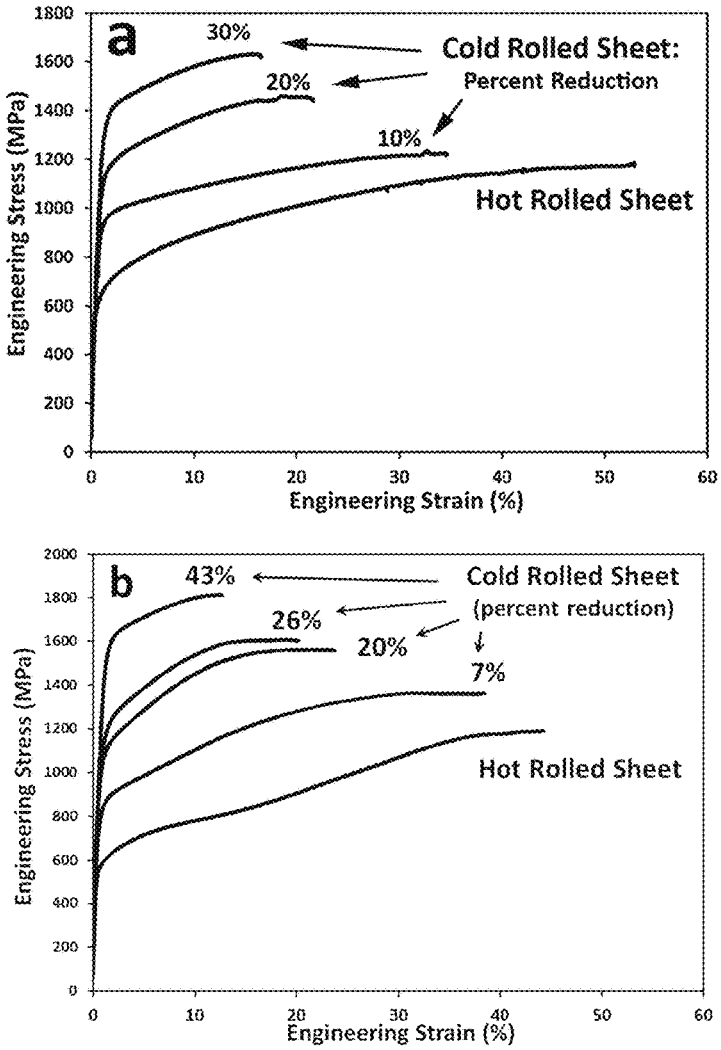
FIG. 51 Stress-strain curves after hot rolling and cold rolling with different reduction; (a) Alloy 43 and (b) Alloy 44.

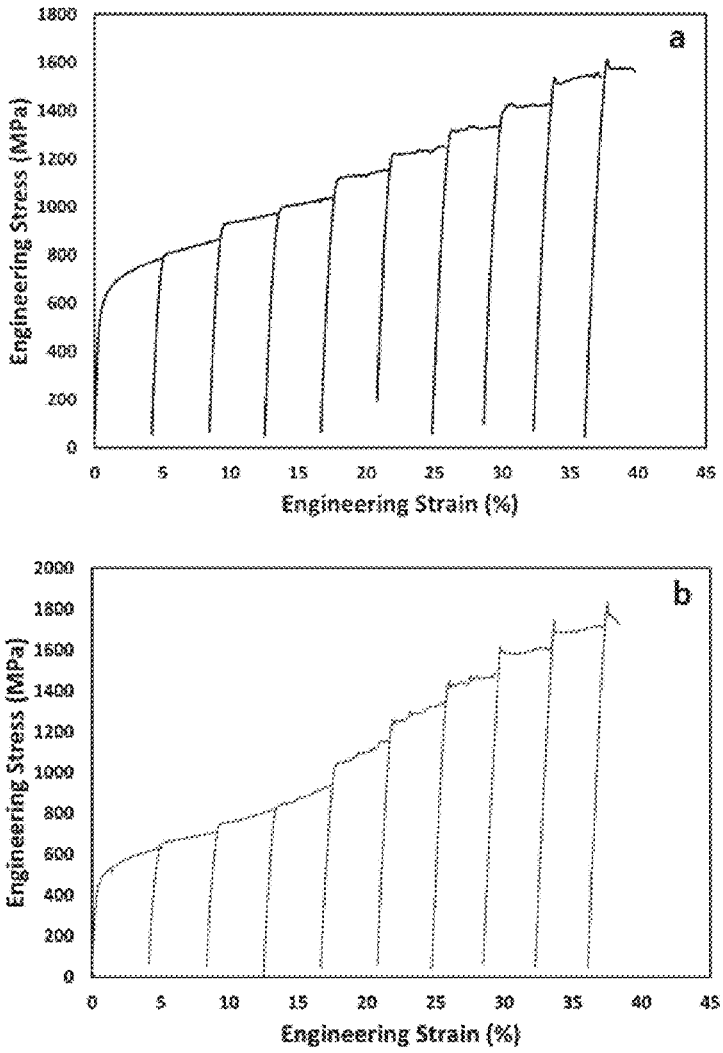
FIG. 52 Stress-strain curves for (a) Alloy 8 and (b) Alloy 44 at incremental testing with 4% deformation at each step.

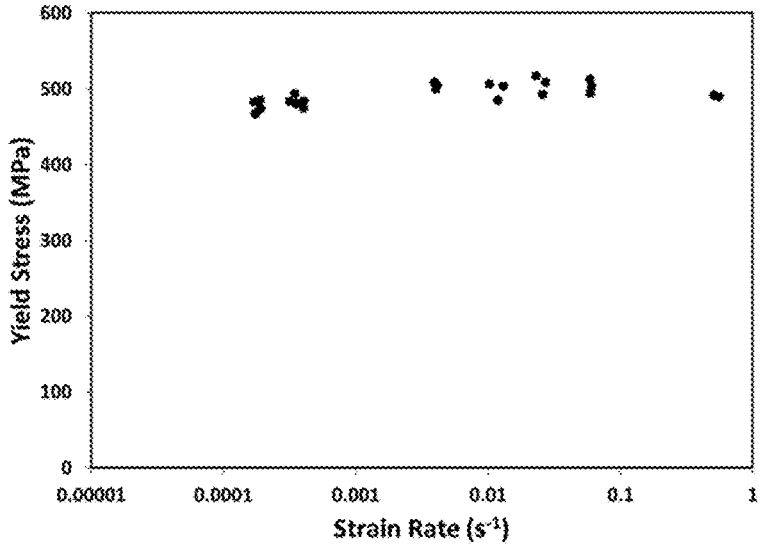
FIG. 53 Yield stress in Alloy 44 as a function of test strain rate.
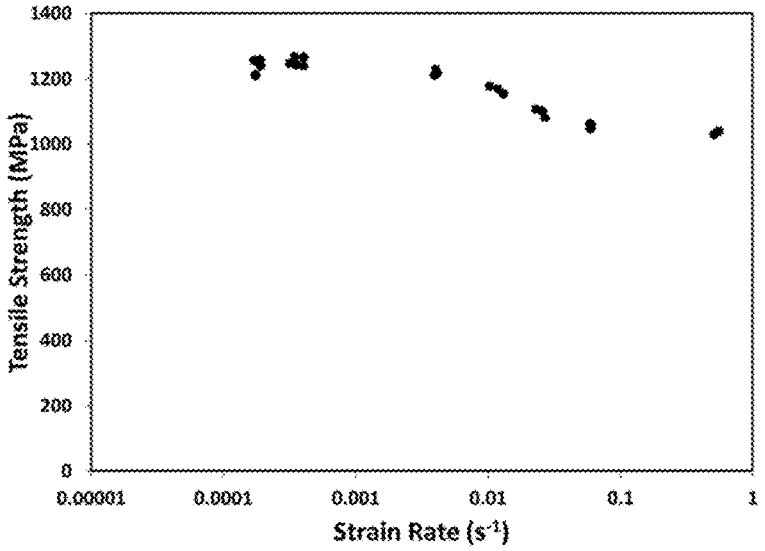
FIG. 54 Ultimate tensile strength in Alloy 44 as a function of test strain rate.

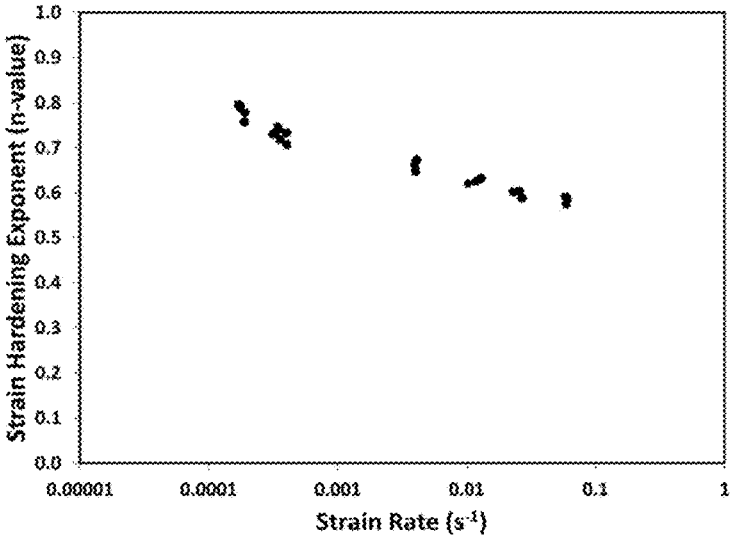
FIG. 55 Strain hardening exponent in Alloy 44 as a function of test strain rate.
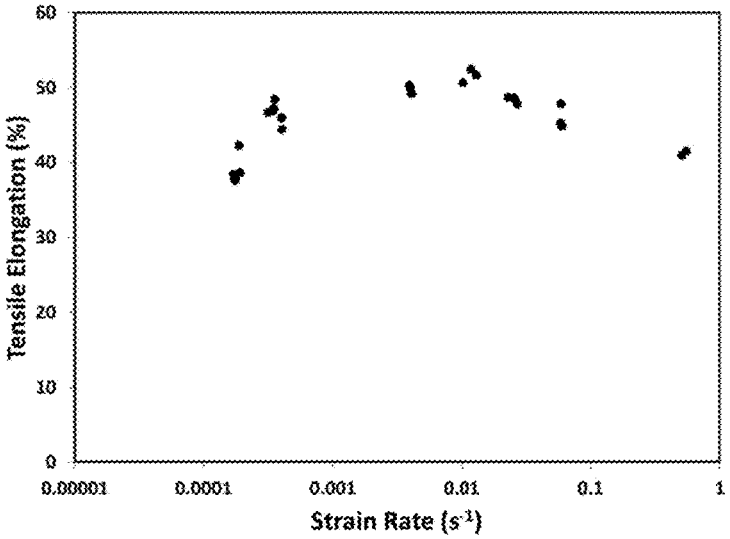
FIG. 56 Tensile elongation in Alloy 44 as a function of test strain rate.

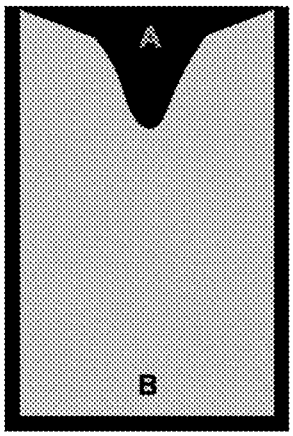
FIG. 57 Schematic illustration of cast slab cross section showing the shrinkage funnel and the locations from which samples for chemical analysis were taken.
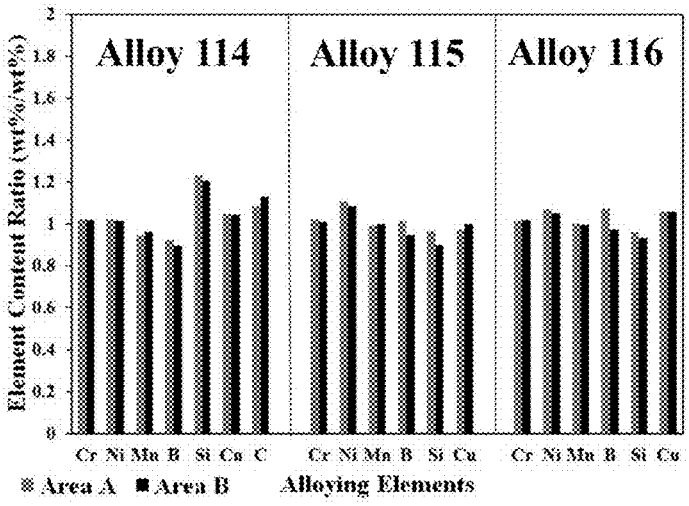
FIG. 58 Element content in wt% from areas A and B for selected High Ductility Steel alloys.

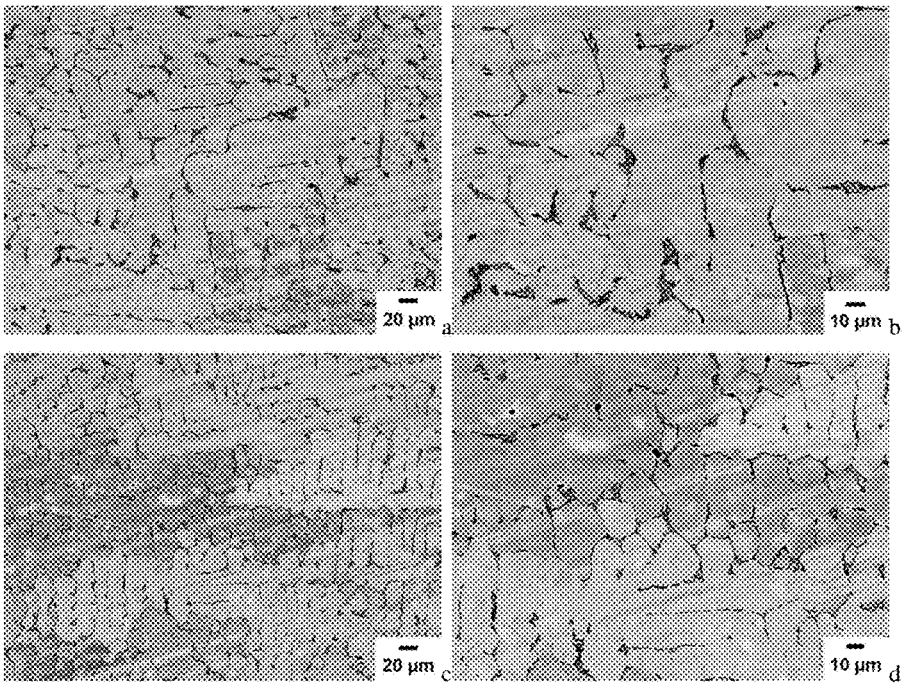
FIG. 59 Backscattered SEM images of microstructure in as-cast Alloy 8 slab at different magnifications; Central area of cast slab(a, b); Area close to the slab surface (c, d).

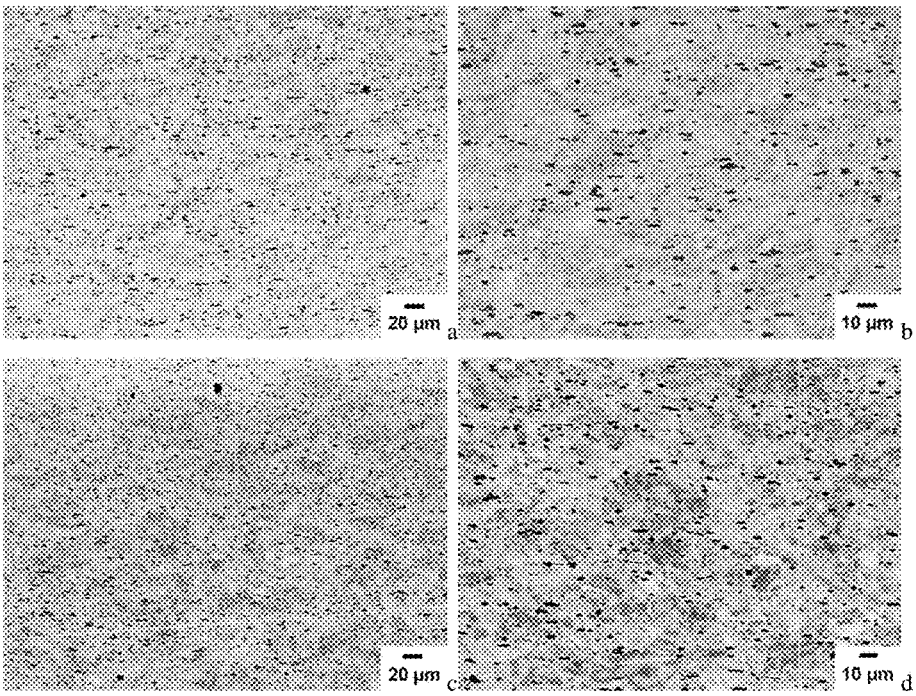
FIG. 60 Backscattered SEM images of microstructure in hot rolled Alloy 8 slab at different magnifications; Central area of cast slab(a, b); Area close to the slab surface (c, d).

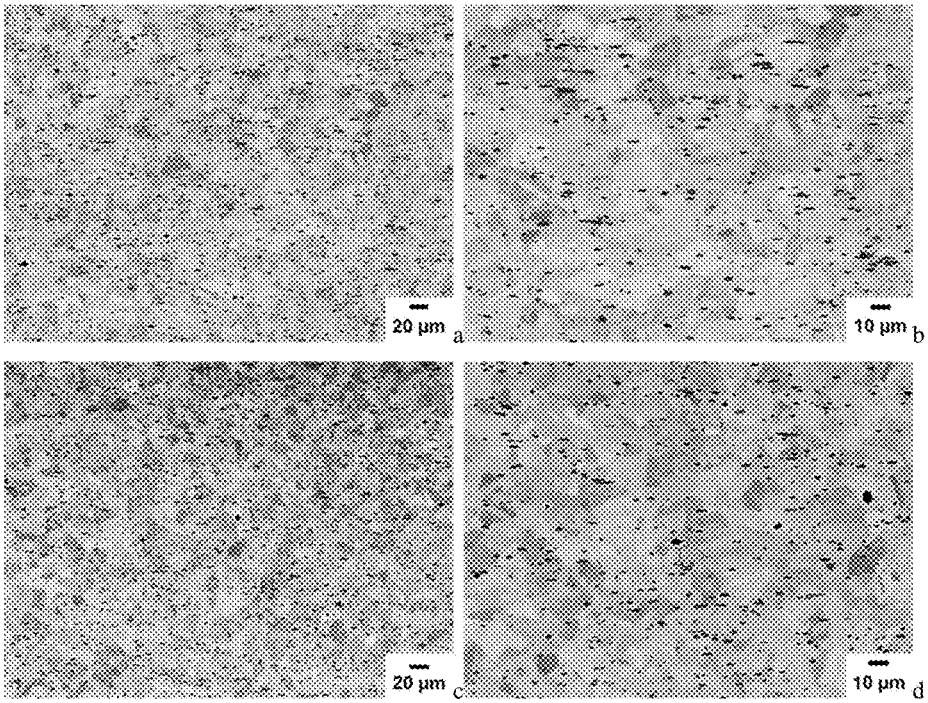
FIG. 61 Backscattered SEM images of hot rolled Alloy 8 slab after heat treatment at 850°C for 6hr at different magnifications; Central area of cast slab(a, b); Area close to the slab surface (c, d).

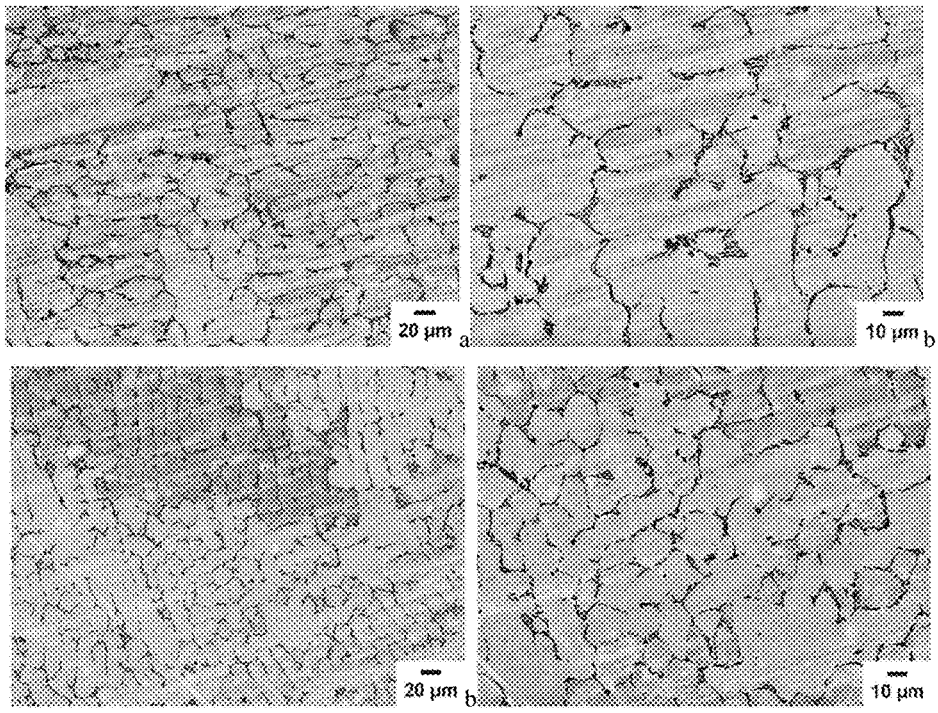
FIG. 62 Backscattered SEM images of microstructure in as-cast Alloy 20 slab at different magnifications; Central area of cast slab(a, b); Area close to the slab surface (c, d).

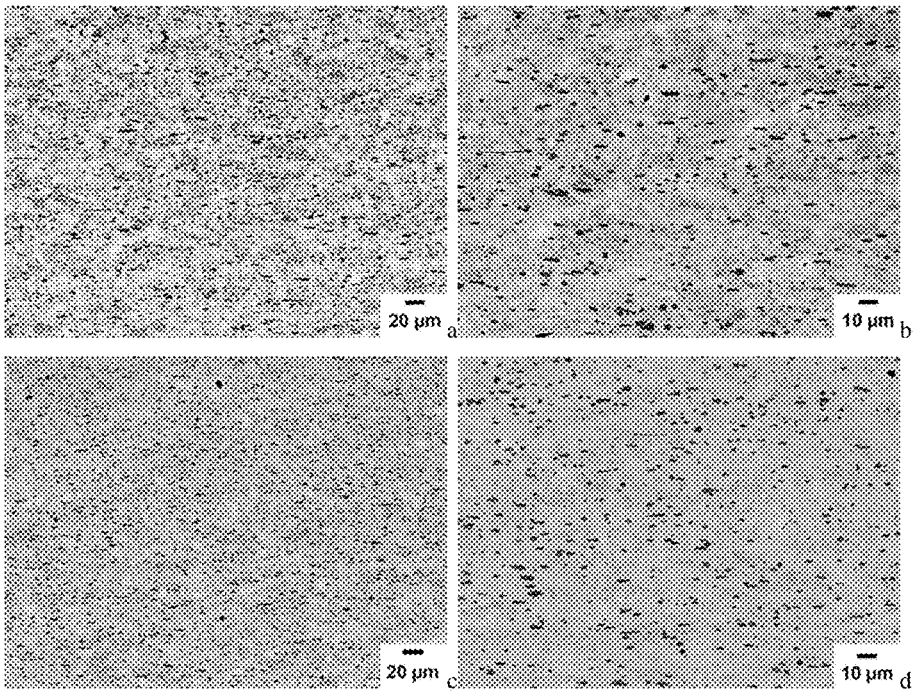
FIG. 63 Backscattered SEM images of microstructure in hot rolled Alloy 20 slab at different magnifications; Central area of cast slab(a, b); Area close to the slab surface (c, d).

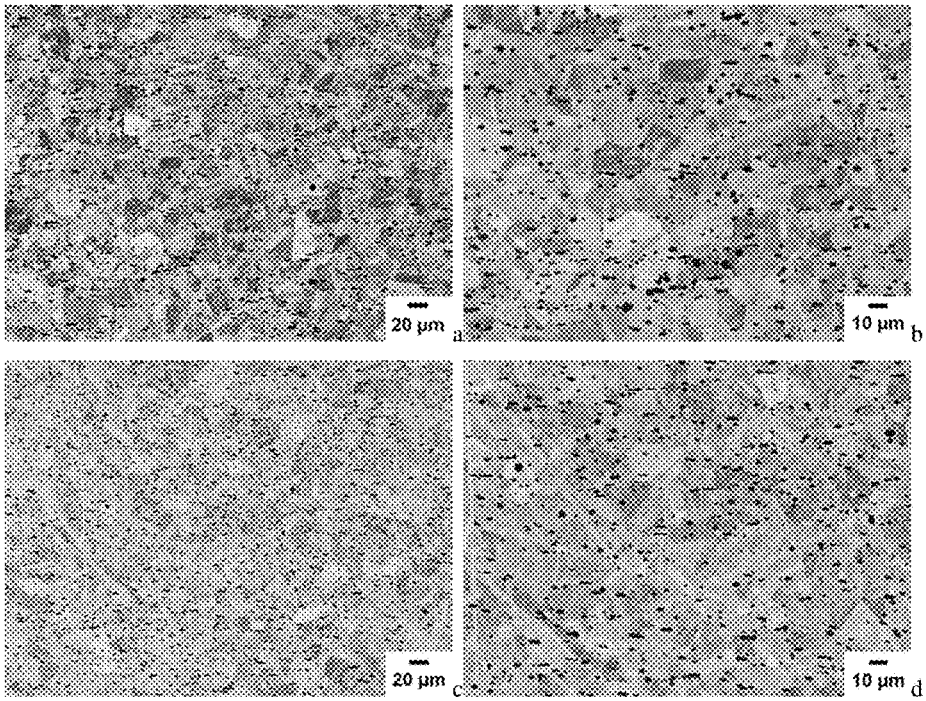
FIG. 64 Backscattered SEM images of hot rolled Alloy 20 slab after heat treatment at 1075°C for 6hr at different magnifications; Central area of cast slab(a, b); Area close to the slab surface (c, d).

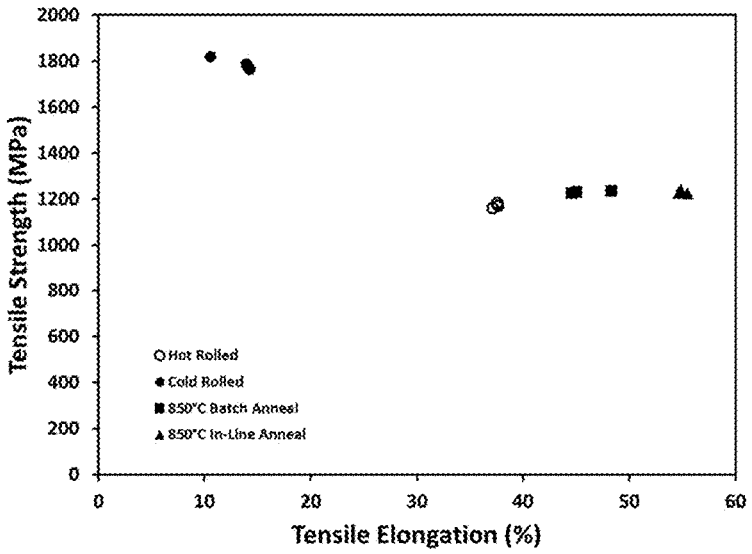
FIG. 65 Tensile properties of Alloy 44 slab cast at different steps of post processing.
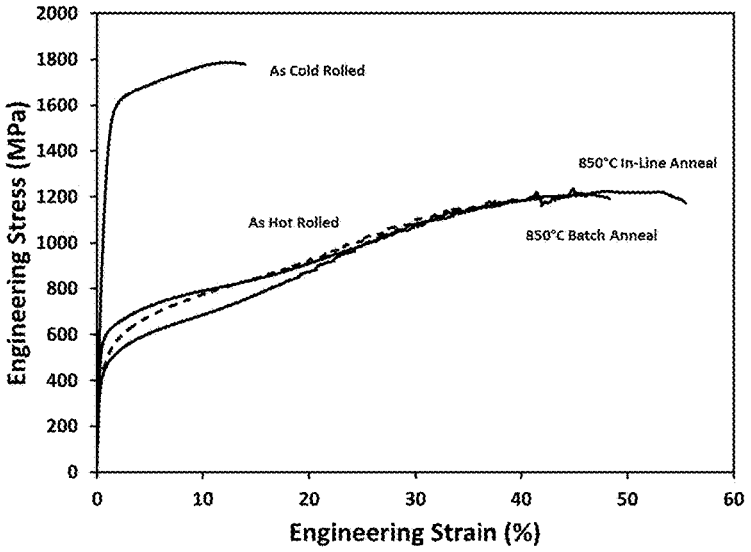
FIG. 66 Representative tensile curves Alloy 44 slab cast at different steps of post processing.

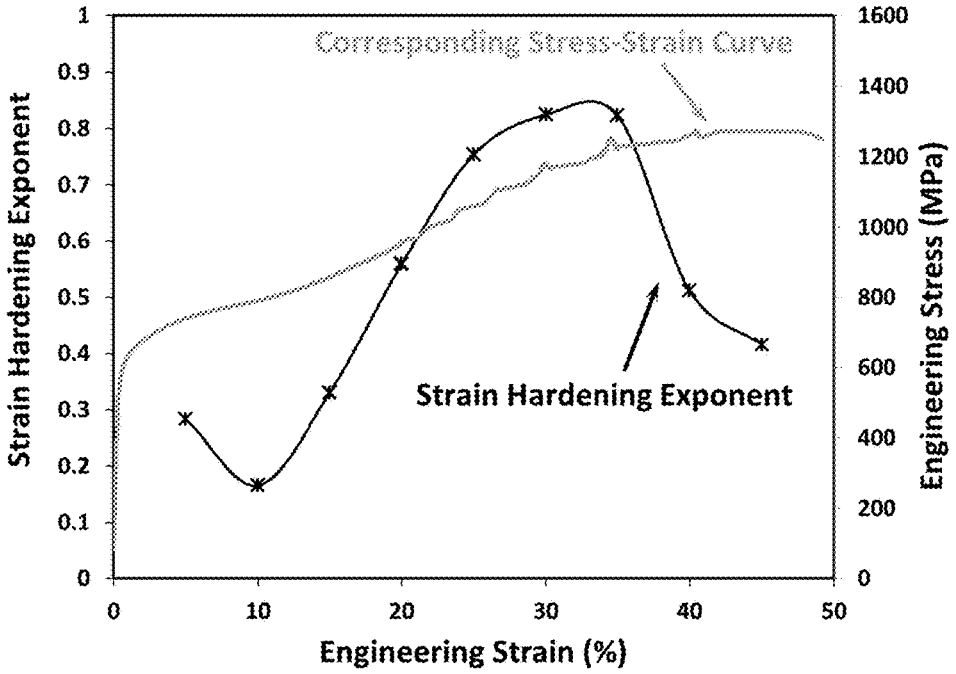
FIG. 67 Strain Hardening Exponent value as a function of strain in Alloy 44.

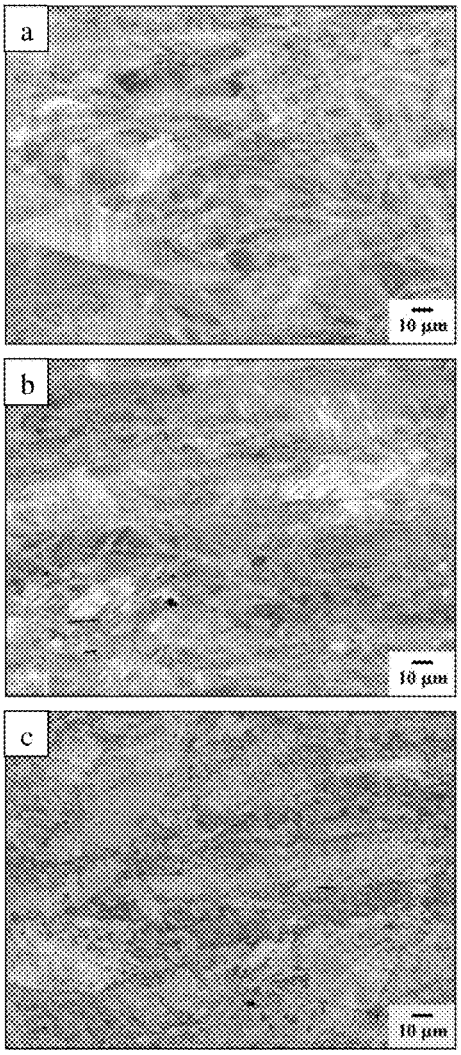
FIG. 68 Backscattered SEM images of Microstructure in (a) Alloy 141, (b) Alloy 142 and (c) Alloy 143 after hot rolling.

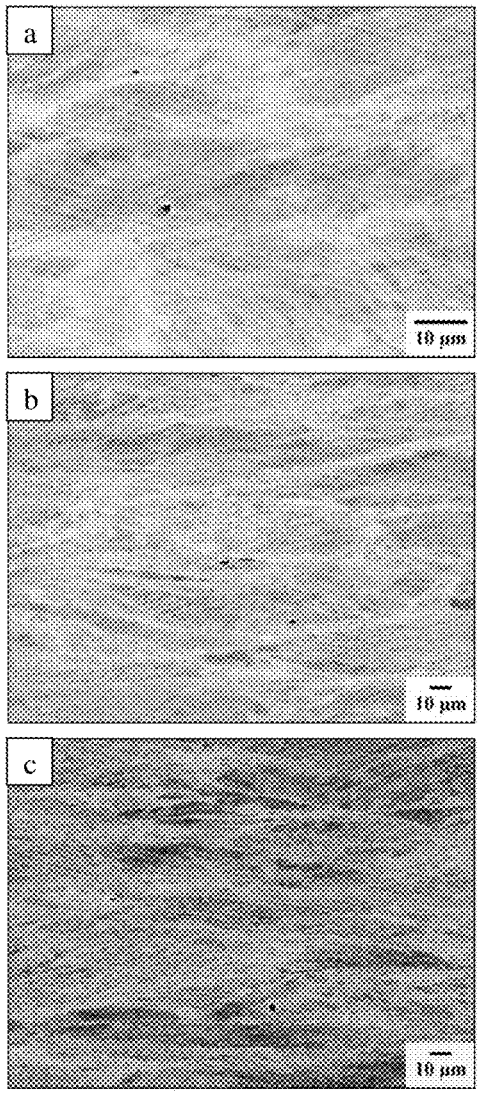
FIG. 69 Backscattered SEM images of microstructure in (a) Alloy 141, (b) Alloy 142 and (c) Alloy 143 after cold rolling.

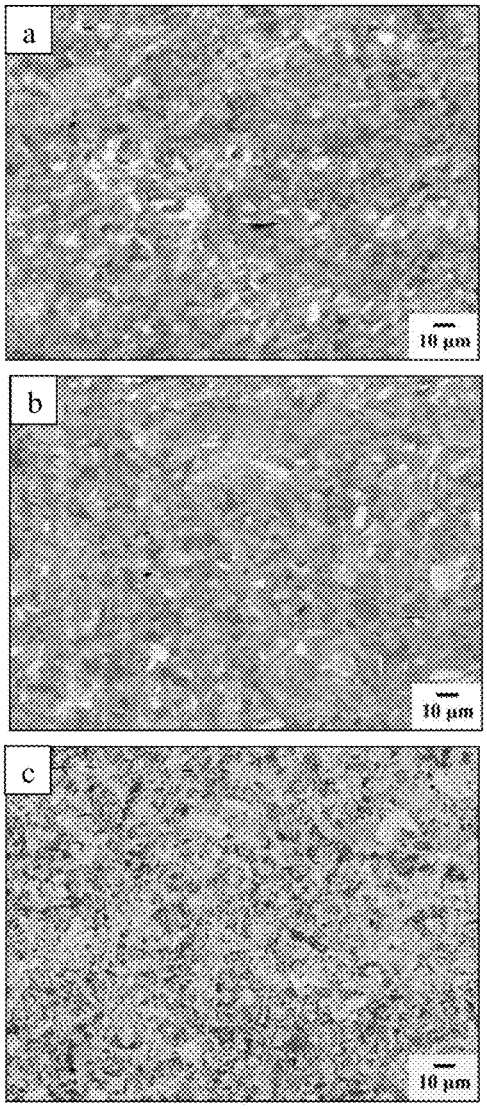
FIG.70 Backscattered SEM images of microstructure in (a) Alloy 141, (b) Alloy 142 and (c) Alloy 143 after cold rolling and heat treatment.

HIGH DUCTILITY STEEL ALLOYS WITH MIXED MICROCONSTITUENT STRUCTURE

CROSS-REFERENCE TO RELATED APPLICATIONS

This application claims the benefit of U.S. Provisional Patent Application Ser. No. 62/054,728, filed on September, 2014 and U.S. Provisional Patent Application Ser. No. 62/064,903, filed on Oct. 16, 2014, which are fully incorporated herein by reference.

FIELD OF INVENTION

This disclosure deals with steel alloys containing mixed microconstituent structure that has the ability to provide ductility at tensile strength levels at or above 900 MPa.

BACKGROUND

Steel has been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on how the steel is cooled, a wide variety of characteristic microstructures (i.e. pearlite, bainite, and martensite) can be obtained with a wide range of properties. This manipulation of the eutectoid transformation has resulted in the wide variety of steels available currently.

Currently, there are over 25,000 worldwide equivalents in 51 different ferrous alloy metal groups. For steel, which is produced in sheet form, broad classifications may be employed based on tensile strength characteristics. Low Strength Steels (LSS) may be defined as exhibiting tensile strengths less than 270 MPa and include such types as interstitial free and mild steels. High-Strength Steels (HSS) may be defined as exhibiting tensile strengths from 270 to 700 MPa and include such types as high strength low alloy, high strength interstitial free and bake hardenable steels. Advanced High-Strength Steels (AHSS) steels may be defined as exhibiting tensile strengths greater than 700 MPa and include such types as martensitic steels (MS), dual phase (DP) steels, transformation induced plasticity (TRIP) steels, and complex phase (CP) steels. As the strength level increases, the ductility of the steel generally decreases. For example, LSS, HSS and AHSS may indicate tensile elongations at levels of 25% to 55%, 10% to 45% and 4% to 30%, respectively.

Steel material production in the United States is currently about 100 million tons per year and worth about $75 billion. According to the American Iron and Steel Institute, 24% of the US steel production is utilized in the auto industry. Total steel in the average 2010 vehicle was about 60%. New advanced high-strength steels (AHSS) account for 17% of the vehicle and this is expected to grow up to 300% by the year 2020. [American Iron and Steel Institute. (2013). Profile 2013. Washington, D.C.]

Continuous casting, also called strand casting, is one of the most commonly used casting process for steel production. It is the process whereby molten metal is solidified into a "semifinished" billet, bloom, or slab for subsequent rolling in the finishing mills (FIG. 1). Prior to the introduction of continuous casting in the 1950s, steel was poured into stationary molds to form ingots. Since then, "continuous casting" has evolved to achieve improved yield, quality, productivity and cost efficiency. It allows for lower-cost production of metal sections with better quality, due to the inherently lower costs of continuous, standardized production of a product, as well as providing increased control over the process through automation. This process is used most frequently to cast steel (in terms of tonnage cast). Continuous casting of slabs with either in-line hot rolling or subsequent separate hot rolling are important post processing steps to produce coils of sheet. Slabs are typically cast from 150 to 500 mm thick and then allowed to cool to room temperature. Subsequent hot rolling of the slabs after preheating in tunnel furnaces is done in several stages through both roughing and hot rolling mills to get down to thickness's typically from 2 to 10 mm in thickness. Continuous casting with an as-cast thickness of 20 to 150 mm is called Thin Slab Casting (FIG. 2). It has in-line hot rolling in a number of steps in sequence to get down to thicknesses typically from 2 to 10 mm. There are many variations of this technique such as casting between of 100 to 300 mm in thickness to produce intermediate thickness slabs which are subsequently hot rolled. Additionally, other casting processes are known including single and double belt cast processes which produce as-cast thickness in the range of 5 to 100 mm in thickness and which are usually in-line hot rolled to reduce the gauge thickness to targeted levels for coil production. In the automotive industry, the forming of parts from sheet materials coming from coils is accomplished through many processes including bending, hot and cold press forming, drawing, or further shape rolling.

SUMMARY

The present disclosure is directed at a method for forming a mixed microconstituent steel alloy that begins with the method comprising: (a) supplying a metal alloy comprising Fe at a level of 61.0 to 81.0 atomic percent, Si at a level of 0.6 to 9.0 atomic percent, Mn at a level of 1.0 to 17.0 atomic percent; and B optionally up to 6.0 at. %; (b) melting the alloy and cooling and solidifying and forming an alloy that has a matrix grain size of 5.0 μm to 1000 μm and boride grains, if present, at a size of 1.0 μm to 50.0 μm; and (c) exposing the alloy formed in step (b) to heat and stress and forming an alloy that has matrix grains at a size of 1.0 μm to 100 μm, boride grains, if present, at a size of 0.2 μm to 10.0 μm and precipitation grains at a size of 1.0 nm to 200 nm.

The heat and stress in step (c) may comprise heating from 700° C. up to the solidus temperature of the alloy and wherein said alloy has a yield strength and said stress exceeds said yield strength. The stress may be in the range of 5 MPa to 1000 MPa. The alloy formed in step (c) may have a yield strength of 140 MPa to 815 MPa.

The alloy in step (c) may then be exposed to a mechanical stress to provide an alloy having a tensile strength of greater than or equal to 900 MPa and an elongation greater than 2.5%. More specifically, the alloy may have a tensile strength of 900 MPa to 1820 MPa and an elongation from 2.5% to 76.0%.

The alloy in step (c) may then be exposed to a mechanical stress to provide an alloy having matrix grain size of 100 nm to 50.0 μm and boride grain size of 0.2 μm to 10 μm. The alloy may also be characterized as having precipitation grains at a size of 1 nm to 200 nm. The alloy formed in step (c) may be further characterized as having mixed microconstituent structure comprising one group of matrix grains at a size of 0.5 μm to 50.0 μm and another group of matrix grains at a size of 100 nm to 2000 nm. The microconstituent group with matrix grain sizes from 0.5 μm to 50.0 μm contains primarily austenite matrix grains which may include a fraction of ferrite grains. The amount of austenite grains in this microconstituent group is from 50 to 100% by volume. The microconstituent group with 100 nm to 2000 nm matrix grains will contain primarily ferrite matrix grains which may include a fraction of austenite grains. The amount of ferrite grains in this microconstituent group is from 50 to 100% by volume. Note that the above amounts or ratios are only comparing ratios of matrix grains not including the boride, if present, or precipitate grains.

The alloy so formed in step (c) and exposed to mechanical stress may then be exposed to a temperature to recrystallize said alloy where said recrystallized alloy has matrix grains at a size of 1.0 μm to 50.0 μm. The recrystallized alloy will then indicate a yield strength and may be exposed to mechanical stress that exceeds said yield strength to provide an alloy having a tensile strength of at or greater than or equal to 900 MPa and an elongation of at or greater than 2.5%.

In related embodiment, the present disclosure is directed at an alloy comprising Fe at a level of 61.0 to 81.0 atomic percent, Si at a level of 0.6 to 9.0 atomic percent, Mn at a level of 1.0 to 17.0 atomic percent and B optionally up to 6.0 at. % characterized that the alloy contains mixed microconstituent structure comprising a first group of matrix grains of 0.5 μm to 50.0 μm, boride grains, if present, of 0.2 μm to 10.0 μm, and precipitation grains of 1.0 nm to 200 nm and a second group of matrix grains of 100 nm to 2000 nm, boride grains, if present, of 0.2 μm to 10.0 μm and precipitation grains of 1 nm to 200 nm. The alloy has a tensile strength of greater than or equal to 900 MPa and an elongation of greater than or equal to 2.5%. More specifically, the alloy has a tensile strength of 900 MPa to 1820 MPa and an elongation of 2.5% to 76.0%.

Accordingly, the alloys of present disclosure have application to continuous casting processes including belt casting, thin strip/twin roll casting, thin slab casting, thick slab casting, semi-solid metal casting, centrifugal casting, and mold/die casting. The alloys can be produced in the form of both flat and long products including sheet, plate, rod, rail, pipe, tube, wire and find particular application in a wide range of industries including but not limited to automotive, oil and gas, air transportation, aerospace, construction, mining, marine transportation, power, railroads.

BRIEF DESCRIPTION OF THE DRAWINGS

The detailed description below may be better understood with reference to the accompanying FIGS. which are provided for illustrative purposes and are not to be considered as limiting any aspect of this invention.

FIG. 1 illustrates a continuous slab casting process flow diagram.

FIG. 2 illustrates a thin slab casting process flow diagram showing steel sheet production steps. Note that the process can be broken up into 3 process stages as shown.

FIG. 3 illustrates a schematic representation of (a) Modal Nanophase Structure (Structure 3*a* in FIG. 4); (b) High Strength Nanomodal Structure (Structure 3*b* in FIG. 4); and (c) new Mixed Microconstituent Structure. Black dots represent boride phase. Nanoscale precipitates are not shown.

FIG. 4 Structures and mechanisms in new High Ductility Steel alloys. Note that the boride grains are optional. They will form when boron is added to the alloy but will not form when boron is not present (i.e. when it is not added/optional).

FIG. 5 illustrates representative stress-strain curves demonstrating mechanical response of the alloys depending on their structure.

FIG. 6 illustrates a view of the as-cast laboratory slab from Alloy 61.

FIG. 7 illustrates a view of the laboratory slab from Alloy 59 after hot rolling.

FIG. 8 illustrates a view of the laboratory slab from Alloy 59 after hot and cold rolling.

FIG. 9 illustrates a comparison of stress-strain curves of new non-stainless steel sheet types with existing Dual Phase (DP) steels.

FIG. 10 illustrates a comparison of stress-strain curves of new non-stainless steel sheet types with existing Complex Phase (CP) steels.

FIG. 11 illustrates a comparison of stress-strain curves of new non-stainless steel sheet types with existing Transformation Induced Plasticity (TRIP) steels.

FIG. 12 illustrates a comparison of stress-strain curves of new non-stainless steel sheet types with existing Martensitic (MS) steels.

FIG. 13 illustrates a stress-strain curve corresponding to the TEM sample from the gage section after deformation in the as-cast condition.

FIG. 14 illustrates backscattered SEM micrographs of microstructure in as-cast 50 mm thick Alloy 8 slab: a) at the edge; b) in the center of cross-section.

FIG. 15 illustrates bright-field TEM micrograph and selected electron diffraction pattern of microstructure in the 50 mm thick as-cast Alloy 8 slab.

FIG. 16 illustrates bright-field TEM micrographs of microstructure in the 50 mm thick as-cast Alloy 8 slab showing staking faults in the matrix grains.

FIG. 17 illustrates a stress-strain curve corresponding to the TEM sample from the gage section after deformation of Alloy 8 in hot rolled condition.

FIG. 18 illustrates backscattered SEM micrograph of microstructure in the Alloy 8 slab after hot rolling at 1075° C. with 97% reduction.

FIG. 19 illustrates x-ray diffraction data (intensity vs two-theta) for Alloy 8 slab after hot rolling at 1075° C. with 97% reduction; a) Measured pattern, b) Rietveld calculated pattern with peaks identified.

FIG. 20 illustrates x-ray diffraction data (intensity vs two-theta) for Alloy 8 slab after hot rolling at 1075° C. with 97% reduction and tensile testing; a) Measured pattern, b) Rietveld calculated pattern with peaks identified.

FIG. 21 illustrates bright-field TEM micrograph at low magnification and selected area electron diffraction pattern for Alloy 8 slab after hot rolling.

FIG. 22 illustrates bright-field TEM micrographs of microstructure in Alloy 8 slab after hot rolling and tensile deformation showing matrix grains of Modal Nanophase Structure.

FIG. 23 illustrates bright-field (a) and dark-field (b) TEM micrographs of microstructure in Alloy 8 slab after hot rolling and tensile deformation showing a "pocket" with High Strength Nanomodal Structure.

FIG. 24 illustrates stress-strain curves corresponding to the TEM samples from the gage section after deformation in hot rolled Alloy 8 after two different heat treatments.

FIG. 25 illustrates SEM backscattered electron micrograph of microstructure in Alloy 8 slab after hot rolling and following heat treatment at 950° C. for 6 hr.

FIG. 26 illustrates SEM backscattered electron micrograph of microstructure in Alloy 8 after hot rolling and following heat treatment at 1075° C. for 2 hr.

FIG. 27 illustrates x-ray diffraction data (intensity vs two-theta) for Alloy 8 slab after hot rolling and heat treatment at 950° C. for 6 hours; a) Measured pattern, b) Rietveld calculated pattern with peaks identified.

FIG. 28 illustrates x-ray diffraction data (intensity vs two-theta) for Alloy 8 slab after hot rolling, heat treatment at 950° C. for 6 hours and tensile testing; a) Measured pattern, b) Rietveld calculated pattern with peaks identified.

FIG. 29 illustrates bright-field TEM micrograph at low magnification and selected area electron diffraction pattern for Alloy 8 slab after hot rolling and heat treatment at 950° C. for 6 hr showing matrix grains of Recrystallized Modal Structure.

FIG. 30 illustrates bright-field TEM micrograph at low magnification and selected area electron diffraction pattern for Alloy 8 slab after hot rolling and heat treatment at 1075° C. for 2 hr showing matrix grains of Recrystallized Modal Structure.

FIG. 31 illustrates bright-field TEM micrographs of microstructure in Alloy 8 slab after hot rolling, heat treatment at 950° C. for 6 hr and tensile testing to fracture showing matrix grains of Modal Nanophase Structure.

FIG. 32 illustrates bright-field and dark-field TEM micrographs of microstructure in Alloy 8 slab after hot rolling, heat treatment at 950° C. for 6 hr and tensile testing to fracture showing a "pocket" with High Strength Nanomodal Structure.

FIG. 33 illustrates bright-field TEM micrographs of microstructure in Alloy 8 slab after hot rolling, heat treatment at 950° C. for 6 hr and tensile testing demonstrating Mixed Microconstituent Structure at lower magnification.

FIG. 34 illustrates bright-field and dark-field TEM micrographs of microstructure in Alloy 8 slab after hot rolling, heat treatment at 1075° C. 2 hr and tensile deformation to fracture.

FIG. 35 illustrates Stress-strain curves corresponding to the TEM samples from the gage sections after deformation in cold rolled condition with and without heat treatment.

FIG. 36 illustrates SEM backscattered electron micrograph of microstructure in hot rolled Alloy 8 slab after cold rolling.

FIG. 37 illustrates SEM backscattered electron micrograph of microstructure in hot rolled Alloy 8 slab after cold rolling and heat treatment at 950° C. for 6 hr.

FIG. 38 illustrates x-ray diffraction data (intensity vs two-theta) for hot rolled Alloy 8 slab after cold rolling; a) Measured pattern, b) Rietveld calculated pattern with peaks identified.

FIG. 39 illustrates x-ray diffraction data (intensity vs two-theta) for hot rolled Alloy 8 slab after cold rolling and tensile testing; a) Measured pattern, b) Rietveld calculated pattern with peaks identified.

FIG. 40 illustrates x-ray diffraction data (intensity vs two-theta) for hot rolled Alloy 8 slab after cold rolling and heat treatment at 950° C. for 6 hours; a) Measured pattern, b) Rietveld calculated pattern with peaks identified.

FIG. 41 illustrates x-ray diffraction data (intensity vs two-theta) for hot rolled Alloy 8 slab after cold rolling, heat treatment at 950° C. for 6 hours and tensile testing; a) Measured pattern, b) Rietveld calculated pattern with peaks identified.

FIG. 42 illustrates bright-field TEM micrographs of microstructure in hot rolled Alloy 8 slab after cold rolling showing Mixed Microconstituent Structure.

FIG. 43 illustrates bright-field TEM micrographs of microstructure in hot rolled Alloy 8 slab after cold rolling and tensile deformation to fracture showing matrix grains of Modal Nanophase Structure.

FIG. 44 illustrates bright-field and dark-field TEM micrographs of microstructure in hot rolled Alloy 8 slab after cold rolling and tensile deformation to fracture showing a "pocket" with High Strength Nanomodal Structure.

FIG. 45 illustrates bright-field and dark-field TEM micrographs of microstructure in hot rolled Alloy 8 slab after cold rolling and tensile deformation to fracture demonstrating Mixed Microconstituent Structure at lower magnification.

FIG. 46 illustrates bight-field TEM micrograph at low magnification and selected area electron diffraction pattern for hot rolled Alloy 8 slab after cold rolling and heat treatments at 950° C. for 6 hr showing matrix grains of Recrystallized Modal Structure.

FIG. 47 illustrates bright-field and dark-field TEM micrographs of microstructure in hot rolled Alloy 8 slab after cold rolling, heat treatments at 950° C. for 6 hr and tensile deformation to fracture showing Mixed Microconstituent Structure.

FIG. 48 illustrates bright-field TEM micrograph and selected area electron diffraction pattern for hot rolled Alloy 8 slab after cold rolling, heat treatments at 950° C. for 6 hr and tensile deformation to fracture from the area with High Strength Nanomodal Structure.

FIG. 49 illustrates bright-field TEM micrograph and selected area electron diffraction pattern for hot rolled Alloy 8 slab after cold rolling, heat treatments at 950° C. for 6 hr and tensile deformation to fracture from the area with Modal Nanophase Structure.

FIG. 50 illustrates property recovery in Alloy 44 through cycles of cold rolling and annealing: (a) and (b)—cycle 1, (c) and (d)—cycle 2, (e) and (f)—cycle 3.

FIG. 51 illustrates stress-strain curves after hot rolling and cold rolling with different reduction; (a) Alloy 43 and (b) Alloy 44.

FIG. 52 illustrates stress-strain curves for (a) Alloy 8 and (b) Alloy 44 at incremental testing with 4% deformation at each step.

FIG. 53 illustrates yield stress in Alloy 44 as a function of test strain rate.

FIG. 54 illustrates ultimate tensile strength in Alloy 44 as a function of test strain rate.

FIG. 55 illustrates strain hardening exponent in Alloy 44 as a function of test strain rate.

FIG. 56 illustrates tensile elongation in Alloy 44 as a function of test strain rate.

FIG. 57 illustrates schematic representation of cast slab cross section showing the shrinkage funnel and the locations from which samples for chemical analysis were taken.

FIG. 58 illustrates element content in wt % from areas A and B for selected High Ductility Steel alloys.

FIG. 59 illustrates backscattered SEM images of microstructure in as-cast Alloy 8 slab at different magnifications; Central area of cast slab(a, b); Area close to the slab surface (c, d).

FIG. 60 illustrates backscattered SEM images of microstructure in hot rolled Alloy 8 slab at different magnifications; Central area of cast slab(a, b); Area close to the slab surface (c, d).

FIG. 61 illustrates backscattered SEM images of hot rolled Alloy 8 slab after heat treatment at 850° C. for 6 hr at different magnifications; Central area of cast slab(a, b); Area close to the slab surface (c, d).

FIG. 62 illustrates backscattered SEM images of microstructure in as-cast Alloy 20 slab at different magnifications; Central area of cast slab(a, b); Area close to the slab surface (c, d).

FIG. 63 illustrates backscattered SEM images of hot rolled Alloy 20 slab at different magnifications; Central area of cast slab(a, b); Area close to the slab surface (c, d).

FIG. 64 illustrates backscattered SEM images of hot rolled Alloy 20 slab after heat treatment at 1075° C. for 6 hr at different magnifications; Central area of cast slab(a, b); Area close to the slab surface (c, d).

FIG. 65 illustrates tensile properties of Alloy 44 slab at different steps of post processing.

FIG. 66 illustrates representative tensile curves Alloy 44 slab at different steps of post processing.

FIG. 67 illustrates Strain Hardening Exponent value as a function of strain in Alloy 44.

FIG. 68 illustrates backscattered SEM images of microstructure in (a) Alloy 141, (b) Alloy 142 and (c) Alloy 143 after hot rolling.

FIG. 69 illustrates backscattered SEM images of microstructure in (a) Alloy 141, (b) Alloy 142 and (c) Alloy 143 after cold rolling.

FIG. 70 illustrates backscattered SEM images of microstructure in (a) Alloy 141, (b) Alloy 142 and (c) Alloy 143 after cold rolling and heat treatment.

DETAILED DESCRIPTION

The steel alloys herein have an ability for formation of a mixed microconstituent structure. The alloys therefore indicate relatively high ductility (e.g. elongations of greater than or equal to about 2.5%) at tensile strength levels at or above 900 MPa. Mixed microconstituent structure herein is characterized by a combination of structural features as described below and is represented by relatively coarse matrix grains with randomly distributed "pockets" of relatively more refined grain structure. The observed property combinations depend on the volume fraction of each structural microconstituent which is influenced by alloy chemistry and thermo-mechanical processing applied to the material.

Mixed Microconstituent Structure

The relatively high ductility steel alloys herein are such that they are capable of formation what is identified herein as a Mixed Microconstituent Structure. A schematic representation of such mixed structures is shown in FIG. 3. In FIG. 3, the complex boride pinning phases are shown by the black dots (the nanoscale precipitation phases are not included). The matrix grains are represented by the hexagonal structures. The Modal NanoPhase Structure consists of unrefined matrix grains while the High Strength NanoModal Structure exhibits relatively more refined matrix grains. The Mixed Microconstituent Structure as illustrated in FIG. 3 exhibits regions/pockets of microconstituent structures of both Modal Nanophase Structure and High Strength Nanomodal Structure.

Mixed Microconstituent Structure formation including associated structures and mechanisms of formation are next shown in FIG. 4. As shown therein, Modal Structure (Structure #1, FIG. 4) is initially formed starting with a liquid melt of the alloy and solidifying by cooling, which provides nucleation and growth of particular phases having particular grain sizes. Grain size herein may be understood as the size of a single crystal of a specific particular phase preferably identifiable by methods such as scanning electron microscopy or transmission electron microscopy. The Modal Structure in the alloys herein contain mainly austenite matrix grains and intergranular regions consisting of austenite and complex boride phases, if present. Depending on the alloy chemistry the ferrite phase may also be present in the matrix. It is common that stacking faults are found in the austenite matrix grains of Modal Structure. The size of austenite matrix grains is typically in the range of 5 μm to 1000 μm and the size of boride phase (i.e. non-metallic grains such as $M_2B$ where M is the metal and is covalently bonded to B, if present) is from 1 μm to 50 μm. The variations in starting phase sizes will be dependent on the alloy chemistry and also the cooling rate which is highly dependent on the starting/solidifying thickness. For example, an alloy that is cast at 200 mm thick may have a starting grain size that is an order of magnitude higher than an alloy cast at 50 mm thick. Generally the mechanisms of refinement work achieving the targeted structures is independent of starting grain size.

The boride phase, if present, may also preferably be a "pinning" type, which is reference to the feature that the matrix grains will effectively be stabilized by the pinning phases with resistance to coarsening at elevated temperature. Note that the metal boride grains have been identified as exhibiting the $M_2B$ stoichiometry but other stoichiometry's are possible and may provide effective pinning including $M_3B$, MB ($M_1B_1$), $M_{23}B_6$, and $M_7B_3$. Accordingly, Structure #1 of the High Ductility Steel alloys herein may be achieved by processing through either laboratory scale procedures and/or through industrial scale methods that include but not limited to thin strip casting, thin slab casting, thick slab casting, centrifugal casting, mold or die casting.

Deformation at elevated temperature (i.e. application of temperature and stress) of the High Ductility Steel alloys herein with initial Modal Structure leads to refinement and homogenization of the Modal Structure through Dynamic Nanophase Refinement (Mechanism #1, FIG. 4) leading to formation of Homogenized Nanomodal Structure (Structure #2, FIG. 4). Typical temperatures for Dynamic NanoPhase Refinement would be 700° C. up to the solidus temperature of the alloy. Typical stresses are those that would exceed the elevated temperature yield strength of the alloy which would be in the range of 5 MPa to 1000 MPa. At an industrial scale these mechanisms can occur through a number of processes that include but not limited to hot rolling, hot pressing, hot forging, hot extrusion etc. The resultant Homogenized Nanomodal Structure is represented by equiaxed matrix grains with $M_2B$ boride phases, if present, distributed in the matrix. Depending on the deformation parameters, the size of the matrix grains can vary, but generally is in the range of 1 μm to 100 μm, and that of boride phase, if present, is in the range from 0.2 μm to 10 μm. Additionally, as a result of the stresses, small nanoscale phases might be present in a form of nanoprecipitates with grain size from 1 to 200 nm. Volume fraction, (which may be 1 to 40%) of these phases depends on alloy chemistry, processing conditions, and material response to the processing conditions.

The formation of the Homogenized Nanomodal Structure can occur in one or in several steps and may occur partially or completely. In practice, this may occur for instance during the normal hot rolling of slabs after initial casting. The slabs may be placed in a tunnel furnace and reheated and then roughing mill rolled which may be include multiple stands or in a reversing mill and then subsequently rolled to an intermediate gauge and then the hot slab can be further processed with or without additional reheating, finished to a final hot rolled gauge thickness in a finishing mill which may or may not be in multiple stages/stands. During each step of the rolling process, the Dynamic NanoPhase Refinement will occur until the Homogenized Nanomodal Structure is fully formed and the targeted gauge reduction is achieved.

Mechanical properties of the High Ductility Steel alloys with Homogenized Nanomodal Structure depend on alloy chemistry and their phase composition (volume fraction of High Strength Nanomodal Structure vs Modal Nanophase Structure) and will vary with a yield strength from about 140 to 815 MPa. Note that after stress is applied which exceeds the yield strength then the Homogenized Nanomodal Structure begins to transform to the Mixed Microconstituent Structure (Structure #3, FIG. 4). Thus, the Homogenized Nanomodal Structure is a transitional structure.

The Homogenized Nanomodal Structure will transform into a Mixed Microconstituent Structure (Structure #3, FIG. 4) through a process called Dynamic Nanophase Strengthening (Mechanism #2, FIG. 4). Dynamic Nanophase Strengthening occurs when the yield strength of the material (i.e. about 140 to 815 MPa) is exceeded and it will continue until the tensile strength of the material is reached.

In FIG. 5, a schematic representation of the mechanical response of the new High Ductility Steel alloys is provided in comparison to different microconstituent regions present within the structure. As shown, the new High Ductility Steel alloys demonstrate relatively high ductility analogous to in combination with high strength and the combination of mixed microconstituent structures in relatively close contact results in improved synergistic combinations of properties.

Homogenized Nanomodal Structure (Structure #2, FIG. 4) during deformation undergoes transformation into a Mixed Microconstituent Structure (Structure #3, FIG. 4). The Mixed Microconstituent Structure will contain microconstituent regions which can be understood as 'pockets' of Structure 3*a* and Structure 3*b* material intimately mixed. Favorable combinations of mechanical properties can be varied by changing the volume fractions of each Structure (3*a* or 3*b*) from 95% Structure 3*a*/5% Structure 3*b* through the entire volumetric range of 5% Structure 3*a*/95% Structure 3*b*. The volume fractions may vary in 1% increments. Thus, one may have 5% Structure 3*a*, 95% Structure 3*b*, 6% Structure 3*a*, 94% Structure 3*b*, 7% Structure 3*a*, 93% Structure 3*b*, 8% Structure 3*a*, 92% Structure 3*b*, 9% Structure 3*a*, 92% Structure 3*b*, 10% Structure 3*a*, 90% Structure 3*b*, etc., until one has 95% Structure 3*a* and 5% Structure 3*b*. Accordingly, it may be understood that the mixed microconstituent structure will have one group of matrix grains (Structure 3*a*) in the range of 0.5 μm to 50.0 μm in combination with another group of matrix grains of 100 nm to 2000 nm (Structure 3*b*).

During the deformation, Dynamic Nanophase Strengthening (Mechanism #2, FIG. 4) occurs locally in microstructural "pockets" of High Strength Nanomodal Structure areas (Structure 3*b*, FIG. 4) which are distributed in the Modal Nanophase Structure (Structure #3*a*, FIG. 4). The size of the microconstituent 'pockets' typically varies from 1 μm to 20 μm. The austenite matrix phase (gamma-Fe) in randomly distributed "pockets" of Structure 3*b* material transforms to ferrite phase (alpha-Fe) with additional precipitation of a dihexagonal pyramidal class hexagonal phase with a $P6_3mc$ space group (#186) and/or a ditrigonal dipyramidal class hexagonal phase with P6bar2C space group (#190). The phase transformation causes matrix grain refinement to a range of 100 nm to 2,000 nm in these "pockets" of High Strength Nanomodal Structure (Structure #3*b*, FIG. 4). The un-transformed matrix phase of the Modal Nanophase Structure (Structure #3*a*, FIG. 4) remains at micron-scale with grain size from 0.5 to 50 μm and may contain nanoprecipitates formed through Dynamic Phase Precipitation typical for Structure 3*a* alloys (Mechanism #1 FIG. 3). Boride phase, if present, is in the range of 0.2 μm to 10 μm and the size of NanoPhase precipitates is in the range of 1 nm to 200 nm in both structural microconstituents. Mechanical properties of new High Ductility Steel alloys with Mixed Microconstituent Structure (Structure #3, FIG. 4) depend on alloy chemistry and their phase composition (volume fraction of High Strength Nanomodal Structure vs Modal Nanophase Structure) and vary in a wide range of tensile properties including yield strength from 245 MPa to 1804 MPa, tensile strength from about 900 MPa to 1820 MPa and total elongation from about 2.5% to 76.0%.

After plastically deforming, Dynamic Nanophase Strengthening (Mechanism #2, FIG. 4) results in the formation of the Mixed Microconstituent Structure (Structure #3, FIG. 4). As stated previously, relatively high ductility will be observed. In the cases where further deformation is required such as for example, additional cold rolling gauge reduction to finer gauges, then the Mixed Microconstituent Structure (Structure #3, FIG. 4) can be recrystallized. This process of plastic deformation, such as cold rolling gauge reduction followed by annealing to recrystallize, followed by more plastic deformation can be repeated in a cyclic manner for as many times as necessary (generally up to 10) in order to hit final gauge, size, or shape targets for the myriad uses of steels possible as described herein. This temperature range of recrystallization will vary depending on a number of factors including the amount of cold work that has been previously applied and the alloy chemistry but will generally occur in the temperature range from 700° C. up to the solidus temperature of the alloy. The resulting structure that forms from recrystallization is the Recrystallized Modal Structure (Structure #2*a*, FIG. 4).

When fully recrystallized, the Structure #2*a* contains few dislocations or twins, but stacking faults can be found in some recrystallized grains. Depending on the alloy chemistry and heat treatment, the equiaxed recrystallized austenite matrix grains can range from 1 μm to 50 μm in size while $M_2B$ boride phase is in the range of 0.2 μm to 10 μm with precipitate phases in the range from 1 nm to 200 nm. Mechanical properties of Recrystallized Modal Structure (Structure #2*a*, FIG. 4) depend on alloy chemistry and their phase composition (volume fraction of High Strength Nanomodal Structure vs Modal Nanophase Structure) and will vary with a yield Strength from about 140 MPa to 815 MPa. Note that after stress is applied which exceeds the yield strength, then the Homogenized Nanomodal Structure starts to transform to the Mixed Microconstituent Structure (Structure #3, FIG. 4) through the identified Dynamic Nanophase Strengthening (Mechanism #2, FIG. 4). Thus, the Recrystallized Modal Structure is a transitional structure. The cyclic nature of these phase transformations with full property recovery is a unique and new phenomenon that is a specific feature of new High Ductility Steel alloys. Table 3 below provides a comparison of the structure and performance features of High Ductility Steel alloys herein.

TABLE 3

Structures and Performance of New High Ductility Steel Alloys

| Property/ Mechanism | Structure Type #1 Modal Structure | Structure Type #2 Homogenized Nanomodal Structure | Structure Type #3 Mixed Microconstituent Structure | Structure Type #2a Recrystallized Modal Structure |
|---|---|---|---|---|
| Structure Formation | Starting with a liquid melt, solidifying this liquid melt and forming directly | Homogenization through Dynamic Nanophase Refinement occurring during deformation at elevated temperatures | Dynamic Nanophase Strengthening mechanism occurring through application of mechanical stress in distributed microstructural "pockets" | Recrystallization occurring at elevated temperatures exposure of cold worked material with Mixed Microconstituent Structure |
| Transformations | Liquid solidification followed by nucleation and growth | Boride phase breakup and homogenization, matrix grain refinement, nanoprecipitation | Stress induced austenite transformation involving new phase formation and precipitation | Recrystallization of cold deformed iron matrix |
| Enabling Phases | Austenite and/ or ferrite with optional boride pinning phases | Austenite, optionally ferrite, optional boride pinning phases, optionally hexagonal phase precipitates | Ferrite, austenite, optional boride pinning phases, hexagonal phase precipitates | Austenite, optionally ferrite, optional boride pinning phases, hexagonal phase precipitates |
| Matrix Grain Size | 5 μm to 1000 μm | 1 μm to 100 μm | 100 nm to 50 μm | 1 μm to 50 μm |
| Boride Size (if present) | 1 μm to 50 μm | 0.2 μm to 10 μm | 0.2 μm to 10 μm | 0.2 μm to 10 μm |
| Precipitation Size | — | 1 nm to 200 nm | 1 nm to 200 nm | 1 nm to 200 nm |
| Tensile Response | Actual with properties achieved based on Structure #1 | Intermediate structures; transforms into Structure #3 when undergoing plastic deformation | Actual with properties achieved based on formation of the structure and fraction of transformation. | Intermediate structures; transforms into Structure #3 when undergoing plastic deformation |
| Yield Strength | 190 to 445 MPa | 140 to 815 MPa | 245 to 1804 MPa | 140 to 815 MPa |
| Tensile Strength | 440 to 882 MPa | — | 900 to 1820 MPa | — |
| Total Elongation | 1.4 to 20.2% | — | 2.5 to 76.0% | — |

Structures and Mechanisms Through Sheet Production Routes

The ability of the new High Ductility Steel alloys herein to form Homogenized/Recrystallized Modal Structure (Structure #2/2*a*, FIG. 4) that undergoes Dynamic Nanophase Strengthening (Mechanism #2, FIG. 4) during deformation leading to Mixed Microconstituent Structure (Structure #3, FIG. 4) formation and advanced property combinations enables sheet production by different methods of continuous casting including but not limited to belt casting, thin strip/twin roll casting, thin slab casting, and thick slab casting with achievement of advanced property combination by subsequent post-processing. Note that the process of forming the liquid melt of the alloys in Table 4 is similar in each commercial production process listed above. One common route is to start with scrap which can then be melted in an electric arc furnace (EAF), followed by argon oxygen decarburization (AOD) treatment, and the final alloying through a ladle metallurgy furnace (LMF). Another route is to start with iron ore pellets and process the alloy chemistry through a traditional integrated mill using a basic oxygen furnace (BOF). While different intermediate steps are done, the final stages of the production of coils through each commercial steel production process can be similar, in spite of the large variation in the as-cast thickness. Typically, the last step of hot rolling results in the production of hot rolled coils with thickness from 1.5 to 10 mm which is dependent on the specific process flow and goals of each steel producer. For the specific chemistries of the alloys in this application and the specific structural formation and enabling mechanisms as outlined in FIG. 4, the resulting structure of these as-hot rolled coils would be the Homogenized Nanomodal or Recrystallized Modal Structure (Structure #2/2*a*, FIG. 4). If thinner gauges are then needed, cold rolling of the hot rolled coils is typically done to provide final gauge thickness which may be in the range of 0.2 to 3.5 mm in thickness). During these cold rolling gauge reduction steps, the new structures and mechanisms as outlined in FIG. 4 would be operational (i.e. Structure #2 transforms into Structure #3 through Mechanism #2 during cold rolling, recrystallized into Structure #2*a* during subsequent annealing which transforms back to Structure #3 through Mechanism #2 at further cold rolling, and so on). As explained previously and shown in the case examples, the process of Mixed Microconstituent Structure (Structure #3, FIG. 4) formation, recrystallization into the Recrystallized Modal Structure (Structure #2*a*, FIG. 4), and refinement and strengthening through Dynamic Nanophase Strengthening (Mechanism #2, FIG. 4) back into the Mixed Microconstituent Structure (Structure #3, FIG. 4) can be applied in a cyclic manner as often as necessary in order to hit end user gauge thickness requirements. Final targeted properties can be additionally modified by final heat treatment with controlled parameters.

Main Body

The chemical composition of the alloys herein is shown in Table 4 which provides the preferred atomic ratios utilized. These chemistries have been used for material processing through slab casting in an Indutherm VTC800V vacuum tilt casting machine. Alloys of designated compositions were weighed out in 3 kilogram charges using designated quantities of commercially-available ferroadditive powders of known composition and impurity content, and additional alloying elements as needed, according to the atomic ratios provided in Table 4 for each alloy. Weighed out alloy charges were placed in zirconia coated silica-based crucibles and loaded into the casting machine. Melting took place under vacuum using a 14 kHz RF induction coil. Charges were heated until fully molten, with a period of time between 45 seconds and 60 seconds after the last point at which solid constituents were observed, in order to provide superheat and ensure melt homogeneity. Melts were then poured into a water-cooled copper die to form laboratory cast slabs of approximately 50 mm thick that is in the thickness range for Thin Slab Casting process (FIG. 2) and 75 mm×100 mm in size. An example of laboratory cast slab from Alloy 61 is shown in FIG. 6.

TABLE 4

| Chemical Composition of the Alloys (at. %) | | | | | | | | |
|---|---|---|---|---|---|---|---|---|
| Alloy | Fe | Cr | Ni | Mn | B | Si | Cu | C |
| Alloy 1 | 75.49 | 2.13 | 2.38 | 11.84 | 1.94 | 3.63 | 1.55 | 1.04 |
| Alloy 2 | 73.99 | 2.13 | 2.38 | 11.84 | 1.94 | 5.13 | 1.55 | 1.04 |
| Alloy 3 | 76.39 | 2.13 | 2.38 | 12.44 | 1.94 | 2.13 | 1.55 | 1.04 |
| Alloy 4 | 74.89 | 2.13 | 2.38 | 12.44 | 1.94 | 3.63 | 1.55 | 1.04 |
| Alloy 5 | 73.39 | 2.13 | 2.38 | 12.44 | 1.94 | 5.13 | 1.55 | 1.04 |
| Alloy 6 | 77.39 | 2.13 | 2.38 | 11.84 | 1.54 | 2.13 | 1.55 | 1.04 |
| Alloy 7 | 75.89 | 2.13 | 2.38 | 11.84 | 1.54 | 3.63 | 1.55 | 1.04 |
| Alloy 8 | 74.39 | 2.13 | 2.38 | 11.84 | 1.54 | 5.13 | 1.55 | 1.04 |
| Alloy 9 | 76.79 | 2.13 | 2.38 | 12.44 | 1.54 | 2.13 | 1.55 | 1.04 |
| Alloy 10 | 75.29 | 2.13 | 2.38 | 12.44 | 1.54 | 3.63 | 1.55 | 1.04 |
| Alloy 11 | 73.79 | 2.13 | 2.38 | 12.44 | 1.54 | 5.13 | 1.55 | 1.04 |
| Alloy 12 | 76.49 | 2.13 | 2.38 | 11.84 | 2.44 | 2.13 | 1.55 | 1.04 |
| Alloy 13 | 74.99 | 2.13 | 2.38 | 11.84 | 2.44 | 3.63 | 1.55 | 1.04 |
| Alloy 14 | 73.49 | 2.13 | 2.38 | 11.84 | 2.44 | 5.13 | 1.55 | 1.04 |
| Alloy 15 | 75.89 | 2.13 | 2.38 | 12.44 | 2.44 | 2.13 | 1.55 | 1.04 |
| Alloy 16 | 74.39 | 2.13 | 2.38 | 12.44 | 2.44 | 3.63 | 1.55 | 1.04 |
| Alloy 17 | 72.89 | 2.13 | 2.38 | 12.44 | 2.44 | 5.13 | 1.55 | 1.04 |
| Alloy 18 | 76.40 | 2.13 | 1.19 | 13.62 | 1.94 | 2.13 | 1.55 | 1.04 |
| Alloy 19 | 74.90 | 2.13 | 1.19 | 13.62 | 1.94 | 3.63 | 1.55 | 1.04 |
| Alloy 20 | 73.40 | 2.13 | 1.19 | 13.62 | 1.94 | 5.13 | 1.55 | 1.04 |
| Alloy 21 | 76.80 | 2.13 | 1.19 | 13.62 | 1.54 | 2.13 | 1.55 | 1.04 |
| Alloy 22 | 75.30 | 2.13 | 1.19 | 13.62 | 1.54 | 3.63 | 1.55 | 1.04 |
| Alloy 23 | 73.80 | 2.13 | 1.19 | 13.62 | 1.54 | 5.13 | 1.55 | 1.04 |
| Alloy 24 | 76.99 | 2.13 | 1.19 | 13.03 | 1.94 | 2.13 | 1.55 | 1.04 |
| Alloy 25 | 75.49 | 2.13 | 1.19 | 13.03 | 1.94 | 3.63 | 1.55 | 1.04 |
| Alloy 26 | 73.99 | 2.13 | 1.19 | 13.03 | 1.94 | 5.13 | 1.55 | 1.04 |
| Alloy 27 | 77.39 | 2.13 | 1.19 | 13.03 | 1.54 | 2.13 | 1.55 | 1.04 |
| Alloy 28 | 75.89 | 2.13 | 1.19 | 13.03 | 1.54 | 3.63 | 1.55 | 1.04 |
| Alloy 29 | 74.39 | 2.13 | 1.19 | 13.03 | 1.54 | 5.13 | 1.55 | 1.04 |
| Alloy 30 | 74.89 | 2.13 | 1.19 | 13.03 | 1.54 | 5.13 | 1.55 | 0.54 |
| Alloy 31 | 73.89 | 2.13 | 1.19 | 13.03 | 1.54 | 5.13 | 1.55 | 1.54 |
| Alloy 32 | 74.69 | 2.13 | 1.19 | 13.03 | 1.74 | 5.13 | 1.55 | 0.54 |

TABLE 4-continued

| Chemical Composition of the Alloys (at. %) | | | | | | | | |
|---|---|---|---|---|---|---|---|---|
| Alloy | Fe | Cr | Ni | Mn | B | Si | Cu | C |
| Alloy 33 | 74.19 | 2.13 | 1.19 | 13.03 | 1.74 | 5.13 | 1.55 | 1.04 |
| Alloy 34 | 73.69 | 2.13 | 1.19 | 13.03 | 1.74 | 5.13 | 1.55 | 1.54 |
| Alloy 35 | 75.44 | 2.13 | 1.19 | 13.03 | 1.74 | 4.38 | 1.55 | 0.54 |
| Alloy 36 | 74.94 | 2.13 | 1.19 | 13.03 | 1.74 | 4.38 | 1.55 | 1.04 |
| Alloy 37 | 74.44 | 2.13 | 1.19 | 13.03 | 1.74 | 4.38 | 1.55 | 1.54 |
| Alloy 38 | 73.94 | 2.13 | 1.19 | 13.03 | 1.74 | 5.88 | 1.55 | 0.54 |
| Alloy 39 | 73.44 | 2.13 | 1.19 | 13.03 | 1.74 | 5.88 | 1.55 | 1.04 |
| Alloy 40 | 72.94 | 2.13 | 1.19 | 13.03 | 1.74 | 5.88 | 1.55 | 1.54 |
| Alloy 41 | 74.09 | 2.13 | 1.19 | 13.33 | 1.54 | 5.13 | 1.55 | 1.04 |
| Alloy 42 | 75.09 | 1.13 | 1.19 | 13.33 | 1.54 | 5.13 | 1.55 | 1.04 |
| Alloy 43 | 73.09 | 3.13 | 1.19 | 13.33 | 1.54 | 5.13 | 1.55 | 1.04 |
| Alloy 44 | 73.99 | 2.63 | 1.19 | 13.18 | 1.54 | 5.13 | 1.55 | 0.79 |
| Alloy 45 | 75.54 | 2.63 | 1.19 | 13.18 | 1.54 | 5.13 | 0.00 | 0.79 |
| Alloy 46 | 74.37 | 2.63 | 1.19 | 14.35 | 1.54 | 5.13 | 0.00 | 0.79 |
| Alloy 47 | 74.76 | 2.63 | 1.97 | 13.18 | 1.54 | 5.13 | 0.00 | 0.79 |
| Alloy 48 | 74.29 | 2.63 | 1.19 | 14.08 | 1.54 | 5.13 | 0.35 | 0.79 |
| Alloy 49 | 74.59 | 2.63 | 1.79 | 13.18 | 1.54 | 5.13 | 0.35 | 0.79 |
| Alloy 50 | 75.18 | 2.63 | 0.00 | 13.18 | 1.54 | 5.13 | 1.55 | 0.79 |
| Alloy 51 | 74.29 | 2.63 | 0.00 | 14.07 | 1.54 | 5.13 | 1.55 | 0.79 |
| Alloy 52 | 73.40 | 2.63 | 0.00 | 14.96 | 1.54 | 5.13 | 1.55 | 0.79 |
| Alloy 53 | 72.50 | 2.63 | 0.00 | 15.86 | 1.54 | 5.13 | 1.55 | 0.79 |
| Alloy 54 | 74.58 | 2.63 | 0.60 | 13.18 | 1.54 | 5.13 | 1.55 | 0.79 |
| Alloy 55 | 74.14 | 2.63 | 0.60 | 13.62 | 1.54 | 5.13 | 1.55 | 0.79 |
| Alloy 56 | 73.69 | 2.63 | 0.60 | 14.07 | 1.54 | 5.13 | 1.55 | 0.79 |
| Alloy 57 | 73.24 | 2.63 | 0.60 | 14.52 | 1.54 | 5.13 | 1.55 | 0.79 |
| Alloy 58 | 75.40 | 0.63 | 0.00 | 14.96 | 1.54 | 5.13 | 1.55 | 0.79 |
| Alloy 59 | 71.40 | 4.63 | 0.00 | 14.96 | 1.54 | 5.13 | 1.55 | 0.79 |
| Alloy 60 | 76.00 | 0.63 | 0.60 | 14.96 | 1.54 | 5.13 | 0.35 | 0.79 |
| Alloy 61 | 74.00 | 2.63 | 0.60 | 14.96 | 1.54 | 5.13 | 0.35 | 0.79 |
| Alloy 62 | 72.00 | 4.63 | 0.60 | 14.96 | 1.54 | 5.13 | 0.35 | 0.79 |
| Alloy 63 | 76.96 | 0.63 | 0.00 | 13.40 | 1.54 | 5.13 | 1.55 | 0.79 |
| Alloy 64 | 74.96 | 2.63 | 0.00 | 13.40 | 1.54 | 5.13 | 1.55 | 0.79 |
| Alloy 65 | 72.96 | 4.63 | 0.00 | 13.40 | 1.54 | 5.13 | 1.55 | 0.79 |
| Alloy 66 | 77.26 | 0.63 | 0.60 | 12.50 | 1.54 | 5.13 | 1.55 | 0.79 |
| Alloy 67 | 75.26 | 2.63 | 0.60 | 12.50 | 1.54 | 5.13 | 1.55 | 0.79 |
| Alloy 68 | 73.26 | 4.63 | 0.60 | 12.50 | 1.54 | 5.13 | 1.55 | 0.79 |
| Alloy 69 | 76.46 | 0.63 | 0.00 | 13.90 | 1.54 | 5.13 | 1.55 | 0.79 |
| Alloy 70 | 74.46 | 2.63 | 0.00 | 13.90 | 1.54 | 5.13 | 1.55 | 0.79 |
| Alloy 71 | 72.46 | 4.63 | 0.00 | 13.90 | 1.54 | 5.13 | 1.55 | 0.79 |
| Alloy 72 | 77.23 | 0.63 | 0.00 | 13.90 | 1.54 | 5.13 | 0.78 | 0.79 |
| Alloy 73 | 75.23 | 2.63 | 0.00 | 13.90 | 1.54 | 5.13 | 0.78 | 0.79 |
| Alloy 74 | 73.23 | 4.63 | 0.00 | 13.90 | 1.54 | 5.13 | 0.78 | 0.79 |
| Alloy 75 | 76.63 | 0.63 | 0.60 | 13.90 | 1.54 | 5.13 | 0.78 | 0.79 |
| Alloy 76 | 74.63 | 2.63 | 0.60 | 13.90 | 1.54 | 5.13 | 0.78 | 0.79 |
| Alloy 77 | 72.63 | 4.63 | 0.60 | 13.90 | 1.54 | 5.13 | 0.78 | 0.79 |
| Alloy 78 | 72.45 | 3.63 | 0.78 | 14.90 | 1.54 | 5.13 | 0.78 | 0.79 |
| Alloy 79 | 72.95 | 3.63 | 0.78 | 14.40 | 1.54 | 5.13 | 0.78 | 0.79 |
| Alloy 80 | 73.45 | 3.63 | 0.78 | 13.90 | 1.54 | 5.13 | 0.78 | 0.79 |
| Alloy 81 | 73.95 | 3.63 | 0.78 | 13.40 | 1.54 | 5.13 | 0.78 | 0.79 |
| Alloy 82 | 74.45 | 3.63 | 0.78 | 12.90 | 1.54 | 5.13 | 0.78 | 0.79 |
| Alloy 83 | 74.95 | 3.63 | 0.78 | 12.40 | 1.54 | 5.13 | 0.78 | 0.79 |
| Alloy 84 | 71.45 | 3.63 | 0.78 | 14.90 | 2.54 | 5.13 | 0.78 | 0.79 |
| Alloy 85 | 71.95 | 3.63 | 0.78 | 14.40 | 2.54 | 5.13 | 0.78 | 0.79 |
| Alloy 86 | 72.45 | 3.63 | 0.78 | 13.90 | 2.54 | 5.13 | 0.78 | 0.79 |
| Alloy 87 | 72.95 | 3.63 | 0.78 | 13.40 | 2.54 | 5.13 | 0.78 | 0.79 |
| Alloy 88 | 73.45 | 3.63 | 0.78 | 12.90 | 2.54 | 5.13 | 0.78 | 0.79 |
| Alloy 89 | 73.95 | 3.63 | 0.78 | 12.40 | 2.54 | 5.13 | 0.78 | 0.79 |
| Alloy 90 | 73.32 | 2.13 | 0.60 | 15.40 | 1.54 | 5.13 | 1.09 | 0.79 |
| Alloy 91 | 73.82 | 2.13 | 0.60 | 14.90 | 1.54 | 5.13 | 1.09 | 0.79 |
| Alloy 92 | 74.32 | 2.13 | 0.60 | 14.40 | 1.54 | 5.13 | 1.09 | 0.79 |
| Alloy 93 | 73.32 | 2.13 | 0.60 | 15.40 | 1.94 | 4.73 | 1.09 | 0.79 |
| Alloy 94 | 73.82 | 2.13 | 0.60 | 14.90 | 1.94 | 4.73 | 1.09 | 0.79 |
| Alloy 95 | 74.32 | 2.13 | 0.60 | 14.40 | 1.94 | 4.73 | 1.09 | 0.79 |
| Alloy 96 | 72.07 | 2.73 | 0.30 | 14.20 | 1.04 | 5.13 | 1.09 | 3.44 |
| Alloy 97 | 68.19 | 4.55 | 1.69 | 14.22 | 0.77 | 8.84 | 1.09 | 0.65 |
| Alloy 98 | 69.47 | 4.21 | 2.63 | 9.76 | 0.69 | 7.86 | 2.76 | 2.62 |
| Alloy 99 | 67.67 | 6.22 | 1.15 | 11.52 | 0.65 | 8.55 | 1.09 | 3.15 |
| Alloy 100 | 77.65 | 0.67 | 0.08 | 13.09 | 0.97 | 2.73 | 1.09 | 3.72 |
| Alloy 101 | 78.72 | 1.56 | 3.22 | 7.64 | 1.25 | 2.73 | 3.22 | 1.66 |
| Alloy 102 | 72.18 | 2.26 | 1.35 | 15.80 | 0.77 | 6.65 | 0.76 | 0.23 |
| Alloy 103 | 75.88 | 1.06 | 1.09 | 13.77 | 5.23 | 0.65 | 0.36 | 1.96 |
| Alloy 104 | 73.40 | 3.88 | 2.11 | 12.85 | 4.96 | 0.96 | 1.69 | 0.15 |
| Alloy 105 | 78.38 | 0.07 | 3.44 | 11.69 | 3.14 | 1.15 | 1.84 | 0.29 |
| Alloy 106 | 80.19 | 0.00 | 0.95 | 13.28 | 2.25 | 0.88 | 1.66 | 0.79 |
| Alloy 107 | 78.33 | 2.55 | 0.00 | 11.98 | 1.37 | 3.73 | 0.81 | 1.23 |
| Alloy 108 | 75.41 | 3.03 | 0.78 | 12.90 | 1.18 | 5.13 | 0.78 | 0.79 |

TABLE 4-continued

| Chemical Composition of the Alloys (at. %) | | | | | | | | |
|---|---|---|---|---|---|---|---|---|
| Alloy | Fe | Cr | Ni | Mn | B | Si | Cu | C |
| Alloy 109 | 72.41 | 3.03 | 0.78 | 12.90 | 1.18 | 8.13 | 0.78 | 0.79 |
| Alloy 110 | 75.91 | 3.03 | 0.78 | 12.40 | 1.18 | 5.13 | 0.78 | 0.79 |
| Alloy 111 | 72.91 | 3.03 | 0.78 | 12.40 | 1.18 | 8.13 | 0.78 | 0.79 |
| Alloy 112 | 76.41 | 3.03 | 0.78 | 11.90 | 1.18 | 5.13 | 0.78 | 0.79 |
| Alloy 113 | 73.41 | 3.03 | 0.78 | 11.90 | 1.18 | 8.13 | 0.78 | 0.79 |
| Alloy 114 | 76.91 | 3.03 | 0.78 | 11.4 | 1.18 | 5.13 | 0.78 | 0.79 |
| Alloy 115 | 76.51 | 3.03 | 0.78 | 11.4 | 1.18 | 5.13 | 1.18 | 0.79 |
| Alloy 116 | 76.11 | 3.03 | 0.78 | 11.4 | 1.18 | 5.13 | 1.58 | 0.79 |
| Alloy 117 | 78.41 | 1.03 | 0.78 | 11.9 | 1.18 | 5.13 | 0.78 | 0.79 |
| Alloy 118 | 78.01 | 1.03 | 0.78 | 11.9 | 1.18 | 5.13 | 1.18 | 0.79 |
| Alloy 119 | 77.61 | 1.03 | 0.78 | 11.9 | 1.18 | 5.13 | 1.58 | 0.79 |
| Alloy 120 | 78.41 | 3.03 | 0.78 | 11.9 | 1.18 | 3.13 | 0.78 | 0.79 |
| Alloy 121 | 78.01 | 3.03 | 0.78 | 11.9 | 1.18 | 3.13 | 1.18 | 0.79 |
| Alloy 122 | 77.61 | 3.03 | 0.78 | 11.9 | 1.18 | 3.13 | 1.58 | 0.79 |
| Alloy 123 | 80.91 | 1.03 | 0.78 | 11.4 | 1.18 | 3.13 | 0.78 | 0.79 |
| Alloy 124 | 80.51 | 1.03 | 0.78 | 11.4 | 1.18 | 3.13 | 1.18 | 0.79 |
| Alloy 125 | 80.11 | 1.03 | 0.78 | 11.4 | 1.18 | 3.13 | 1.58 | 0.79 |
| Alloy 126 | 67.54 | 4.55 | 1.69 | 14.22 | 0.77 | 8.84 | 1.09 | 0.65 |
| Alloy 127 | 69.49 | 4.55 | 1.69 | 14.22 | 0.77 | 7.54 | 1.09 | 0.65 |
| Alloy 128 | 70.79 | 4.55 | 1.69 | 14.22 | 0.77 | 6.24 | 1.09 | 0.65 |
| Alloy 129 | 67.19 | 4.55 | 1.69 | 15.22 | 0.77 | 8.84 | 1.09 | 0.65 |
| Alloy 130 | 68.49 | 4.55 | 1.69 | 15.22 | 0.77 | 7.54 | 1.09 | 0.65 |
| Alloy 131 | 69.79 | 4.55 | 1.69 | 15.22 | 0.77 | 6.24 | 1.09 | 0.65 |
| Alloy 132 | 69.14 | 4.55 | 1.69 | 15.22 | 0.77 | 6.24 | 1.09 | 0.65 |
| Alloy 133 | 69.98 | 4.55 | 1.69 | 14.72 | 0.77 | 6.55 | 1.09 | 0.65 |
| Alloy 134 | 69.48 | 4.55 | 1.69 | 15.22 | 0.77 | 6.55 | 1.09 | 0.65 |
| Alloy 135 | 68.98 | 4.55 | 1.69 | 15.72 | 0.77 | 6.55 | 1.09 | 0.65 |
| Alloy 136 | 68.48 | 4.55 | 1.69 | 16.22 | 0.77 | 6.55 | 1.09 | 0.65 |
| Alloy 137 | 74.03 | 0.5 | 1.69 | 14.72 | 0.77 | 6.55 | 1.09 | 0.65 |
| Alloy 138 | 73.53 | 0.5 | 1.69 | 15.22 | 0.77 | 6.55 | 1.09 | 0.65 |
| Alloy 139 | 73.03 | 0.5 | 1.69 | 15.72 | 0.77 | 6.55 | 1.09 | 0.65 |
| Alloy 140 | 72.53 | 0.5 | 1.69 | 16.22 | 0.77 | 6.55 | 1.09 | 0.65 |
| Alloy 141 | 75.53 | 2.63 | 1.19 | 13.18 | 0.00 | 5.13 | 1.55 | 0.79 |
| Alloy 142 | 73.99 | 2.63 | 1.19 | 13.18 | 0.00 | 6.67 | 1.55 | 0.79 |
| Alloy 143 | 72.49 | 2.63 | 1.19 | 13.18 | 0.00 | 8.17 | 1.55 | 0.79 |
| Alloy 144 | 74.74 | 2.63 | 1.19 | 13.18 | 0.00 | 5.13 | 1.55 | 1.58 |
| Alloy 145 | 73.20 | 2.63 | 1.19 | 13.18 | 0.00 | 6.67 | 1.55 | 1.58 |
| Alloy 146 | 71.70 | 2.63 | 1.19 | 13.18 | 0.00 | 8.17 | 1.55 | 1.58 |
| Alloy 147 | 76.43 | 2.63 | 1.19 | 13.18 | 0.00 | 5.13 | 0.65 | 0.79 |
| Alloy 148 | 75.75 | 2.63 | 1.19 | 13.86 | 0.00 | 5.13 | 0.65 | 0.79 |
| Alloy 149 | 77.08 | 2.63 | 1.19 | 13.18 | 0.00 | 5.13 | 0.00 | 0.79 |
| Alloy 150 | 76.30 | 2.63 | 1.97 | 13.18 | 0.00 | 5.13 | 0.00 | 0.79 |
| Alloy 151 | 76.69 | 2.63 | 1.58 | 13.18 | 0.00 | 5.13 | 0.00 | 0.79 |
| Alloy 152 | 76.11 | 2.63 | 1.58 | 13.76 | 0.00 | 5.13 | 0.00 | 0.79 |
| Alloy 153 | 61.88 | 11.22 | 12.55 | 1.12 | 7.45 | 5.22 | 0.00 | 0.56 |
| Alloy 154 | 76.99 | 2.13 | 2.38 | 11.84 | 1.94 | 2.13 | 1.55 | 1.04 |
| Alloy 155 | 69.36 | 10.70 | 1.25 | 10.56 | 3.00 | 4.13 | 1.00 | 0.00 |
| Alloy 156 | 74.03 | 2.13 | 2.38 | 11.84 | 1.94 | 6.13 | 1.55 | 0.00 |

From the above it can be seen that the alloys herein that are susceptible to the transformations illustrated in FIG. 4 fall into the following groupings: (1) Fe/Cr/Ni/Mn/B/Si/Cu/C (alloys 1-44, 48, 49, 54-57, 60-62, 66-68, 75-105, 108-140); (2) Fe/Cr/Ni/Mn/B/Si/C (alloys 45-47, 153); (3) Fe/Cr/Ni/Mn/B/Si/Cu (alloys 156, 157); (4) Fe/Ni/Mn/B/Si/Cu/C (alloy 106); (5) Fe/Cr/Mn/B/Si/Cu/C (alloys 50-53, 58, 59, 63-65, 69-74, 107), (6) Fe/Cr/Ni/Mn/Si/Cu/C (alloys 141-148); (7) Fe/Cr/Ni/Mn/Si/C (alloys 149-152).

From the above, one of skill in the art would understand the alloy composition herein to include the following three elements at the following indicated atomic percent: Fe (61-81 at. %); Si (0.6-9.0 at. %); Mn (1.0-17.0 at. %). In addition, it can be appreciated that the following elements are optional and may be present at the indicated atomic percent: Ni (0.1-13.0 at. %); Cr (0.1-12.0 at. %); B (0.1-6.0 at. %); Cu (0.1-4.0 at. %); C (0.1-4.0 at. %). Impurities may be present include Al, Mo, Nb, S, O, N, P, W, Co, Sn, Zr, Pd and V, which may be present up to 10 atomic percent.

Thermal analysis of the alloys herein was performed on the as-solidified cast slab samples on a Netzsch Pegasus 404 Differential Scanning calorimeter (DSC). Measurement profiles consisted of a rapid ramp up to 900° C., followed by a controlled ramp to 1425° C. at a rate of 10° C./minute, a controlled cooling from 1425° C. to 900° C. at a rate of 10° C./min, and a second heating to 1425° C. at a rate of 10° C./min. Measurements of solidus, liquidus, and peak temperatures were taken from the final heating stage, in order to ensure a representative measurement of the material in an equilibrium state with the best possible measurement contact. In the alloys listed in Table 4, melting occurs in one or multiple stages with initial melting from ~1080° C. depending on alloy chemistry and final melting temperature exceeding 1450° C. in some cases (Table 5). Variations in melting behavior reflect a complex phase formation during solidification of the alloys depending on their chemistry.

TABLE 5

| Differential Thermal Analysis Data for Melting Behavior | | | | | | |
|---|---|---|---|---|---|---|
| Alloy | Solidus (° C.) | Liquidus (° C.) | Peak #1 (° C.) | Peak #2 (° C.) | Peak #3 (° C.) | Peak #4 (° C.) |
| Alloy 1 | 1145 | 1415 | 1163 | — | 1402 | 1409 |
| Alloy 2 | 1127 | 1391 | 1151 | — | — | 1377 |
| Alloy 3 | 1148 | 1416 | 1166 | — | — | 1408 |
| Alloy 4 | 1141 | 1404 | 1160 | — | 1393 | 1400 |
| Alloy 5 | 1128 | 1387 | 1153 | — | — | 1376 |
| Alloy 6 | 1143 | 1424 | 1159 | — | — | 1415 |
| Alloy 7 | 1144 | 1421 | 1164 | — | 1412 | 1418 |
| Alloy 8 | 1137 | 1401 | 1158 | — | 1391 | 1398 |
| Alloy 9 | 1145 | 1431 | 1162 | — | — | 1419 |
| Alloy 10 | 1138 | 1411 | 1155 | — | 1400 | 1407 |
| Alloy 11 | 1134 | 1392 | 1152 | — | — | 1382 |
| Alloy 12 | 1148 | 1408 | 1167 | — | — | 1399 |
| Alloy 13 | 1145 | 1399 | 1165 | — | 1387 | 1395 |
| Alloy 14 | 1133 | 1386 | 1158 | — | 1374 | 1382 |
| Alloy 15 | 1148 | 1411 | 1168 | — | 1399 | 1407 |
| Alloy 16 | 1143 | 1395 | 1164 | — | 1385 | 1391 |
| Alloy 17 | 1123 | 1373 | 1150 | — | — | 1363 |
| Alloy 18 | 1143 | 1410 | 1161 | | 1401 | 1408 |
| Alloy 19 | 1139 | 1407 | 1156 | | 1392 | 1398 |
| Alloy 20 | 1127 | 1386 | 1150 | — | — | 1375 |
| Alloy 21 | 1151 | 1436 | 1166 | — | 1421 | 1430 |
| Alloy 22 | 1139 | 1407 | 1158 | — | — | 1397 |
| Alloy 23 | 1124 | 1394 | 1147 | — | — | 1382 |
| Alloy 24 | 1145 | 1422 | 1163 | — | 1412 | 1416 |
| Alloy 25 | 1140 | 1406 | 1158 | — | 1395 | — |
| Alloy 26 | 1133 | 1192 | 1152 | — | 1377 | 1384 |
| Alloy 27 | 1144 | 1423 | 1157 | — | — | 1412 |
| Alloy 28 | 1143 | 1414 | 1159 | — | 1406 | 1409 |
| Alloy 29 | 1141 | 1400 | 1159 | — | 1388 | 1394 |
| Alloy 30 | 1151 | 1416 | 1170 | — | — | 1403 |
| Alloy 31 | 1140 | 1412 | 1159 | — | — | 1398 |
| Alloy 32 | 1148 | 1411 | 1169 | — | 1399 | 1404 |
| Alloy 33 | 1141 | 1401 | 1162 | — | — | 1391 |
| Alloy 34 | 1134 | 1397 | 1154 | — | — | 1386 |
| Alloy 35 | 1144 | 1407 | 1162 | — | — | 1398 |
| Alloy 36 | 1135 | 1402 | 1156 | — | — | 1392 |
| Alloy 37 | 1130 | 1397 | 1150 | — | — | 1387 |
| Alloy 38 | 1148 | 1400 | 1166 | — | 1387 | 1392 |
| Alloy 39 | 1139 | 1392 | 1160 | — | — | 1381 |
| Alloy 40 | 1145 | 1415 | 1166 | — | 1402 | 1409 |
| Alloy 41 | 1141 | 1414 | 1162 | — | 1400 | 1406 |
| Alloy 42 | 1125 | 1396 | 1143 | — | — | 1387 |
| Alloy 43 | 1160 | 1421 | 1178 | — | 1400 | 1411 |
| Alloy 44 | 1154 | 1422 | 1175 | — | 1399 | 1417 |
| Alloy 45 | 1148 | 1421 | 1170 | — | — | 1405 |
| Alloy 46 | 1152 | 1414 | 1169 | — | — | 1402 |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 47 | 1149 | 1416 | 1169 | — | — | 1406 |
| Alloy 48 | 1154 | 1410 | 1171 | — | — | 1402 |
| Alloy 49 | 1143 | 1408 | 1166 | — | — | 1400 |
| Alloy 50 | 1162 | 1427 | 1182 | 1365 | 1409 | 1417 |
| Alloy 51 | 1156 | 1416 | 1177 | 1382 | 1400 | 1411 |
| Alloy 52 | 1160 | 1414 | 1177 | — | 1392 | 1406 |
| Alloy 53 | 1159 | 1416 | 1178 | 1390 | — | 1407 |
| Alloy 54 | 1162 | 1420 | 1178 | 1396 | — | 1416 |
| Alloy 55 | 1159 | 1421 | 1177 | 1395 | 1405 | 1417 |
| Alloy 56 | 1152 | 1413 | 1171 | — | — | 1397 |
| Alloy 57 | 1154 | 1414 | 1175 | — | — | 1396 |
| Alloy 58 | 1144 | 1418 | 1157 | — | 1403 | 1411 |
| Alloy 59 | 1174 | 1418 | 1195 | 1357 | 1399 | 1414 |
| Alloy 60 | 1140 | 1412 | 1151 | — | — | 1403 |
| Alloy 61 | 1158 | 1425 | 1177 | 1390 | 1405 | 1415 |
| Alloy 62 | 1171 | 1416 | 1190 | 1383 | 1399 | 1407 |
| Alloy 63 | 1141 | 1420 | 1151 | 1406 | 1415 | 1416 |
| Alloy 64 | 1157 | 1403 | 1170 | — | — | 1394 |
| Alloy 65 | 1171 | 1409 | 1186 | 1381 | 1402 | 1404 |
| Alloy 66 | 1143 | 1410 | 1155 | — | — | 1407 |
| Alloy 67 | 1158 | 1415 | 1172 | — | 1380 | 1402 |
| Alloy 68 | 1166 | 1404 | 1187 | 1395 | — | — |
| Alloy 69 | 1150 | 1424 | 1161 | 1398 | 1409 | 1419 |
| Alloy 70 | 1150 | 1407 | 1171 | 1398 | — | — |
| Alloy 71 | 1172 | 1414 | 1191 | 1375 | 1395 | 1407 |
| Alloy 72 | 1141 | 1425 | 1156 | 1406 | — | — |
| Alloy 73 | 1163 | 1429 | 1180 | 1382 | 1413 | 1426 |
| Alloy 74 | 1170 | 1421 | 1191 | 1369 | 1403 | 1415 |
| Alloy 75 | 1146 | 1424 | 1159 | — | 1412 | — |
| Alloy 76 | 1155 | 1419 | 1174 | — | 1398 | 1415 |
| Alloy 77 | 1166 | 1414 | 1187 | 1385 | 1396 | 1407 |
| Alloy 78 | 1169 | 1419 | 1186 | 1388 | 1400 | 1413 |
| Alloy 79 | 1163 | 1418 | 1184 | 1385 | 1401 | 1412 |
| Alloy 80 | 1159 | 1414 | 1178 | 1397 | 1407 | — |
| Alloy 81 | 1159 | 1413 | 1181 | 1397 | — | — |
| Alloy 82 | 1164 | 1427 | 1185 | 1388 | 1409 | 1417 |
| Alloy 83 | 1160 | 1425 | 1182 | 1388 | 1407 | 1418 |
| Alloy 84 | 1169 | 1404 | 1189 | 1382 | 1400 | — |
| Alloy 85 | 1159 | 1390 | 1182 | 1376 | — | — |
| Alloy 86 | 1159 | 1392 | 1183 | 1377 | — | — |
| Alloy 88 | 1156 | 1388 | 1181 | 1374 | — | — |
| Alloy 87 | 1160 | 1398 | 1185 | 1377 | 1394 | — |
| Alloy 89 | 1171 | 1411 | 1191 | 1365 | 1392 | 1407 |
| Alloy 90 | 1151 | 1412 | 1168 | 1396 | — | — |
| Alloy 91 | 1153 | 1418 | 1169 | 1400 | 1407 | — |
| Alloy 92 | 1152 | 1420 | 1169 | 1402 | 1414 | — |
| Alloy 93 | 1148 | 1406 | 1169 | 1393 | 1402 | — |
| Alloy 94 | 1149 | 1403 | 1169 | 1392 | 1399 | — |
| Alloy 95 | 1149 | 1402 | 1168 | 1391 | 1396 | — |
| Alloy 96 | 1093 | 1377 | 1113 | 1366 | — | — |
| Alloy 97 | 1142 | 1384 | 1165 | 1335 | 1369 | 1378 |
| Alloy 98 | 1083 | 1362 | 1116 | 1350 | — | — |
| Alloy 99 | 1083 | 1346 | 1108 | 1137 | 1385 | — |
| Alloy 100 | 1102 | 1405 | 1113 | 1393 | 1400 | — |
| Alloy 101 | 1152 | 1446 | 1167 | — | — | 1439 |
| Alloy 102 | 1149 | 1414 | 1167 | 1388 | 1397 | 1408 |
| Alloy 103 | 1131 | 1376 | 1154 | — | — | 1359 |
| Alloy 104 | 1174 | 1382 | 1196 | — | — | 1369 |
| Alloy 105 | 1142 | 1419 | 1156 | 1407 | 1412 | 1414 |
| Alloy 106 | 1146 | 1439 | 1158 | — | 1430 | 1436 |
| Alloy 107 | 1161 | 1437 | 1177 | — | 1412 | 1426 |
| Alloy 108 | 1162 | 1416 | 1177 | — | — | 1407 |
| Alloy 109 | 1147 | 1399 | 1167 | — | 1335 | 1383 |
| Alloy 110 | 1159 | 1421 | 1176 | — | — | 1408 |
| Alloy 111 | 1146 | 1392 | 1167 | — | 1338 | 1383 |
| Alloy 112 | 1157 | 1417 | 1174 | 1409 | — | — |
| Alloy 113 | 1144 | 1395 | 1166 | 1341 | 1383 | — |
| Alloy 114 | 1159 | 1425 | 1179 | — | — | 1406 |
| Alloy 115 | 1161 | 1431 | 1180 | 1395 | 1416 | 1424 |
| Alloy 116 | 1162 | 1425 | 1182 | 1395 | 1413 | 1420 |
| Alloy 117 | 1143 | 1423 | 1158 | — | — | 1417 |
| Alloy 118 | 1145 | 1425 | 1160 | — | — | 1417 |
| Alloy 119 | 1142 | 1422 | 1159 | — | — | 1414 |
| Alloy 120 | 1163 | 1436 | 1180 | — | — | 1430 |
| Alloy 121 | 1162 | 1435 | 1181 | — | 1428 | 1431 |

TABLE 5-continued

Differential Thermal Analysis Data for Melting Behavior

| Alloy | Solidus (° C.) | Liquidus (° C.) | Peak #1 (° C.) | Peak #2 (° C.) | Peak #3 (° C.) | Peak #4 (° C.) |
|---|---|---|---|---|---|---|
| Alloy 122 | 1163 | 1431 | 1182 | — | — | 1427 |
| Alloy 123 | 1150 | 1441 | 1162 | — | — | 1436 |
| Alloy 124 | 1154 | 1444 | 1166 | — | — | 1439 |
| Alloy 125 | 1154 | 1438 | 1166 | — | — | 1433 |
| Alloy 126 | 1130 | 1370 | 1153 | — | 1316 | 1357 |
| Alloy 127 | 1146 | 1397 | 1174 | — | 1358 | 1384 |
| Alloy 128 | 1161 | 1411 | 1182 | — | — | 1388 |
| Alloy 129 | 1127 | 1378 | 1164 | — | 1332 | 1368 |
| Alloy 130 | 1145 | 1390 | 1173 | — | 1371 | 1385 |
| Alloy 131 | 1153 | 1402 | 1178 | — | — | 1392 |
| Alloy 132 | 1135 | 1388 | 1156 | — | — | 1380 |
| Alloy 133 | 1164 | 1401 | 1181 | — | — | 1387 |
| Alloy 134 | 1160 | 1394 | 1176 | — | — | 137 |
| Alloy 135 | 1159 | 1391 | 1175 | — | — | 1385 |
| Alloy 136 | 1153 | 1389 | 1172 | — | — | 1382 |
| Alloy 137 | 1128 | 1403 | 1139 | — | — | 1396 |
| Alloy 138 | 1123 | 1404 | 1138 | — | — | 1395 |
| Alloy 139 | 1122 | 1399 | 1135 | — | — | 1392 |
| Alloy 140 | 1118 | 1396 | 1132 | — | — | 1390 |
| Alloy 141 | 1385 | | 1427 | — | — | — |
| Alloy 142 | 1365 | 1422 | 1404 | — | — | — |
| Alloy 143 | 1341 | 1408 | 1369 | 1402 | — | — |
| Alloy 144 | 1353 | 1421 | 1413 | — | — | — |
| Alloy 145 | 1353 | 1407 | 1400 | — | — | — |
| Alloy 146 | | | | | | |
| Alloy 147 | | | | | | |
| Alloy 148 | | | | | | |
| Alloy 149 | | | | | | |
| Alloy 150 | | | | | | |
| Alloy 151 | | | | | | |
| Alloy 152 | | | | | | |
| Alloy 153 | | | | | | |
| Alloy 154 | 1136 | 1402 | 1155 | 1394 | — | — |
| Alloy 155 | 1208 | 1392 | 1230 | 1290 | 1377 | — |
| Alloy 156 | 1144 | 1393 | 1166 | 1381 | 1389 | — |

The 50 mm thick laboratory slabs from each alloy were subjected to hot rolling at the temperature of 1075 to 1100° C. depending on alloy solidus temperature. Rolling was done on a Fenn Model 061 single stage rolling mill, employing an in-line Lucifer EHS3GT-B18 tunnel furnace. Material was held at the hot rolling temperature for an initial dwell time of 40 minutes to ensure homogeneous temperature. After each pass on the rolling mill, the sample was returned to the tunnel furnace with a 4 minute temperature recovery hold to partially adjust for temperature loss during each hot rolling pass. Hot rolling was conducted in two campaigns, with the first campaign achieving approximately 85% total reduction to a thickness of 6 mm. Following the first campaign of hot rolling, a section of sheet between 150 mm and 200 mm long was cut from the center of the hot rolled material. This cut section was then used for a second campaign of hot rolling for a total reduction between both campaigns of between 96% and 97%. A list of specific hot rolling parameters used for all alloys is available in Table 6. An example of the hot rolled sheet from Alloy 59 is shown in FIG. 7.

TABLE 6

| Hot Rolling Parameters | | | | | | | |
|---|---|---|---|---|---|---|---|
| Alloy | Initial Rolling Temperature (° C.) | Campaign | Number of Passes | Initial Thickness (mm) | Final Thickness (mm) | Campaign Reduction (%) | Cumulative Reduction (%) |
| Alloy 1 | 1100 | 1 | 7 Pass | 49.51 | 6.12 | 87.6 | 87.6 |
| | | 2 | 3 Pass | 6.12 | 1.60 | 73.8 | 96.8 |
| Alloy 2 | 1075 | 1 | 7 Pass | 49.27 | 6.23 | 87.4 | 87.4 |
| | | 2 | 3 Pass | 6.23 | 1.68 | 73.0 | 96.6 |
| Alloy 3 | 1100 | 1 | 7 Pass | 49.50 | 6.16 | 87.6 | 87.6 |
| | | 2 | 3 Pass | 6.16 | 1.55 | 74.8 | 96.9 |
| Alloy 4 | 1100 | 1 | 7 Pass | 49.39 | 6.16 | 87.5 | 87.5 |
| | | 2 | 3 Pass | 6.16 | 1.62 | 73.7 | 96.7 |
| Alloy 5 | 1075 | 1 | 7 Pass | 49.51 | 6.20 | 87.5 | 87.5 |
| | | 2 | 3 Pass | 6.20 | 1.64 | 73.6 | 96.7 |
| Alloy 6 | 1100 | 1 | 7 Pass | 49.30 | 6.18 | 87.5 | 87.5 |
| | | 2 | 3 Pass | 6.18 | 1.57 | 74.7 | 96.8 |
| Alloy 7 | 1100 | 1 | 7 Pass | 49.20 | 6.25 | 87.3 | 87.3 |
| | | 2 | 3 Pass | 6.25 | 1.58 | 74.7 | 96.8 |
| Alloy 8 | 1075 | 1 | 7 Pass | 49.53 | 6.17 | 87.5 | 87.5 |
| | | 2 | 3 Pass | 6.17 | 1.64 | 73.4 | 96.7 |
| | 1075 | 1 | 7 Pass | 49.59 | 6.25 | 87.4 | 87.4 |
| | | 2 | 3 Pass | 6.25 | 1.62 | 74.1 | 96.7 |
| Alloy 9 | 1100 | 1 | 7 Pass | 49.06 | 6.08 | 87.6 | 87.6 |
| | | 2 | 3 Pass | 6.08 | 1.64 | 73.0 | 96.7 |
| Alloy 10 | 1100 | 1 | 7 Pass | 49.20 | 6.01 | 87.8 | 87.8 |
| | | 2 | 3 Pass | 6.01 | 1.61 | 73.2 | 96.7 |
| Alloy 11 | 1075 | 1 | 7 Pass | 49.32 | 6.20 | 87.4 | 87.4 |
| | | 2 | 3 Pass | 6.20 | 1.68 | 72.9 | 96.6 |
| Alloy 12 | 1100 | 1 | 7 Pass | 49.28 | 6.06 | 87.7 | 87.7 |
| | | 2 | 3 Pass | 6.06 | 1.48 | 75.6 | 97.0 |
| Alloy 13 | 1100 | 1 | 7 Pass | 49.13 | 5.93 | 87.9 | 87.9 |
| | | 2 | 3 Pass | 5.93 | 1.53 | 74.2 | 96.9 |
| Alloy 14 | 1075 | 1 | 7 Pass | 49.50 | 6.17 | 87.5 | 87.5 |
| | | 2 | 3 Pass | 6.17 | 1.58 | 74.4 | 96.8 |
| Alloy 15 | 1100 | 1 | 7 Pass | 48.84 | 6.07 | 87.6 | 87.6 |
| | | 2 | 3 Pass | 6.07 | 1.66 | 72.6 | 96.6 |
| Alloy 16 | 1075 | 1 | 7 Pass | 49.09 | 6.21 | 87.4 | 87.4 |
| | | 2 | 3 Pass | 6.21 | 1.65 | 73.4 | 96.6 |
| Alloy 17 | 1075 | 1 | 7 Pass | 49.29 | 6.21 | 87.4 | 87.4 |
| | | 2 | 3 Pass | 6.21 | 1.71 | 72.4 | 96.5 |
| Alloy 18 | 1100 | 1 | 7 Pass | 49.33 | 6.12 | 87.6 | 87.6 |
| | | 2 | 3 Pass | 6.12 | 1.58 | 74.2 | 96.8 |
| Alloy 19 | 1075 | 1 | 7 Pass | 49.67 | 6.20 | 87.5 | 87.5 |
| | | 2 | 3 Pass | 6.20 | 1.63 | 73.7 | 96.7 |
| Alloy 20 | 1075 | 1 | 7 Pass | 49.63 | 6.24 | 87.4 | 87.4 |
| | | 2 | 3 Pass | 6.24 | 1.80 | 71.2 | 96.4 |
| Alloy 21 | 1100 | 1 | 7 Pass | 49.49 | 6.07 | 87.7 | 87.7 |
| | | 2 | 3 Pass | 6.07 | 1.54 | 74.7 | 96.9 |
| Alloy 22 | 1100 | 1 | 7 Pass | 49.46 | 6.21 | 87.4 | 87.4 |
| | | 2 | 3 Pass | 6.21 | 1.62 | 74.0 | 96.7 |
| Alloy 23 | 1075 | 1 | 7 Pass | 49.80 | 6.18 | 87.6 | 87.6 |
| | | 2 | 3 Pass | 6.18 | 1.72 | 72.1 | 96.5 |
| Alloy 24 | 1100 | 1 | 7 Pass | 49.39 | 6.15 | 87.5 | 87.5 |
| | | 2 | 3 Pass | 6.15 | 1.60 | 74.0 | 96.8 |
| Alloy 25 | 1100 | 1 | 7 Pass | 49.56 | 6.23 | 87.4 | 87.4 |
| | | 2 | 3 Pass | 6.23 | 1.61 | 74.2 | 96.7 |
| Alloy 26 | 1075 | 1 | 7 Pass | 49.43 | 6.22 | 87.4 | 87.4 |
| | | 2 | 3 Pass | 6.22 | 1.64 | 73.6 | 96.7 |
| Alloy 27 | 1100 | 1 | 7 Pass | 49.20 | 6.11 | 87.6 | 87.6 |
| | | 2 | 3 Pass | 6.11 | 1.52 | 75.1 | 96.9 |
| Alloy 28 | 1075 | 1 | 7 Pass | 49.15 | 6.14 | 87.5 | 87.5 |
| | | 2 | 3 Pass | 6.14 | 1.70 | 72.3 | 96.5 |
| Alloy 29 | 1075 | 1 | 7 Pass | 49.92 | 6.36 | 87.3 | 87.3 |
| | | 2 | 3 Pass | 6.36 | 1.62 | 74.5 | 96.7 |
| Alloy 30 | 1100 | 1 | 7 Pass | 48.84 | 6.12 | 87.5 | 87.5 |
| | | 2 | 3 Pass | 6.12 | 1.63 | 73.4 | 96.7 |
| Alloy 31 | 1075 | 1 | 7 Pass | 49.29 | 5.93 | 88.0 | 88.0 |
| | | 2 | 3 Pass | 5.93 | 1.70 | 71.3 | 96.6 |
| Alloy 32 | 1100 | 1 | 7 Pass | 49.12 | 6.14 | 87.5 | 87.5 |
| | | 2 | 3 Pass | 6.14 | 1.57 | 74.4 | 96.8 |
| Alloy 33 | 1100 | 1 | 7 Pass | 49.17 | 6.19 | 87.4 | 87.4 |
| | | 2 | 3 Pass | 6.19 | 1.71 | 72.3 | 96.5 |
| Alloy 34 | 1075 | 1 | 7 Pass | 49.38 | 6.32 | 87.2 | 87.2 |
| | | 2 | 3 Pass | 6.32 | 1.72 | 72.8 | 96.5 |
| Alloy 35 | 1100 | 1 | 7 Pass | 49.29 | 6.12 | 87.6 | 87.6 |
| | | 2 | 3 Pass | 6.12 | 1.62 | 73.5 | 96.7 |

TABLE 6-continued

| Hot Rolling Parameters | | | | | | | |
|---|---|---|---|---|---|---|---|
| Alloy | Initial Rolling Temperature (° C.) | Campaign | Number of Passes | Initial Thickness (mm) | Final Thickness (mm) | Campaign Reduction (%) | Cumulative Reduction (%) |
| Alloy 36 | 1075 | 1 | 7 Pass | 49.43 | 6.12 | 87.6 | 87.6 |
| | | 2 | 3 Pass | 6.12 | 1.72 | 71.9 | 96.5 |
| Alloy 37 | 1075 | 1 | 7 Pass | 49.24 | 6.14 | 87.5 | 87.5 |
| | | 2 | 3 Pass | 6.14 | 1.68 | 72.6 | 96.6 |
| Alloy 38 | 1100 | 1 | 7 Pass | 49.22 | 6.09 | 87.6 | 87.6 |
| | | 2 | 3 Pass | 6.09 | 1.63 | 73.3 | 96.7 |
| Alloy 39 | 1100 | 1 | 7 Pass | 49.36 | 6.16 | 87.5 | 87.5 |
| | | 2 | 3 Pass | 6.16 | 1.70 | 72.5 | 96.6 |
| Alloy 40 | 1075 | 1 | 7 Pass | 49.26 | 6.17 | 87.5 | 87.5 |
| | | 2 | 3 Pass | 6.17 | 1.79 | 71.0 | 96.4 |
| Alloy 41 | 1075 | 1 | 7 Pass | 49.27 | 6.09 | 87.6 | 87.6 |
| | | 2 | 3 Pass | 6.09 | 1.74 | 71.4 | 96.5 |
| Alloy 42 | 1075 | 1 | 7 Pass | 49.32 | 6.06 | 87.7 | 87.7 |
| | | 2 | 3 Pass | 6.06 | 1.58 | 73.9 | 96.8 |
| Alloy 43 | 1100 | 1 | 7 Pass | 49.64 | 6.23 | 87.4 | 87.4 |
| | | 2 | 3 Pass | 6.23 | 1.53 | 75.4 | 96.9 |
| Alloy 44 | 1100 | 1 | 7 Pass | 49.68 | 6.26 | 87.4 | 87.4 |
| | | 2 | 3 Pass | 6.26 | 1.68 | 73.1 | 96.6 |
| | 1100 | 1 | 7 Pass | 49.24 | 6.20 | 87.4 | 87.4 |
| | | 2 | 3 Pass | 6.20 | 1.62 | 73.9 | 96.7 |
| | 1100 | 1 | 7 Pass | 49.63 | 6.14 | 87.6 | 87.6 |
| | | 2 | 3 Pass | 6.14 | 1.59 | 74.1 | 96.8 |
| Alloy 45 | 1100 | 1 | 7 Pass | 49.51 | 6.23 | 87.4 | 87.4 |
| | | 2 | 3 Pass | 6.23 | 1.65 | 73.5 | 96.7 |
| Alloy 46 | 1100 | 1 | 7 Pass | 49.61 | 6.22 | 87.5 | 87.5 |
| | | 2 | 3 Pass | 6.22 | 1.61 | 74.1 | 96.8 |
| Alloy 47 | 1100 | 1 | 7 Pass | 49.75 | 6.13 | 87.7 | 87.7 |
| | | 2 | 3 Pass | 6.13 | 1.61 | 73.7 | 96.8 |
| Alloy 48 | 1100 | 1 | 7 Pass | 48.69 | 6.12 | 87.4 | 87.4 |
| | | 2 | 3 Pass | 6.12 | 1.58 | 74.3 | 96.8 |
| Alloy 49 | 1100 | 1 | 7 Pass | 49.50 | 6.18 | 87.5 | 87.5 |
| | | 2 | 3 Pass | 6.18 | 1.64 | 73.4 | 96.7 |
| Alloy 50 | 1100 | 1 | 7 Pass | 49.68 | 6.24 | 87.4 | 87.4 |
| | | 2 | 3 Pass | 6.24 | 1.65 | 73.6 | 96.7 |
| Alloy 51 | 1100 | 1 | 7 Pass | 49.42 | 6.13 | 87.6 | 87.6 |
| | | 2 | 3 Pass | 6.13 | 1.60 | 73.8 | 96.8 |
| Alloy 52 | 1100 | 1 | 7 Pass | 49.44 | 6.16 | 87.5 | 87.5 |
| | | 2 | 3 Pass | 6.16 | 1.63 | 73.6 | 96.7 |
| Alloy 53 | 1100 | 1 | 7 Pass | 49.58 | 6.14 | 87.6 | 87.6 |
| | | 2 | 3 Pass | 6.14 | 1.61 | 73.9 | 96.8 |
| Alloy 54 | 1100 | 1 | 7 Pass | 49.34 | 6.07 | 87.7 | 87.7 |
| | | 2 | 3 Pass | 6.07 | 1.73 | 71.4 | 96.5 |
| Alloy 55 | 1100 | 1 | 7 Pass | 49.33 | 5.98 | 87.9 | 87.9 |
| | | 2 | 3 Pass | 5.98 | 1.67 | 72.1 | 96.6 |
| Alloy 56 | 1100 | 1 | 7 Pass | 49.73 | 6.05 | 87.8 | 87.8 |
| | | 2 | 3 Pass | 6.05 | 1.56 | 74.2 | 96.9 |
| Alloy 57 | 1100 | 1 | 7 Pass | 49.58 | 6.10 | 87.7 | 87.7 |
| | | 2 | 3 Pass | 6.10 | 1.64 | 73.2 | 96.7 |
| Alloy 58 | 1100 | 1 | 7 Pass | 49.66 | 6.09 | 87.7 | 87.7 |
| | | 2 | 3 Pass | 6.09 | 1.62 | 73.4 | 96.7 |
| Alloy 59 | 1125 | 1 | 7 Pass | 49.51 | 6.08 | 87.7 | 87.7 |
| | | 2 | 3 Pass | 6.08 | 1.62 | 73.4 | 96.7 |
| Alloy 60 | 1100 | 1 | 7 Pass | 49.77 | 6.12 | 87.7 | 87.7 |
| | | 2 | 3 Pass | 6.12 | 1.58 | 74.2 | 96.8 |
| Alloy 61 | 1100 | 1 | 7 Pass | 49.33 | 6.18 | 87.5 | 87.5 |
| | | 2 | 3 Pass | 6.18 | 1.57 | 74.6 | 96.8 |
| Alloy 62 | 1125 | 1 | 7 Pass | 49.73 | 6.26 | 87.4 | 87.4 |
| | | 2 | 3 Pass | 6.26 | 1.62 | 74.1 | 96.7 |
| Alloy 63 | 1100 | 1 | 7 Pass | 49.58 | 6.19 | 87.5 | 87.5 |
| | | 2 | 3 Pass | 6.19 | 1.58 | 74.5 | 96.8 |
| Alloy 64 | 1100 | 1 | 7 Pass | 49.43 | 6.20 | 87.5 | 87.5 |
| | | 2 | 3 Pass | 6.20 | 1.64 | 73.5 | 96.7 |
| Alloy 65 | 1125 | 1 | 7 Pass | 49.53 | 6.06 | 87.8 | 87.8 |
| | | 2 | 3 Pass | 6.06 | 1.57 | 74.2 | 96.8 |
| Alloy 66 | 1100 | 1 | 7 Pass | 50.09 | 6.11 | 87.8 | 87.8 |
| | | 2 | 3 Pass | 6.11 | 1.53 | 75.0 | 97.0 |
| Alloy 67 | 1100 | 1 | 7 Pass | 50.12 | 6.17 | 87.7 | 87.7 |
| | | 2 | 3 Pass | 6.17 | 1.65 | 73.2 | 96.7 |
| Alloy 68 | 1100 | 1 | 7 Pass | 49.68 | 6.09 | 87.7 | 87.7 |
| | | 2 | 3 Pass | 6.09 | 1.60 | 73.7 | 96.8 |
| Alloy 69 | 1100 | 1 | 7 Pass | 50.11 | 6.11 | 87.8 | 87.8 |
| | | 2 | 3 Pass | 6.11 | 1.52 | 75.1 | 97.0 |

TABLE 6-continued

| Hot Rolling Parameters | | | | | | | |
|---|---|---|---|---|---|---|---|
| Alloy | Initial Rolling Temperature (° C.) | Campaign | Number of Passes | Initial Thickness (mm) | Final Thickness (mm) | Campaign Reduction (%) | Cumulative Reduction (%) |
| Alloy 70 | 1100 | 1 | 7 Pass | 49.69 | 6.18 | 87.6 | 87.6 |
| | | 2 | 3 Pass | 6.18 | 1.45 | 76.5 | 97.1 |
| Alloy 71 | 1125 | 1 | 7 Pass | 49.96 | 6.31 | 87.4 | 87.4 |
| | | 2 | 3 Pass | 6.31 | 1.41 | 77.7 | 97.2 |
| Alloy 72 | 1100 | 1 | 6 Pass | 48.54 | 9.45 | 80.5 | 80.5 |
| | | 2 | 4 Pass | 9.45 | 1.60 | 83.1 | 96.7 |
| Alloy 73 | 1100 | 1 | 6 Pass | 48.38 | 9.30 | 80.8 | 80.8 |
| | | 2 | 4 Pass | 9.30 | 1.56 | 83.2 | 96.8 |
| Alloy 74 | 1125 | 1 | 6 Pass | 48.66 | 9.18 | 81.1 | 81.1 |
| | | 2 | 4 Pass | 9.18 | 1.56 | 83.0 | 96.8 |
| Alloy 75 | 1100 | 1 | 6 Pass | 48.42 | 9.13 | 81.1 | 81.1 |
| | | 2 | 4 Pass | 9.13 | 1.52 | 83.3 | 96.9 |
| Alloy 76 | 1100 | 1 | 6 Pass | 48.61 | 9.16 | 81.1 | 81.1 |
| | | 2 | 4 Pass | 9.16 | 1.70 | 81.4 | 96.5 |
| Alloy 77 | 1125 | 1 | 6 Pass | 48.40 | 9.20 | 81.0 | 81.0 |
| | | 2 | 4 Pass | 9.20 | 1.73 | 81.2 | 96.4 |
| Alloy 78 | 1125 | 1 | 6 Pass | 48.83 | 9.15 | 81.3 | 81.3 |
| | | 2 | 4 Pass | 9.15 | 1.57 | 82.9 | 96.8 |
| Alloy 79 | 1100 | 1 | 6 Pass | 48.64 | 9.25 | 81.0 | 81.0 |
| | | 2 | 4 Pass | 9.25 | 1.56 | 83.2 | 96.8 |
| Alloy 80 | 1100 | 1 | 6 Pass | 48.83 | 9.13 | 81.3 | 81.3 |
| | | 2 | 4 Pass | 9.13 | 1.60 | 82.5 | 96.7 |
| Alloy 81 | 1100 | 1 | 6 Pass | 48.79 | 9.09 | 81.4 | 81.4 |
| | | 2 | 4 Pass | 9.09 | 1.59 | 82.5 | 96.7 |
| Alloy 82 | 1100 | 1 | 6 Pass | 48.64 | 9.03 | 81.4 | 81.4 |
| | | 2 | 4 Pass | 9.03 | 1.57 | 82.7 | 96.8 |
| Alloy 83 | 1100 | 1 | 6 Pass | 48.72 | 9.13 | 81.3 | 81.3 |
| | | 2 | 4 Pass | 9.13 | 1.57 | 82.8 | 96.8 |
| Alloy 84 | 1100 | 1 | 6 Pass | 48.61 | 9.16 | 81.2 | 81.2 |
| | | 2 | 4 Pass | 9.16 | 1.63 | 82.3 | 96.7 |
| Alloy 85 | 1100 | 1 | 6 Pass | 48.85 | 9.18 | 81.2 | 81.2 |
| | | 2 | 4 Pass | 9.18 | 1.60 | 82.6 | 96.7 |
| Alloy 86 | 1100 | 1 | 6 Pass | 48.96 | 9.31 | 81.0 | 81.0 |
| | | 2 | 4 Pass | 9.31 | 1.50 | 83.9 | 96.9 |
| Alloy 87 | 1100 | 1 | 6 Pass | 48.99 | 9.14 | 81.3 | 81.3 |
| | | 2 | 4 Pass | 9.14 | 1.52 | 83.4 | 96.9 |
| Alloy 88 | 1100 | 1 | 6 Pass | 48.64 | 9.14 | 81.2 | 81.2 |
| | | 2 | 4 Pass | 9.14 | 1.53 | 83.3 | 96.9 |
| Alloy 89 | 1100 | 1 | 6 Pass | 48.97 | 9.24 | 81.1 | 81.1 |
| | | 2 | 4 Pass | 9.24 | 1.46 | 84.2 | 97.0 |
| Alloy 90 | 1100 | 1 | 6 Pass | 48.95 | 9.14 | 81.3 | 81.3 |
| | | 2 | 4 Pass | 9.14 | 1.50 | 83.6 | 96.9 |
| Alloy 91 | 1100 | 1 | 6 Pass | 48.51 | 9.11 | 81.2 | 81.2 |
| | | 2 | 4 Pass | 9.11 | 1.66 | 81.8 | 96.6 |
| Alloy 92 | 1100 | 1 | 6 Pass | 48.65 | 9.15 | 81.2 | 81.2 |
| | | 2 | 4 Pass | 9.15 | 1.46 | 84.0 | 97.0 |
| Alloy 93 | 1100 | 1 | 6 Pass | 48.70 | 9.05 | 81.4 | 81.4 |
| | | 2 | 4 Pass | 9.05 | 1.47 | 83.7 | 97.0 |
| Alloy 94 | 1100 | 1 | 6 Pass | 49.03 | 9.02 | 81.6 | 81.6 |
| | | 2 | 4 Pass | 9.02 | 1.61 | 82.2 | 96.7 |
| Alloy 95 | 1100 | 1 | 6 Pass | 49.09 | 9.00 | 81.7 | 81.7 |
| | | 2 | 4 Pass | 9.00 | 1.63 | 81.9 | 96.7 |
| Alloy 96 | 1050 | 1 | 6 Pass | 49.30 | 9.27 | 81.2 | 81.2 |
| | | 2 | 4 Pass | 9.27 | 1.85 | 80.0 | 96.2 |
| Alloy 97 | 1075 | 1 | 6 Pass | 49.45 | 9.37 | 81.1 | 81.1 |
| | | 2 | 4 Pass | 9.37 | 1.75 | 81.4 | 96.5 |
| | 1075 | 1 | 6 Pass | 49.16 | 9.18 | 81.3 | 81.3 |
| | | 2 | 3 Pass | 9.18 | 1.95 | 78.8 | 96.0 |
| Alloy 98 | 1025 | 1 | 6 Pass | 49.09 | 9.54 | 80.6 | 80.6 |
| | | 2 | 4 Pass | 9.54 | 1.83 | 80.9 | 96.3 |
| Alloy 99 | 1025 | 1 | 6 Pass | 49.16 | 9.63 | 80.4 | 80.4 |
| | | 2 | 4 Pass | 9.63 | 2.01 | 79.1 | 95.9 |
| Alloy 100 | 1050 | 1 | 6 Pass | 48.87 | 9.29 | 81.0 | 81.0 |
| | | 2 | 4 Pass | 9.29 | 1.69 | 81.8 | 96.5 |
| Alloy 101 | 1100 | 1 | 6 Pass | 49.10 | 9.11 | 81.5 | 81.5 |
| | | 2 | 4 Pass | 9.11 | 1.54 | 83.1 | 96.9 |
| Alloy 102 | 1100 | 1 | 6 Pass | 49.06 | 8.86 | 81.9 | 81.9 |
| | | 2 | 4 Pass | 8.85 | 1.59 | 81.9 | 96.7 |
| Alloy 103 | 1075 | 1 | 6 Pass | 49.29 | 7.72 | 84.3 | 84.3 |
| | | 2 | 4 Pass | 7.72 | 1.59 | 79.4 | 96.8 |
| Alloy 104 | 1125 | 1 | 6 Pass | 48.91 | 8.70 | 82.2 | 82.2 |
| | | 2 | 4 Pass | 8.70 | 1.42 | 83.7 | 97.1 |

TABLE 6-continued

| Hot Rolling Parameters | | | | | | | |
|---|---|---|---|---|---|---|---|
| Alloy | Initial Rolling Temperature (° C.) | Campaign | Number of Passes | Initial Thickness (mm) | Final Thickness (mm) | Campaign Reduction (%) | Cumulative Reduction (%) |
| Alloy 105 | 1100 | 1 | 6 Pass | 48.45 | 8.79 | 81.9 | 81.9 |
| | | 2 | 4 Pass | 8.79 | 1.42 | 83.8 | 97.1 |
| Alloy 106 | 1100 | 1 | 6 Pass | 48.13 | 8.73 | 81.9 | 81.9 |
| | | 2 | 4 Pass | 8.73 | 1.48 | 83.1 | 96.9 |
| Alloy 107 | 1100 | 1 | 6 Pass | 48.94 | 8.87 | 81.9 | 81.9 |
| | | 2 | 4 Pass | 8.87 | 1.54 | 82.6 | 96.8 |
| Alloy 108 | 1100 | 1 | 6 Pass | 48.97 | 9.17 | 81.3 | 81.3 |
| | | 2 | 4 Pass | 9.17 | 1.46 | 84.1 | 97.0 |
| Alloy 109 | 1100 | 1 | 6 Pass | 49.03 | 9.17 | 81.3 | 81.3 |
| | | 2 | 4 Pass | 9.17 | 1.71 | 81.4 | 96.5 |
| Alloy 110 | 1100 | 1 | 6 Pass | 49.29 | 9.07 | 81.6 | 81.6 |
| | | 2 | 4 Pass | 9.07 | 1.51 | 83.3 | 96.9 |
| Alloy 111 | 1100 | 1 | 6 Pass | 49.25 | 9.38 | 81.0 | 81.0 |
| | | 2 | 4 Pass | 9.38 | 1.60 | 83.0 | 96.8 |
| Alloy 112 | 1100 | 1 | 6 Pass | 48.95 | 9.03 | 81.6 | 81.6 |
| | | 2 | 4 Pass | 9.03 | 1.67 | 81.5 | 96.6 |
| Alloy 113 | 1100 | 1 | 6 Pass | 49.38 | 9.12 | 81.5 | 81.5 |
| | | 2 | 4 Pass | 9.12 | 1.64 | 82.0 | 96.7 |
| Alloy 114 | 1100 | 1 | 6 Pass | 48.72 | 9.13 | 81.3 | 81.3 |
| | | 2 | 4 Pass | 9.13 | 1.29 | 85.9 | 97.4 |
| Alloy 115 | 1100 | 1 | 6 Pass | 48.88 | 9.07 | 81.5 | 81.5 |
| | | 2 | 4 Pass | 9.07 | 1.24 | 86.3 | 97.5 |
| Alloy 116 | 1100 | 1 | 6 Pass | 48.90 | 8.89 | 81.8 | 81.8 |
| | | 2 | 4 Pass | 8.89 | 1.43 | 83.9 | 97.1 |
| Alloy 117 | 1100 | 1 | 6 Pass | 48.98 | 8.95 | 81.7 | 81.7 |
| | | 2 | 4 Pass | 8.95 | 1.39 | 84.5 | 97.2 |
| Alloy 118 | 1100 | 1 | 6 Pass | 49.02 | 8.99 | 81.7 | 81.7 |
| | | 2 | 4 Pass | 8.99 | 1.63 | 81.8 | 96.7 |
| Alloy 119 | 1100 | 1 | 6 Pass | 48.80 | 8.89 | 81.8 | 81.8 |
| | | 2 | 4 Pass | 8.89 | 1.58 | 82.2 | 96.8 |
| Alloy 120 | 1100 | 1 | 6 Pass | 48.62 | 9.07 | 81.3 | 81.3 |
| | | 2 | 4 Pass | 9.07 | 1.54 | 83.1 | 96.8 |
| Alloy 121 | 1100 | 1 | 6 Pass | 48.60 | 9.33 | 80.8 | 80.8 |
| | | 2 | 4 Pass | 9.33 | 1.61 | 82.7 | 96.7 |
| Alloy 122 | 1100 | 1 | 6 Pass | 48.61 | 9.29 | 80.9 | 80.9 |
| | | 2 | 4 Pass | 9.29 | 1.68 | 81.9 | 96.5 |
| Alloy 123 | 1100 | 1 | 6 Pass | 48.79 | 9.29 | 81.0 | 81.0 |
| | | 2 | 4 Pass | 9.29 | 1.61 | 82.6 | 96.7 |
| Alloy 124 | 1100 | 1 | 6 Pass | 48.63 | 9.46 | 80.5 | 80.5 |
| | | 2 | 4 Pass | 9.46 | 1.63 | 82.8 | 96.7 |
| Alloy 125 | 1100 | 1 | 6 Pass | 48.74 | 9.54 | 80.4 | 80.4 |
| | | 2 | 4 Pass | 9.54 | 1.63 | 82.9 | 96.7 |
| Alloy 126 | 1075 | 1 | 6 Pass | 48.79 | 9.43 | 80.7 | 80.7 |
| | | 2 | 4 Pass | 9.43 | 2.09 | 77.8 | 95.7 |
| Alloy 127 | 1100 | 1 | 6 Pass | 48.81 | 9.44 | 80.7 | 80.7 |
| | | 2 | 4 Pass | 9.44 | 1.96 | 79.2 | 96.0 |
| Alloy 128 | 1100 | 1 | 6 Pass | 49.01 | 9.53 | 80.6 | 80.6 |
| | | 2 | 4 Pass | 9.53 | 1.92 | 79.9 | 96.1 |
| Alloy 129 | 1075 | 1 | 6 Pass | 48.97 | 9.53 | 80.5 | 80.5 |
| | | 2 | 4 Pass | 9.53 | 2.07 | 78.2 | 95.8 |
| Alloy 130 | 1100 | 1 | 6 Pass | 48.99 | 9.17 | 81.3 | 81.3 |
| | | 2 | 4 Pass | 9.17 | 2.03 | 77.8 | 95.8 |
| | 1100 | 1 | 6 Pass | 48.92 | 9.37 | 80.9 | 80.9 |
| | | 2 | 3 Pass | 9.37 | 2.00 | 78.7 | 95.9 |
| Alloy 131 | 1100 | 1 | 6 Pass | 48.96 | 9.26 | 81.1 | 81.1 |
| | | 2 | 4 Pass | 9.26 | 1.96 | 78.8 | 96.0 |
| Alloy 132 | 1075 | 1 | 6 Pass | 48.92 | 9.25 | 81.1 | 81.1 |
| | | 2 | 4 Pass | 9.25 | 1.89 | 79.6 | 96.1 |
| Alloy 133 | 1100 | 1 | 6 Pass | 48.99 | 9.44 | 80.7 | 80.7 |
| | | 2 | 3 Pass | 9.44 | 1.95 | 79.3 | 96.0 |
| Alloy 134 | 1100 | 1 | 6 Pass | 49.05 | 9.38 | 80.9 | 80.9 |
| | | 2 | 3 Pass | 9.38 | | | |
| Alloy 135 | 1100 | 1 | 6 Pass | 48.92 | 9.39 | 80.8 | 80.8 |
| | | 2 | 3 Pass | 9.39 | 2.13 | 77.3 | 95.7 |
| Alloy 136 | 1100 | 1 | 6 Pass | 49.22 | 9.39 | 80.9 | 80.9 |
| | | 2 | 3 Pass | 9.39 | 2.02 | 78.4 | 95.9 |
| Alloy 137 | 1075 | 1 | 6 Pass | 49.11 | 9.46 | 80.7 | 80.7 |
| | | 2 | 3 Pass | 9.46 | | | |
| Alloy 138 | 1075 | 1 | 6 Pass | 49.07 | | | |
| | | 2 | 3 Pass | | | | |
| Alloy 139 | 1075 | 1 | 6 Pass | 48.80 | | | |
| | | 2 | 3 Pass | | | | |

TABLE 6-continued

| Hot Rolling Parameters | | | | | | | |
|---|---|---|---|---|---|---|---|
| Alloy | Initial Rolling Temperature (° C.) | Campaign | Number of Passes | Initial Thickness (mm) | Final Thickness (mm) | Campaign Reduction (%) | Cumulative Reduction (%) |
| Alloy 140 | 1075 | 1 | 6 Pass | 49.08 | | | |
| | | 2 | 3 Pass | | | | |
| Alloy 141 | 1275 | 1 | 6 Pass | 49.30 | 9.15 | 81.5 | 81.5 |
| | | 2 | 3 Pass | 9.15 | 1.69 | 81.5 | 96.6 |
| Alloy 142 | 1275 | 1 | 6 Pass | 48.82 | 9.19 | 81.2 | 81.2 |
| | | 2 | 3 Pass | 9.19 | 1.83 | 80.1 | 96.3 |
| Alloy 143 | 1275 | 1 | 6 Pass | 49.07 | 8.90 | 81.9 | 81.9 |
| | | 2 | 3 Pass | 8.90 | 1.82 | 79.6 | 96.3 |
| Alloy 144 | 1275 | 1 | 6 Pass | 48.79 | 9.02 | 81.5 | 81.5 |
| | | 2 | 3 Pass | 9.02 | | | |
| Alloy 145 | 1275 | 1 | 6 Pass | 48.86 | 9.22 | 81.1 | 81.1 |
| | | 2 | 3 Pass | 9.22 | | | |
| Alloy 146 | 1275 | 1 | 6 Pass | 48.90 | | | |
| | | 2 | 3 Pass | | | | |
| Alloy 147 | | | | | | | |
| Alloy 148 | | | | | | | |
| Alloy 149 | | | | | | | |
| Alloy 150 | | | | | | | |
| Alloy 151 | | | | | | | |
| Alloy 152 | | | | | | | |
| Alloy 153 | | | | | | | |
| Alloy 154 | 1100 | 1 | 7 Pass | 49.14 | 6.30 | 87.2 | 87.2 |
| | | 2 | 3 Pass | 6.30 | 1.77 | 72.0 | 96.4 |
| Alloy 155 | 1150 | 1 | 7 Pass | 48.51 | 7.20 | 85.2 | 85.2 |
| | | 2 | 3 Pass | 7.25 | 1.89 | 73.9 | 96.1 |
| Alloy 156 | 1100 | 1 | 6 Pass | 49.02 | 9.37 | 80.9 | 80.9 |
| | | 2 | 4 Pass | 9.37 | 1.68 | 82.1 | 96.6 |

The density of the alloys was measured on-sections of cast material that had been hot rolled to between 6 mm and 9.5 mm. Sections were cut to 25 mm×25 mm dimensions, and then surface ground to remove oxide from the hot rolling process. Measurements of bulk density were taken from these ground samples, using the Archimedes method in a specially constructed balance allowing weighing in both air and distilled water. The density of each Alloy is tabulated in Table 7 and was found to vary from 7.40 g/cm$^3$ to 7.90 g/cm$^3$. Experimental results have revealed that the accuracy of this technique is ±0.01 g/cm$^3$.

TABLE 7

| Average Alloy Densities | |
|---|---|
| Alloy | Density [g/cm$^3$] |
| Alloy 1 | 7.40 |
| Alloy 2 | 7.75 |
| Alloy 3 | 7.87 |
| Alloy 4 | 7.80 |
| Alloy 5 | 7.74 |
| Alloy 6 | 7.87 |
| Alloy 7 | 7.81 |
| Alloy 8 | 7.75 |
| Alloy 9 | 7.87 |
| Alloy 10 | 7.81 |
| Alloy 11 | 7.75 |
| Alloy 12 | 7.85 |
| Alloy 13 | 7.79 |
| Alloy 14 | 7.75 |
| Alloy 15 | 7.86 |
| Alloy 16 | 7.77 |
| Alloy 17 | 7.77 |
| Alloy 18 | 7.84 |
| Alloy 19 | 7.79 |
| Alloy 20 | 7.67 |
| Alloy 21 | 7.84 |

TABLE 7-continued

| Average Alloy Densities | |
|---|---|
| Alloy | Density [g/cm$^3$] |
| Alloy 22 | 7.80 |
| Alloy 23 | 7.75 |
| Alloy 24 | 7.86 |
| Alloy 25 | 7.79 |
| Alloy 26 | 7.75 |
| Alloy 27 | 7.86 |
| Alloy 28 | 7.81 |
| Alloy 29 | 7.75 |
| Alloy 30 | 7.74 |
| Alloy 31 | 7.73 |
| Alloy 32 | 7.75 |
| Alloy 33 | 7.74 |
| Alloy 34 | 7.73 |
| Alloy 35 | 7.78 |
| Alloy 36 | 7.77 |
| Alloy 37 | 7.75 |
| Alloy 38 | 7.71 |
| Alloy 39 | 7.70 |
| Alloy 40 | 7.70 |
| Alloy 41 | 7.74 |
| Alloy 42 | 7.65 |
| Alloy 43 | 7.73 |
| Alloy 44 | 7.74 |
| Alloy 45 | 7.76 |
| Alloy 46 | 7.74 |
| Alloy 47 | 7.75 |
| Alloy 48 | 7.74 |
| Alloy 49 | 7.76 |
| Alloy 50 | 7.74 |
| Alloy 51 | 7.74 |
| Alloy 52 | 7.73 |
| Alloy 53 | 7.72 |
| Alloy 54 | 7.75 |
| Alloy 55 | 7.74 |
| Alloy 56 | 7.74 |

TABLE 7-continued

| Average Alloy Densities | |
|---|---|
| Alloy | Density [g/cm$^3$] |
| Alloy 57 | 7.73 |
| Alloy 58 | 7.74 |
| Alloy 59 | 7.70 |
| Alloy 60 | 7.76 |
| Alloy 61 | 7.74 |
| Alloy 62 | 7.72 |
| Alloy 63 | 7.76 |
| Alloy 64 | 7.75 |
| Alloy 65 | 7.72 |
| Alloy 66 | 7.77 |
| Alloy 67 | 7.75 |
| Alloy 68 | 7.73 |
| Alloy 69 | 7.76 |
| Alloy 70 | 7.74 |
| Alloy 71 | 7.72 |
| Alloy 72 | 7.76 |
| Alloy 73 | 7.74 |
| Alloy 74 | 7.72 |
| Alloy 75 | 7.76 |
| Alloy 76 | 7.75 |
| Alloy 77 | 7.73 |
| Alloy 78 | 7.72 |
| Alloy 79 | 7.73 |
| Alloy 80 | 7.74 |
| Alloy 81 | 7.74 |
| Alloy 82 | 7.74 |
| Alloy 83 | 7.75 |
| Alloy 84 | 7.71 |
| Alloy 85 | 7.71 |
| Alloy 86 | 7.71 |
| Alloy 87 | 7.72 |
| Alloy 88 | 7.72 |
| Alloy 89 | 7.73 |
| Alloy 90 | 7.73 |
| Alloy 91 | 7.74 |
| Alloy 92 | 7.75 |
| Alloy 93 | 7.74 |
| Alloy 94 | 7.75 |
| Alloy 95 | 7.75 |
| Alloy 96 | 7.67 |
| Alloy 97 | 7.59 |
| Alloy 98 | 7.63 |
| Alloy 99 | 7.55 |
| Alloy 100 | 7.78 |
| Alloy 101 | 7.88 |
| Alloy 102 | 7.75 |
| Alloy 103 | 7.80 |
| Alloy 104 | 7.83 |
| Alloy 105 | 7.90 |
| Alloy 106 | 7.89 |
| Alloy 107 | 7.81 |
| Alloy 108 | 7.76 |
| Alloy 109 | 7.64 |
| Alloy 110 | 7.76 |
| Alloy 111 | 7.64 |
| Alloy 112 | 7.76 |
| Alloy 113 | 7.65 |
| Alloy 141 | 7.78 |
| Alloy 142 | 7.72 |
| Alloy 143 | 7.66 |
| Alloy 144 | 7.76 |
| Alloy 145 | 7.70 |
| Alloy 154 | 7.81 |
| Alloy 155 | 7.68 |
| Alloy 156 | 7.73 |

The fully hot-rolled sheets from selected alloys were then subjected to further cold rolling in multiple passes. Rolling was done on a Fenn Model 061 single stage rolling mill. A list of specific cold rolling parameters used for the alloys is shown in Table 8. An example of the cold rolled sheet from Alloy 59 is shown in FIG. 8.

TABLE 8

| Cold Rolling Parameters | | | | |
|---|---|---|---|---|
| Alloy | Number of Passes | Initial Thickness (mm) | Final Thickness (mm) | Reduction (%) |
| Alloy 6 | 4 | 1.62 | 1.20 | 25.7 |
| Alloy 8 | 4 | 1.59 | 1.21 | 23.8 |
| Alloy 29 | 4 | 1.59 | 1.19 | 25.7 |
| Alloy 30 | 3 | 1.63 | 1.22 | 24.9 |
| Alloy 31 | 6 | 1.75 | 1.19 | 32.2 |
| Alloy 32 | 6 | 1.66 | 1.21 | 27.2 |
| Alloy 33 | 6 | 1.71 | 1.21 | 29.6 |
| Alloy 34 | 7 | 1.74 | 1.21 | 30.5 |
| Alloy 35 | 4 | 1.62 | 1.20 | 25.6 |
| Alloy 36 | 10 | 1.76 | 1.21 | 31.1 |
| Alloy 37 | 7 | 1.71 | 1.21 | 29.3 |
| Alloy 38 | 6 | 1.64 | 1.21 | 26.0 |
| Alloy 39 | 6 | 1.68 | 1.21 | 27.9 |
| Alloy 40 | 8 | 1.78 | 1.22 | 31.7 |
| Alloy 41 | 6 | 1.74 | 1.20 | 30.8 |
| Alloy 42 | 4 | 1.63 | 1.20 | 26.6 |
| Alloy 43 | 4 | 1.59 | 1.19 | 25.3 |
| | 5 | 1.64 | 1.19 | 27.3 |
| Alloy 44 | 5 | 1.68 | 1.20 | 28.5 |
| | 6 | 1.65 | 1.20 | 27.7 |
| | 5 | 1.59 | 1.19 | 25.2 |
| Alloy 45 | 5 | 1.64 | 1.19 | 27.2 |
| Alloy 46 | 6 | 1.64 | 1.20 | 27.1 |
| Alloy 47 | 5 | 1.60 | 1.19 | 25.1 |
| Alloy 48 | 4 | 1.62 | 1.19 | 26.6 |
| Alloy 49 | 6 | 1.64 | 1.19 | 27.2 |
| Alloy 50 | 5 | 1.61 | 1.20 | 25.2 |
| Alloy 51 | 5 | 1.64 | 1.19 | 27.5 |
| Alloy 52 | 4 | 1.61 | 1.19 | 26.4 |
| Alloy 53 | 4 | 1.62 | 1.19 | 26.5 |
| Alloy 54 | 5 | 1.70 | 1.21 | 28.9 |
| Alloy 55 | 5 | 1.67 | 1.19 | 28.4 |
| Alloy 56 | 4 | 1.62 | 1.17 | 27.6 |
| Alloy 57 | 3 | 1.62 | 1.20 | 26.0 |
| Alloy 58 | 4 | 1.62 | 1.19 | 26.5 |
| Alloy 59 | 4 | 1.61 | 1.19 | 26.1 |
| Alloy 60 | 5 | 1.59 | 1.20 | 24.4 |
| Alloy 61 | 5 | 1.68 | 1.19 | 29.4 |
| Alloy 62 | 6 | 1.68 | 1.19 | 29.2 |
| Alloy 63 | 5 | 1.58 | 1.21 | 23.2 |
| Alloy 64 | 7 | 1.70 | 1.21 | 28.8 |
| Alloy 66 | 4 | 1.54 | 1.21 | 21.6 |
| Alloy 67 | 5 | 1.63 | 1.22 | 25.2 |
| Alloy 65 | 4 | 1.58 | 1.20 | 24.1 |
| Alloy 68 | 6 | 1.65 | 1.19 | 27.7 |
| Alloy 69 | 4 | 1.59 | 1.20 | 24.1 |
| Alloy 70 | 4 | 1.57 | 1.19 | 23.8 |
| Alloy 71 | 3 | 1.46 | 1.16 | 20.5 |
| Alloy 72 | 4 | 1.59 | 1.20 | 24.7 |
| Alloy 73 | 5 | 1.60 | 1.20 | 25.0 |
| Alloy 75 | 3 | 1.55 | 1.21 | 22.2 |
| Alloy 74 | 4 | 1.57 | 1.18 | 25.2 |
| Alloy 76 | 5 | 1.68 | 1.22 | 27.3 |
| Alloy 77 | 6 | 1.72 | 1.22 | 29.1 |
| Alloy 78 | 8 | 1.57 | 1.10 | 29.7 |
| Alloy 79 | 6 | 1.52 | 1.10 | 27.9 |
| Alloy 80 | 6 | 1.57 | 1.16 | 26.2 |
| Alloy 81 | 4 | 1.64 | 1.22 | 25.7 |
| Alloy 82 | 8 | 1.60 | 1.15 | 28.4 |
| Alloy 83 | 3 | 1.55 | 1.22 | 21.8 |
| Alloy 84 | 5 | 1.61 | 1.19 | 25.7 |
| Alloy 85 | 4 | 1.60 | 1.20 | 25.0 |
| Alloy 86 | 3 | 1.52 | 1.21 | 20.5 |
| Alloy 87 | 5 | 1.54 | 1.20 | 21.8 |
| Alloy 88 | 4 | 1.57 | 1.21 | 22.7 |
| Alloy 89 | 5 | 1.55 | 1.20 | 22.9 |
| Alloy 90 | 2 | 1.50 | 1.17 | 21.7 |
| Alloy 91 | 4 | 1.71 | 1.20 | 29.7 |
| Alloy 92 | 3 | 1.53 | 1.18 | 23.1 |
| Alloy 93 | 3 | 1.53 | 1.18 | 23.1 |
| Alloy 94 | 3 | 1.60 | 1.21 | 24.2 |
| Alloy 95 | 4 | 1.67 | 1.21 | 27.6 |
| Alloy 96 | 9 | 1.82 | 1.21 | 33.7 |
| Alloy 97 | 5 | 1.68 | 1.19 | 29.3 |

TABLE 8-continued

| Cold Rolling Parameters | | | | |
|---|---|---|---|---|
| Alloy | Number of Passes | Initial Thickness (mm) | Final Thickness (mm) | Reduction (%) |
| | 14 | 1.92 | 1.19 | 38.0 |
| Alloy 98 | 10 | 1.79 | 1.21 | 32.3 |
| Alloy 99 | 13 | 2.00 | 1.48 | 25.9 |
| Alloy 100 | 5 | 1.66 | 1.21 | 26.8 |
| Alloy 101 | 2 | 1.59 | 1.20 | 24.6 |
| Alloy 102 | 3 | 1.61 | 1.20 | 25.5 |
| Alloy 103 | 7 | 1.58 | 1.21 | 23.7 |
| Alloy 104 | 2 | 1.42 | 1.15 | 18.7 |
| Alloy 105 | 2 | 1.42 | 1.16 | 18.3 |
| Alloy 106 | 2 | 1.43 | 1.19 | 17.1 |
| Alloy 107 | 3 | 1.51 | 1.20 | 20.3 |
| Alloy 108 | 3 | 1.47 | 1.15 | 21.6 |
| Alloy 109 | 7 | 1.68 | 1.20 | 28.2 |
| Alloy 110 | 3 | 1.50 | 1.21 | 19.4 |
| Alloy 111 | 7 | 1.58 | 1.20 | 23.9 |
| Alloy 112 | 15 | 1.68 | 1.21 | 27.7 |
| Alloy 113 | 14 | 1.68 | 1.22 | 27.6 |
| Alloy 114 | 4 | 1.40 | 1.12 | 20.2 |
| Alloy 115 | 2 | 1.36 | 1.11 | 18.5 |
| Alloy 116 | 2 | 1.49 | 1.19 | 20.4 |
| Alloy 117 | 3 | 1.51 | 1.17 | 22.5 |
| Alloy 118 | 3 | 1.61 | 1.20 | 25.3 |
| Alloy 119 | 3 | 1.60 | 1.19 | 25.2 |
| Alloy 120 | 3 | 1.53 | 1.17 | 23.3 |
| Alloy 121 | 4 | 1.60 | 1.19 | 25.4 |
| Alloy 122 | 5 | 1.68 | 1.20 | 28.5 |
| Alloy 123 | 17 | 1.76 | 1.26 | 28.6 |
| Alloy 134 | 7 | 1.63 | 1.21 | 25.8 |
| Alloy 125 | 11 | 1.62 | 1.22 | 24.9 |
| Alloy 126 | 6 | 2.10 | 1.36 | 35.1 |
| Alloy 127 | — | 2.12 | 1.47 | 30.7 |
| Alloy 128 | 6 | 2.00 | 1.34 | 33.2 |
| Alloy 129 | 8 | 1.92 | 1.21 | 36.8 |
| Alloy 130 | 7 | 2.13 | 1.37 | 35.5 |
| Alloy 131 | 5 | 2.02 | 1.40 | 30.6 |
| Alloy 132 | 9 | 1.99 | 1.21 | 39.2 |
| Alloy 133 | 9 | 2.01 | 1.22 | 39.3 |
| Alloy 134 | 4 | 1.76 | 1.18 | 33.1 |
| Alloy 135 | 5 | 1.82 | 1.18 | 35.1 |
| Alloy 136 | 7 | 1.87 | 1.20 | 35.8 |
| Alloy 137 | 4 | 1.71 | 1.15 | 33.7 |
| Alloy 138 | 5 | 1.75 | 1.16 | 33.9 |
| Alloy 139 | | | | |
| Alloy 140 | 9 | 2.01 | 1.22 | 39.3 |
| Alloy 141 | 4 | 1.76 | 1.18 | 33.1 |
| Alloy 142 | 5 | 1.82 | 1.18 | 35.1 |
| Alloy 143 | 7 | 1.87 | 1.20 | 35.8 |
| Alloy 144 | 4 | 1.71 | 1.15 | 33.7 |
| Alloy 145 | 5 | 1.75 | 1.16 | 33.9 |
| Alloy 146 | | | | |
| Alloy 147 | | | | |
| Alloy 148 | | | | |
| Alloy 149 | | | | |
| Alloy 150 | | | | |
| Alloy 151 | | | | |
| Alloy 152 | | | | |
| Alloy 153 | | | | |
| Alloy 154 | 5 | 1.77 | 1.30 | 26.6 |
| Alloy 155 | 5 | 1.89 | 1.27 | 32.9 |
| Alloy 156 | 5 | 1.68 | 1.20 | 28.7 |

After hot and cold rolling, tensile specimens and SEM samples were cut via EDM. The resultant samples were heat treated at the parameters specified in Table 9. Heat treatments were conducted in a Lucifer 7GT-K12 sealed box furnace under an argon gas purge, or in a ThermCraft XSL-3-0-24-1C tube furnace. In the case of air cooling, the specimens were held at the target temperature for a target period of time, removed from the furnace and cooled down in air. In cases of controlled cooling, the furnace temperature was lowered at a specified rate with samples loaded.

TABLE 9

| Heat Treatment Parameters | | | | |
|---|---|---|---|---|
| Heat Treatment | Furnace Temperature [° C.] | Dwell Time [min] | Atmosphere | Cooling |
| HT1 | 850 | 360 | Argon Flow | 0.75° C./min to <500° C. |
| HT2 | 950 | 360 | Argon Flow | Air Normalized |
| HT3 | 1150 | 120 | Vacuum | Air Normalized |
| HT4 | 1125 | 120 | Vacuum | Air Normalized |
| HT5 | 1100 | 120 | Vacuum | Air Normalized |
| HT6 | 1075 | 120 | Vacuum | Air Normalized |
| HT7 | 950 | 360 | Argon Flow | 0.75° C./min to <500° C. |
| HT8 | 850 | 5 | Argon Flow | Air Normalized |
| HT9 | 1050 | 120 | Vacuum | Air Normalized |
| HT10 | 1025 | 120 | Vacuum | Air Normalized |
| HT11 | 850 | 360 | Hydrogen | Fast Furnace Control |
| HT12 | 950 | 360 | Hydrogen | Fast Furnace Control |
| HT13 | 1100 | 120 | Hydrogen | Fast Furnace Control |
| HT14 | 1075 | 120 | Hydrogen | Fast Furnace Control |
| HT15 | 1200 | 120 | Hydrogen | Fast Furnace Control |

Tensile specimens were tested in the hot rolled, cold rolled, and heat treated conditions. Tensile properties were measured on an Instron mechanical testing frame (Model 3369), utilizing Instron's Bluehill control and analysis software. All tests were run at room temperature in displacement control with the bottom fixture held rigid and the top fixture moving; the load cell is attached to the top fixture.

Tensile properties of the alloys in the as hot rolled condition are listed in Table 10. The ultimate tensile strength values may vary from 786 to 1524 MPa with tensile elongation from 17.4 to 63.4%. The yield stress is in a range from 142 to 812 MPa. Mechanical properties of the steel alloys herein depend on alloy chemistry, processing conditions, and material mechanistic response to the processing conditions.

TABLE 10

| Tensile Properties of Selected After Hot Rolling | | | |
|---|---|---|---|
| Alloy | Yield Stress (MPa) | Ultimate Strength (MPa) | Tensile Elongation (%) |
| Alloy 1 | 566 | 1035 | 53.8 |
| | 566 | 1006 | 49.1 |
| Alloy 2 | 571 | 1150 | 54.8 |
| | 532 | 1163 | 55.0 |
| | 622 | 1170 | 49.6 |
| Alloy 3 | 550 | 938 | 46.1 |
| | 545 | 946 | 42.8 |
| | 567 | 955 | 39.6 |
| Alloy 4 | 583 | 1001 | 41.6 |
| | 554 | 990 | 49.9 |
| | 571 | 988 | 43.7 |
| Alloy 5 | 569 | 1072 | 54.1 |
| | 585 | 1072 | 51.3 |
| | 562 | 1085 | 53.0 |
| Alloy 6 | 551 | 976 | 55.7 |
| | 558 | 971 | 53.9 |
| | 551 | 965 | 50.0 |
| Alloy 7 | 559 | 1046 | 55.8 |
| | 560 | 1059 | 57.8 |
| | 543 | 1055 | 56.7 |
| Alloy 8 | 546 | 1154 | 56.8 |
| | 552 | 1149 | 53.5 |
| | 567 | 1157 | 57.3 |
| Alloy 9 | 347 | 969 | 49.5 |
| | 265 | 967 | 54.9 |
| | 318 | 963 | 53.6 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 10 | 545 | 1029 | 59.0 |
| | 548 | 1018 | 56.9 |
| | 551 | 1014 | 57.7 |
| Alloy 11 | 564 | 1075 | 56.1 |
| | 563 | 1074 | 56.8 |
| Alloy 12 | 591 | 973 | 43.5 |
| | 571 | 976 | 45.5 |
| | 558 | 972 | 46.9 |
| Alloy 13 | 578 | 1034 | 48.5 |
| | 575 | 1031 | 48.4 |
| | 555 | 1023 | 45.8 |
| Alloy 14 | 613 | 1118 | 51.5 |
| | 591 | 1125 | 56.0 |
| | 615 | 1104 | 52.9 |
| Alloy 15 | 586 | 969 | 43.9 |
| | 596 | 976 | 45.4 |
| | 561 | 972 | 44.8 |
| Alloy 16 | 593 | 993 | 44.9 |
| | 613 | 1040 | 37.1 |
| | 619 | 1000 | 38.3 |
| Alloy 17 | 568 | 1087 | 45.6 |
| | 573 | 1081 | 44.9 |
| Alloy 18 | 515 | 1059 | 53.2 |
| | 524 | 1027 | 53.2 |
| | 521 | 1026 | 50.4 |
| Alloy 19 | 549 | 1091 | 52.8 |
| | 553 | 1105 | 53.7 |
| | 579 | 1100 | 52.3 |
| Alloy 20 | 584 | 1170 | 49.0 |
| | 600 | 1148 | 46.4 |
| | 605 | 1164 | 48.7 |
| Alloy 21 | 564 | 1031 | 56.2 |
| | 547 | 1033 | 54.7 |
| | 527 | 1008 | 46.7 |
| Alloy 22 | 552 | 1079 | 50.9 |
| | 530 | 1109 | 59.9 |
| | 534 | 1082 | 58.5 |
| Alloy 23 | 514 | 1157 | 51.8 |
| | 549 | 1148 | 48.3 |
| | 542 | 1146 | 48.8 |
| Alloy 24 | 532 | 1041 | 51.2 |
| | 543 | 1035 | 51.4 |
| | 537 | 1050 | 52.6 |
| Alloy 25 | 543 | 1088 | 45.7 |
| | 540 | 1130 | 54.7 |
| | 545 | 1123 | 52.9 |
| Alloy 26 | 559 | 1228 | 47.9 |
| | 563 | 1238 | 47.6 |
| | 564 | 1243 | 49.3 |
| Alloy 27 | 516 | 1127 | 54.0 |
| | 566 | 1115 | 52.1 |
| | 566 | 1113 | 52.8 |
| Alloy 28 | 583 | 1141 | 57.5 |
| | 583 | 1156 | 49.8 |
| | 563 | 1144 | 54.7 |
| Alloy 29 | 530 | 1201 | 47.8 |
| | 519 | 1232 | 53.2 |
| | 530 | 1221 | 52.2 |
| Alloy 30 | 419 | 1349 | 39.8 |
| | 447 | 1303 | 43.6 |
| | 439 | 1308 | 41.3 |
| Alloy 31 | 669 | 1143 | 50.9 |
| | 629 | 1167 | 52.4 |
| Alloy 32 | 467 | 1264 | 41.9 |
| | 457 | 1270 | 40.6 |
| | 453 | 1296 | 42.1 |
| Alloy 33 | 589 | 1186 | 42.0 |
| | 566 | 1158 | 38.5 |
| | 586 | 1217 | 37.0 |
| Alloy 34 | 627 | 1122 | 47.7 |
| | 612 | 1144 | 43.7 |
| | 632 | 1121 | 45.3 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 35 | 464 | 1259 | 46.0 |
| | 431 | 1217 | 38.0 |
| | 461 | 1204 | 35.6 |
| Alloy 36 | 571 | 1187 | 41.1 |
| | 592 | 1176 | 44.7 |
| | 583 | 1190 | 49.1 |
| Alloy 37 | 586 | 1057 | 46.7 |
| | 605 | 1075 | 53.2 |
| | 600 | 1083 | 48.2 |
| Alloy 38 | 454 | 1288 | 39.2 |
| | 436 | 1316 | 40.8 |
| | 459 | 1283 | 34.8 |
| Alloy 39 | 533 | 1244 | 43.1 |
| | 512 | 1263 | 46.6 |
| | 517 | 1186 | 39.4 |
| Alloy 40 | 638 | 1153 | 49.4 |
| | 623 | 1155 | 43.0 |
| | 641 | 1159 | 45.9 |
| Alloy 41 | 557 | 1245 | 45.3 |
| | 568 | 1182 | 45.6 |
| | 728 | 1229 | 47.3 |
| | 590 | 1233 | 45.7 |
| Alloy 42 | 528 | 1228 | 46.7 |
| | 506 | 1233 | 45.2 |
| | 542 | 1221 | 41.7 |
| Alloy 43 | 550 | 1201 | 52.9 |
| | 532 | 1185 | 48.6 |
| | 575 | 1186 | 52.9 |
| Alloy 44 | 480 | 1236 | 45.3 |
| | 454 | 1277 | 41.9 |
| | 459 | 1219 | 48.2 |
| | 453 | 1219 | 40.3 |
| | 460 | 1218 | 42.6 |
| | 467 | 1213 | 45.7 |
| | 468 | 1280 | 41.8 |
| | 468 | 1272 | 37.2 |
| | 466 | 1251 | 36.0 |
| | 457 | 1238 | 43.0 |
| | 447 | 1262 | 37.0 |
| | 467 | 1220 | 41.2 |
| Alloy 45 | 367 | 1286 | 28.6 |
| | 361 | 1316 | 24.8 |
| | 370 | 1294 | 26.8 |
| Alloy 46 | 377 | 1269 | 34.2 |
| | 354 | 1264 | 33.1 |
| | 369 | 1304 | 34.2 |
| Alloy 47 | 410 | 1301 | 35.9 |
| | 358 | 1276 | 31.9 |
| | 391 | 1279 | 35.0 |
| Alloy 48 | 369 | 1232 | 29.7 |
| | 389 | 1309 | 34.0 |
| | 379 | 1250 | 31.1 |
| Alloy 49 | 455 | 1325 | 36.2 |
| | 428 | 1314 | 29.9 |
| | 441 | 1277 | 29.9 |
| Alloy 50 | 388 | 1354 | 34.2 |
| | 389 | 1342 | 32.3 |
| Alloy 51 | 426 | 1253 | 38.0 |
| | 436 | 1286 | 39.2 |
| | 427 | 1258 | 40.6 |
| Alloy 52 | 407 | 1225 | 43.7 |
| | 419 | 1246 | 47.4 |
| | 448 | 1224 | 49.6 |
| Alloy 53 | 482 | 1129 | 55.6 |
| | 435 | 1124 | 47.7 |
| | 429 | 1141 | 49.8 |
| Alloy 54 | 430 | 1180 | 30.0 |
| | 441 | 1283 | 36.0 |
| | 424 | 1281 | 33.6 |
| Alloy 55 | 459 | 1265 | 38.2 |
| | 443 | 1293 | 41.7 |
| | 423 | 1266 | 35.7 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 56 | 444 | 1246 | 46.0 |
| | 469 | 1225 | 46.5 |
| | 461 | 1215 | 51.2 |
| Alloy 57 | 462 | 1181 | 52.4 |
| | 427 | 1230 | 48.3 |
| | 460 | 1185 | 51.1 |
| Alloy 58 | 388 | 1276 | 40.3 |
| | 383 | 1281 | 39.3 |
| | 418 | 1270 | 34.6 |
| Alloy 59 | 457 | 1209 | 49.2 |
| | 452 | 1183 | 44.9 |
| Alloy 60 | 339 | 1150 | 23.6 |
| | 356 | 1314 | 32.9 |
| | 356 | 1309 | 36.1 |
| Alloy 61 | 420 | 1224 | 33.7 |
| | 390 | 1187 | 31.2 |
| | 376 | 1231 | 30.9 |
| Alloy 62 | 396 | 1196 | 37.1 |
| | 388 | 1200 | 39.2 |
| Alloy 63 | 396 | 1401 | 30.7 |
| | 385 | 1395 | 29.4 |
| | 418 | 1388 | 29.1 |
| Alloy 64 | 389 | 1261 | 29.0 |
| | 379 | 1302 | 29.0 |
| | 386 | 1294 | 32.0 |
| Alloy 65 | 390 | 1278 | 36.5 |
| | 439 | 1240 | 31.2 |
| | 433 | 1315 | 41.4 |
| Alloy 66 | 385 | 1317 | 23.4 |
| | 407 | 1293 | 23.2 |
| | 421 | 1360 | 26.7 |
| Alloy 67 | 430 | 1363 | 34.4 |
| | 431 | 1330 | 32.3 |
| | 403 | 1361 | 37.5 |
| Alloy 68 | 473 | 1256 | 31.2 |
| | 479 | 1271 | 35.0 |
| | 482 | 1304 | 33.3 |
| Alloy 69 | 446 | 1392 | 34.3 |
| | 422 | 1350 | 33.3 |
| | 379 | 1343 | 33.7 |
| Alloy 70 | 390 | 1304 | 41.0 |
| | 436 | 1301 | 40.6 |
| | 436 | 1293 | 37.6 |
| Alloy 71 | 424 | 1227 | 38.0 |
| | 401 | 1260 | 44.7 |
| | 441 | 1279 | 44.6 |
| Alloy 72 | 374 | 1281 | 24.7 |
| | 357 | 1259 | 22.9 |
| | 366 | 1294 | 25.9 |
| Alloy 73 | 370 | 1328 | 27.3 |
| | 401 | 1272 | 22.9 |
| | 400 | 1248 | 24.6 |
| Alloy 74 | 386 | 1091 | 20.5 |
| | 407 | 1263 | 31.0 |
| Alloy 75 | 377 | 1347 | 31.3 |
| | 371 | 1234 | 24.7 |
| | 357 | 1306 | 27.5 |
| Alloy 76 | 409 | 1296 | 32.5 |
| | 412 | 1288 | 33.3 |
| | 425 | 1288 | 34.7 |
| Alloy 77 | 381 | 1249 | 30.6 |
| | 394 | 1255 | 37.1 |
| | 383 | 1222 | 34.3 |
| Alloy 78 | 454 | 1192 | 39.6 |
| | 451 | 1219 | 42.6 |
| Alloy 79 | 457 | 1215 | 40.8 |
| Alloy 80 | 448 | 1224 | 33.2 |
| | 446 | 1228 | 38.1 |
| Alloy 81 | 415 | 1316 | 34.5 |
| | 430 | 1275 | 33.5 |
| Alloy 82 | 371 | 1311 | 26.6 |
| | 387 | 1313 | 28.1 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 83 | 406 | 1411 | 27.9 |
| | 420 | 1284 | 24.5 |
| | 426 | 1300 | 26.4 |
| Alloy 84 | 477 | 1233 | 34.3 |
| | 521 | 1238 | 37.8 |
| Alloy 85 | 472 | 1196 | 32.6 |
| | 467 | 1216 | 34.2 |
| Alloy 86 | 462 | 1207 | 28.8 |
| | 508 | 1170 | 27.7 |
| | 470 | 1206 | 32.7 |
| Alloy 87 | 455 | 1204 | 23.0 |
| | 478 | 1281 | 26.4 |
| | 436 | 1151 | 21.1 |
| Alloy 88 | 448 | 1206 | 25.9 |
| | 465 | 1208 | 25.0 |
| | 463 | 1233 | 27.6 |
| Alloy 89 | 451 | 1314 | 26.0 |
| | 436 | 1123 | 20.7 |
| Alloy 90 | 403 | 1162 | 49.9 |
| | 419 | 1178 | 47.9 |
| | 449 | 1163 | 48.2 |
| Alloy 91 | 439 | 1199 | 50.6 |
| | 515 | 1242 | 46.2 |
| Alloy 92 | 418 | 1209 | 36.1 |
| | 423 | 1228 | 40.1 |
| Alloy 93 | 436 | 1169 | 43.9 |
| | 474 | 1163 | 46.7 |
| | 414 | 1188 | 42.6 |
| Alloy 94 | 428 | 1229 | 43.5 |
| | 440 | 1208 | 37.9 |
| | 406 | 1249 | 37.2 |
| Alloy 95 | 426 | 1218 | 34.2 |
| | 438 | 1232 | 38.4 |
| Alloy 96 | 661 | 1113 | 29.0 |
| | 713 | 1108 | 34.8 |
| Alloy 97 | 477 | 1175 | 57.7 |
| | 468 | 1189 | 58.7 |
| | 567 | 1180 | 49.1 |
| Alloy 98 | 804 | 1176 | 22.7 |
| | 785 | 1184 | 23.9 |
| | 812 | 1196 | 28.1 |
| Alloy 99 | 716 | 1254 | 17.4 |
| | 746 | 1281 | 18.4 |
| Alloy 100 | 769 | 1051 | 28.0 |
| | 610 | 1060 | 27.1 |
| | 623 | 1063 | 32.0 |
| Alloy 101 | 537 | 786 | 24.7 |
| | 542 | 806 | 23.6 |
| | 545 | 801 | 21.5 |
| Alloy 102 | 343 | 1011 | 46.4 |
| | 360 | 1012 | 48.1 |
| | 366 | 1016 | 48.4 |
| Alloy 107 | 392 | 1140 | 19.6 |
| | 379 | 1119 | 18.5 |
| | 425 | 1086 | 18.4 |
| Alloy 108 | 381 | 1352 | 32.5 |
| | 351 | 1311 | 27.6 |
| | 401 | 1341 | 32.1 |
| Alloy 109 | 367 | 1279 | 27.4 |
| | 410 | 1305 | 32.3 |
| | 393 | 1300 | 29.8 |
| Alloy 110 | 409 | 1388 | 29.7 |
| | 400 | 1238 | 23.5 |
| | 377 | 1370 | 27.6 |
| Alloy 111 | 388 | 1336 | 29.1 |
| | 388 | 1347 | 30.2 |
| | 374 | 1325 | 28.6 |
| Alloy 112 | 366 | 1391 | 29.2 |
| | 349 | 1326 | 24.1 |
| | 355 | 1465 | 33.3 |
| Alloy 113 | 366 | 1311 | 23.6 |
| | 390 | 1272 | 22.9 |
| | 389 | 1333 | 25.2 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 114 | 379 | 1332 | 21.2 |
| | 358 | 1441 | 22.1 |
| | 363 | 1331 | 20.6 |
| Alloy 115 | 351 | 1400 | 26.2 |
| | 362 | 1304 | 22.6 |
| | 369 | 1256 | 22.4 |
| Alloy 116 | 413 | 1333 | 28.1 |
| | 378 | 1330 | 27.0 |
| Alloy 117 | 315 | 1301 | 20.3 |
| | 319 | 1293 | 19.9 |
| | 316 | 1391 | 22.2 |
| Alloy 118 | 318 | 1345 | 22.6 |
| | 328 | 1365 | 23.0 |
| Alloy 119 | 355 | 1339 | 26.5 |
| Alloy 120 | 349 | 1248 | 21.6 |
| | 327 | 1206 | 19.3 |
| | 352 | 1373 | 24.2 |
| Alloy 121 | 369 | 1401 | 33.3 |
| | 345 | 1357 | 26.8 |
| | 363 | 1351 | 27.0 |
| Alloy 122 | 371 | 1291 | 32.0 |
| | 383 | 1303 | 34.6 |
| | 367 | 1265 | 29.6 |
| Alloy 123 | 319 | 1400 | 19.7 |
| | 317 | 1524 | 22.1 |
| | 327 | 1382 | 20.2 |
| Alloy 124 | 347 | 1468 | 28.3 |
| | 345 | 1451 | 26.9 |
| | 325 | 1490 | 28.1 |
| Alloy 125 | 335 | 1121 | 19.4 |
| | 376 | 1421 | 27.5 |
| | 358 | 1426 | 30.7 |
| Alloy 126 | 431 | 1107 | 43.6 |
| | 411 | 1074 | 46.4 |
| Alloy 127 | 433 | 1155 | 50.1 |
| | 417 | 1187 | 58.3 |
| | 440 | 1149 | 49.6 |
| Alloy 128 | 436 | 1123 | 60.4 |
| | 417 | 1162 | 53.0 |
| | 426 | 1145 | 56.7 |
| Alloy 129 | 477 | 1111 | 57.7 |
| | 444 | 1141 | 56.7 |
| | 479 | 1131 | 56.1 |
| Alloy 130 | 413 | 1096 | 59.8 |
| | 450 | 1087 | 58.5 |
| | 445 | 1094 | 59.2 |
| Alloy 131 | 414 | 1086 | 62.7 |
| | 441 | 1062 | 63.4 |
| | 454 | 1057 | 59.8 |
| Alloy 132 | 457 | 999 | 47.7 |
| | 445 | 991 | 46.8 |
| | 402 | 1004 | 45.4 |
| Alloy 141 | 329 | 1184 | 53.3 |
| | 314 | 1195 | 49.8 |
| | 330 | 1191 | 49.0 |
| Alloy 142 | 314 | 1211 | 52.4 |
| | 344 | 1210 | 55.4 |
| | 353 | 1205 | 54.1 |
| Alloy 143 | 366 | 1228 | 42.8 |
| | 355 | 1235 | 49.1 |
| | 334 | 1207 | 50.4 |
| Alloy 144 | 469 | 981 | 39.5 |
| | 429 | 960 | 35.1 |
| | 465 | 967 | 39.8 |
| Alloy 145 | 414 | 947 | 29.0 |
| | 439 | 970 | 30.6 |
| | 416 | 965 | 30.2 |
| Alloy 154 | 492 | 1125 | 26.5 |
| | 393 | 1099 | 25.9 |
| | 476 | 1133 | 25.8 |
| | 546 | 1188 | 33.9 |
| | 525 | 1185 | 32.9 |

TABLE 10-continued

Tensile Properties of Selected After Hot Rolling

| Alloy | Yield Stress (MPa) | Ultimate Strength (MPa) | Tensile Elongation (%) |
|---|---|---|---|
| Alloy 155 | 630 | 1008 | 45.2 |
| | 645 | 1024 | 46.1 |
| | 634 | 1022 | 45.8 |
| Alloy 156 | 143 | 1185 | 38.3 |
| | 142 | 1204 | 37.4 |
| | 167 | 1200 | 36.9 |

Tensile properties of selected alloys after hot rolling and subsequent cold rolling are listed in Table 11.

The ultimate tensile strength values may vary from 1159 to 1707 MPa with tensile elongation from 2.6 to 36.4%. The yield stress is in a range from 796 to 1388 MPa. Mechanical properties of the steel alloys herein depend on alloy chemistry, processing conditions, and material mechanistic response to the processing conditions.

TABLE 11

Tensile Properties of Selected Alloys After Cold Rolling

| Alloy | Yield Stress (MPa) | Ultimate Strength (MPa) | Tensile Elongation (%) |
|---|---|---|---|
| Alloy 1 | 1070 | 1383 | 23.0 |
| | 1050 | 1385 | 14.0 |
| | 1091 | 1373 | 21.3 |
| | 1115 | 1474 | 16.0 |
| | 968 | 1441 | 11.6 |
| | 1071 | 1504 | 18.1 |
| Alloy 2 | 979 | 1401 | 26.0 |
| | 974 | 1416 | 18.2 |
| | 949 | 1415 | 25.8 |
| Alloy 8 | 839 | 1360 | 32.5 |
| | 812 | 1365 | 35.3 |
| | 894 | 1390 | 32.1 |
| | 881 | 1359 | 36.4 |
| Alloy 28 | 1243 | 1496 | 18.8 |
| | 918 | 1516 | 17.5 |
| | 1069 | 1538 | 19.9 |
| Alloy 29 | 1178 | 1570 | 20.9 |
| | 1042 | 1557 | 24.1 |
| Alloy 30 | 994 | 1630 | 20.5 |
| | 1035 | 1626 | 22.4 |
| | 975 | 1634 | 20.5 |
| Alloy 31 | 1201 | 1581 | 16.6 |
| | 1230 | 1528 | 10.9 |
| | 1154 | 1584 | 20.5 |
| Alloy 32 | 977 | 1630 | 18.2 |
| | 1026 | 1623 | 19.8 |
| | 1055 | 1630 | 18.8 |
| Alloy 33 | 1176 | 1556 | 9.3 |
| | 1170 | 1528 | 9.0 |
| Alloy 34 | 1327 | 1543 | 19.0 |
| | 1212 | 1529 | 20.2 |
| | 1268 | 1549 | 18.1 |
| Alloy 35 | 948 | 1551 | 14.1 |
| | 999 | 1575 | 19.1 |
| | 1064 | 1597 | 17.4 |
| Alloy 36 | 1159 | 1629 | 11.8 |
| | 1231 | 1636 | 11.9 |
| | 1129 | 1631 | 12.6 |
| Alloy 37 | 1163 | 1474 | 15.8 |
| | 1142 | 1481 | 12.7 |
| | 1036 | 1499 | 17.0 |
| Alloy 38 | 1087 | 1670 | 13.8 |
| | 1051 | 1642 | 13.2 |
| | 1049 | 1645 | 14.6 |
| Alloy 39 | 1005 | 1534 | 9.9 |
| | 1093 | 1557 | 12.4 |
| | 1085 | 1522 | 9.7 |

TABLE 11-continued

Tensile Properties of Selected Alloys After Cold Rolling

| Alloy | Yield Stress (MPa) | Ultimate Strength (MPa) | Tensile Elongation (%) |
|---|---|---|---|
| Alloy 40 | 1183 | 1578 | 17.9 |
| | 1253 | 1575 | 16.0 |
| | 1225 | 1551 | 19.2 |
| Alloy 41 | 1146 | 1624 | 22.4 |
| | 1103 | 1631 | 23.1 |
| | 1102 | 1630 | 19.9 |
| Alloy 42 | 982 | 1620 | 25.1 |
| | 979 | 1612 | 25.3 |
| | 1177 | 1563 | 21.1 |
| Alloy 43 | 1065 | 1521 | 27.2 |
| | 1160 | 1564 | 24.5 |
| | 975 | 1522 | 25.9 |
| Alloy 44 | 966 | 1613 | 13.4 |
| | 998 | 1615 | 15.4 |
| | 1053 | 1611 | 20.6 |
| Alloy 45 | 1142 | 1671 | 8.4 |
| | 1113 | 1615 | 6.7 |
| Alloy 46 | 1093 | 1580 | 9.1 |
| | 1057 | 1622 | 10.2 |
| | 1073 | 1649 | 12.0 |
| Alloy 47 | 1023 | 1699 | 19.8 |
| | 1051 | 1655 | 12.1 |
| | 1052 | 1660 | 15.7 |
| Alloy 48 | 952 | 1648 | 18.4 |
| | 1018 | 1632 | 15.1 |
| | 1023 | 1633 | 16.0 |
| Alloy 58 | 1043 | 1597 | 13.5 |
| Alloy 59 | 1052 | 1544 | 20.5 |
| | 1057 | 1555 | 22.7 |
| | 1060 | 1546 | 20.5 |
| Alloy 60 | 1007 | 1512 | 9.0 |
| | 1082 | 1548 | 10.2 |
| | 989 | 1609 | 13.2 |
| Alloy 64 | 997 | 1675 | 10.5 |
| | 1005 | 1707 | 14.5 |
| | 1068 | 1687 | 9.4 |
| Alloy 96 | 1388 | 1633 | 5.5 |
| | 1310 | 1635 | 5.7 |
| | 1335 | 1636 | 5.2 |
| Alloy 97 | 1105 | 1537 | 26.8 |
| | 1114 | 1547 | 25.3 |
| | 1148 | 1528 | 25.0 |
| Alloy 102 | 963 | 1302 | 24.9 |
| | 964 | 1295 | 24.0 |
| | 956 | 1295 | 24.3 |
| Alloy 103 | 1179 | 1492 | 3.5 |
| | 1133 | 1438 | 2.6 |
| | 1105 | 1469 | 4.3 |
| Alloy 104 | 796 | 1218 | 12.6 |
| | 874 | 1159 | 8.9 |
| Alloy 105 | 881 | 1203 | 14.8 |
| | 823 | 1235 | 18.8 |
| | 824 | 1217 | 20.9 |
| Alloy 106 | 823 | 1506 | 15.3 |
| | 895 | 1547 | 17.4 |
| | 809 | 1551 | 20.8 |
| Alloy 107 | 948 | 1384 | 3.2 |
| | 1007 | 1359 | 3.6 |
| | 933 | 1435 | 4.0 |
| Alloy 141 | 975 | 1587 | 25.3 |
| | 1043 | 1570 | 23.8 |
| | 1044 | 1559 | 22.5 |
| Alloy 142 | 1109 | 1630 | 21.4 |
| | 1085 | 1594 | 18.4 |
| | 1057 | 1604 | 21.3 |
| Alloy 143 | 1135 | 1686 | 22.1 |
| | 1159 | 1681 | 21.9 |
| Alloy 144 | 1048 | 1409 | 26.4 |
| | 1031 | 1402 | 18.5 |
| | 1093 | 1416 | 29.1 |
| Alloy 145 | 1048 | 1541 | 26.7 |
| | 1107 | 1531 | 23.2 |
| | 1119 | 1508 | 16.7 |

TABLE 11-continued

Tensile Properties of Selected Alloys After Cold Rolling

| Alloy | Yield Stress (MPa) | Ultimate Strength (MPa) | Tensile Elongation (%) |
|---|---|---|---|
| Alloy 114 | 1146 | 1637 | 7.5 |
| | 1144 | 1632 | 9.4 |
| | 1184 | 1634 | 8.0 |
| Alloy 115 | 1095 | 1487 | 7.2 |
| | 1243 | 1512 | 7.4 |
| | 1278 | 1491 | 8.4 |

Tensile properties of the hot rolled sheets after hot rolling with subsequent heat treatment at different parameters (Table 9) are listed in Table 12. The ultimate tensile strength values may vary from 900 MPa to 1205 MPa with tensile elongation from 30.1 to 68.4%. The yield stress is in a range from 245 to 494 MPa. Mechanical properties of the steel alloys herein depend on alloy chemistry, processing conditions, and material mechanistic response to the processing conditions.

TABLE 12

Tensile Properties of Alloys with Hot Rolling and Subsequent Heat Treatment

| Alloy | Standard Heat Treatment | Yield Stress (MPa) | Ultimate Strength (MPa) | Tensile Elongation (%) |
|---|---|---|---|---|
| Alloy 1 | HT1 | 407 | 951 | 31.0 |
| | | 404 | 954 | 32.0 |
| | | 383 | 997 | 36.3 |
| | HT2 | 314 | 1049 | 52.0 |
| | | 346 | 1056 | 49.9 |
| | | 326 | 1016 | 54.4 |
| | HT5 | 304 | 1069 | 42.6 |
| | | 303 | 1093 | 45.0 |
| | | 286 | 1018 | 37.7 |
| | HT7 | 337 | 992 | 56.1 |
| | | 343 | 987 | 52.3 |
| | | 338 | 962 | 50.6 |
| Alloy 2 | HT1 | 434 | 1185 | 43.2 |
| | | 424 | 1178 | 42.3 |
| | HT6 | 359 | 1021 | 37.8 |
| | | 362 | 1032 | 36.9 |
| | | 353 | 1007 | 37.0 |
| | HT7 | 395 | 1035 | 39.4 |
| | | 382 | 1006 | 35.5 |
| | | 403 | 1033 | 38.1 |
| Alloy 3 | HT1 | 326 | 953 | 58.0 |
| | | 327 | 958 | 60.0 |
| | HT2 | 250 | 947 | 60.2 |
| | | 259 | 923 | 59.2 |
| | HT5 | 264 | 967 | 51.7 |
| | | 264 | 948 | 47.8 |
| | | 251 | 961 | 49.7 |
| Alloy 4 | HT1 | 378 | 1007 | 46.5 |
| | | 381 | 971 | 36.9 |
| | | 380 | 993 | 42.9 |
| | HT2 | 325 | 905 | 48.0 |
| | | 337 | 901 | 40.8 |
| | | 353 | 939 | 52.8 |
| | HT5 | 281 | 1007 | 46.5 |
| | | 299 | 992 | 47.4 |
| | | 284 | 1037 | 50.1 |
| | HT7 | 341 | 918 | 57.9 |
| | | 333 | 925 | 64.2 |
| Alloy 5 | HT1 | 426 | 1056 | 34.6 |
| | | 423 | 1160 | 47.4 |
| | | 423 | 1133 | 42.9 |
| | HT2 | 396 | 1087 | 59.9 |
| | | 365 | 982 | 36.9 |
| | | 365 | 1109 | 53.4 |

TABLE 12-continued

Tensile Properties of Alloys with Hot Rolling and Subsequent Heat Treatment

| Alloy | Standard Heat Treatment | Yield Stress (MPa) | Ultimate Strength (MPa) | Tensile Elongation (%) |
|---|---|---|---|---|
| | HT6 | 364 | 980 | 44.0 |
| | | 342 | 997 | 44.0 |
| | HT7 | 370 | 990 | 40.5 |
| | | 375 | 1017 | 47.5 |
| | | 377 | 999 | 45.8 |
| Alloy 6 | HT1 | 394 | 1038 | 65.1 |
| | | 322 | 1036 | 64.6 |
| | | 325 | 1038 | 67.9 |
| | HT2 | 266 | 1062 | 58.3 |
| | HT5 | 245 | 994 | 51.6 |
| | | 251 | 923 | 42.8 |
| | HT7 | 284 | 1056 | 48.9 |
| | | 300 | 1089 | 50.7 |
| Alloy 7 | HT1 | 329 | 1122 | 46.3 |
| | | 312 | 1008 | 37.3 |
| | HT2 | 324 | 1122 | 55.2 |
| | | 324 | 1125 | 61.3 |
| | | 328 | 1122 | 60.0 |
| | HT5 | 290 | 1098 | 51.7 |
| | | 272 | 1054 | 43.7 |
| | | 290 | 1083 | 50.0 |
| | HT7 | 322 | 1122 | 57.3 |
| | | 315 | 1117 | 54.2 |
| | | 319 | 1056 | 40.4 |
| Alloy 8 | HT2 | 361 | 1171 | 47.1 |
| | | 354 | 1154 | 48.9 |
| | | 365 | 1163 | 55.7 |
| | | 362 | 1199 | 52.1 |
| | HT6 | 350 | 1044 | 40.8 |
| | | 350 | 983 | 35.4 |
| | | 343 | 1003 | 34.2 |
| | HT7 | 365 | 1103 | 45.1 |
| | | 369 | 1105 | 44.6 |
| | | 366 | 1121 | 48.1 |
| Alloy 9 | HT1 | 327 | 971 | 56.4 |
| | | 326 | 995 | 54.9 |
| | | 311 | 963 | 59.0 |
| | HT2 | 278 | 980 | 59.4 |
| | | 289 | 998 | 53.1 |
| | HT5 | 355 | 993 | 47.3 |
| | | 254 | 956 | 40.7 |
| | | 248 | 984 | 45.8 |
| | HT7 | 305 | 977 | 57.0 |
| | | 278 | 941 | 65.7 |
| | | 311 | 1008 | 53.2 |
| Alloy 10 | HT1 | 245 | 1046 | 41.6 |
| | | 309 | 1033 | 41.4 |
| | | 283 | 1004 | 38.1 |
| | HT2 | 323 | 1012 | 58.1 |
| | | 323 | 1061 | 62.9 |
| | | 319 | 1024 | 65.6 |
| | HT5 | 280 | 1012 | 50.4 |
| | | 279 | 1028 | 52.1 |
| | | 261 | 1041 | 57.6 |
| | HT7 | 345 | 1038 | 60.2 |
| | | 344 | 1041 | 55.7 |
| Alloy 11 | HT1 | 494 | 1078 | 34.5 |
| | | 409 | 1085 | 36.3 |
| | | 412 | 1146 | 40.8 |
| | HT2 | 344 | 1095 | 57.1 |
| | | 342 | 1062 | 55.6 |
| | | 352 | 1071 | 57.2 |
| | HT6 | 335 | 1034 | 45.9 |
| | | 477 | 1006 | 39.0 |
| | HT7 | 334 | 1099 | 55.6 |
| | | 333 | 1123 | 58.6 |
| | | 342 | 1121 | 55.3 |
| Alloy 12 | HT1 | 344 | 977 | 44.0 |
| | | 329 | 900 | 34.4 |
| | HT2 | 301 | 926 | 52.3 |
| | | 302 | 900 | 59.1 |
| | | 302 | 967 | 49.6 |

TABLE 12-continued

Tensile Properties of Alloys with Hot Rolling and Subsequent Heat Treatment

| Alloy | Standard Heat Treatment | Yield Stress (MPa) | Ultimate Strength (MPa) | Tensile Elongation (%) |
|---|---|---|---|---|
| | HT5 | 269 | 1001 | 41.4 |
| | | 288 | 1029 | 44.3 |
| | | 281 | 1036 | 42.7 |
| | HT7 | 317 | 907 | 57.2 |
| | | 316 | 913 | 55.8 |
| | | 317 | 931 | 60.3 |
| Alloy 13 | HT1 | 389 | 989 | 32.7 |
| | | 406 | 954 | 31.1 |
| | HT2 | 335 | 977 | 55.1 |
| | | 346 | 960 | 45.4 |
| | | 342 | 966 | 41.0 |
| | HT5 | 293 | 1059 | 48.6 |
| | | 292 | 1037 | 47.5 |
| | | 288 | 1069 | 43.1 |
| | HT7 | 352 | 994 | 51.5 |
| | | 359 | 991 | 50.1 |
| | | 354 | 985 | 46.8 |
| Alloy 14 | HT2 | 383 | 987 | 34.2 |
| | | 379 | 1081 | 48.1 |
| | HT6 | 371 | 1028 | 42.3 |
| | | 367 | 1007 | 40.5 |
| | | 383 | 1025 | 45.7 |
| | HT7 | 391 | 1024 | 38.4 |
| | | 396 | 1015 | 37.6 |
| Alloy 15 | HT1 | 324 | 923 | 56.0 |
| | | 333 | 908 | 50.5 |
| | HT5 | 336 | 959 | 48.0 |
| Alloy 16 | HT1 | 394 | 961 | 37.3 |
| | | 372 | 1002 | 46.7 |
| | | 377 | 990 | 43.7 |
| | HT2 | 331 | 970 | 68.4 |
| | | 346 | 944 | 62.9 |
| | | 336 | 970 | 53.9 |
| | HT6 | 312 | 977 | 56.6 |
| | | 318 | 1005 | 56.0 |
| | | 315 | 981 | 59.1 |
| | HT7 | 348 | 930 | 54.4 |
| | | 360 | 926 | 51.5 |
| Alloy 17 | HT1 | 397 | 997 | 41.9 |
| | HT2 | 383 | 1049 | 51.8 |
| | | 378 | 1003 | 40.3 |
| | | 379 | 1017 | 47.9 |
| | HT6 | 466 | 1008 | 55.3 |
| | | 350 | 1002 | 54.0 |
| | | 356 | 953 | 40.0 |
| | HT7 | 398 | 999 | 40.9 |
| | | 421 | 1019 | 44.3 |
| Alloy 18 | HT1 | 375 | 1045 | 44.9 |
| | | 397 | 1048 | 47.2 |
| | | 353 | 1114 | 52.3 |
| | HT2 | 321 | 1016 | 58.6 |
| | | 320 | 984 | 59.1 |
| | | 323 | 1036 | 63.9 |
| | HT5 | 305 | 950 | 42.8 |
| | | 295 | 965 | 44.4 |
| | | 296 | 956 | 36.3 |
| | | 288 | 928 | 37.9 |
| | HT8 | 412 | 1014 | 61.2 |
| | | 412 | 1007 | 59.0 |
| | | 407 | 995 | 56.8 |
| Alloy 19 | HT1 | 419 | 989 | 30.4 |
| | | 403 | 1027 | 33.0 |
| | HT2 | 351 | 1029 | 54.7 |
| | | 351 | 1019 | 52.5 |
| | | 359 | 1025 | 51.0 |
| | HT6 | 346 | 1061 | 40.5 |
| | | 344 | 1091 | 41.0 |
| | | 352 | 1035 | 39.1 |
| Alloy 20 | HT1 | 440 | 1128 | 37.6 |
| | | 451 | 1146 | 41.0 |
| | HT2 | 364 | 1075 | 40.8 |
| | | 368 | 1054 | 37.5 |
| | | 389 | 1107 | 40.5 |

TABLE 12-continued

Tensile Properties of Alloys with Hot Rolling and Subsequent Heat Treatment

| Alloy | Standard Heat Treatment | Yield Stress (MPa) | Ultimate Strength (MPa) | Tensile Elongation (%) |
|---|---|---|---|---|
| | HT6 | 367 | 1044 | 38.6 |
| | | 367 | 1017 | 35.8 |
| | | 381 | 1022 | 35.5 |
| Alloy 21 | HT1 | 363 | 1073 | 55.4 |
| | | 364 | 1095 | 61.8 |
| | | 357 | 1090 | 62.6 |
| | HT2 | 320 | 1012 | 68.3 |
| | | 318 | 1026 | 59.8 |
| | | 318 | 1017 | 63.4 |
| | HT5 | 301 | 980 | 42.0 |
| | | 299 | 1018 | 42.6 |
| | | 279 | 1036 | 49.1 |
| | | 274 | 1028 | 45.2 |
| | | 311 | 997 | 38.3 |
| | HT8 | 411 | 999 | 66.0 |
| | | 410 | 1003 | 63.9 |
| | | 409 | 1001 | 68.2 |
| Alloy 22 | HT1 | 377 | 1144 | 54.2 |
| | | 414 | 1151 | 51.2 |
| | | 391 | 1138 | 55.1 |
| | HT2 | 344 | 1102 | 58.8 |
| | | 347 | 1051 | 59.4 |
| | | 346 | 1072 | 58.4 |
| | HT5 | 330 | 1002 | 41.6 |
| | | 333 | 977 | 41.2 |
| | | 328 | 996 | 43.4 |
| Alloy 23 | HT1 | 416 | 1083 | 36.9 |
| | | 462 | 1023 | 30.3 |
| | HT2 | 375 | 1101 | 47.7 |
| | | 379 | 1127 | 51.9 |
| | | 377 | 1093 | 47.5 |
| | HT6 | 331 | 1008 | 37.8 |
| | | 363 | 1068 | 39.7 |
| | | 347 | 1116 | 39.9 |
| Alloy 24 | HT1 | 359 | 1049 | 40.3 |
| | | 358 | 1128 | 47.7 |
| | | 355 | 1124 | 45.1 |
| | HT2 | 317 | 1074 | 58.8 |
| | | 327 | 1052 | 61.1 |
| | | 326 | 1029 | 57.8 |
| | HT5 | 317 | 963 | 44.4 |
| | | 332 | 960 | 42.3 |
| | | 288 | 938 | 36.5 |
| | | 304 | 941 | 36.2 |
| | | 291 | 937 | 37.6 |
| | HT8 | 408 | 1049 | 60.7 |
| | | 398 | 1027 | 58.5 |
| | | 418 | 1039 | 58.8 |
| Alloy 25 | HT1 | 406 | 1067 | 32.4 |
| | | 396 | 1023 | 30.1 |
| | HT2 | 370 | 1093 | 50.1 |
| | | 360 | 1086 | 45.6 |
| | | 359 | 1115 | 47.7 |
| | HT5 | 321 | 967 | 33.3 |
| | | 345 | 976 | 34.0 |
| | | 344 | 984 | 35.7 |
| Alloy 26 | HT1 | 449 | 1108 | 30.1 |
| | | 441 | 1158 | 32.9 |
| | HT2 | 399 | 1192 | 45.0 |
| | | 403 | 1131 | 41.2 |
| | | 398 | 1075 | 36.3 |
| | HT6 | 382 | 1071 | 30.5 |
| | | 378 | 1067 | 30.1 |
| Alloy 27 | HT1 | 365 | 1134 | 47.9 |
| | | 359 | 1027 | 33.8 |
| | | 368 | 1060 | 38.7 |
| | HT2 | 313 | 1029 | 55.6 |
| | | 323 | 1037 | 61.2 |
| | | 317 | 1047 | 62.2 |
| | HT5 | 299 | 1044 | 35.8 |
| | | 296 | 1126 | 51.6 |
| | | 307 | 1141 | 46.5 |
| | | 262 | 1040 | 36.7 |

TABLE 12-continued

Tensile Properties of Alloys with Hot Rolling and Subsequent Heat Treatment

| Alloy | Standard Heat Treatment | Yield Stress (MPa) | Ultimate Strength (MPa) | Tensile Elongation (%) |
|---|---|---|---|---|
| | | 273 | 1069 | 44.2 |
| | | 275 | 1073 | 43.8 |
| | HT8 | 402 | 1062 | 63.6 |
| | | 402 | 1054 | 62.0 |
| | | 400 | 1055 | 62.6 |
| Alloy 28 | HT1 | 400 | 1137 | 39.0 |
| | | 397 | 1205 | 46.4 |
| | | 397 | 1202 | 50.3 |
| | HT2 | 355 | 1076 | 47.4 |
| | | 415 | 1100 | 49.9 |
| | | 355 | 1106 | 47.0 |
| | HT6 | 332 | 1122 | 37.8 |
| | | 333 | 1203 | 46.4 |
| Alloy 114 | HT1 | 339 | 1072 | 50.78 |
| | | 337 | 1056 | 49.97 |
| | | 344 | 1067 | 45.14 |
| | | 282 | 1116 | 44.11 |
| | | 276 | 1061 | 30.58 |
| | | 282 | 1032 | 32.5 |
| | HT2 | 299 | 949 | 47.54 |
| | | 304 | 959 | 46.67 |
| | HT5 | 309 | 1022 | 43.47 |
| | | 287 | 981 | 31.58 |
| | | 282 | 1074 | 37.01 |
| Alloy 115 | HT1 | 437 | 1137 | 31.83 |
| | | 459 | 1132 | 32.54 |
| | | 434 | 1140 | 31.54 |
| | HT2 | 443 | 1136 | 36.63 |
| | | 408 | 1146 | 35.81 |
| | | 439 | 1126 | 35.58 |
| | HT3 | 367 | 1098 | 39.4 |
| | | 354 | 1094 | 38.68 |
| | | 334 | 1095 | 39.73 |

Tensile properties of the selected alloys after hot rolling with subsequent cold rolling and heat treatment at different parameters (Table 9) are listed in Table 13. The ultimate tensile strength values may vary from 901 MPa to 1493 MPa with tensile elongation from 30.0 to 76.0%. The yield stress is in a range from 217 to 657 MPa. As it can be seen, advanced property combinations with high and tensile strength above 900 MPa can be achieved in the sheet material from High Ductility Alloys herein after full post processing including hot rolling, cold rolling and heat treatment.

TABLE 13

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| Alloy 1 | HT1 | 359 | 1086 | 50.0 |
| | | 344 | 1066 | 50.2 |
| | | 354 | 1096 | 50.7 |
| | | 349 | 1056 | 52.0 |
| | | 353 | 1055 | 52.8 |
| | | 354 | 1103 | 52.4 |
| | HT2 | 329 | 995 | 67.8 |
| | | 314 | 1003 | 65.8 |
| | | 318 | 1000 | 58.7 |
| | | 312 | 967 | 52.9 |
| | | 309 | 985 | 65.9 |
| | HT5 | 301 | 915 | 44.2 |
| Alloy 2 | HT1 | 434 | 1173 | 39.5 |
| | | 414 | 1187 | 51.3 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT2 | 382 | 982 | 36.2 |
| | | 399 | 1006 | 40.0 |
| | | 386 | 1068 | 48.2 |
| | | 380 | 1062 | 52.5 |
| | | 382 | 1049 | 47.2 |
| | HT6 | 344 | 1032 | 38.0 |
| | | 341 | 1055 | 39.3 |
| | | 331 | 1067 | 40.3 |
| Alloy 8 | HT1 | 432 | 1184 | 35.1 |
| | | 455 | 1134 | 32.9 |
| | | 450 | 1244 | 44.3 |
| | HT2 | 342 | 1090 | 42.4 |
| | | 348 | 1071 | 45.0 |
| | | 340 | 1054 | 37.4 |
| | HT6 | 312 | 1106 | 36.5 |
| | | 314 | 1022 | 33.9 |
| | | 318 | 1081 | 34.9 |
| Alloy 29 | HT1 | 424 | 1151 | 31.8 |
| | HT2 | 376 | 1197 | 49.0 |
| | | 379 | 1139 | 40.6 |
| | | 387 | 1154 | 43.6 |
| | | 366 | 1118 | 36.9 |
| | | 366 | 1170 | 42.5 |
| | | 387 | 1185 | 42.9 |
| | | 404 | 1127 | 38.5 |
| | | 401 | 1085 | 36.3 |
| | HT6 | 355 | 1189 | 39.2 |
| | | 355 | 1079 | 30.4 |
| | | 354 | 1214 | 45.1 |
| | | 339 | 999 | 32.2 |
| | | 372 | 1018 | 33.7 |
| | | 331 | 1006 | 32.7 |
| Alloy 30 | HT1 | 360 | 1222 | 47.3 |
| | | 381 | 1220 | 42.1 |
| | | 378 | 1218 | 46.4 |
| | | 372 | 1215 | 36.6 |
| | | 373 | 1266 | 38.3 |
| | | 370 | 1300 | 44.3 |
| | HT2 | 341 | 1110 | 33.5 |
| | | 342 | 1156 | 45.9 |
| | | 349 | 1126 | 40.8 |
| | | 356 | 1185 | 33.2 |
| | HT5 | 325 | 1117 | 41.6 |
| | | 319 | 1139 | 42.6 |
| | | 327 | 1146 | 42.2 |
| | | 296 | 1067 | 42.6 |
| | | 306 | 1080 | 39.0 |
| Alloy 31 | HT2 | 362 | 1082 | 35.2 |
| | | 357 | 1152 | 43.5 |
| | | 377 | 1108 | 40.5 |
| | | 356 | 1137 | 47.8 |
| | | 359 | 1141 | 49.9 |
| | | 356 | 1065 | 39.0 |
| | HT6 | 390 | 987 | 41.1 |
| | | 390 | 971 | 40.1 |
| | | 388 | 994 | 41.6 |
| | | 377 | 929 | 32.2 |
| | | 378 | 981 | 33.2 |
| Alloy 32 | HT1 | 388 | 1259 | 42.5 |
| | | 377 | 1254 | 44.8 |
| | | 383 | 1183 | 44.7 |
| | | 394 | 1194 | 47.1 |
| | | 378 | 1186 | 49.6 |
| | HT2 | 356 | 1152 | 34.1 |
| | | 356 | 1121 | 30.9 |
| | | 361 | 1111 | 31.0 |
| | | 388 | 1129 | 33.4 |
| | | 384 | 1136 | 34.3 |
| | | 393 | 1117 | 31.2 |
| | HT5 | 330 | 1134 | 37.8 |
| | | 338 | 1120 | 35.2 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | | 339 | 1132 | 39.4 |
| | | 336 | 1204 | 37.5 |
| | | 331 | 1191 | 39.7 |
| Alloy 33 | HT1 | 453 | 1094 | 31.2 |
| | HT2 | 412 | 1034 | 30.5 |
| | | 409 | 1131 | 37.7 |
| | | 408 | 1124 | 36.9 |
| | | 374 | 1098 | 36.4 |
| | | 391 | 1135 | 39.5 |
| | | 413 | 1085 | 39.5 |
| | HT5 | 355 | 1008 | 31.4 |
| Alloy 34 | HT2 | 421 | 1020 | 37.6 |
| | | 403 | 1044 | 41.0 |
| | | 415 | 1060 | 42.5 |
| | HT6 | 380 | 985 | 30.1 |
| | | 389 | 1062 | 34.7 |
| | | 388 | 1011 | 30.9 |
| Alloy 35 | HT1 | 376 | 1141 | 31.2 |
| | HT2 | 361 | 1105 | 31.0 |
| | HT5 | 347 | 1109 | 31.4 |
| | | 303 | 1104 | 32.0 |
| Alloy 36 | HT2 | 396 | 1129 | 42.3 |
| | | 403 | 1098 | 38.8 |
| | | 404 | 1084 | 35.6 |
| | HT6 | 332 | 1169 | 46.5 |
| | | 323 | 1115 | 33.9 |
| | | 330 | 1195 | 42.8 |
| Alloy 37 | HT2 | 414 | 1063 | 43.1 |
| | | 421 | 975 | 33.3 |
| | | 418 | 1057 | 44.4 |
| | HT6 | 354 | 944 | 43.6 |
| | | 343 | 952 | 44.9 |
| Alloy 38 | HT1 | 421 | 1178 | 32.1 |
| | | 381 | 1197 | 33.0 |
| | | 402 | 1284 | 39.7 |
| | HT2 | 406 | 1189 | 35.5 |
| | | 394 | 1157 | 33.1 |
| Alloy 39 | HT2 | 421 | 1053 | 30.7 |
| | | 424 | 1105 | 33.5 |
| | | 424 | 1121 | 34.2 |
| Alloy 40 | HT2 | 399 | 1248 | 53.3 |
| | | 393 | 1201 | 48.0 |
| | HT6 | 391 | 1009 | 31.1 |
| Alloy 41 | HT2 | 376 | 1107 | 43.2 |
| | | 372 | 1125 | 47.2 |
| | | 367 | 1087 | 41.2 |
| | HT6 | 331 | 1109 | 35.5 |
| | | 321 | 1045 | 32.6 |
| Alloy 42 | HT1 | 421 | 1228 | 37.7 |
| | HT2 | 358 | 1067 | 35.2 |
| | | 354 | 1020 | 33.0 |
| | | 369 | 1147 | 39.9 |
| | HT6 | 317 | 1194 | 38.4 |
| | | 302 | 1121 | 34.2 |
| | | 284 | 1186 | 34.6 |
| Alloy 43 | HT2 | 375 | 1107 | 53.0 |
| | | 376 | 1116 | 53.7 |
| | | 369 | 1111 | 53.2 |
| | HT5 | 327 | 963 | 37.5 |
| | | 331 | 962 | 36.0 |
| | | 331 | 950 | 36.1 |
| Alloy 44 | HT1 | 367 | 1174 | 46.2 |
| | | 369 | 1193 | 45.1 |
| | | 367 | 1179 | 50.2 |
| | | 452 | 1152 | 34.5 |
| | | 384 | 1198 | 47.0 |
| | | 380 | 1206 | 47.7 |
| | | 378 | 1216 | 44.6 |
| | | 387 | 1224 | 52.0 |
| | | 386 | 1219 | 51.3 |
| | HT2 | 348 | 1095 | 33.9 |
| | | 351 | 1090 | 32.7 |
| | | 366 | 1177 | 44.9 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | | 367 | 1139 | 38.4 |
| | | 368 | 1173 | 44.3 |
| | | 407 | 1135 | 38.8 |
| | HT5 | 318 | 1060 | 31.8 |
| | | 326 | 1021 | 30.4 |
| | | 320 | 1008 | 30.2 |
| | | 341 | 1087 | 46.1 |
| | | 321 | 1066 | 48.0 |
| | | 318 | 1094 | 44.7 |
| | | 330 | 1163 | 46.8 |
| | | 335 | 1150 | 43.1 |
| | HT8 | 484 | 1278 | 48.3 |
| | | 485 | 1264 | 45.5 |
| | | 479 | 1261 | 48.7 |
| | | 421 | 1282 | 48.0 |
| | | 421 | 1266 | 50.2 |
| | | 460 | 1238 | 50.3 |
| Alloy 45 | HT1 | 366 | 1321 | 45.6 |
| | | 355 | 1304 | 37.8 |
| | | 348 | 1292 | 34.4 |
| | HT8 | 444 | 1365 | 45.2 |
| | | 444 | 1371 | 41.3 |
| | | 450 | 1368 | 43.4 |
| Alloy 46 | HT1 | 370 | 1238 | 36.2 |
| | | 366 | 1260 | 35.0 |
| | HT8 | 474 | 1340 | 43.0 |
| | | 455 | 1337 | 48.7 |
| Alloy 47 | HT1 | 361 | 1295 | 44.2 |
| | | 368 | 1246 | 42.2 |
| | | 362 | 1245 | 45.0 |
| | HT5 | 331 | 1090 | 37.5 |
| | | 332 | 1075 | 42.2 |
| | | 320 | 1066 | 36.5 |
| | HT8 | 479 | 1348 | 42.7 |
| | | 496 | 1340 | 48.1 |
| | | 487 | 1378 | 45.7 |
| Alloy 48 | HT1 | 381 | 1234 | 35.6 |
| | | 374 | 1182 | 32.6 |
| | | 364 | 1227 | 38.0 |
| | HT5 | 362 | 1169 | 40.8 |
| | | 363 | 1172 | 36.8 |
| | | 352 | 1160 | 40.8 |
| | HT8 | 463 | 1295 | 49.4 |
| | | 473 | 1308 | 46.1 |
| | | 460 | 1297 | 48.0 |
| Alloy 49 | HT1 | 375 | 1250 | 42.1 |
| | | 396 | 1226 | 42.9 |
| | HT2 | 339 | 1137 | 34.1 |
| | HT5 | 334 | 1104 | 36.4 |
| | | 322 | 1063 | 43.0 |
| | | 304 | 1027 | 37.2 |
| | HT8 | 480 | 1293 | 44.1 |
| | | 476 | 1335 | 47.6 |
| | | 485 | 1315 | 46.1 |
| Alloy 50 | HT1 | 359 | 1279 | 40.3 |
| | | 361 | 1242 | 34.2 |
| | | 366 | 1301 | 42.0 |
| | HT2 | 345 | 1229 | 38.4 |
| | | 352 | 1236 | 37.0 |
| | HT8 | 494 | 1357 | 42.2 |
| | | 485 | 1341 | 42.3 |
| | | 482 | 1343 | 40.0 |
| Alloy 51 | HT1 | 379 | 1221 | 46.2 |
| | | 407 | 1230 | 47.4 |
| | | 407 | 1240 | 47.8 |
| | HT2 | 364 | 1206 | 43.8 |
| | | 357 | 1214 | 43.8 |
| | | 359 | 1201 | 41.4 |
| | HT5 | 329 | 1057 | 42.9 |
| | | 307 | 1015 | 38.8 |
| | | 313 | 1061 | 38.3 |
| | HT8 | 476 | 1282 | 48.1 |
| | | 451 | 1241 | 50.1 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| Alloy 52 | HT1 | 394 | 1184 | 55.6 |
| | | 384 | 1171 | 49.0 |
| | | 396 | 1184 | 52.5 |
| | HT2 | 366 | 1110 | 52.2 |
| | | 362 | 1138 | 49.3 |
| | | 360 | 1135 | 52.6 |
| | HT5 | 360 | 1070 | 36.6 |
| | | 335 | 1041 | 33.1 |
| | | 342 | 1058 | 37.0 |
| | HT8 | 491 | 1166 | 53.5 |
| | | 502 | 1187 | 50.4 |
| Alloy 53 | HT1 | 391 | 1118 | 55.7 |
| | | 389 | 1116 | 60.5 |
| | | 401 | 1113 | 59.5 |
| | HT2 | 354 | 1041 | 60.4 |
| | | 355 | 1048 | 53.8 |
| | | 353 | 1053 | 58.0 |
| | HT5 | 326 | 931 | 49.2 |
| | | 331 | 923 | 53.9 |
| | | 320 | 973 | 41.8 |
| | HT8 | 481 | 1116 | 60.0 |
| | | 481 | 1132 | 55.4 |
| | | 486 | 1122 | 56.8 |
| Alloy 54 | HT1 | 416 | 1300 | 39.5 |
| | | 389 | 1210 | 31.0 |
| | | 386 | 1265 | 37.3 |
| | HT2 | 353 | 1165 | 33.7 |
| | | 366 | 1207 | 37.5 |
| | HT5 | 302 | 1034 | 37.9 |
| | | 309 | 1073 | 39.8 |
| | | 301 | 1048 | 40.6 |
| | HT8 | 473 | 1251 | 44.0 |
| | | 469 | 1269 | 48.4 |
| | | 491 | 1326 | 46.2 |
| Alloy 55 | HT1 | 420 | 1249 | 48.4 |
| | | 385 | 1164 | 32.8 |
| | | 397 | 1243 | 46.6 |
| | HT2 | 358 | 1194 | 43.5 |
| | | 355 | 1140 | 36.1 |
| | | 350 | 1059 | 30.0 |
| | HT5 | 327 | 1074 | 31.9 |
| | | 334 | 1091 | 32.5 |
| | HT8 | 486 | 1295 | 51.6 |
| | | 471 | 1295 | 48.5 |
| Alloy 56 | HT1 | 429 | 1156 | 34.4 |
| | HT2 | 349 | 1149 | 43.5 |
| | | 339 | 1118 | 38.8 |
| | | 349 | 1132 | 40.2 |
| | HT5 | 319 | 990 | 44.0 |
| | | 324 | 997 | 42.9 |
| | | 322 | 995 | 42.1 |
| | HT8 | 508 | 1257 | 48.8 |
| | | 489 | 1226 | 46.8 |
| | | 526 | 1205 | 52.1 |
| Alloy 57 | HT1 | 437 | 1093 | 34.9 |
| | | 432 | 1107 | 36.6 |
| | | 434 | 1076 | 34.2 |
| | HT2 | 376 | 1113 | 53.4 |
| | | 380 | 1093 | 42.2 |
| | | 374 | 1087 | 47.5 |
| | HT5 | 340 | 1058 | 41.2 |
| | | 345 | 1081 | 43.5 |
| | | 339 | 1094 | 45.1 |
| | HT8 | 464 | 1162 | 53.0 |
| | | 480 | 1194 | 53.4 |
| | | 508 | 1174 | 57.4 |
| Alloy 58 | HT1 | 373 | 1124 | 32.4 |
| | | 343 | 1157 | 32.2 |
| | | 371 | 1148 | 34.4 |
| | HT2 | 347 | 1098 | 31.3 |
| | HT5 | 329 | 1097 | 37.3 |
| | | 324 | 1088 | 35.4 |
| | | 320 | 1109 | 38.2 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT8 | 436 | 1231 | 54.5 |
| | | 438 | 1261 | 49.7 |
| | | 442 | 1250 | 51.8 |
| Alloy 59 | HT1 | 515 | 1178 | 42.5 |
| | | 507 | 1155 | 44.5 |
| | | 493 | 1158 | 44.2 |
| | HT2 | 389 | 1122 | 46.0 |
| | | 388 | 1153 | 47.9 |
| | HT4 | 316 | 912 | 45.3 |
| | | 319 | 916 | 46.5 |
| | | 335 | 1002 | 43.9 |
| | HT8 | 563 | 1207 | 52.4 |
| Alloy 60 | HT2 | 334 | 1132 | 44.4 |
| | HT5 | 352 | 1144 | 44.6 |
| | | 353 | 1152 | 49.5 |
| | HT8 | 411 | 1301 | 47.5 |
| | | 411 | 1306 | 47.1 |
| | | 422 | 1257 | 50.7 |
| Alloy 61 | HT1 | 368 | 1235 | 45.7 |
| | | 371 | 1236 | 51.7 |
| | | 365 | 1205 | 44.7 |
| | HT2 | 341 | 1071 | 30.1 |
| | | 342 | 1077 | 30.8 |
| | HT5 | 347 | 980 | 46.6 |
| | | 355 | 996 | 47.9 |
| | | 352 | 1003 | 41.9 |
| | HT8 | 495 | 1258 | 50.4 |
| | | 515 | 1254 | 53.5 |
| | | 520 | 1279 | 45.5 |
| Alloy 62 | HT1 | 480 | 1170 | 45.4 |
| | | 480 | 1140 | 44.5 |
| | | 482 | 1146 | 36.9 |
| | HT2 | 370 | 1147 | 52.5 |
| | | 377 | 1103 | 40.4 |
| | | 352 | 1107 | 38.4 |
| | HT4 | 345 | 1083 | 36.4 |
| | | 377 | 1117 | 37.9 |
| | HT8 | 541 | 1251 | 46.8 |
| | | 565 | 1219 | 45.3 |
| | | 579 | 1221 | 51.7 |
| Alloy 63 | HT2 | 311 | 1224 | 31.3 |
| | HT5 | 312 | 1225 | 37.4 |
| | | 296 | 1169 | 35.7 |
| | | 303 | 1206 | 36.0 |
| | HT8 | 413 | 1369 | 39.2 |
| | | 409 | 1361 | 41.3 |
| Alloy 64 | HT1 | 372 | 1238 | 32.8 |
| | | 376 | 1271 | 35.0 |
| | | 373 | 1199 | 32.2 |
| | HT5 | 335 | 1237 | 37.2 |
| | | 333 | 1208 | 39.2 |
| | | 330 | 1200 | 39.9 |
| | HT8 | 469 | 1342 | 46.0 |
| | | 467 | 1345 | 43.1 |
| | | 460 | 1321 | 37.5 |
| Alloy 65 | HT1 | 457 | 1180 | 31.6 |
| | HT2 | 339 | 1095 | 31.3 |
| | | 339 | 1064 | 30.8 |
| | HT4 | 294 | 1004 | 38.6 |
| | | 293 | 1000 | 36.9 |
| | | 298 | 1010 | 37.8 |
| | HT8 | 503 | 1239 | 40.7 |
| | | 520 | 1315 | 45.0 |
| | | 528 | 1281 | 45.9 |
| Alloy 66 | HT5 | 312 | 1319 | 30.0 |
| | | 316 | 1353 | 31.9 |
| | HT8 | 397 | 1419 | 37.8 |
| | | 400 | 1416 | 37.8 |
| | | 391 | 1396 | 38.0 |
| Alloy 67 | HT1 | 377 | 1298 | 32.3 |
| | HT2 | 355 | 1305 | 38.1 |
| | HT5 | 347 | 1191 | 30.1 |
| | HT8 | 461 | 1377 | 42.3 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | | 467 | 1347 | 42.2 |
| | | 466 | 1376 | 43.0 |
| Alloy 68 | HT1 | 457 | 1269 | 33.6 |
| | | 467 | 1250 | 32.7 |
| | HT2 | 352 | 1190 | 41.9 |
| | | 357 | 1207 | 45.2 |
| | | 379 | 1223 | 36.3 |
| | HT5 | 330 | 1136 | 40.2 |
| | | 305 | 1087 | 35.9 |
| | | 325 | 1145 | 40.4 |
| | HT8 | 532 | 1309 | 42.6 |
| | | 545 | 1311 | 49.3 |
| | | 543 | 1319 | 39.8 |
| Alloy 69 | HT5 | 289 | 1021 | 35.9 |
| | | 304 | 1103 | 38.8 |
| | | 305 | 1096 | 39.3 |
| | HT8 | 432 | 1349 | 41.3 |
| | | 415 | 1314 | 43.1 |
| | | 424 | 1329 | 38.7 |
| Alloy 70 | HT1 | 397 | 1231 | 35.2 |
| | | 387 | 1226 | 33.6 |
| | HT2 | 346 | 1139 | 30.1 |
| | | 327 | 1163 | 31.4 |
| | HT5 | 346 | 1115 | 30.8 |
| | | 346 | 1135 | 32.7 |
| | HT8 | 463 | 1286 | 49.6 |
| | | 466 | 1315 | 50.5 |
| | | 477 | 1321 | 43.6 |
| Alloy 71 | HT1 | 471 | 1171 | 30.6 |
| | HT8 | 550 | 1299 | 45.5 |
| | | 528 | 1242 | 45.6 |
| | | 537 | 1262 | 46.8 |
| Alloy 72 | HT1 | 318 | 1214 | 34.1 |
| | | 307 | 1192 | 35.3 |
| | | 329 | 1218 | 34.7 |
| | HT5 | 285 | 1040 | 33.8 |
| | | 310 | 1142 | 37.8 |
| | HT8 | 403 | 1390 | 39.5 |
| | | 409 | 1343 | 34.0 |
| | | 406 | 1352 | 32.6 |
| Alloy 73 | HT1 | 361 | 1301 | 36.3 |
| | | 352 | 1230 | 30.1 |
| | | 358 | 1264 | 33.5 |
| | HT2 | 340 | 1170 | 31.3 |
| | HT5 | 341 | 1117 | 35.6 |
| | | 317 | 1062 | 38.4 |
| | | 322 | 1099 | 38.7 |
| | HT8 | 438 | 1349 | 46.4 |
| | | 451 | 1319 | 39.8 |
| | | 445 | 1343 | 45.9 |
| Alloy 74 | HT1 | 463 | 1225 | 32.5 |
| | HT2 | 361 | 1203 | 45.9 |
| | | 359 | 1157 | 35.1 |
| | HT4 | 329 | 1019 | 39.8 |
| | | 330 | 1059 | 38.9 |
| | | 322 | 1023 | 40.7 |
| | HT8 | 538 | 1283 | 36.5 |
| | | 521 | 1335 | 43.3 |
| | | 521 | 1238 | 32.4 |
| Alloy 75 | HT1 | 320 | 1223 | 31.4 |
| | | 345 | 1210 | 31.8 |
| | HT5 | 341 | 1242 | 32.8 |
| | HT8 | 404 | 1326 | 35.6 |
| | | 412 | 1343 | 42.7 |
| | | 417 | 1327 | 35.6 |
| Alloy 76 | HT1 | 370 | 1277 | 41.3 |
| | | 365 | 1244 | 47.5 |
| | HT8 | 454 | 1279 | 47.6 |
| | | 458 | 1320 | 45.9 |
| | | 444 | 1272 | 45.1 |
| Alloy 77 | HT1 | 480 | 1169 | 34.3 |
| | | 471 | 1177 | 33.6 |
| | | 461 | 1210 | 37.6 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT2 | 359 | 1115 | 37.2 |
| | | 350 | 1140 | 43.3 |
| | | 358 | 1068 | 34.4 |
| | HT4 | 346 | 1059 | 48.3 |
| | | 343 | 1054 | 46.3 |
| | | 335 | 1000 | 41.2 |
| | HT8 | 544 | 1245 | 46.5 |
| | | 521 | 1244 | 44.3 |
| | | 541 | 1250 | 42.3 |
| Alloy 78 | HT1 | 452 | 1134 | 46.1 |
| | | 449 | 1161 | 48.2 |
| | | 451 | 1122 | 46.4 |
| | HT2 | 321 | 903 | 44.8 |
| | | 326 | 902 | 47.2 |
| | | 328 | 925 | 44.8 |
| | HT4 | 349 | 943 | 43.4 |
| | | 333 | 942 | 46.1 |
| | | 339 | 939 | 39.7 |
| | HT8 | 535 | 1200 | 57.4 |
| | | 550 | 1209 | 47.6 |
| | | 545 | 1221 | 53.7 |
| Alloy 79 | HT1 | 456 | 1194 | 45.6 |
| | | 451 | 1173 | 42.5 |
| | | 453 | 1216 | 42.7 |
| | HT2 | 335 | 958 | 43.7 |
| | | 331 | 954 | 43.7 |
| | | 330 | 970 | 44.6 |
| | HT4 | 345 | 1055 | 32.4 |
| | | 341 | 1027 | 31.6 |
| | | 341 | 1023 | 30.8 |
| | HT5 | 346 | 966 | 34.6 |
| | | 335 | 909 | 45.8 |
| | HT8 | 552 | 1276 | 46.2 |
| | | 544 | 1255 | 50.8 |
| Alloy 80 | HT1 | 425 | 1192 | 48.1 |
| | | 412 | 1226 | 43.4 |
| | | 422 | 1226 | 40.2 |
| | HT2 | 313 | 976 | 39.9 |
| | | 315 | 957 | 40.9 |
| | | 318 | 967 | 42.9 |
| | HT5 | 314 | 1037 | 44.2 |
| | | 297 | 1019 | 37.3 |
| | | 300 | 1025 | 38.9 |
| | HT8 | 514 | 1308 | 44.1 |
| | | 500 | 1256 | 48.8 |
| | | 527 | 1299 | 52.9 |
| Alloy 81 | HT1 | 437 | 1265 | 33.3 |
| | | 440 | 1230 | 31.3 |
| | HT2 | 348 | 1182 | 36.4 |
| | | 332 | 1131 | 41.3 |
| | | 356 | 1195 | 38.2 |
| | HT5 | 378 | 1260 | 37.6 |
| | | 373 | 1213 | 35.6 |
| | | 372 | 1230 | 34.9 |
| | HT8 | 523 | 1335 | 45.8 |
| | | 520 | 1306 | 44.1 |
| | | 519 | 1314 | 44.2 |
| Alloy 82 | HT1 | 434 | 1262 | 33.1 |
| | | 404 | 1241 | 32.8 |
| | | 403 | 1251 | 31.9 |
| | HT2 | 321 | 1138 | 32.6 |
| | | 302 | 1087 | 32.7 |
| | | 288 | 1039 | 37.0 |
| | HT5 | 293 | 1042 | 35.0 |
| | | 309 | 1072 | 35.7 |
| | | 300 | 1067 | 34.2 |
| | HT8 | 518 | 1377 | 39.5 |
| | | 523 | 1422 | 39.2 |
| | | 507 | 1391 | 42.0 |
| Alloy 83 | HT2 | 345 | 1303 | 36.6 |
| | HT8 | 515 | 1425 | 34.7 |
| | | 497 | 1377 | 39.1 |
| | | 480 | 1367 | 42.2 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT5 | 337 | 1267 | 33.6 |
| | | 332 | 1272 | 37.2 |
| | | 335 | 1268 | 35.4 |
| Alloy 84 | HT1 | 494 | 1110 | 31.5 |
| | | 521 | 1139 | 38.1 |
| | HT2 | 397 | 1089 | 36.2 |
| | | 390 | 1099 | 44.7 |
| | | 408 | 1123 | 44.6 |
| | HT5 | 395 | 963 | 42.1 |
| | | 398 | 987 | 43.0 |
| | | 398 | 998 | 35.4 |
| | HT8 | 554 | 1178 | 41.2 |
| | | 555 | 1182 | 44.6 |
| | | 551 | 1183 | 40.8 |
| Alloy 85 | HT1 | 490 | 1137 | 33.1 |
| | | 474 | 1136 | 33.5 |
| | HT2 | 414 | 1104 | 33.7 |
| | | 408 | 1124 | 34.2 |
| | | 403 | 1136 | 37.7 |
| | HT5 | 405 | 1032 | 39.0 |
| | | 390 | 1046 | 43.2 |
| | | 401 | 1009 | 40.9 |
| | HT8 | 559 | 1205 | 39.6 |
| | | 554 | 1208 | 37.0 |
| | | 557 | 1206 | 35.9 |
| Alloy 86 | HT1 | 493 | 1177 | 30.1 |
| | HT2 | 406 | 1141 | 34.4 |
| | HT5 | 398 | 1125 | 31.6 |
| | HT8 | 545 | 1240 | 32.7 |
| | | 546 | 1262 | 34.1 |
| Alloy 87 | HT8 | 560 | 1350 | 31.3 |
| | | 557 | 1315 | 30.5 |
| Alloy 88 | HT1 | 461 | 1239 | 34.4 |
| | HT2 | 397 | 1185 | 30.6 |
| | | 399 | 1217 | 33.2 |
| | HT5 | 359 | 1079 | 40.9 |
| | | 344 | 1041 | 38.2 |
| | | 369 | 1110 | 39.7 |
| | HT8 | 550 | 1291 | 33.1 |
| | | 542 | 1318 | 35.8 |
| | | 522 | 1280 | 34.1 |
| Alloy 89 | HT5 | 349 | 1167 | 32.8 |
| | | 340 | 1158 | 31.3 |
| | | 354 | 1191 | 30.9 |
| Alloy 90 | HT1 | 407 | 1124 | 56.1 |
| | | 405 | 1117 | 56.7 |
| | | 372 | 1095 | 53.0 |
| | HT2 | 341 | 1022 | 40.4 |
| | | 352 | 1033 | 42.4 |
| | | 358 | 1049 | 42.7 |
| | HT5 | 323 | 1030 | 37.3 |
| | | 326 | 1015 | 35.7 |
| | | 330 | 1014 | 38.2 |
| | HT8 | 471 | 1150 | 55.0 |
| | | 482 | 1171 | 50.2 |
| | | 511 | 1166 | 56.9 |
| Alloy 91 | HT1 | 363 | 1162 | 55.5 |
| | | 367 | 1165 | 49.9 |
| | | 358 | 1111 | 53.8 |
| | HT2 | 342 | 989 | 31.7 |
| | | 339 | 1037 | 36.0 |
| | | 331 | 1020 | 34.1 |
| | HT5 | 332 | 1057 | 36.7 |
| | | 326 | 1053 | 35.6 |
| | | 333 | 1031 | 34.2 |
| | HT8 | 489 | 1217 | 53.8 |
| | | 500 | 1245 | 52.0 |
| | | 487 | 1215 | 52.3 |
| Alloy 92 | HT1 | 360 | 1184 | 45.2 |
| | | 364 | 1166 | 43.2 |
| | | 354 | 1170 | 45.5 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT2 | 367 | 1027 | 30.1 |
| | | 321 | 1047 | 33.4 |
| | | 329 | 1028 | 30.2 |
| | HT5 | 316 | 954 | 44.3 |
| | | 326 | 996 | 42.4 |
| | | 321 | 994 | 44.6 |
| | HT8 | 479 | 1258 | 50.1 |
| | | 481 | 1240 | 52.1 |
| | | 463 | 1273 | 50.2 |
| Alloy 93 | HT1 | 380 | 1106 | 53.4 |
| | | 372 | 1096 | 58.4 |
| | | 380 | 1109 | 58.2 |
| | HT2 | 342 | 1046 | 39.7 |
| | | 346 | 1036 | 42.4 |
| | | 343 | 1067 | 45.6 |
| | HT5 | 328 | 901 | 48.9 |
| | | 326 | 905 | 44.1 |
| | HT8 | 509 | 1164 | 47.7 |
| | | 493 | 1155 | 48.8 |
| | | 509 | 1153 | 50.4 |
| Alloy 94 | HT1 | 365 | 1139 | 48.8 |
| | | 371 | 1127 | 40.4 |
| | | 370 | 1140 | 54.3 |
| | HT2 | 330 | 1045 | 35.3 |
| | | 341 | 1038 | 34.4 |
| | | 353 | 1075 | 37.2 |
| | HT5 | 347 | 935 | 44.7 |
| | | 327 | 953 | 47.2 |
| | | 339 | 974 | 43.0 |
| | HT8 | 484 | 1200 | 54.5 |
| | | 473 | 1238 | 52.5 |
| | | 488 | 1231 | 51.8 |
| Alloy 95 | HT1 | 371 | 1154 | 41.7 |
| | | 356 | 1150 | 43.3 |
| | HT2 | 354 | 1099 | 33.0 |
| | | 353 | 1115 | 35.3 |
| | | 354 | 1067 | 33.1 |
| | HT5 | 338 | 993 | 40.1 |
| | | 360 | 1006 | 31.3 |
| | HT8 | 477 | 1242 | 44.3 |
| | | 481 | 1265 | 47.2 |
| | | 475 | 1216 | 49.3 |
| Alloy 96 | HT2 | 508 | 1042 | 35.8 |
| | HT9 | 453 | 954 | 31.6 |
| | | 454 | 953 | 31.1 |
| | | 445 | 937 | 33.3 |
| Alloy 97 | HT1 | 517 | 1033 | 30.8 |
| | | 524 | 1042 | 31.5 |
| | HT2 | 406 | 1101 | 64.9 |
| | | 396 | 1087 | 61.7 |
| | | 391 | 1096 | 64.8 |
| | HT6 | 362 | 1018 | 59.4 |
| | | 356 | 1001 | 51.6 |
| | | 359 | 1006 | 53.4 |
| | HT8 | 641 | 1199 | 54.3 |
| | | 616 | 1171 | 58.9 |
| | | 640 | 1195 | 54.2 |
| Alloy 98 | HT10 | 432 | 956 | 46.5 |
| | | 427 | 959 | 47.4 |
| | | 435 | 960 | 50.4 |
| Alloy 100 | HT9 | 336 | 922 | 33.1 |
| | HT8 | 467 | 1003 | 36.0 |
| Alloy 101 | HT8 | 406 | 925 | 43.6 |
| | | 413 | 955 | 46.3 |
| Alloy 102 | HT1 | 322 | 939 | 58.7 |
| | | 327 | 956 | 61.8 |
| | | 324 | 934 | 56.8 |
| | HT2 | 327 | 926 | 49.8 |
| | | 343 | 936 | 55.9 |
| | HT8 | 420 | 1006 | 59.5 |
| | | 420 | 998 | 51.1 |
| | | 417 | 995 | 55.8 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| Alloy 108 | HT1 | 359 | 1335 | 42.6 |
| | | 350 | 1303 | 41.4 |
| | HT5 | 286 | 1051 | 32.3 |
| | | 290 | 1066 | 34.3 |
| | | 286 | 1057 | 33.5 |
| | HT8 | 455 | 1380 | 41.7 |
| | | 455 | 1355 | 40.5 |
| | | 468 | 1394 | 38.5 |
| Alloy 109 | HT2 | 354 | 1176 | 31.6 |
| | HT5 | 342 | 1078 | 30.4 |
| | | 333 | 1096 | 40.8 |
| | | 339 | 1106 | 37.3 |
| | HT8 | 511 | 1344 | 45.1 |
| | | 540 | 1354 | 45.2 |
| | | 521 | 1341 | 47.4 |
| Alloy 110 | HT5 | 329 | 1342 | 34.1 |
| | | 328 | 1374 | 35.9 |
| | HT8 | 440 | 1407 | 36.2 |
| | | 438 | 1404 | 34.3 |
| | | 437 | 1446 | 40.2 |
| Alloy 111 | HT8 | 506 | 1350 | 31.3 |
| | | 506 | 1404 | 41.9 |
| | | 500 | 1393 | 44.1 |
| Alloy 112 | HT1 | 344 | 1374 | 35.3 |
| | | 348 | 1378 | 33.0 |
| | HT8 | 449 | 1474 | 37.4 |
| | | 459 | 1447 | 38.9 |
| | | 461 | 1489 | 35.4 |
| Alloy 113 | HT5 | 322 | 1223 | 34.3 |
| | | 317 | 1245 | 31.6 |
| | HT8 | 508 | 1444 | 32.9 |
| | | 503 | 1435 | 36.1 |
| | | 504 | 1408 | 31.8 |
| Alloy 114 | HT8 | 428 | 1474 | 34.3 |
| Alloy 115 | HT8 | 448 | 1456 | 37.9 |
| | | 441 | 1422 | 35.5 |
| | | 451 | 1473 | 37.3 |
| Alloy 116 | HT1 | 365 | 1357 | 38.7 |
| | HT2 | 286 | 1194 | 32.8 |
| | | 325 | 1181 | 30.2 |
| | HT8 | 438 | 1423 | 41.1 |
| | | 449 | 1393 | 38.4 |
| | | 449 | 1429 | 38.1 |
| Alloy 117 | HT8 | 402 | 1465 | 30.5 |
| | | 401 | 1480 | 34.2 |
| Alloy 118 | HT8 | 406 | 1463 | 36.1 |
| | | 411 | 1439 | 36.7 |
| Alloy 119 | HT1 | 335 | 1294 | 31.4 |
| | HT5 | 302 | 1343 | 35.0 |
| | | 300 | 1337 | 33.3 |
| | HT8 | 412 | 1400 | 36.6 |
| | | 417 | 1390 | 38.9 |
| | | 408 | 1392 | 32.5 |
| Alloy 120 | HT8 | 413 | 1415 | 35.1 |
| | | 413 | 1433 | 35.0 |
| | | 424 | 1433 | 30.1 |
| Alloy 121 | HT1 | 329 | 1342 | 38.2 |
| | | 308 | 1311 | 36.4 |
| | | 320 | 1325 | 36.1 |
| | HT5 | 317 | 1345 | 32.8 |
| | HT8 | 455 | 1402 | 36.9 |
| | | 450 | 1424 | 35.4 |
| | | 458 | 1398 | 34.6 |
| Alloy 122 | HT1 | 308 | 1216 | 33.1 |
| | | 324 | 1220 | 32.8 |
| | HT2 | 327 | 1207 | 34.7 |
| | | 296 | 1185 | 33.5 |
| | HT5 | 308 | 1262 | 39.1 |
| | | 302 | 1276 | 34.7 |
| | | 302 | 1259 | 39.0 |
| | HT8 | 430 | 1343 | 40.9 |
| | | 417 | 1350 | 40.0 |
| | | 425 | 1318 | 41.2 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| Alloy 124 | HT8 | 387 | 1493 | 31.7 |
| | | 386 | 1479 | 32.9 |
| | | 380 | 1468 | 33.1 |
| Alloy 125 | HT8 | 398 | 1451 | 34.9 |
| | | 385 | 1439 | 34.9 |
| | | 391 | 1445 | 36.4 |
| Alloy 126 | HT1 | 467 | 1016 | 40.5 |
| | | 470 | 1008 | 38.7 |
| | | 486 | 1014 | 38.8 |
| | HT11 | 454 | 1012 | 53.2 |
| | | 460 | 1024 | 53.5 |
| | | 439 | 1020 | 53.5 |
| | HT2 | 427 | 985 | 49.2 |
| | | 378 | 969 | 57.3 |
| | | 415 | 978 | 55.0 |
| | HT12 | 394 | 999 | 58.2 |
| | | 400 | 1000 | 56.1 |
| | | 408 | 1005 | 58.3 |
| | HT6 | 347 | 944 | 42.8 |
| | | 357 | 954 | 54.8 |
| | | 361 | 948 | 55.0 |
| | HT14 | 393 | 979 | 57.5 |
| | | 390 | 982 | 57.1 |
| | | 400 | 979 | 58.0 |
| | HT8 | 602 | 1054 | 49.6 |
| | | 633 | 1077 | 52.2 |
| | | 622 | 1076 | 50.8 |
| Alloy 127 | HT1 | 505 | 1100 | 48.8 |
| | | 505 | 1102 | 47.8 |
| | | 506 | 1083 | 43.1 |
| | HT11 | 463 | 1111 | 56.4 |
| | | 462 | 1116 | 56.5 |
| | | 472 | 1099 | 56.3 |
| | HT2 | 376 | 1051 | 58.8 |
| | | 375 | 1054 | 65.3 |
| | | 374 | 1061 | 63.1 |
| | HT12 | 382 | 1095 | 68.3 |
| | | 376 | 1096 | 67.4 |
| | | 379 | 1101 | 68.9 |
| | HT5 | 325 | 904 | 48.8 |
| | | 303 | 907 | 55.4 |
| | HT13 | 386 | 1092 | 68.3 |
| | | 340 | 1067 | 70.2 |
| | | 333 | 1068 | 72.2 |
| | HT8 | 608 | 1160 | 61.8 |
| | | 620 | 1171 | 60.6 |
| | | 630 | 1178 | 61.3 |
| Alloy 128 | HT1 | 503 | 1060 | 39.3 |
| | | 506 | 1069 | 49.4 |
| | | 491 | 1053 | 51.2 |
| | HT11 | 421 | 1098 | 54.1 |
| | | 436 | 1110 | 54.1 |
| | | 431 | 1091 | 56.5 |
| | HT2 | 344 | 1038 | 57.2 |
| | | 348 | 1002 | 62.0 |
| | | 358 | 1026 | 56.8 |
| | HT12 | 352 | 1080 | 64.1 |
| | | 353 | 1079 | 65.8 |
| | | 360 | 1086 | 63.1 |
| | HT5 | 300 | 918 | 56.0 |
| | HT13 | 313 | 1069 | 65.8 |
| | | 322 | 1064 | 64.5 |
| | | 303 | 1062 | 62.6 |
| | HT8 | 576 | 1146 | 61.4 |
| | | 595 | 1151 | 56.5 |
| | | 593 | 1155 | 57.3 |
| Alloy 129 | HT1 | 562 | 1049 | 37.3 |
| | | 548 | 1056 | 40.8 |
| | | 568 | 1051 | 37.5 |
| | HT11 | 482 | 1056 | 48.6 |
| | | 476 | 1071 | 60.4 |
| | | 492 | 1053 | 47.5 |

TABLE 13-continued

Tensile Properties of Selected Alloys After Cold Rolling and Heat Treatment

| Alloy | Standard Heat Treatment | Yield Stress (MPa) | Ultimate Strength (MPa) | Tensile Elongation (%) |
|---|---|---|---|---|
| | HT2 | 395 | 987 | 55.6 |
| | | 406 | 1027 | 72.8 |
| | | 399 | 1008 | 70.9 |
| | HT12 | 385 | 1036 | 74.3 |
| | | 387 | 1040 | 73.9 |
| | | 404 | 1045 | 68.0 |
| | HT6 | 371 | 989 | 54.5 |
| | | 379 | 1011 | 60.7 |
| | | 368 | 1007 | 57.5 |
| | HT14 | 420 | 1017 | 73.0 |
| | | 416 | 1020 | 75.0 |
| | | 417 | 1015 | 75.2 |
| | HT8 | 636 | 1115 | 37.2 |
| | | 635 | 1128 | 57.6 |
| | | 657 | 1162 | 55.4 |
| Alloy 130 | HT1 | 536 | 1045 | 42.6 |
| | | 534 | 1051 | 44.6 |
| | | 536 | 1044 | 42.5 |
| | HT11 | 471 | 1040 | 58.7 |
| | | 480 | 1053 | 58.8 |
| | | 482 | 1053 | 59.9 |
| | HT2 | 372 | 984 | 71.2 |
| | | 373 | 992 | 65.9 |
| | | 372 | 999 | 70.3 |
| | HT12 | 369 | 1022 | 74.0 |
| | | 364 | 1013 | 69.8 |
| | | 361 | 1011 | 73.8 |
| | HT5 | 337 | 982 | 60.6 |
| | | 326 | 955 | 55.4 |
| | | 355 | 982 | 60.3 |
| | HT13 | 332 | 995 | 75.1 |
| | | 332 | 990 | 75.0 |
| | | 332 | 1002 | 74.9 |
| | HT8 | 623 | 1117 | 59.6 |
| | | 618 | 1092 | 44.3 |
| | | 607 | 1121 | 58.5 |
| Alloy 131 | HT1 | 518 | 1034 | 52.5 |
| | | 517 | 1032 | 54.9 |
| | | 517 | 1031 | 53.6 |
| | HT11 | 436 | 1040 | 62.7 |
| | | 436 | 1031 | 59.1 |
| | | 439 | 1043 | 53.3 |
| | HT2 | 340 | 953 | 62.2 |
| | | 342 | 953 | 67.7 |
| | | 349 | 960 | 61.9 |
| | HT12 | 356 | 1023 | 66.4 |
| | | 354 | 1004 | 74.0 |
| | | 351 | 1007 | 74.0 |
| | HT5 | 328 | 948 | 64.1 |
| | | 314 | 951 | 55.5 |
| | | 308 | 945 | 64.6 |
| | HT13 | 324 | 988 | 74.1 |
| | | 320 | 984 | 74.5 |
| | | 322 | 996 | 72.5 |
| | HT8 | 601 | 1078 | 60.8 |
| | | 629 | 1104 | 60.0 |
| | | 624 | 1092 | 65.7 |
| Alloy 132 | HT1 | 444 | 936 | 52.4 |
| | | 437 | 928 | 48.1 |
| | | 437 | 931 | 49.5 |
| | HT11 | 430 | 948 | 55.1 |
| | | 416 | 943 | 53.8 |
| | | 435 | 938 | 54.2 |
| | HT12 | 360 | 927 | 56.0 |
| | | 371 | 923 | 58.2 |
| | | 369 | 934 | 59.2 |
| | HT14 | 323 | 907 | 58.3 |
| | | 326 | 903 | 58.4 |
| | | 320 | 901 | 59.4 |
| | HT8 | 588 | 986 | 49.4 |
| | | 580 | 988 | 47.9 |
| | | 593 | 988 | 52.3 |

TABLE 13-continued

| Tensile Properties of Selected Alloys After Cold Rolling and Heat Treatment | | | | |
|---|---|---|---|---|
| Alloy | Standard Heat Treatment | Yield Stress (MPa) | Ultimate Strength (MPa) | Tensile Elongation (%) |
| HDA-141 | HT15 | 223 | 1083 | 42.1 |
| | | 217 | 1104 | 47.2 |
| | | 220 | 1100 | 49.5 |
| | HT8 | 459 | 1227 | 51.3 |
| | | 470 | 1198 | 58.0 |
| | | 489 | 1220 | 48.5 |
| HDA-142 | HT15 | 217 | 1091 | 46.6 |
| | | 221 | 1107 | 48.1 |
| | | 224 | 1116 | 51.3 |
| | HT8 | 489 | 1248 | 54.2 |
| | | 505 | 1251 | 52.7 |
| | | 487 | 1255 | 56.1 |
| HDA-143 | HT15 | 228 | 1072 | 34.7 |
| | | 226 | 1047 | 32.3 |
| | | 239 | 1135 | 47.8 |
| | HT8 | 502 | 1284 | 54.0 |
| | | 506 | 1247 | 54.3 |
| | | 505 | 1254 | 55.2 |
| Alloy 144 | HT15 | 280 | 823 | 34.3 |
| | | 282 | 838 | 33.2 |
| | | 282 | 850 | 37.8 |
| | HT8 | 501 | 1104 | 71.0 |
| | | 487 | 1104 | 68.8 |
| | | 469 | 1091 | 75.7 |
| Alloy 145 | HT15 | 294 | 801 | 28.0 |
| | | 298 | 825 | 32.0 |
| | | 294 | 832 | 33.1 |
| | HT8 | 540 | 1170 | 48.2 |
| | | 524 | 1178 | 59.0 |
| | | 546 | 1216 | 70.3 |

CASE EXAMPLES

Case Example #1: Tensile Properties Comparison with Existing Steel Grades

Tensile properties of selected alloys were compared with tensile properties of existing steel grades. The selected alloys and corresponding treatment parameters are listed in Table 14. Tensile stress-strain curves are compared to that of existing Dual Phase (DP) steels (FIG. 9); Complex Phase (CP) steels (FIG. 10); Transformation Induced Plasticity (TRIP) steels (FIG. 11); and Martensitic (MS) steels (FIG. 12). A Dual Phase Steel may be understood as a steel type consisting of a ferritic matrix containing hard martensitic second phases in the form of islands, a Complex Phase Steel may be understood as a steel type consisting of a matrix consisting of ferrite and bainite containing small amounts of martensite, retained austenite, and pearlite, a Transformation Induced Plasticity steel may be understood as a steel type which consists of austenite embedded in a ferrite matrix which additionally contains hard bainitic and martensitic second phases and a Martensitic steel may be understood as a steel type consisting of a martensitic matrix which may contain small amounts of ferrite and/or bainite. As it can be seen, the alloys claimed in this disclosure have superior properties as compared to existing advanced high strength (AHSS) steel grades.

TABLE 14

| Downselected Representative Tensile Curve Labels and Identity | | | | |
|---|---|---|---|---|
| Curve Label | Alloy | Hot Rolling | Cold Rolling | Heat Treatment |
| A | Alloy 47 | 87.7%/73.7% at 1100° C. | 25.1% | No |
| B | Alloy 43 | 87.4%/75.4% at 1100° C. | 25.3% | No |
| C | Alloy 47 | 87.7%/73.7% at 1100° C. | 25.1% | 850° C., 5 min |
| D | Alloy 22 | 87.4%/74.0% at 1100° C. | No | No |

Case Example #2: Structure and Properties of High Ductility Alloys in as-Cast State Using commercial purity feedstock, a 3 kg charge of selected alloys were weighed out according to the alloy stoichiometry in Table 4 and cast into a 50 mm thick laboratory slabs in an Indutherm VTC800V vacuum tilt casting machine. Tensile specimens were made from sections close to the bottom of cast slabs by electric discharge machine (EDM). Tensile properties of the alloys in the as cast condition are listed in 15. The ultimate tensile strength values may vary from 440 to 881 MPa with tensile elongation from 1.4 to 20.2%. The yield stress is in a range from 192 to 444 MPa. The mechanical characteristic values in the steel alloys herein will depend on alloy chemistry. FIG. 13 shows a representative tensile stress-strain curve of the as-cast slab from Alloy 8. It can be seen that in the as-cast condition, this alloy reaches 20% elongation that indicates an intrinsically ductile material is formed. Since as-cast slabs will need subsequently post processed such as hot rolling, sufficient ductility is needed for handling to prevent cracking.

TABLE 15

| Tensile Properties of Selected Alloys As Cast | | | |
|---|---|---|---|
| Alloy | Yield Stress (MPa) | UTS (MPa) | Tensile Elongation (%) |
| Alloy 2 | 299 | 590 | 10.8 |
| | 272 | 536 | 11.0 |
| | 280 | 539 | 9.4 |
| Alloy 4 | 277 | 605 | 15.6 |
| | 296 | 655 | 15.0 |
| Alloy 6 | 246 | 538 | 17.2 |
| | 243 | 519 | 16.0 |
| | 255 | 580 | 16.8 |
| Alloy 7 | 255 | 499 | 12.5 |
| | 274 | 584 | 13.4 |
| | 256 | 527 | 15.8 |
| Alloy 8 | 273 | 543 | 14.9 |
| | 282 | 629 | 20.2 |
| | 273 | 528 | 15.2 |
| Alloy 14 | 320 | 584 | 11.4 |
| | 302 | 574 | 11.7 |
| | 300 | 578 | 10.0 |
| Alloy 18 | 249 | 526 | 10.0 |
| | 264 | 534 | 13.8 |
| | 254 | 567 | 16.1 |
| Alloy 19 | 293 | 563 | 12.5 |
| | 266 | 552 | 10.0 |
| | 264 | 529 | 12.4 |
| Alloy 20 | 279 | 548 | 12.8 |
| | 274 | 539 | 11.7 |
| | 302 | 619 | 16.0 |
| Alloy 21 | 244 | 553 | 17.2 |
| | 254 | 538 | 11.8 |
| | 234 | 539 | 18.5 |

TABLE 15-continued

Tensile Properties of Selected Alloys As Cast

| Alloy | Yield Stress (MPa) | UTS (MPa) | Tensile Elongation (%) |
|---|---|---|---|
| Alloy 22 | 269 | 569 | 17.5 |
| | 261 | 635 | 17.8 |
| | 250 | 550 | 14.9 |
| Alloy 23 | 281 | 524 | 11.7 |
| | 292 | 599 | 14.3 |
| | 272 | 536 | 13.4 |
| Alloy 24 | 245 | 566 | 17.0 |
| | 272 | 564 | 14.4 |
| | 250 | 630 | 17.0 |
| Alloy 25 | 271 | 534 | 10.4 |
| | 269 | 559 | 13.3 |
| | 275 | 556 | 9.5 |
| Alloy 26 | 291 | 583 | 11.5 |
| | 259 | 544 | 12.2 |
| | 284 | 507 | 8.1 |
| Alloy 31 | 338 | 651 | 17.8 |
| | 332 | 579 | 14.3 |
| | 328 | 597 | 16.9 |
| Alloy 32 | 248 | 613 | 11.3 |
| | 244 | 543 | 9.6 |
| | 243 | 563 | 8.4 |
| Alloy 33 | 306 | 616 | 15.4 |
| | 297 | 565 | 13.5 |
| | 287 | 549 | 13.7 |
| Alloy 34 | 318 | 665 | 18.7 |
| | 331 | 606 | 14.5 |
| | 332 | 602 | 15.6 |
| Alloy 35 | 252 | 666 | 15.6 |
| | 265 | 563 | 11.8 |
| | 283 | 586 | 11.5 |
| Alloy 36 | 277 | 538 | 12.7 |
| | 290 | 611 | 15.0 |
| | 276 | 551 | 12.7 |
| Alloy 37 | 318 | 645 | 18.6 |
| | 312 | 579 | 13.8 |
| | 316 | 584 | 14.7 |
| Alloy 38 | 271 | 611 | 12.6 |
| | 294 | 585 | 11.4 |
| | 275 | 560 | 10.3 |
| Alloy 39 | 307 | 559 | 12.6 |
| | 303 | 590 | 15.2 |
| | 310 | 594 | 11.5 |
| Alloy 40 | 331 | 596 | 11.7 |
| | 347 | 622 | 10.1 |
| | 337 | 583 | 12.2 |
| Alloy 41 | 294 | 542 | 13.0 |
| | 296 | 526 | 9.4 |
| | 289 | 562 | 14.4 |
| Alloy 42 | 296 | 604 | 12.2 |
| | 273 | 547 | 14.3 |
| | 279 | 552 | 13.8 |
| Alloy 43 | 299 | 572 | 16.3 |
| | 311 | 574 | 12.1 |
| | 293 | 543 | 12.9 |
| Alloy 44 | 244 | 539 | 10.4 |
| | 251 | 592 | 11.6 |
| | 249 | 602 | 13.1 |
| Alloy 45 | 244 | 603 | 5.4 |
| | 283 | 592 | 6.1 |
| | 230 | 596 | 7.1 |
| Alloy 46 | 238 | 645 | 9.4 |
| | 245 | 599 | 8.6 |
| | 244 | 602 | 9.1 |
| Alloy 47 | 271 | 632 | 8.3 |
| | 248 | 640 | 9.8 |
| | 278 | 677 | 9.6 |
| Alloy 48 | 240 | 607 | 9.3 |
| | 242 | 582 | 8.4 |
| | 235 | 584 | 8.4 |
| Alloy 49 | 238 | 589 | 7.2 |
| | 231 | 615 | 9.9 |
| | 270 | 599 | 7.9 |
| Alloy 50 | 304 | 596 | 8.7 |
| | 277 | 582 | 8.8 |
| | 261 | 631 | 11.0 |

TABLE 15-continued

Tensile Properties of Selected Alloys As Cast

| Alloy | Yield Stress (MPa) | UTS (MPa) | Tensile Elongation (%) |
|---|---|---|---|
| Alloy 51 | 245 | 615 | 12.7 |
| | 253 | 543 | 8.6 |
| Alloy 53 | 282 | 604 | 14.9 |
| | 286 | 646 | 14.5 |
| | 295 | 580 | 11.9 |
| Alloy 54 | 243 | 652 | 12.9 |
| | 248 | 609 | 12.6 |
| | 275 | 606 | 11.2 |
| Alloy 55 | 237 | 600 | 13.7 |
| | 289 | 590 | 12.3 |
| | 248 | 618 | 13.0 |
| Alloy 56 | 239 | 615 | 14.5 |
| | 248 | 560 | 12.2 |
| | 239 | 519 | 10.5 |
| Alloy 57 | 225 | 543 | 13.5 |
| | 262 | 524 | 11.1 |
| | 247 | 616 | 16.0 |
| Alloy 58 | 327 | 881 | 11.8 |
| | 244 | 580 | 10.4 |
| | 261 | 598 | 10.9 |
| Alloy 59 | 273 | 646 | 16.9 |
| | 252 | 578 | 14.6 |
| | 281 | 565 | 13.1 |
| Alloy 60 | 301 | 553 | 3.8 |
| | 289 | 551 | 4.2 |
| | 289 | 546 | 3.9 |
| Alloy 61 | 225 | 536 | 7.6 |
| | 267 | 587 | 5.3 |
| | 259 | 593 | 6.8 |
| Alloy 62 | 340 | 662 | 8.1 |
| | 375 | 672 | 8.6 |
| | 278 | 628 | 10.7 |
| Alloy 63 | 228 | 550 | 6.2 |
| | 239 | 540 | 6.0 |
| | 223 | 522 | 6.3 |
| Alloy 64 | 294 | 571 | 7.5 |
| | 245 | 538 | 8.2 |
| | 263 | 590 | 9.9 |
| Alloy 65 | 251 | 561 | 11.7 |
| | 215 | 559 | 12.6 |
| | 235 | 580 | 11.9 |
| Alloy 66 | 194 | 527 | 6.3 |
| | 203 | 544 | 6.2 |
| | 205 | 663 | 6.3 |
| Alloy 67 | 285 | 539 | 6.2 |
| | 254 | 591 | 9.1 |
| | 263 | 626 | 10.4 |
| Alloy 68 | 272 | 582 | 11.9 |
| | 251 | 567 | 12.8 |
| | 269 | 627 | 14.0 |
| Alloy 69 | 192 | 581 | 6.1 |
| | 223 | 575 | 8.1 |
| | 250 | 560 | 7.0 |
| Alloy 70 | 237 | 636 | 11.2 |
| | 234 | 595 | 9.8 |
| | 264 | 581 | 8.4 |
| Alloy 71 | 225 | 519 | 10.3 |
| | 235 | 554 | 12.4 |
| | 239 | 566 | 9.2 |
| Alloy 72 | 254 | 543 | 4.3 |
| | 265 | 586 | 5.4 |
| | 261 | 537 | 4.6 |
| Alloy 73 | 252 | 601 | 8.0 |
| | 232 | 622 | 7.3 |
| | 290 | 585 | 6.2 |
| Alloy 74 | 267 | 601 | 9.4 |
| | 207 | 693 | 11.8 |
| | 255 | 622 | 11.7 |
| Alloy 75 | 294 | 596 | 6.9 |
| | 235 | 636 | 9.3 |
| | 245 | 546 | 7.0 |
| Alloy 76 | 259 | 576 | 7.9 |
| | 253 | 595 | 9.6 |
| | 256 | 557 | 8.6 |

TABLE 15-continued

Tensile Properties of Selected Alloys As Cast

| Alloy | Yield Stress (MPa) | UTS (MPa) | Tensile Elongation (%) |
|---|---|---|---|
| Alloy 77 | 263 | 558 | 9.3 |
| | 269 | 569 | 8.0 |
| | 221 | 562 | 10.0 |
| Alloy 78 | 208 | 582 | 13.6 |
| | 207 | 512 | 10.7 |
| | 231 | 585 | 13.5 |
| Alloy 79 | 223 | 619 | 14.8 |
| | 236 | 601 | 14.2 |
| | 269 | 631 | 11.6 |
| Alloy 80 | 219 | 618 | 11.1 |
| | 211 | 530 | 8.1 |
| | 235 | 627 | 10.8 |
| Alloy 81 | 243 | 626 | 11.4 |
| | 237 | 601 | 12.4 |
| | 222 | 639 | 12.1 |
| Alloy 82 | 275 | 661 | 11.4 |
| | 244 | 661 | 10.8 |
| | 253 | 553 | 7.8 |
| Alloy 83 | 218 | 631 | 8.0 |
| | 244 | 615 | 7.9 |
| | 241 | 608 | 8.6 |
| Alloy 84 | 281 | 590 | 10.8 |
| | 308 | 607 | 9.1 |
| | 282 | 580 | 10.5 |
| Alloy 85 | 288 | 632 | 11.2 |
| | 280 | 560 | 7.7 |
| | 275 | 619 | 9.6 |
| Alloy 86 | 279 | 599 | 10.1 |
| | 293 | 636 | 10.6 |
| | 299 | 652 | 10.1 |
| Alloy 87 | 275 | 615 | 10.1 |
| | 273 | 623 | 9.5 |
| | 339 | 627 | 8.1 |
| Alloy 88 | 284 | 640 | 10.8 |
| | 287 | 603 | 9.7 |
| | 263 | 640 | 8.9 |
| Alloy 89 | 284 | 636 | 8.9 |
| | 315 | 595 | 7.2 |
| | 279 | 636 | 9.7 |
| Alloy 90 | 250 | 551 | 9.9 |
| | 220 | 608 | 13.2 |
| | 236 | 567 | 10.6 |
| Alloy 91 | 236 | 587 | 11.4 |
| | 238 | 511 | 9.1 |
| | 283 | 596 | 11.0 |
| Alloy 92 | 253 | 613 | 12.4 |
| | 270 | 564 | 9.8 |
| | 281 | 621 | 12.2 |
| Alloy 93 | 239 | 575 | 11.6 |
| | 246 | 565 | 12.4 |
| | 282 | 641 | 12.0 |
| Alloy 94 | 229 | 566 | 6.4 |
| | 251 | 607 | 8.4 |
| | 245 | 613 | 9.3 |
| Alloy 95 | 246 | 611 | 11.7 |
| | 203 | 665 | 11.5 |
| | 220 | 604 | 11.0 |
| Alloy 96 | 405 | 599 | 6.9 |
| | 389 | 545 | 6.3 |
| | 387 | 563 | 7.3 |
| Alloy 97 | 260 | 605 | 18.1 |
| | 283 | 617 | 19.7 |
| | 277 | 603 | 19.8 |
| Alloy 98 | 381 | 501 | 2.8 |
| | 386 | 526 | 4.3 |
| | 394 | 506 | 2.0 |
| Alloy 99 | 439 | 634 | 4.7 |
| | 439 | 626 | 3.6 |
| | 444 | 666 | 4.9 |
| Alloy 100 | 316 | 478 | 7.9 |
| | 335 | 538 | 9.7 |
| | 332 | 507 | 10.6 |
| Alloy 101 | 261 | 484 | 14.3 |
| | 258 | 443 | 14.0 |
| | 257 | 448 | 13.4 |

TABLE 15-continued

Tensile Properties of Selected Alloys As Cast

| Alloy | Yield Stress (MPa) | UTS (MPa) | Tensile Elongation (%) |
|---|---|---|---|
| Alloy 102 | 268 | 637 | 13.3 |
| | 310 | 672 | 14.3 |
| | 307 | 667 | 14.5 |
| Alloy 103 | 346 | 538 | 1.4 |
| | 321 | 649 | 4.2 |
| | 337 | 623 | 3.2 |
| | 340 | 574 | 1.9 |
| | 320 | 594 | 2.6 |
| | 313 | 602 | 2.5 |
| Alloy 104 | 259 | 562 | 4.3 |
| | 251 | 551 | 6.1 |
| | 244 | 550 | 5.4 |
| Alloy 105 | 196 | 548 | 8.1 |
| | 207 | 653 | 8.4 |
| | 201 | 580 | 8.1 |
| | 210 | 440 | 4.9 |
| | 210 | 452 | 4.9 |
| | 216 | 455 | 5.1 |
| Alloy 106 | 225 | 509 | 7.3 |
| | 220 | 481 | 5.5 |
| | 240 | 492 | 5.5 |
| Alloy 107 | 226 | 502 | 6.8 |
| | 234 | 550 | 7.6 |
| | 236 | 547 | 6.4 |
| Alloy 108 | 211 | 559 | 7.0 |
| | 213 | 557 | 8.0 |
| | 216 | 599 | 8.1 |
| Alloy 109 | 201 | 677 | 10.1 |
| | 260 | 612 | 9.6 |
| | 313 | 636 | 8.6 |
| Alloy 110 | 277 | 582 | 6.4 |
| | 219 | 625 | 7.7 |
| | 242 | 549 | 5.5 |
| Alloy 111 | 225 | 583 | 7.4 |
| | 213 | 597 | 7.6 |
| | 196 | 601 | 7.1 |
| Alloy 112 | 210 | 629 | 7.9 |
| | 202 | 536 | 4.5 |
| | 202 | 586 | 6.1 |
| Alloy 113 | 236 | 589 | 8.5 |
| | 214 | 632 | 7.7 |
| | 293 | 607 | 7.8 |

The microstructure of the Alloy 8 slab in as-cast state was studied by scanning electron microscopy (SEM) and transmission electron microscopy (TEM). For SEM study, the cross-section of the cast slab was ground on SiC abrasive papers with reduced grit size, and then polished progressively with diamond media paste down to 1 μm. The final polishing was done with 0.02 μm grit $SiO_2$ solution. Microstructures were examined by scanning electron microscopy (SEM) using an EVO-MA10 scanning electron microscope manufactured by Carl Zeiss SMT Inc. To prepare TEM specimens, the EDM cut piece was first thinned by grinding with pads of reduced grit size every time, and further thinned to 60 to 70 μm thickness by polishing with 9 μm, 3 μm and 1 μm diamond suspension solution, respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling was done at 4.5 Kev, and the inclination angle was reduced from 4° to 2° to open up the thin area. The TEM studies were done using a JEOL 2100 high-resolution microscope operated at 200 kV.

SEM backscattered images of Alloy 8 as-cast slab show a dendritic matrix phase with $M_2B$ boride phase at the grain boundaries, as shown in FIG. 14. In general, the matrix phase grains are of tens of microns in size while the interdendritic $M_2B$ boride phase is on the order of 1 to 5 μm that is typical for Modal Structure (Structure #1, FIG. 4). Note that additional austenite phase is generally found in the interdendritic regions with the complex $M_2B$ boride phase. Microstructure in the center of the slab is slightly coarser than that close to the slab surface (FIGS. 14*a* and *b*). TEM study of the as-cast Alloy 8 sample from the center of the slab shows that the matrix grains contain few dislocations (FIG. 15*a*). Selected electron diffraction pattern and a number of observed stacking faults suggest that the matrix is represented by face-centered-cubic phase of γ-Fe (FIG. 15 and FIG. 16). It can be seen that the TEM results corresponds very well to the tensile test results. The austenitic matrix phase in the as-cast slab provides substantial ductility for the subsequent slab processing hot rolling steps.

This Case Example illustrates that a formation of Modal Structure (Structure #1, FIG. 4) in the High Ductility Alloys herein is an initial step and a key factor for further microstructural development through post processing towards advanced property combinations.

Case Example #3: Mixed Microconstituent Structure Formation after Hot Rolling

Using commercial purity feedstock, a 3 kg charge of Alloy 8 was weighed out according to the alloy stoichiometry in Table 4 and cast into a 50 mm thick laboratory slab in an Indutherm VTC800V vacuum tilt casting machine that was then processed with a two-step hot rolling at 1075° C. by a rolling strain of 87.5% and 73.4%, respectively (total reduction is ~97%). The thickness of hot rolled sheet was ~1.7 mm. The tensile specimen was cut from the sheet material after hot rolling using wire electrical discharge machining (EDM). Tensile properties were measured on an Instron mechanical testing frame (Model 3369), utilizing Instron's Bluehill control and analysis software. The test was run at room temperature in displacement control with the bottom fixture held rigid and the top fixture moving; the load cell is attached to the top fixture. Corresponding stress-strain curve is shown in FIG. 17. The alloy in the hot rolled condition has demonstrated ductility of 56% with ultimate strength of 1155 MPa. The ductility is 2.8 times greater than the as-cast ductility of Alloy 8 (FIG. 13) in Case Example #2. Samples for SEM, x-ray and TEM studies were cut from the hot rolled sheet before and after deformation.

To make SEM specimens, the cross-section samples of the sheets were cut and ground by SiC paper and then polished progressively with diamond media paste down to 1 μm grit. The final polishing was done with 0.02 μm grit $SiO_2$ solution. The microstructure at central layer region of cross-section of sheet was observed, imaged and evaluated. SEM microscopic analysis was conducted using an EVO-MA10 scanning electron microscope manufactured by Carl Zeiss SMT Inc. Microstructure of hot rolled samples studied by SEM is shown in FIG. 18. As it can be seen, after hot rolling with total reduction of 97% at 1075° C., the coarse as-cast dendritic microstructure (Modal Structure, FIG. 4) is broken-up and homogenized through Dynamic Nanophase Refinement (Mechanism #1, FIG. 4). The hot rolled microstructure is represented by a Homogenized NanoModal Structure (Structure #2, FIG. 4) containing a matrix phase with borides phase (the black phase) homogeneously distributed in the matrix. The size of the boride phase is typically in the range from 1 to 5 μm, with some elongated borides of 10 to 15 μm aligned in the rolling direction.

Additional details of the Alloy 8 structure were revealed using X-ray diffraction. X-ray diffraction was done using a Panalytical X'Pert MPD diffractometer with a Cu Kα x-ray tube and operated at 45 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIG. 19 and FIG. 20, X-ray diffraction scans are shown including the measured/experimental pattern and the Rietveld refined pattern for the Alloy 8 after hot rolling and, after hot rolling and tensile testing, respectively. As can be seen, good fit of the experimental data was obtained in both cases. Analysis of the X-ray patterns including specific phases found, their space groups and lattice parameters is shown in Table 16. Note that in complex multicomponent crystals, the atoms are not often situated at the lattice points. Additionally, each lattice point will not correlate necessarily to a singular atom but instead to a group of atoms. Space group theory, thus expands on the relationship of symmetry in a unit cell and relates all of the possible combinations of atoms in space. Mathematically then there are a total of 230 different space groups which are made from combinations of the 32 Crystallographic Point Groups with the 14 Bravais Lattices, with each Bravais Lattice belonging to one of 7 Lattice Systems. The 230 unique space groups describe all possible crystal symmetries arising from periodic arrangements of atoms in space with the total number arising from various combinations of symmetry operations including various combinations of translational symmetry operations in the unit cell including lattice centering, reflection, rotation, rotoinversion, screw axis and glide plane operations. For hexagonal crystal structures, there are a total of 27 hexagonal space groups which are identified by space group numbers #168 through #194.

As can be seen in Table 16, after hot rolling (at 1075° C. with 97% reduction) three phases are found which are γ-Fe (austenite), $M_2B_1$ phase, and ditrigonal dipyramidal hexagonal phase. The presence of the hexagonal phase is a characteristic feature of Dynamic Nanophase Refinement (Mechanism #1, FIG. 4). After tensile deformation two additional phases of α-Fe and dihexagonal pyramidal hexagonal phase were identified as a result of austenite transformation under the stress through Dynamic Nanophase Strengthening (Mechanism #2, FIG. 4). Along with additional phase formation, the lattice parameters of the identified phases change indicating that the amount of solute elements dissolved in these phases changed. This would indicate that phase transformations are induced by element redistribution under the applied stress.

TABLE 16

Rietveld Phase Analysis of Alloy 8 Structure After Hot Rolling

| Condition | Phase 1 | Phase 2 | Phase 3 | Phase 4 | Phase 5 |
|---|---|---|---|---|---|
| | γ - Fe | $M_2B$ | Hexagonal Phase 1 | | |
| Hot Rolled Sheet | Structure: Cubic Space group #: 225 (Fm3m) LP: a = 3.599 Å | Structure: Tetragonal Space group #: 140 (I4/mcm) LP: a = 5.132 Å, c = 4.203 Å | Structure: Hexagonal Space group #: #190 (P6bar2C) LP: a = 5.180 Å, c = 13.242 Å | | |
| | γ - Fe | α-Fe | $M_2B$ | Hexagonal Phase 1 (new) | Hexagonal Phase 2 (new) |
| Hot Rolled and Tensile Tested | Structure: Cubic Space group #: 225 (Fm3m) LP: a = 3.596 Å | Structure: Cubic Space group #: #229 (Im3m) LP: a = 2.894 Å | Structure: Tetragonal Space group #: 140 (I4/mcm) LP: a = 5.134 Å, c = 4.190 Å | Structure: Hexagonal Space group #: #190 (P6bar2C) LP: a = 5.129 Å, c = 12.174 Å | Structure: Hexagonal Space group #: #186 (P63mc) LP: a = 2.942 Å, c = 6.431 Å |

To examine the structural features of the Alloy 8 structure in more detail, high resolution transmission electron microscopy (TEM) was utilized. To prepare TEM specimens, the gage sections of tensile tested samples were first cut with EDM, and then thinned by grinding with pads of reduced grit size every time. Further thinning to 60 to 70 μm thickness was done by polishing with 9 μm, 3 μm, and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens may be ion-milled using a Gatan Precision Ion Polishing System (PIPS). The ion-milling was done at 4.5 Kev, and the inclination angle was reduced from 4° to 2° to open up the thin area. The TEM studies were done using a JEOL 2100 high-resolution microscope operated at 200 kV.

FIG. 21 shows the bright-field TEM image and selected area diffraction pattern of Alloy 8 sample after hot rolling. It can be seen that the sample after hot rolling contains relatively large dislocation cells that are formed within the matrix grains. The size of the dislocation cells is on the order of 2 to 4 μm. The cell wall is formulated with high density of dislocations while the dislocation density inside the cell is relatively low. The selected area electron diffraction suggests that the crystal structure remains face-centered-cubic austenitic structure (γ-Fe) that corresponds to x-ray data. Ditrigonal dipyramidal hexagonal phase was not detected by TEM analysis suggesting extremely small nanoscale grains at nanoscale which are difficult to observe.

The TEM images of Alloy 8 microstructure after the hot rolling and tensile deformation are shown in FIG. 22 and FIG. 23 demonstrating two different structures coexisting in the deformed sample. There are structural regions that are represented by large matrix grains with a high density of dislocations, as shown in FIG. 22. It can be seen that dislocations interact with each other and are heavily entangled. As a result, the interaction of dislocations turns into dislocation cell structure with obviously higher dislocation density at cell boundaries than at the cell interior. The dislocation cells in the deformed structure are obviously smaller that these at initial state after hot rolling. Structural features of these regions are typical for Modal Nanophase Structure of Structure 3*a* alloys (FIG. 4). In addition to Modal Nanophase Structure, there are regions of microstructure in the Alloy 8 sample after the hot rolling and tensile deformation that contains significantly refined grains with size of 100 to 300 nm as shown in FIGS. 27*a* and 27*b*. This refined structure corresponds to High Strength Nanomodal Structure that forms through Dynamic Nanophase Strengthening upon plastic deformation (Mechanism #2, FIG. 4). Dynamic Nanophase Strengthening in hot rolled Alloy 8 did not occur universally but locally in "pockets" of sample microstructure leading to formation of Mixed Microconstituent Structure (Structure #3, FIG. 4) in the sample volume.

This Case Example illustrates a formation of the Mixed Microconstituent Structure through Dynamic Nanophase Strengthening in "pockets" of hot rolled Alloy 8 sample microstructure upon deformation when transformed microconstituent regions of High Strength Nanomodal Structure with refined grains and microconstituent regions of Modal Nanophase Structure.

Case Example #4: Heat Treatment Effect on Mixed Microconstituent Structure Formation after Hot Rolling in Alloy 8

The Alloy 8 hot rolled sheet from previous Case Example #3 was heat treated at 950° C. for 6 hr and at 1075° C. for 2 hr. The tensile specimens were cut from the sheet material after hot rolling and heat treatment using wire electrical discharge machining (EDM). Tensile properties were measured on an Instron mechanical testing frame (Model 3369), utilizing Instron's Bluehill control and analysis software. The tests were run at room temperature in displacement control with the bottom fixture held rigid and the top fixture moving; the load cell is attached to the top fixture. Corresponding stress-strain curves are shown in FIG. 24. Samples for SEM, x-ray and TEM studies were cut from the hot rolled sheet before and after deformation.

To make SEM specimens, the cross-section samples of the sheets were cut and ground by SiC paper and then polished progressively with diamond media paste down to 1 μm grit. The final polishing was done with 0.02 μm grit $SiO_2$ solution. The microstructure at central layer region of cross-section of sheet was observed, imaged and evaluated. SEM microscopic analysis was conducted using an EVO-MA10 scanning electron microscope manufactured by Carl Zeiss SMT Inc. FIG. 25 shows the backscattered SEM image of Alloy 8 samples after hot rolling and heat treatment at 950° C. for 6 hours. Compared to the sample after hot rolling (FIG. 18), the dimension and morphology of boride phase did not show an obvious change, but the matrix phase is recrystallized. Similarly the heat treatment at 1075° C. for 2 hours did not change the size and morphology of boride phase, FIG. 30, but matrix grains show sharp clear boundaries suggesting that a higher extent of recrystallization occurred with slightly larger average size. In addition, some annealing twins may be found. The SEM results suggest that heat treatment induces recrystallization in the hot rolled sheet with formation of Recrystallized Modal Structure (Structure #2*a*, FIG. 4), and increasing the heat treatment temperature would cause a higher degree of recrystallization as well as some growth of the matrix phase.

Additional details of the Alloy 8 structure after hot rolling and heat treatment at 950° C. for 6 hours were revealed using X-ray diffraction. X-ray diffraction was done using a Panalytical X'Pert MPD diffractometer with a Cu Kα x-ray tube and operated at 45 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIG. 27 and FIG. 28, X-ray diffraction scans are shown including the measured/experimental pattern and the Rietveld refined pattern for the Alloy 8 after hot rolling and heat treatment in the undeformed condition and after tensile testing, respectively. As can be seen, good fit of the experimental data was obtained in both cases. Analysis of the X-ray patterns including specific phases found, their space groups and lattice parameters is shown in Table 16.

As can be seen in Table 17, after hot rolling (at 1075° C. with 97% reduction) and heat treatment (950° C. for 6 hours), four phases were identified: γ-Fe (austenite), M2B1 phase, ditrigonal dipyramidal hexagonal phase and dihexagonal pyramidal hexagonal phase. As compared to phase composition of Alloy 8 after hot rolling only (Table 16), a second hexagonal phase is formed upon heat treatment suggesting phase transformation in addition to recrystallization. After tensile deformation, a fifth phase, α-Fe, was found in the sample, suggesting further austenite transformation under tensile stress. Along with additional phase formation, the lattice parameters of initial phases change indicating that the amount of solute elements dissolved in these phases have changed. This would indicate that phase transformations are induced by elements redistribution under the applied stress.

TABLE 17

Rietveld Phase Analysis of Alloy 8 Structure After Hot Rolling and Heat Treatment

| Condition | Phase 1 | Phase 2 | Phase 3 | Phase 4 | Phase 5 |
|---|---|---|---|---|---|
| | γ - Fe | $M_2B$ | Hexagonal Phase 1 | Hexagonal Phase 2 | |
| Hot Rolled and Heat Treated Sheet | Structure: Cubic Space group #: 225 (Fm3m) LP: a = 3.597 Å | Structure: Tetragonal Space group #: 140 (I4/mcm) LP: a = 5.131 Å, c = 4.198 Å | Structure: Hexagonal Space group #: #190 (P6bar2C) LP: a = 5.217 Å, c = 12.345 Å | Structure: Hexagonal Space group #: #186 (P63mc) LP: a = 2.969 Å, c = 6.551 Å | |
| | γ - Fe | α-Fe | $M_2B$ Structure: | Hexagonal Phase 1 | Hexagonal Phase 2 |
| Hot Rolled, Heat Treated and Tensile Tested | Structure: Cubic Space group #: 225 (Fm3m) LP: a = 3.593 A | Structure: Cubic Space group #: #229 (Im3m) LP: a = 2.875 Å | Tetragonal Space group #: 140 (I4/mcm) LP: a = 5.082 Å, c = 4.740 Å | Structure: Hexagonal Space group #: #190 (P6bar2C) LP: a = 5.117 Å, c = 12.034 Å | Structure: Hexagonal Space group #: #186 (P63mc) LP: a = 2.943 Å, c = 6.447 Å |

To examine the structural features of the Alloy 8 after hot rolling (at 1075° C. with 97% reduction) and heat treatment (950° C. for 6 hours) in more detail, high resolution transmission electron microscopy (TEM) was utilized. To prepare TEM specimens, the samples were first cut with EDM, and then thinned by grinding with pads of reduced grit size every time. Further thinning to 60 to 70 μm thickness was done by polishing with 9 μm, 3 μm, and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling was done at 4.5 Kev, and the inclination angle was reduced from 4° to 2° to open up the thin area. The TEM studies were done using a JEOL 2100 high-resolution microscope operated at 200 kV.

The TEM images of hot rolled Alloy 8 slab sample after heat treatments at 950° C. and 1075° C. are shown in FIG. 29 and FIG. 30, respectively. In both cases, Recrystallized Modal Structure (Structure #2*a*, FIG. 4) with relatively large matrix grains was observed as a result of recrystallization during heat treatment. The results are consistent with SEM observation (FIG. 25 and FIG. 30). Matrix grains have sharp straight grain boundaries and are free from dislocations but contain stacking faults. Selected area electron diffraction shows that the crystal structure of recrystallized matrix grains is of face-centered-cubic structure of γ-Fe. After the samples were tensile tested to fracture, different microstructures are however found between the samples heat treated at 950° C. and 1075° C. As shown in FIG. 31 and FIG. 32, in hot rolled Alloy 8 sample after heat treatment at 950° C., dislocations were generated in the recrystallized matrix grains of Modal Nanophase Structure (Structure #3*a*, FIG. 4) and "pockets" of transformed High Strength Nanomodal Structure (Structure #3*b*, FIG. 4) were found throughout the sample volume as a result of local Dynamic Nanophase Strengthening (Mechanism #2, FIG. 4). The refined grains are shown by bright-field TEM image and verified by dark-field image in FIG. 32. The transformed "pocket" is displayed in lower magnification images shown in FIG. 33. It can be seen that the neighboring area shows less extent of refinement or transformation compared to the transformed "pocket". Since the sample was recrystallized by heat treatment prior to the tensile deformation, transformed "pockets" appear to be related to the crystal orientation of the recrystallized grains. As shown in FIG. 33*b*, some recrystallized grains had higher extent of transformation than others, for the refined grains are more readily visualized in the transformed areas. It is presumed that the crystal orientation in some grains was in favor of easy dislocation slip such that high dislocation density was accumulated causing localized phase transformation leading to the grain refinement. In the sample heat treated at 1075° C., although dislocations were generated forming a large dislocation cell in the recrystallized matrix grains as shown in FIG. 34*a*, it can be seen that the dislocations are loosely packed and "pockets" of transformed microstructure were not clearly observed. As a result, overall a lesser extent of austenite transformation through Dynamic Nanophase Strengthening in the sample heat treated at 1075° C. resulted in lower properties as compared to that heat treated at 950° C. (FIG. 24).

This Case Example illustrates the formation of the Mixed Microconstituent Structure upon deformation of the alloy in hot rolled and heat treated state where transformed regions of High Strength Nanomodal Structure with refined grains are distributed in the Modal NanoPhase Structure of the un-transformed matrix.

Case Example #5: Mixed Microconstituent Structure Formation after Cold Rolling in Alloy 8

Using commercial purity feedstock, a 3 kg charge of Alloy 8 was weighed out according to the alloy stoichiometry in Table 4 and cast into a 50 mm thick laboratory slab in an Indutherm VTC800V vacuum tilt casting machine that was then processed with a two-step hot rolling at 1075° C. by rolling strains of 87.5% and 73.4%. The final thickness of the hot rolled sheet was 1.7 mm. Hot rolled Alloy 8 sheet was further cold rolled by 19.2% to 1.4 mm thickness. Cold rolled Alloy 8 sheet was heat treated at 950° C. for 6 hr. Tensile specimens were cut from the sheet material after cold rolling and after cold rolling and heat treatment using wire electrical discharge machining (EDM). Tensile properties were measured on an Instron mechanical testing frame (Model 3369), utilizing Instron's Bluehill control and analysis software. The test was run at room temperature in displacement control with the bottom fixture held rigid and the top fixture moving; the load cell is attached to the top fixture. Corresponding stress-strain curves are shown in FIG. 35. Samples for SEM, x-ray, and TEM studies were cut from the hot rolled sheet before and after deformation.

To make SEM specimens, the cross-section samples of the sheets were cut and ground by SiC paper and then polished progressively with diamond media paste down to 1 μm grit. The final polishing was done with 0.02 μm grit $SiO_2$ solution. The microstructure at the central layer of cross-section of sheet was observed, imaged, and evaluated. SEM microscopic analysis was conducted using an EVO-MA10 scanning electron microscope manufactured by Carl Zeiss SMT Inc.

FIG. 36 shows the backscattered SEM image of the Alloy 8 sheet after hot rolling and cold rolling. It can be seen that the cold rolling did not significantly change morphology and dimension of borides, although some large boride phase may have been crushed into smaller pieces slightly lowering the average boride size. Rolling texture appears to form in the sheet along horizontal direction, as can be seen from the alignment of boride phase in FIG. 36. Following the cold rolling, heat treatment at 950° C. for 6 hours did not modify the dimension and morphology of borides, but resulted in full matrix grain recrystallization (FIG. 37). The resultant microstructure contains equiaxed matrix grains with a size in the range of 15 to 40 μm. As shown in FIG. 37, the recrystallized matrix grains exhibit sharp and straight grain boundaries. The high degree of recrystallization is resulted from the high strain energy introduced by cold rolling.

Additional details of the Alloy 8 structure are revealed using X-ray diffraction. X-ray diffraction was done using a Panalytical X'Pert MPD diffractometer with a Cu Kα x-ray tube and operated at 45 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIG. 38 through FIG. 41, X-ray diffraction scans are shown including the measured/experimental pattern and the Rietveld refined pattern for the Alloy 8 after cold rolling (FIG. 38), after cold rolling and tensile testing (FIG. 39), after cold rolling and heat treatment (FIG. 40), after cold rolling, heat treatment and tensile testing (FIG. 41). As can be seen, good fit of the experimental data was obtained in both cases. Analysis of the X-ray patterns including specific phases found, their space groups, and lattice parameters is shown in Table 17.

As can be seen in Table 18, four phases were identified: γ-Fe (austenite), α-Fe (ferrite), $M_2B_1$ phase, and ditrigonal dipyramidal hexagonal phase in all cases when cold rolling was applied. However, the lattice parameters of the phases change indicating that the amount of solute elements dissolved in these phases have changed depending on the alloy processing.

TABLE 18

Rietveld Phase Analysis of Alloy 8 Structure After Cold Rolling and Heat Treatment

| Condition | Phase 1 | Phase 2 | Phase 3 | Phase 4 |
|---|---|---|---|---|
| | γ - Fe | α-Fe | $M_2B$ | Hexagonal Phase 1 |
| Cold Rolled Sheet | Structure: Cubic<br>Space group #: | Structure: Cubic<br>Space group #: | Structure: Tetragonal<br>Space group #: | Structure:<br>Hexagonal |

TABLE 18-continued

| Rietveld Phase Analysis of Alloy 8 Structure After Cold Rolling and Heat Treatment | | | | |
|---|---|---|---|---|
| Condition | Phase 1 | Phase 2 | Phase 3 | Phase 4 |
| | 225 (Fm3m)<br>LP: a = 3.595 Å | #229 (Im3m)<br>LP: a = 2.896 Å | 140 (I4/mcm)<br>LP: a = 5.141 Å,<br>c = 4.175 Å | Space group #:<br>#190 (P6bar2C)<br>LP: a = 5.162 Å,<br>c = 13.225 Å |
| | γ - Fe | α-Fe | $M_2B$ | Hexagonal<br>Phase 1 |
| Cold Rolled and Tensile Tested | Structure: Cubic<br>Space group #:<br>225 (Fm3m)<br>LP: a = 3.596 Å | Structure: Cubic<br>Space group #:<br>#229 (Im3m)<br>LP: a = 2.895 Å | Structure:<br>Tetragonal<br>Space group #:<br>140 (I4/mcm)<br>LP: a = 5.129 Å,<br>c = 4.190 Å | Structure:<br>Hexagonal<br>Space group #:<br>#190 (P6bar2C)<br>LP: a = 5.120 Å,<br>c = 12.785 Å |
| | γ - Fe | α-Fe | $M_2B$ | Hexagonal<br>Phase 1 |
| Cold Rolled and Heat Treated Sheet | Structure: Cubic<br>Space group #:<br>225 (Fm3m)<br>LP: a = 3.599 Å | Structure: Cubic<br>Space group #:<br>#229 (Im3m)<br>LP: a = 2.894 Å | Structure:<br>Tetragonal<br>Space group #:<br>140 (I4/mcm)<br>LP: a = 5.130 Å,<br>c = 4.202 Å | Structure:<br>Hexagonal<br>Space group #:<br>#190 (P6bar2C)<br>LP: a = 5.112 Å,<br>c = 12.785 Å |
| | γ - Fe | α-Fe | $M_2B$ | Hexagonal<br>Phase 1 |
| Cold Rolled, Heat Treated and Tensile Tested | Structure: Cubic<br>Space group #:<br>225 (Fm3m)<br>LP: a = 3.594 Å | Structure: Cubic<br>Space group #:<br>#229 (Im3m)<br>LP: a = 2.869 Å | Structure:<br>Tetragonal<br>Space group #:<br>140 (I4/mcm)<br>LP: a = 5.119 Å,<br>c = 4.198 Å | Structure:<br>Hexagonal<br>Space group #:<br>#190 (P6bar2C)<br>LP: a = 5.184 Å,<br>c = 12.785 Å |

To examine the structural features of the Alloy 8 structure in more detail, high resolution transmission electron microscopy (TEM) was utilized. To prepare TEM specimens, the samples were first cut with EDM, and then thinned by grinding with pads of reduced grit size every time. Further thinning to 60 to 70 μm thickness was done by polishing with 9 μm, 3 μm, and 1 μm diamond suspension solution respectively. Discs of 3 mm in diameter were punched from the foils and the final polishing was fulfilled with electropolishing using a twin-jet polisher. The chemical solution used was a 30% nitric acid mixed in methanol base. In case of insufficient thin area for TEM observation, the TEM specimens were ion-milled using a Gatan Precision Ion Polishing System (PIPS). The ion-milling was done at 4.5 Kev, and the inclination angle was reduced from 4° to 2° to open up the thin area. The TEM studies were done using a JEOL 2100 high-resolution microscope operated at 200 kV.

The TEM images of Alloy 8 after cold rolling are shown in FIG. 42. As it can be seen, dislocation cell structure is present in the matrix grains. Since the size and geometry of dislocation cells were similar to these in hot rolled samples, it is unclear whether the dislocation cell structure in the cold rolled sample was inherited or newly formed. "Pockets" of transformed High Strength Nanomodal Structure (Structure #3*b*, FIG. 4) can be found locally in the cold rolled samples (FIG. 42*b*) that were not observed in the hot rolled samples (FIG. 21). However, the transformation "pockets" in cold rolled sample are in general sparse, and the refined grains, as shown by the black phase in FIG. 42*b*, are not prevalent. It suggests that Dynamic Nanophase Strengthening occurs at small degree only leading to partial transformation. Higher level of transformation was found in cold rolled Alloy 8 after tensile deformation (FIG. 43). As shown in FIG. 43*a*, the deformed samples accumulated a high density of dislocations in the untransformed matrix grains of Nanophase Modal Structure (Structure #3*a*, FIG. 4), and the heavily tangled dislocations developed into a cellular structure. These dislocation cells generated by the tensile deformation are smaller than those by hot rolling (FIG. 22) and cold rolling (FIG. 42*a*), suggesting there were newly formed dislocation cells upon tensile deformation. Furthermore, high volume fraction of "pockets" with High Strength Nanomodal Structure (Structure #3*b*, FIG. 4) was observed in the deformed sample. FIG. 44 shows the microstructure within one of such transformed "pockets". It can be seen that refined grains with size of 100 to 500 nm are formed in the sample that is verified in both the bright-field and dark-field images. FIG. 45 shows the transformed "pockets" in contrast to their less transformed neighbors demonstrating a Mixed Microconstituent Structure (Structure #3, FIG. 4) in cold rolled and tensile tested samples from Alloy 8.

After the cold-rolled sample was heat treated at 950° C. for 6 hrs, a recrystallized microstructure was observed to be formed. As shown in FIG. 46*a*, recrystallized matrix grains with straight and sharp grain boundaries were found and the matrix grains were mostly dislocation free but contain stacking faults. Selected electron diffraction suggests that the recrystallized grains are of a face-centered-cubic structure of γ-Fe, as shown in FIG. 46*b*. When the cold rolled and heat treated Alloy 8 samples with recrystallized microstructure was deformed in tension to fracture, Mixed Microconstituent Structure (Structure #3, FIG. 4) was detected. FIG. 47 shows the microstructure in a transformed "pocket" of High Strength Nanomodal Structure (Structure #3*b*, FIG. 4), in which refined grains are formed, as verified by the bright-field and dark-field images. Selected area electron diffraction from the grain in the transformed "pocket" shows a phase of body-centered-cubic structure as shown in FIG. 48. FIG. 49*a* shows a TEM micrograph of an area of the same sample with Nanophase Modal Structure (Structure #3*a*, FIG. 4). Selected area electron diffraction from this area shows a of face-centered-cubic structure phase of γ-Fe (FIG. 49*b*). It unambiguously demonstrates that the grain refinement through Dynamic Nanophase Strengthening (Mechanism #2, FIG. 4) occurs in the "pockets" of Recrystallized Modal Structure (Structure #2*a*, FIG. 4) leading to the Mixed Microconstituent Structure (Structure #3, FIG. 4) formation in the sample volume.

This Case Example illustrates the formation of the Mixed Microconstituent Structure upon deformation of the alloy by cold rolling and after tensile deformation of cold rolled and heat treated Alloy 8 when transformed regions of High Strength Nanomodal Structure with refined grains are distributed in the Modal Nanophase Structure of the untransformed matrix.

Case Example #6: Property Recovery

Using commercial purity feedstock, a 3 kg charge of Alloy 44 was weighed out according to the alloy stoichiometry in Table 4 and cast into a 50 mm thick laboratory slab in an Indutherm VTC800V vacuum tilt casting machine. The slab was then processed with a two-step hot rolling at 1100° C. by a rolling strain of 87.4% and 73.9%, respectively (total reduction is ~97%). The thickness of hot rolled sheet was ~1.7 mm. Hot rolled Alloy 44 sheet was further cold-rolled by 19.3% to ~1.4 mm thickness. The tensile specimens were cut from the sheet material after hot rolling and after cold rolling using wire electrical discharge machining (EDM). Tensile properties were measured on an Instron mechanical testing frame (Model 3369), utilizing Instron's Bluehill control and analysis software. The test was run at room temperature in displacement control with the bottom fixture held rigid and the top fixture moving; the load cell is attached to the top fixture. Tensile properties of the Alloy 44 after hot and cold rolling are shown in FIG. 50*a*. As it can be seen, significant strengthening occurs from 1200 to 1600 MPa after cold rolling with a drop in ductility to ~20%. The cold rolled sheet was then heat treated at 850° C. for 10 min imitating continuous in-line annealing used during commercial cold rolling processes. The tensile specimens were cut from the heat treated sheet and tested in tension. Resultant properties are similar to that in as-hot rolled state with more consistent ductility (~50%) concluding Cycle 1 of sheet processing as shown in FIG. 50*b*.

Cold rolled and heat treated sheet was then cold rolled again with reduction of 22.3% with following heat treatment at 850° C. for 10 min. Measured tensile properties are shown in FIGS. 50*c* and *d*, respectively, demonstrating strengthening during cold rolling with property recovery after heat treatment at Cycle 2. Similar results were observed at the Cycle 3 (FIGS. 50*e* and *f*) when heat treated sheet after Cycle 2 was cold rolled with 21.45% reduction followed by heat treatment at 850° C. for 10 min.

This Case Example illustrates property recovery in the High Ductility Steel alloy through cycles of cold rolling and heat treatment. The process of Mixed Microconstituent Structure (Structure #3, FIG. 4) formation, recrystallization into the Recrystallized Modal Structure (Structure #2*a*, FIG. 4), and refinement and strengthening through Dynamic Nanophase Strengthening (Mechanism #2, FIG. 4) back into the Mixed Microconstituent Structure (Structure #3, FIG. 4) can be applied in a cyclic manner as often as necessary in order to hit end user gauge thickness requirements. Moreover, this cyclic processing can provide sheet material from the same alloy with a wide different property combinations as shown in FIG. 54 *a-f*.

Case Example #7: Property Tuning by Post Processing

Using commercial purity feedstock, a 3 kg charge of Alloy 43 and Alloy 44 were weighed out according to the alloy stoichiometry in Table 4 and cast into a 50 mm thick laboratory slab in an Indutherm VTC800V vacuum tilt casting machine that was then processed with a two-step hot rolling with parameters specified in Table 6. The thickness of hot rolled sheet was ~1.7 mm. Hot rolled sheet was further cold-rolled with reductions of 10, 20 and 30% for Alloy 43 and 7, 20, 26, and 43% for Alloy 44. The tensile specimens were cut from the sheet material after hot rolling and after cold rolling using wire electrical discharge machining (EDM). Tensile properties were measured on an Instron mechanical testing frame (Model 3369), utilizing Instron's Bluehill control and analysis software. The test was run at room temperature in displacement control with the bottom fixture held rigid and the top fixture moving; the load cell is attached to the top fixture. FIG. 51 shows corresponding stress-strain curves for both alloys after hot rolling and cold rolling with different reduction. As it can be seen, the strength of the alloys increases with increasing cold rolling reduction while alloy ductility decreases. Very high strength can be achieved in the High Ductility Steel alloys through cold rolling. As shown in FIG. 51*a*, Alloy 43 reaches tensile strength of 1630 MPa with 16% elongation after 30% cold rolling reduction and Alloy 44 demonstrated tensile strength of 1814 MPa with 12.7% elongation after 43% cold rolling reduction (FIG. 51*b*).

This Case Example illustrates that property combinations in the High Ductility Steel alloys can be controlled by the level of cold rolling reduction depending on the end user property requirements. The level of cold rolling reduction affects the volume fraction of the transformed High Strength Nanomodal Structure (Structure #3*b*, FIG. 4) in the Mixed Microconstituent Structure (Structure #3, FIG. 4) of the cold rolled sheet that determines the final sheet properties.

Case Example #8: Sheet Material Behavior at Incremental Straining

Using commercial purity feedstock, a 3 kg charge of Alloy 8 and Alloy 44 were weighed out according to the alloy stoichiometry in Table 4 and cast into a 50 mm thick laboratory slab in an Indutherm VTC800V vacuum tilt casting machine that was then processed with a two-step hot rolling with corresponding parameters specified in Table 6. Hot rolled sheet from Alloy 44 was then subjected to further cold rolling in multiple passes, with a total reduction of approximately 25%. Rolling was done on a Fenn Model 061 single stage rolling mill. Specific cold rolling parameters used for the alloy is shown in Table 8. Cold rolled sheet from alloy 44 was annealed at 850° C. for 5 min. Tensile specimens were cut via EDM from hot rolled sheet of Alloy 8 and hot rolled, cold rolled and heat treated sheet of Alloy 44. The specimens were incrementally tested in tension. Tensile testing was performed on an Instron Model 3369 mechanical testing frame, using the Instron Bluehill control and analysis software. Samples were tested at room temperature under displacement control at a strain rate of $1\times10^{-3}$ per second. Samples were mounted to a stationary bottom fixture, and a top fixture attached to a moving crosshead. A 50 kN load cell was attached to the top fixture to measure load. Each tensile test was run to a total tensile elongation of 4%, after which the samples were unloaded and re-measured, and then tested again. This process was continued until the sample failed during testing. The resultant stress-strain curves for Alloy 8 and Alloy 44 at incremental testing are shown in FIGS. 52*a* and *b*, respectively. As it can be seen, both alloys have demonstrated significant strengthening at each loading-unloading cycle confirming Dynamic Nanophase Strengthening in the alloys during deformation at each straining cycle. Yield stress varies from 421 MPa up to 1579 MPa in Alloy 8 and from 406 MPa to 1804 MPa in Alloy 44 depending on a number of deformation cycles.

Very high strength can be achieved in the High Ductility Steel alloys through cold rolling. As shown in FIG. 51*a*, Alloy 43 reaches tensile strength of 1630 MPa with 16% elongation after 30% cold rolling reduction and Alloy 44 demonstrated tensile strength of 1814 MPa with 12.7% elongation after 43% cold rolling reduction (FIG. 51*b*).

This Case Example illustrates hardening in the High Ductility Steel alloys through Dynamic Nanophase Strengthening with the Mixed Microconstituent Structure (Structure #3, FIG. 4) at each straining cycle. The volume fraction of the High Strength Nanomodal Structure (Structure #3*b*, FIG. 4) increases with each cycle leading to higher yield stress and higher strength of the alloy. Depending on the end user property requirements, yield stress can vary in a wide range for the same alloy by controlled pre-straining.

Case Example #9: Strain Rate Sensitivity

Using commercial purity feedstock, a 3 kg charge of Alloy 44 was weighed out according to the alloy stoichiometry in Table 4 and cast into a 50 mm thick laboratory slab in an Indutherm VTC800V vacuum tilt casting machine that was hot rolled to 2.5 mm, and subsequently cold rolled to 1.2 mm. Rolling was done on a Fenn Model 061 single stage rolling mill. Hot rolling used an in-line Lucifer EHS3GT-B18 tunnel furnace, with the rolled material heated to 1100° C., using an initial dwell time of 40 minutes to ensure homogeneous starting temperature, and a 4 minute temperature recovery hold in between each hot rolling pass. Cold rolling employed the same rolling mill, but without the use of the in-line tunnel furnace. Tensile specimens were cut from the cold rolled material via EDM, and then heat treated at 850° C. for 10 minutes with air cooling. Heat treatment was conducted in a Lucifer 7GT-K12 sealed box furnace under an argon gas purge. Heat treated specimens were ground on a belt sander to remove oxide from the specimen surface, and then tensile tested. Tensile testing was performed on Instron Model 3369 and Instron Model 5984 mechanical testing frames, using the Instron Bluehill control and analysis software. Samples were tested at room temperature under displacement control at a strain rates listed in Table 19. Samples were mounted to a stationary bottom fixture, and a top fixture attached to a moving crosshead. A load cell was attached to the top fixture to measure load. The load limit of the 3369 load cell was 50 kN, and the load limit for the 5984 load cell was 150 kN. In order to determine the actual strain rates observed by the samples, with a minimal influence of machine compliance, sample strain was measured using an advanced video extensometer (AVE). These measurements were plotted over time, and an approximate average rate of strain was calculated from the slope of a line fit to the resulting plot of values. Results of the tests are plotted as strain rate dependence of yield stress, ultimate tensile strength, strain hardening exponent, and tensile elongation shown in FIG. 53 through FIG. 56, respectively. As it can be seen, yield stress shows almost no strain rate dependence around 500 MPa with slight drop at low strain rates (FIG. 53). Ultimate tensile strength is constant at ~1250 MPa at low strain rates and drops to ~1020 MPa at high strain rates (FIG. 54). The transition strain rate range is from $5\times10^{-3}$ to $5\times10^{-2}$ $sec^{-1}$. However, the strain hardening exponent demonstrates a gradual decrease with increasing strain rate (FIG. 55) while still is higher than 0.5 at the fastest test applied. This trend is opposite that typically observed for metal materials with dislocation mechanism strengthening. Elongation value has been found to have a maximum at strain rate of $1\times10^{-2}$ $sec^{-1}$ (FIG. 56).

TABLE 19

List of Utilized Strain Rates

| Average Actual Strain Rate ($s^{-1}$) | Testing Frame Used |
|---|---|
| $1.8 \times 10^{-4}$ | Instron 3369 |
| $3.6 \times 10^{-4}$ | Instron 3369 |
| $4 \times 10^{-3}$ | Instron 3369 |
| $1.2 \times 10^{-2}$ | Instron 3369 |
| $2.5 \times 10^{-2}$ | Instron 3369 |
| $5.9 \times 10^{-2}$ | Instron 3369 |
| $5.3 \times 10^{-1}$ | Instron 5984 |

This Case Example illustrates that strain rate does not affect yield stress of the material but influences material behavior after yielding when Dynamic Nanophase Strengthening (Mechanism #2, FIG. 4) activates. The results clearly show the robustness of the structures and mechanisms since high combination of tensile properties are obtained over a wide range of strain rates.

Case Example #10: Chemistry Uniformity Through Cast Volume

Using commercial purity feedstock, 3 kg charges of Alloy 114, Alloy 115 and Alloy 116 were weighed out according to the alloy stoichiometry in Table 4 and cast into a 50 mm thick laboratory slab in an Indutherm VTC800V vacuum tilt casting machine. In the center of the cast plate was a shrinkage funnel that was created by the solidification of the last amount of molten metal liquid. A schematic illustration of the cross section through the center of the cast slab with the marked positions where the samples for chemical analysis were taken from is shown in FIG. 57. Samples were cut by wire EDM from the top (marked "A" in FIG. 57) and from the bottom (marked "B" in FIG. 57) of the cast slab. Chemical analysis was conducted by Inductively Coupled Plasma (ICP) method which is capable of accurately measuring the concentration of individual elements.

The results of the chemical analysis are shown in FIG. 58. The content of each individual element in wt % is shown for each sample location (the top "A" vs bottom "B"). As it can be seen, the deviation in element contents is minimal in each alloy with the element content ratios from 0.90 to 1.10. The data from these alloys show that there is no significant composition difference between the top (solidifies last) and bottom (solidifies first) of the cast slabs.

This Case Example illustrates that High Ductility Steel alloys solidify uniformly and do not show any chemical macrosegregation through cast volume. This clearly indicates that the process window for production is much greater than the 50 mm used in this example and it is both feasible and anticipated to expect the mechanisms presented here-in to be active through the 20 to 500 mm as-cast thickness of the commercial continuous casting of the alloys presented here-in.

Case Example #11: Structural Homogenization in Alloy 8 Through Hot Rolling

Using commercial purity feedstock, a 3 kg charge of Alloy 8 was weighed out according to the alloy stoichiometry in Table 4 and cast into a 50 mm thick laboratory slab in an Indutherm VTC800V vacuum tilt casting machine. Cast laboratory slabs were subjected to hot rolling using a Fenn Model 061 Rolling Mill and a Lucifer 7-R24 Atmosphere Controlled Box Furnace. The slabs were placed in a hot furnace pre-heated to 1100° C. and held for 40 minutes prior to the start of rolling. The plates were then hot rolled with multiple passes of 10% to 25% reduction mimicking multi-stand hot rolling at the Continuous Slab Casting processes (FIG. 1, FIG. 2). Total hot rolling reduction was 97%.

To analyze the microstructure changes during hot rolling and after heat treatment, samples after casting, hot rolling and heat treatments were examined by the SEM. To make SEM specimens, the cross-sections of the sheet samples were cut and ground by SiC paper and then polished progressively with diamond media paste down to 1 μm grit. The final polishing was done with 0.02 μm grit $SiO_2$ solution. Microstructures of sheet samples from Alloy 8 after hot rolling and heat treatment were examined by scanning electron microscopy (SEM) using an EVO-MA10 scanning electron microscope manufactured by Carl Zeiss SMT Inc.

FIG. 59 demonstrates microstructures at different magnifications of the 50 mm cast ingot in the slab center and close to the surface of the slab. Both areas show dendritic structures with coarse boride phase located at the dendrite boundaries. The center regions illustrate slightly coarser overall microstructure as compared to that close to the surface. FIG. 60 displays the microstructure of the Alloy 8 sheet after hot rolling with 97% reduction. It can be seen that hot rolling resulted in structural homogenization leading to the formation of uniform fine globular boride phase through the sheet thickness. Similar microstructure was observed through the sheet thickness both in the slab center and close to the slab surface. After an additional heat treatment at 850° C. for 6 hrs, as shown in FIG. 61, the boride phase of the same morphology is evenly distributed both in the slab center and close to the slab surface. Microstructure is homogeneous through the sheet thickness and reduced in scale through NanoPhase Refinement.

This Case Example demonstrates an ability for as-cast microstructure of High Ductility Steel alloys to be homogenized by hot rolling with formation of uniform Homogenized NanoModal Structure (Structure #2, FIG. 4) through sheet volume. This enables the ability for structural optimization and uniform properties at sheet production by Continuous Slab production (FIG. 1, FIG. 2) involving multi-stand hot rolling. Homogeneous structure through sheet volume is a key factor required for effectiveness of subsequent steps including Dynamic Nanophase Strengthening (Mechanism #2, FIG. 4) during deformation of the sheet resulting in most optimal properties and material performance.

Case Example #12: Hot Rolling Effect on Structural Homogeneity in Alloy 20 Alloy Using commercial purity feedstock, a 3 kg charge of Alloy 20 was weighed out according to the alloy stoichiometry in Table 4 and cast into a 50 mm thick laboratory slab in an Indutherm VTC800V vacuum tilt casting machine. Cast laboratory slabs were subjected to hot rolling using a Fenn Model 061 rolling mill and a Lucifer 7-R24 atmosphere controlled box furnace. The slabs were placed in a hot furnace pre-heated to 1100° C. and held for 40 minutes prior to the start of rolling. The plates were then hot rolled with multiple passes of 10% to 25% reduction mimicking multi-stand hot rolling at the Continuous Slab Casting processes (FIG. 1, FIG. 2). Total hot rolling reduction was 97%.

To analyze the microstructure changes during hot rolling and after heat treatment, samples after casting, hot rolling and heat treatment were examined by SEM. To make SEM specimens, the cross-sections of the sheet samples were cut and ground by SiC paper and then polished progressively with diamond media paste down to 1 μm grit. The final polishing was done with 0.02 μm grit $SiO_2$ solution. Microstructures of sheet samples from Alloy 8 after hot rolling and heat treatment were examined by scanning electron microscopy (SEM) using an EVO-MA10 scanning electron microscope manufactured by Carl Zeiss SMT Inc.

FIG. 62 demonstrates microstructures at different magnifications of as-cast 50 mm thick slab in the slab center and close to the slab surface. Both areas show dendritic structures with coarse boride phase located at the dendrite boundaries. The slab center regions illustrate slightly coarser overall microstructure as compared to that close to the slab surface. FIG. 63 displays the microstructure of the Alloy 8 sheet after hot rolling with 97% reduction. It can be seen that hot rolling resulted in refinement from NanoPhase Refinement along with structural homogenization leading to the formation of uniform fine globular boride phase through the sheet thickness. Similar microstructure was observed both in central area and close to the slab surface. After an additional heat treatment at 1075° C. for 6 hr, as shown in FIG. 64, the boride phase of the same morphology is evenly distributed both in central and edge areas. Similar structure was observed through the sheet thickness with slightly bigger matrix grains in central area.

This Case Example demonstrates an ability for as-cast microstructure of High Ductility Steel alloys to be homogenized by hot rolling with formation of uniform Homogenized NanoModal Structure (Structure #2, FIG. 4) through sheet volume. This enables structural optimization and uniform properties during sheet production by Continuous Slab production (FIG. 1, FIG. 2) involving multi-stand hot rolling. Homogeneous structure through sheet volume is a key factor required for effectiveness of subsequent Dynamic Nanophase Strengthening (Mechanism #2, FIG. 4) during cold deformation of the sheet resulting in most optimal properties and material performance.

Case Example #13: Effect of Heat Treatment Type on Alloy Properties

Using commercial purity feedstock, Alloy 44 was cast, hot rolled at 1100° C. with subsequent cold rolling to final thickness of 1.2 mm. Rolling was done on a Fenn Model 061 single stage rolling mill. Hot rolling used an in-line Lucifer EHS3GT-B18 tunnel furnace, with the rolled material heated to 1075° C., using an initial dwell time of 40 minutes to ensure homogeneous temperature, and a 4 minute temperature recovery hold in between each hot rolling pass. Cold rolling employed the same rolling mill, but without the use of the in-line tunnel furnace. Two types of heat treatment were applied to cold rolled sheet: 850° C. for 6 hr imitating batch annealing of coils at commercial sheet production and at 850° C. for 10 min imitating in-line annealing of coils on continuous lines at commercial sheet production. Both heat treatments used a furnace temperature of 850° C. Heat treatments were conducted in a Lucifer 7GT-K12 sealed box furnace under an argon gas purge. Tensile specimens were cut via EDM and heat treated according to the treatments outlined in Table 20. Heat treated specimens were ground on a belt sander to remove oxide from the specimen surface, and then tensile tested. Tensile testing was performed on an Instron Model 3369 mechanical testing frame, using the Instron Bluehill control and analysis software. Samples were tested at room temperature under displacement control at a strain rate of $1\times10^{-3}$ per second. Samples were mounted to a stationary bottom fixture, and a top fixture attached to a moving crosshead. A 50 kN load cell was attached to the top fixture to measure load.

Tensile properties of Alloy 44 after hot rolling, cold rolling and both types of annealing are shown in Table 20 and illustrated FIG. 65. Experimental results demonstrate that properties are very consistent after hot rolling at 1161 to 1182 MPa with ~37% ductility. Cold rolling leads to significant strengthening of the alloy (up to 1819 MPa) with decrease in ductility. Following annealing restore ductility level. Note that strength levels remain constant between the two heat treatment types. Tensile elongation and yield stress values vary, with higher elongation and higher yield point observed in samples after annealing at 850° C. for 5 min imitating in-line annealing of coils on continuous lines at commercial sheet production. Representative stress-strain curves are shown in FIG. 66

TABLE 20

Heat Treatment Parameters for Studied Samples

| Sample Condition | Tensile Elongation (%) | Yield Stress (MPa) | UTS (MPa) |
|---|---|---|---|
| As Hot Rolled | 37.7 | 405 | 1171 |
| As Hot Rolled | 37.6 | 409 | 1182 |
| As Hot Rolled | 37.2 | 430 | 1161 |
| As Cold Rolled | 10.6 | 1474 | 1819 |
| As Cold Rolled | 14.3 | 1349 | 1765 |
| As Cold Rolled | 14.0 | 1308 | 1786 |
| 850° C. for 6 hr (Batch Anneal) | 44.6 | 422 | 1227 |
| 850° C. for 6 hr (Batch Anneal) | 48.3 | 406 | 1236 |
| 850° C. for 6 hr (Batch Anneal) | 45.0 | 413 | 1230 |
| 850° C. for 5 min (In-Line Anneal) | 55.5 | 553 | 1224 |
| 850° C. for 5 min (In-Line Anneal) | 54.7 | 555 | 1227 |
| 850° C. for 5 min (In-Line Anneal) | 54.9 | 550 | 1237 |

This Case Example illustrates that properties of High Ductility Steel alloys might be controlled by heat treatment that can be applied to commercially produced sheet coils either by batch annealing or by annealing on a continuous line.

Case Example #14: Elastic Modulus of Selected Alloys in Different Conditions

Elastic modulus was measured for selected alloys. Using commercial purity feedstock, 3 kg charge were weighed out according to the alloy stoichiometry in Table 4 and cast into 50 mm thick laboratory slab in an Indutherm VTC800V vacuum tilt casting machine that was then processed with a two-step hot rolling with corresponding parameters specified in Table 6. Hot rolled sheets were then subjected to further cold rolling in multiple passes, with a total reduction of approximately 25%. Rolling was done on a Fenn Model 061 single stage rolling mill. A list of specific cold rolling parameters used for the alloys is shown in Table 7. All resultant sheets were heat treated in a Lucifer 7GT-K12 sealed box furnace under an argon gas purge at 1050° C. for 5 minutes. Standard modulus measurements were done on sheets in the hot rolled, cold rolled, and flash annealed conditions as listed in Table 21.

TABLE 21

Sample Processing Conditions for Modulus Analysis

| Condition Number | Final Process Step | Sample Thickness [mm] | Anneal Temperature [° C.] | Anneal Time [min] |
|---|---|---|---|---|
| 1 | Hot Rolling | 1.6 | N/A | N/A |
| 2 | Cold Rolling | 1.2 | N/A | N/A |
| 3 | Flash Anneal | 1.2 | 1050 | 5 |

Tensile specimens were cut via EDM in the ASTM E8 subsize standard geometry. Tensile testing was performed on an Instron Model 3369 mechanical testing frame, using the Instron Bluehill control and analysis software. Samples were tested at room temperature under displacement control at a strain rate of $1\times10^{-3}$ per second. Samples were mounted to a stationary bottom fixture, and a top fixture attached to a moving crosshead. A 50 kN load cell was attached to the top fixture to measure load. Tensile loading was performed to a load less than the yield point previously observed in tensile testing of the material, and this loading curve was used to obtain modulus values. Samples were pre-cycled under a tensile load below that of the predicted yield load to minimize the impact of grip settling on the measurements. Measurement results are shown in Table 22.

TABLE 22

Measured Modulus Values for Selected Alloys

| Alloy | Condition | Test 1 [GPa] | Test 2 [GPa] | Test 3 [GPa] | Test 4 [GPa] | Test 5 [GPa] | Average [GPa] |
|---|---|---|---|---|---|---|---|
| Alloy 8 | 1 | 199 | 201 | 198 | 197 | 196 | 198 |
| Alloy 8 | 2 | 169 | 165 | 163 | 166 | 167 | 166 |
| Alloy 8 | 3 | 180 | 180 | 180 | 185 | 180 | 181 |

TABLE 22-continued

Measured Modulus Values for Selected Alloys

| Alloy | Condition | Test 1 [GPa] | Test 2 [GPa] | Test 3 [GPa] | Test 4 [GPa] | Test 5 [GPa] | Average [GPa] |
|---|---|---|---|---|---|---|---|
| Alloy 29 | 1 | 190 | 184 | 186 | 191 | 180 | 186 |
| Alloy 29 | 2 | 164 | 162 | 165 | 169 | 169 | 166 |
| Alloy 29 | 3 | 190 | 188 | 189 | 186 | 194 | 189 |
| Alloy 30 | 1 | 194 | 190 | 206 | 194 | 187 | 194 |
| Alloy 30 | 2 | 173 | 169 | 170 | 171 | 172 | 171 |
| Alloy 30 | 3 | 188 | 181 | 182 | 180 | 183 | 183 |
| Alloy 43 | 1 | 204 | 196 | 198 | 198 | 194 | 198 |
| Alloy 43 | 2 | 160 | 169 | 176 | 169 | 169 | 169 |
| Alloy 43 | 3 | 184 | 187 | 191 | 185 | 186 | 187 |
| Alloy 44 | 1 | 191 | 194 | 191 | 187 | 189 | 190 |
| Alloy 44 | 2 | 171 | 174 | 174 | 167 | 165 | 170 |
| Alloy 44 | 3 | 184 | 181 | 187 | 181 | 183 | 183 |

Measured values of the alloy modulus vary from 160 to 204 GPa depending on alloy chemistry and sample condition. Note that the as hot rolled modulus measurements were conducted on samples with a small degree of warp, which may lower the measured values.

This Case Example illustrates that Elastic Modulus of High Ductility Steel alloys depends on alloy chemistry and produced sheet condition and vary in the range from 160 GPa to 204 GPa.

Case Example #15: Strain Hardening Behavior

Using commercial purity feedstock, a 3 kg charge of Alloy 44 was weighed out according to the alloy stoichiometry in Table 4 and cast into a 50 mm thick laboratory slab in an Indutherm VTC800V vacuum tilt casting machine that was then processed with a two-step hot rolling with corresponding parameters specified in Table 6. Hot rolled sheets were then subjected to further cold rolling in multiple passes, with a total reduction of approximately 25%. Rolling was done on a Fenn Model 061 single stage rolling mill. A list of specific cold rolling parameters used for the alloy is shown in Table 7. The tensile specimen tested in this study was annealed at 850° C. for 5 minutes, and then subsequently air cooled to room temperature. Tensile testing was conducted on an Instron 3369 Model test frame. Samples were mounted to a stationary bottom fixture, and a top fixture attached to a moving crosshead. A load cell was attached to the top fixture to measure load. The load limit of load cell was 50 kN. Strain was measured by using non-contact video extensometer. The resultant stress-strain curve is shown in FIG. 27. Calculations of the strain hardening exponent were performed by the Instron Bluehill software, over ranges defined by manually-selected strain values. The ranges selected each covered, sequentially, 5% elongation of the sample, with a total of nine such ranges covering deformation regime from 0% to 45%. For each of these ranges, the strain hardening exponent was calculated, and plotted against the endpoint of the strain range for which it was calculated. For the 0 to 5% strain range, all data prior to the yield point was excluded from the strain hardening coefficient calculations. Exponent value as a function of strain is shown in FIG. 28. As it can be seen, there is extensive strain hardening of the alloy after 10% strain with the strain hardening exponent reaching the value of above 0.8 and it is remaining higher than 0.4 all the way to fracture. The ability for strain hardening through Dynamic Nano-Phase Strengthening results in high uniform ductility with no or limited necking during cold deformation.

This Case Example illustrates extensive strain hardening in the High Ductility Steel alloys leading to high uniform ductility.

Case Example #16: Microstructure in Boron-Free Alloys

Using commercial purity feedstock, 3 kg charges of Alloy 141, Alloy 142 and Alloy 143 were weighed out according to the alloy stoichiometry in Table 4 and cast into a 50 mm thick laboratory slab in an Indutherm VTC800V vacuum tilt casting machine that was then processed with a two-step hot rolling at 1275° C. Hot rolled sheet from Alloy 141, Alloy 142 and Alloy 143 was further cold rolled to 1.18 mm thickness. Cold rolled sheet from both alloys was heat treated at 850° C. for 5 minutes.

To make SEM specimens, the cross-section samples of the sheets were cut and ground by SiC paper and then polished progressively with diamond media paste down to 1 μm grit. The final polishing was done with 0.02 μm grit $SiO_2$ solution. The microstructure at the central layer of cross-section of sheet was observed, imaged, and evaluated. SEM microscopic analysis was conducted using an EVO-MA10 scanning electron microscope manufactured by Carl Zeiss SMT Inc. FIGS. 68 through 70 shows the backscattered SEM images of the Alloy 141, Alloy 142 and Alloy 143 sheet after hot rolling, after hot rolling and cold rolling, and after hot rolling, cold rolling and heat treatment.

This Case Example demonstrates structural development in the alloys in accordance with the path described in FIG. 4 even in the absence of boride phase.

Case Example #17: Potential Production Routes

The ability of High Ductility Steel alloys herein to undergo structural homogenization during deformation at elevated temperature, their structure and property reversibility during cold rolling/annealing cycles and capability in Mixed Microconstituent Structure formation (Structure #3, FIG. 4) through Dynamic Nanophase Strengthening (Mechanism #2, FIG. 4) leading to advanced property combination enables a wide variety of commercial production methods to be used toward various products for different applications. In addition to sheet production through continuous slab casting, examples of potential commercial processes and production methods are listed in Table 23. Note that this list is not comprehensive but supplied to provide non-limiting examples of the usage of the enabling mechanisms and structures in various commercial processes and industrial products.

Solidification of High Ductility Steel alloys without chemical segregation enable utilization of various casting methods that include but are not limited to mold casting, die casting, semi-solid metal casting, centrifugal casting. Modal Structure (Structure #1, FIG. 4) is anticipated to be formed in the cast products.

Thermo-mechanical treatment of cast products with Modal Structure (Structure #1, FIG. 4) will lead to structural homogenization and/or recrystallization through Dynamic Nanophase Refinement (Mechanism #1, FIG. 4) towards formation of Homogenized NanoModal Structure (Structure #2, FIG. 4). Potential thermo-mechanical treatments include but are not limited to various type of hot rolling. hot extrusion, hot wire drawing, hot forging, hot pressing, hot stamping, etc. Resultant products can be finished or semi-finished with following cold working and/or heat treatment.

Cold working of products with Homogenized NanoModal Structure (Structure #2, FIG. 4) will lead to High Ductility Steel alloy strengthening through Dynamic Nanophase Strengthening (Mechanism #2, FIG. 4) towards Mixed Microconstituent Structure formation (Structure #3, FIG. 4). Cold working can include but is not limited to various cold rolling processes, cold forging, cold pressing, cold stamping, cold swaging, cold wire drawing, etc. Final properties of the resultant products will depend on alloy chemistry and a level of cold working. Properties can further be adjusted by following heat treatment leading to Recrystallized Modal Structure formation (Structure #2*a*, FIG. 4). Final properties of the resultant products will depend on alloy chemistry and a degree of recrystallization that the material was experienced at specific heat treatment parameters.

TABLE 23

Mechanisms at Potential Commercial Processes and Microstructure in the Products

| Material Treatment | Mechanism | Commercial Process | Industrial Products | Microstructure |
|---|---|---|---|---|
| Casting | Solidification | Mold casting, die casting, semi-solid metal casting, centrifugal casting | Cast products | Modal Structure |
| Thermo-mechanical deformation | Homogenization/ dynamic recrystallization | Hot rolling, controlled rolling | Finished structural shapes and rails | Homogenized Modal Structure |
| Thermo-mechanical deformation | Homogenization/ dynamic recrystallization | Hot rolling, pipes | Semi-finished pipes, seam welding required | Homogenized Modal Structure |
| Thermo-mechanical deformation | Homogenization/ dynamic recrystallization | Hot rolling, billets and blooms | Semi-finished billets or blooms for use as feedstock to other processes | Homogenized Modal Structure |
| Thermo-mechanical deformation | Homogenization/ dynamic recrystallization | Powder extrusion | Finished near net shape parts | Homogenized Modal Structure |
| Thermo-mechanical deformation | Homogenization/ dynamic recrystallization | Hot pipe extrusion | Finished seamless pipes | Homogenized Modal Structure |
| Thermo-mechanical deformation | Homogenization/ dynamic recrystallization | Hot wire drawing | Wires | Homogenized Modal Structure |
| Thermo-mechanical deformation | Homogenization/ dynamic recrystallization | Hot forging, hot pressing, hot stamping | Finished or semi-finished parts | Homogenized Modal Structure |
| Cold deformation | Dynamic Nanophase Strengthening | Flat rolling, roll forming, profile rolling, | Long products with different shape | Mixed Microconstituent Structure |
| Cold deformation | Dynamic Nanophase Strengthening | Ring rolling, roll bending | Products with round shape | Mixed Microconstituent Structure |
| Cold deformation | Dynamic Nanophase Strengthening | Cold forging, pressing, stamping, swaging | Finished parts | Mixed Microconstituent Structure |
| Cold deformation | Dynamic Nanophase Strengthening | Cold wire drawing | Wires | Mixed Microconstituent Structure |
| Heat treatment | Recrystallization | Annealing between cold rolling processes or various heat treatment methods for finished products | Various products | Recrystallized Modal Structure |

This Case Example anticipates the potential processing routes for High Ductility Steel alloys herein towards final products for various applications based on their ability for structural homogenization during deformation at elevated temperature, structure and property reversibility during cold rolling/annealing cycles and capability to form Mixed Microconstituent Structure #3, FIG. 4) through Dynamic Nanophase Strengthening (Mechanism #2, FIG. 4) leading to advanced property combination.

The invention claimed is:

1. A method comprising:

a. supplying a metal alloy comprising Fe at a level of 61.0 to 81.0 atomic percent, Si at a level of 0.6 to 9.0 atomic percent, Mn at a level of 1.0 to 17.0 atomic percent and optionally B at a level up to 6.0 atomic percent;

b. melting said alloy and cooling and solidifying and forming an alloy that has a matrix grain size of 5.0 μm to 1000 μm and boride grains, if present, at a size of 1.0 μm to 50.0 μm;

c. exposing said alloy formed in step (b) to heat and stress and forming an alloy that has matrix grains at a size of 1.0 μm to 100 μm, boride grains, if present, at a size of 0.2 μm to 10.0 μm and precipitation grains at a size of 1.0 nm to 200 nm.

2. The method of claim 1 wherein said heat and stress in step (c) comprises heating from 700° C. up to the solidus temperature of said alloy and wherein said alloy has a yield strength and said stress exceeds said yield strength.

3. The method of claim 2 wherein said stress is in the range of 5 MPa to 1000 MPa.

4. The method of claim 1 wherein said alloy formed in step (c) has a yield strength of 140 MPa to 815 MPa.

5. The method of claim 1 wherein said alloy formed in step (c) is exposed to a mechanical stress to provide an alloy having a tensile strength of greater than or equal 900 MPa and an elongation greater than 2.5%.

6. The method of claim 5 wherein said alloy has a tensile strength of 900 MPa to 1820 MPa and an elongation from 2.5% to 76.0%.

7. The method of claim 1 wherein said alloy formed in step (c) is exposed to a mechanical stress to provide an alloy having matrix grain size of 100 nm to 50.0 μm and boride grain size of 0.2 μm to 10.0 μm.

8. The method of claim 7 wherein said alloy has precipitation grains having a size of 1 nm to 200 nm.

9. The method of claim 5 wherein said alloy formed in step (c) after exposure to said mechanical stress has one group of matrix grains at a size of 0.5 μm to 50.0 μm containing 50 to 100% by volume austenite and another group of matrix grains at a size of 100 nm to 2000 nm containing 50 to 100% by volume ferrite.

10. The method of claim 5 wherein said alloy after exposure to said mechanical stress is exposed to a temperature to recrystallize said alloy where said recrystallized alloy has matrix grains at a size of 1.0 μm to 50.0 μm.

11. The method of claim 10 wherein said recrystallized alloy has a yield strength and is exposed to mechanical stress that exceeds said yield strength to provide an alloy having a tensile strength of at or greater than or equal to 900 MPa and an elongation of at or greater than 2.5%.

12. The method of claim 1 wherein said alloy includes one or more of the following:

a. Ni at a level of 0.1 to 13.0 atomic percent;
b. Cr at a level of 0.1 to 11.0 atomic percent;
c. Cu at a level of 0.1 to 4.0 atomic percent;
d. C at a level of 0.1 to 4.0 atomic percent;
e. B at a level of 0.1 to 6.0 atomic percent.

13. A method comprising:

a. supplying a metal alloy comprising Fe at a level of 61.0 to 81.0 atomic percent, Si at a level of 0.6 to 9.0 atomic percent and Mn at a level of 1.0 to 17.0 atomic percent and optionally B at a level up to 6.0 atomic percent, b. melting said alloy and cooling and solidifying and forming an alloy that has a matrix grain size of 5.0 μm to 1000 μm and boride grains, if present, at a size of 1.0 μm to 50.0 μm;

c. exposing said alloy formed in step (b) to heat and stress and forming an alloy that has matrix grains at a size of 1.0 μm to 100 μm, boride grains, if present, at a size of 0.2 μm to 10.0 μm and precipitation grains at a size of 1.0 nm to 200 nm;

d. exposing said alloy in formed in step (c) to a mechanical stress to provide an alloy having a tensile strength of greater than or equal to 900 MPa and an elongation greater than 2.5% wherein said alloy has matrix grains at a size of 100 nm to 50.0 μm and boride grain size, if present, of 0.2 μm to 10.0 μm.

14. The method of claim 13 wherein said alloy formed in step (d) has a tensile strength of 900 MPa to 1820 MPa and an elongation of 2.5% to 76.0%.

15. The method of claim 13 wherein said alloy formed in step (d) is exposed to a temperature to recrystallize said alloy where said recrystallized alloy has matrix grains at a size of 1.0 μm to 50.0 μm.

16. The method of claim 13 wherein said alloy includes one or more of the following;

a. Ni at a level of 0.1 to 13.0 atomic percent;
b. Cr at a level of 0.1 to 11.0 atomic percent;
c. Cu at a level of 0.1 to 4.0 atomic percent;
d. C at a level of 0.1 to 4.0 atomic percent;
e. B at a level of 0.1 to 6.0 atomic percent.

* * * * *